US009138075B2

(12) United States Patent
Hardy et al.

(10) Patent No.: US 9,138,075 B2
(45) Date of Patent: Sep. 22, 2015

(54) PRODUCT MANAGEMENT DISPLAY SYSTEM

(71) Applicant: RTC Industries, Inc., Rolling Meadows, IL (US)

(72) Inventors: Stephen N. Hardy, Wadsworth, OH (US); Stuart Parsons, Maidstone (GB)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 14/136,029

(22) Filed: Dec. 20, 2013

(65) Prior Publication Data

US 2014/0112752 A1 Apr. 24, 2014

Related U.S. Application Data

(63) Continuation-in-part of application No. 13/839,674, filed on Mar. 15, 2013, now Pat. No. 8,978,904, which (Continued)

(51) Int. Cl.
*A47F 1/04* (2006.01)
*A47F 7/00* (2006.01)

(Continued)

(52) U.S. Cl.
CPC ..... *A47F 5/005* (2013.01); *A47B 73/006* (2013.01); *A47B 87/0223* (2013.01);

(Continued)

(58) Field of Classification Search
CPC ..... A47F 1/126; A47F 5/005; A47F 5/0068; A47F 2005/165; A47F 7/28; A47F 5/0018; A47F 5/16; A47F 5/137; A47F 5/132; A47F 5/0087; A47F 1/125; A47F 7/285; A47F 1/04; A47F 7/17; A47F 1/08; A47F 1/12; A47F 3/02; A47F 1/10; A47F 1/06; A47F 1/03; A47F 3/14; A47F 5/0025; A47F 5/0869; A47F 5/0043; A47F 7/024; A47F 7/0146; A47F 7/281; A47B 96/02; A47B 96/025; A47B 57/58; A47B 57/583; A47B 57/585; A47B 57/586; A47B 57/588; A47B 73/00; A47B 73/006; A47B 87/0269; A47B 87/0223; F25D 25/02; F25D 25/027; B65G 1/07; B65G 1/08; B65G 1/06; B65G 1/10; B65D 83/00; G06F 11/06; E05B 69/006; E05B 73/00; E05B 3/00; B42F 7/12; G09F 3/204; G09F 3/08; G09F 3/20; G09F 3/18; G09F 3/185; G09F 3/201; G09F 7/18; Y10T 29/49826
USPC ..... 211/59.2, 59.3, 150, 119.003, 184, 175, 211/195, 4; 312/35, 61, 71, 126, 135, 128, 312/131, 132, 137; 108/60, 61, 71, 6; 221/227, 255, 279, 75, 76, 90, 242, 221/226, 229, 231, 232
See application file for complete search history.

(56) References Cited

U.S. PATENT DOCUMENTS 153,227 A 7/1874 Walker
154,940 A 9/1874 Adams (Continued)

FOREIGN PATENT DOCUMENTS

BE 906083 4/1987
BE 1013877 11/2002

(Continued)

OTHER PUBLICATIONS

*RTC Industries, Inc.* v. *Henschel-Steinau, Inc.*, Complaint, Case: 1:11-cv-05497 Document #:1 Filed: Aug. 12, 2011 p. 1 of 6 Page ID #:1.

(Continued)

*Primary Examiner* — Jennifer E Novosad
(74) *Attorney, Agent, or Firm* — Banner & Witcoff, Ltd.

(57) ABSTRACT

A product management display system for merchandising product on a shelf includes a divider secured to a support structure and a barrier that is moveable by rotation between a folded position and an upright position without a rotation biasing element. A product positioned in the system can contact the barrier when the product moves toward the forward end of the system and rotate the barrier from the folded position to the upright position. The system may include a rotational mounting structure to which the moveable barrier is connected. The rotational mounting structure may be removably connected to the forward end of the divider. The merchandise display system may be used in conjunction with a product tray which provides for product stored in the product tray to be slid from in the product tray into the product pocket of the merchandise display system.

17 Claims, 110 Drawing Sheets

Related U.S. Application Data is a continuation-in-part of application No. 13/542,419, filed on Jul. 5, 2012, now Pat. No. 8,739,984, which is a continuation-in-part of application No. 12/639,656, filed on Dec. 16, 2009, now Pat. No. 8,322,544, which is a continuation-in-part of application No. 12/357,860, filed on Jan. 22, 2009, now Pat. No. 8,453,850, which is a continuation-in-part of application No. 11/760,196, filed on Jun. 8, 2007, now Pat. No. 8,312,999, which is a continuation-in-part of application No. 11/411,761, filed on Apr. 25, 2006, now Pat. No. 7,823,734.

(60) Provisional application No. 60/716,362, filed on Sep. 12, 2005, provisional application No. 60/734,692, filed on Nov. 8, 2005, provisional application No. 61/530,736, filed on Sep. 2, 2011, provisional application No. 61/542,473, filed on Oct. 3, 2011, provisional application No. 61/553,545, filed on Oct. 31, 2011, provisional application No. 61/861,843, filed on Aug. 2, 2013.

(51) Int. Cl.

| | |
|---|---|
| ***A47F 3/14*** | (2006.01) |
| ***A47F 5/00*** | (2006.01) |
| ***A47F 3/02*** | (2006.01) |
| ***A47F 7/28*** | (2006.01) |
| ***A47B 87/02*** | (2006.01) |
| ***A47B 73/00*** | (2006.01) |
| ***B42F 7/12*** | (2006.01) |
| ***A47F 1/12*** | (2006.01) |
| *A47B 57/58* | (2006.01) |

(52) U.S. Cl.

CPC ..... *A47B 87/0269* (2013.01); *A47F 1/04* (2013.01); *A47F 1/125* (2013.01); *A47F 1/126* (2013.01); *A47F 3/02* (2013.01); *A47F 3/14* (2013.01); *A47F 5/0068* (2013.01); *A47F 7/281* (2013.01); *B42F 7/12* (2013.01); *A47B 57/585* (2013.01); *Y10T 29/49863* (2015.01)

(56) References Cited

U.S. PATENT DOCUMENTS

| | | | | |
|---|---|---|---|---|
| 159,940 | A | | 2/1875 | Leverich |
| 355,511 | A | | 1/1887 | Danner |
| 431,373 | A | | 7/1890 | Mendenhall |
| 436,704 | A | | 9/1890 | Green |
| 452,673 | A | | 5/1891 | Hunter |
| 551,642 | A | | 12/1895 | Kleine |
| 607,890 | A | | 7/1898 | Smith |
| 607,891 | A | | 7/1898 | Smith |
| 632,231 | A | | 9/1899 | Blades |
| 808,067 | A | | 12/1905 | Briggs |
| 847,863 | A | | 3/1907 | Watts |
| 927,988 | A | | 7/1909 | Massey |
| 1,030,317 | A | | 6/1912 | Middaugh |
| 1,156,140 | A | | 10/1915 | Hair |
| 1,271,508 | A | | 7/1918 | Hall |
| 1,282,532 | A | | 10/1918 | Bochenek |
| 1,674,582 | A | | 6/1928 | Wheeler |
| 1,703,987 | A | | 3/1929 | Butler |
| 1,712,080 | A | | 5/1929 | Kelly |
| 1,714,266 | A | | 5/1929 | Johnson |
| 1,734,031 | A | | 11/1929 | Carlston |
| 1,849,024 | A | | 3/1932 | McKee |
| 1,910,516 | A | | 5/1933 | Besenberg et al. |
| 1,964,597 | A | | 6/1934 | Rapellin |
| 1,971,749 | A | | 8/1934 | Hamilton |
| 1,991,102 | A | | 2/1935 | Kernaghan |
| 2,013,284 | A | | 9/1935 | Michaud |
| 2,057,627 | A | | 10/1936 | Ferris |
| 2,076,941 | A | | 4/1937 | Farr |
| 2,079,754 | A | | 5/1937 | Waxgiser |
| 2,085,479 | A | | 6/1937 | Shaffer et al. |
| 2,110,299 | A | | 3/1938 | Hinkle |
| 2,111,496 | A | | 3/1938 | Scriba |
| 2,129,122 | A | | 9/1938 | Follett |
| 2,218,444 | A | | 10/1940 | Vineyard |
| 2,284,849 | A | | 6/1942 | Schreyer |
| 2,308,851 | A | | 1/1943 | Anderson |
| 2,499,088 | A | | 2/1950 | Brill et al. |
| 2,516,122 | A | | 7/1950 | Hughes |
| 2,538,908 | A | | 1/1951 | McKeehan |
| 2,555,102 | A | | 5/1951 | Anderson |
| 2,563,570 | A | | 8/1951 | Williams |
| 2,652,154 | A | | 9/1953 | Stevens |
| 2,670,853 | A | | 3/1954 | Schneider |
| 2,678,045 | A | | 5/1954 | Erhard |
| 2,730,825 | A | | 1/1956 | Wilds |
| 2,738,881 | A | | 3/1956 | Michel |
| 2,750,049 | A | | 6/1956 | Hunter |
| 2,767,042 | A | * | 10/1956 | Kesling ..... 312/313 |
| 2,775,365 | A | | 12/1956 | Mestman et al. |
| 2,828,178 | A | * | 3/1958 | Dahlgren ..... 312/408 |
| 2,893,596 | A | | 7/1959 | Gabrielsen |
| 2,918,295 | A | | 12/1959 | Milner |
| 2,934,212 | A | | 4/1960 | Jacobson |
| 2,948,403 | A | | 8/1960 | Vallez |
| 3,083,067 | A | | 3/1963 | Vos et al. |
| 3,103,396 | A | | 9/1963 | Portnoy |
| 3,110,402 | A | | 11/1963 | Mogulescu |
| 3,121,494 | A | | 2/1964 | Berk |
| 3,124,254 | A | * | 3/1964 | Davidson ..... 211/132.1 |
| 3,151,576 | A | | 10/1964 | Patterson |
| 3,161,295 | A | | 12/1964 | Chesley |
| 3,166,195 | A | | 1/1965 | Taber |
| 3,285,429 | A | | 11/1966 | Propst |
| 3,308,961 | A | | 3/1967 | Chesley |
| 3,308,964 | A | | 3/1967 | Pistone |
| 3,331,337 | A | | 7/1967 | MacKay |
| 3,348,732 | A | | 10/1967 | Schwarz |
| 3,405,716 | A | | 10/1968 | Cafiero et al. |
| 3,452,899 | A | | 7/1969 | Libberton |
| 3,497,081 | A | | 2/1970 | Field |
| 3,501,016 | A | | 3/1970 | Eaton |
| 3,501,019 | A | | 3/1970 | Armstrong |
| 3,501,020 | A | | 3/1970 | Krikorian |
| 3,512,652 | A | | 5/1970 | Armstrong |
| D219,058 | S | | 10/1970 | Kaczur |
| 3,550,979 | A | | 12/1970 | Protzmann |
| 3,598,246 | A | | 8/1971 | Galli |
| 3,625,371 | A | * | 12/1971 | Dill ..... 211/153 |
| 3,652,154 | A | | 3/1972 | Gebel |
| 3,667,826 | A | | 6/1972 | Wood et al. |
| 3,698,568 | A | | 10/1972 | Armstrong |
| 3,709,371 | A | | 1/1973 | Luck |
| 3,751,129 | A | | 8/1973 | Wright et al. |
| 3,776,388 | A | | 12/1973 | Mattheis |
| 3,780,876 | A | | 12/1973 | Elkins |
| 3,814,490 | A | | 6/1974 | Dean et al. |
| 3,815,519 | A | | 6/1974 | Meyer |
| 3,830,169 | A | | 8/1974 | Madey |
| 3,836,008 | A | | 9/1974 | Mraz |
| 3,848,745 | A | | 11/1974 | Smith |
| 3,868,021 | A | | 2/1975 | Heinrich |
| 3,870,156 | A | | 3/1975 | O'Neill |
| 3,893,739 | A | | 7/1975 | Bernard |
| 3,949,880 | A | | 4/1976 | Fortunato |
| 3,960,273 | A | | 6/1976 | Weston |
| 4,007,841 | A | | 2/1977 | Seipel |
| 4,015,886 | A | | 4/1977 | Wickenberg |
| 4,042,096 | A | | 8/1977 | Smith |
| 4,106,668 | A | | 8/1978 | Gebhardt et al. |
| 4,205,763 | A | | 6/1980 | Merl |
| 4,269,326 | A | | 5/1981 | Delbrouck |
| 4,300,693 | A | | 11/1981 | Spamer |
| 4,303,162 | A | | 12/1981 | Suttles |
| 4,314,700 | A | | 2/1982 | Dylag |
| 4,331,243 | A | | 5/1982 | Doll |

(56) References Cited

U.S. PATENT DOCUMENTS 4,351,439 A 9/1982 Taylor
4,378,872 A 4/1983 Brown
4,397,606 A 8/1983 Bruton
4,416,380 A 11/1983 Flum
4,437,572 A * 3/1984 Hoffman ..... 211/119.003
4,448,653 A 5/1984 Wegmann
4,454,948 A 6/1984 Spamer
4,454,949 A 6/1984 Flum
4,460,096 A 7/1984 Ricci
D275,058 S 8/1984 Flum
4,463,854 A 8/1984 MacKenzie
4,467,927 A 8/1984 Nathan
4,470,943 A 9/1984 Preis
4,478,337 A 10/1984 Flum
4,482,066 A 11/1984 Dykstra
4,488,653 A 12/1984 Belokin
4,500,147 A * 2/1985 Reister ..... 312/291
4,504,100 A 3/1985 Chaumard
4,550,838 A 11/1985 Nathan et al.
4,588,093 A 5/1986 Field
4,589,349 A 5/1986 Gebhardt et al.
4,590,696 A 5/1986 Squitieri
4,593,823 A 6/1986 Fershko et al.
4,602,560 A 7/1986 Jacky
4,606,280 A 8/1986 Poulton et al.
4,610,491 A * 9/1986 Freeman ..... 312/291
4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,705,175 A 11/1987 Howard et al.
4,706,821 A 11/1987 Kohls et al.
4,712,694 A 12/1987 Breslow
4,724,968 A 2/1988 Wombacher
4,729,481 A 3/1988 Hawkinson et al.
4,730,741 A 3/1988 Jackle, III et al.
4,742,936 A 5/1988 Rein
4,762,235 A 8/1988 Howard et al.
4,762,236 A 8/1988 Jackle, III et al.
4,771,898 A 9/1988 Howard et al.
4,775,058 A 10/1988 Yatsko
4,776,472 A 10/1988 Rosen
4,790,037 A 12/1988 Phillips
4,801,025 A 1/1989 Flum et al.
4,809,855 A 3/1989 Bustos
4,809,856 A 3/1989 Muth
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,887,724 A 12/1989 Pielechowski et al.
4,887,737 A 12/1989 Adenau
4,896,779 A 1/1990 Jureckson
4,899,668 A 2/1990 Valiulis
4,899,893 A 2/1990 Robertson
4,901,853 A 2/1990 Maryatt
4,901,869 A 2/1990 Hawkinson et al.
4,901,872 A 2/1990 Lang
4,907,707 A 3/1990 Crum
4,923,070 A 5/1990 Jackle et al.
4,934,645 A 6/1990 Breslow
4,944,924 A 7/1990 Merl
4,958,739 A 9/1990 Spamer
RE33,515 E 1/1991 Fershko et al.
4,981,224 A 1/1991 Rushing
4,997,094 A 3/1991 Spamer et al.
5,012,936 A 5/1991 Crum
5,024,336 A 6/1991 Spamer
5,025,936 A 6/1991 Lamoureaux
5,027,957 A 7/1991 Skalski
5,054,629 A 10/1991 Breen
5,082,125 A 1/1992 Ninni
5,088,607 A 2/1992 Risafi et al.
5,110,192 A 5/1992 Lauterbach
5,111,942 A 5/1992 Bernardin
5,123,546 A 6/1992 Crum
5,131,563 A 7/1992 Yablans
5,148,927 A 9/1992 Gebka
5,159,753 A 11/1992 Torrence
5,161,702 A 11/1992 Skalski
5,161,704 A 11/1992 Valiulis
5,178,258 A 1/1993 Smalley
5,183,166 A 2/1993 Belokin, Jr. et al.
5,190,186 A 3/1993 Yablans et al.
5,197,610 A 3/1993 Bustos
5,203,463 A 4/1993 Gold
5,215,199 A 6/1993 Bejarano
5,255,802 A 10/1993 Krinke et al.
5,265,738 A 11/1993 Yablans et al.
5,295,596 A 3/1994 Squitieri
5,316,154 A 5/1994 Hajec, Jr.
5,322,668 A 6/1994 Tomasso
5,341,945 A * 8/1994 Gibson ..... 211/184
5,351,839 A 10/1994 Beeler et al.
5,366,099 A 11/1994 Schmid
5,381,908 A 1/1995 Hepp
5,390,802 A 2/1995 Pappagallo et al.
5,397,006 A 3/1995 Terrell
5,397,016 A 3/1995 Torrence et al.
5,405,193 A 4/1995 Herrenbruck
5,408,775 A 4/1995 Abramson et al.
5,413,229 A 5/1995 Zuberbuhler et al.
5,415,297 A 5/1995 Klein et al.
5,419,066 A 5/1995 Harnois et al.
5,439,122 A 8/1995 Ramsay
5,450,969 A 9/1995 Johnson et al.
5,458,248 A 10/1995 Alain
5,464,105 A 11/1995 Mandeltort
5,469,975 A 11/1995 Fajnsztajn
5,469,976 A 11/1995 Burchell
5,505,315 A 4/1996 Carroll
5,542,552 A 8/1996 Yablans et al.
5,562,217 A 10/1996 Salveson et al.
5,577,337 A 11/1996 Lin
5,597,150 A 1/1997 Stein et al.
5,613,621 A 3/1997 Gervasi
D378,888 S 4/1997 Bertilsson
5,615,780 A 4/1997 Nimetz et al.
5,634,564 A 6/1997 Spamer et al.
5,638,963 A 6/1997 Finnelly et al.
5,641,082 A 6/1997 Grainger
5,645,176 A 7/1997 Jay
5,655,670 A 8/1997 Stuart
5,657,702 A 8/1997 Ribeyrolles
5,665,304 A 9/1997 Heinen et al.
5,673,801 A 10/1997 Markson
D386,363 S 11/1997 Dardashti
5,682,824 A 11/1997 Visk
5,685,664 A 11/1997 Parham et al.
5,690,038 A 11/1997 Merit et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,765,390 A * 6/1998 Johnson et al. ..... 62/441
5,788,090 A 8/1998 Kajiwara
5,803,276 A 9/1998 Vogler
5,806,690 A 9/1998 Johnson et al.
5,826,731 A 10/1998 Dardashti
5,839,588 A 11/1998 Hawkinson
D402,490 S 12/1998 Parham
5,848,709 A 12/1998 Gelphman et al.
5,855,283 A 1/1999 Johnson
D405,632 S 2/1999 Parham
5,865,324 A 2/1999 Jay et al.

(56) References Cited

U.S. PATENT DOCUMENTS 5,873,473 A 2/1999 Pater
5,873,489 A * 2/1999 Ide et al. ..... 221/279
5,878,895 A 3/1999 Springs
5,887,732 A 3/1999 Zimmer et al.
5,904,256 A 5/1999 Jay
5,906,283 A 5/1999 Kump et al.
5,944,201 A 8/1999 Babboni et al.
5,970,887 A 10/1999 Hardy
5,971,173 A 10/1999 Valiulis et al.
5,971,204 A 10/1999 Apps
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,041,720 A 3/2000 Hardy
6,044,982 A 4/2000 Stuart
6,047,647 A 4/2000 Laraia, Jr.
6,068,142 A 5/2000 Primiano
6,082,556 A 7/2000 Primiano et al.
6,082,557 A 7/2000 Leahy
6,112,938 A 9/2000 Apps
6,129,218 A 10/2000 Henry et al.
6,142,316 A 11/2000 Harbour
6,142,317 A * 11/2000 Merl ..... 211/59.3
6,164,462 A 12/2000 Mumford
6,164,491 A 12/2000 Bustos et al.
6,173,845 B1 1/2001 Higgins et al.
6,189,734 B1 2/2001 Apps
6,209,731 B1 4/2001 Spamer et al.
6,209,733 B1 4/2001 Higgins et al.
6,226,910 B1 5/2001 Ireland
6,227,385 B1 5/2001 Nickerson
6,227,386 B1 5/2001 Close
6,234,325 B1 5/2001 Higgins et al.
6,234,326 B1 5/2001 Higgins et al.
6,234,328 B1 5/2001 Mason
6,237,784 B1 5/2001 Primiano
D445,615 S 7/2001 Burke
6,253,954 B1 * 7/2001 Yasaka ..... 221/93
6,299,004 B1 10/2001 Thalenfeld et al.
6,305,559 B1 10/2001 Hardy
6,308,839 B1 10/2001 Steinberg et al.
6,311,852 B1 11/2001 Ireland
6,325,221 B2 12/2001 Parham
6,325,222 B1 12/2001 Avery
6,330,758 B1 12/2001 Feibelman
6,357,606 B1 3/2002 Henry
6,375,015 B1 4/2002 Wingate
6,382,431 B1 5/2002 Burke
6,390,310 B1 * 5/2002 Insalaco ..... 211/134
6,398,044 B1 6/2002 Robertson
6,401,942 B1 6/2002 Eckert
6,405,880 B1 6/2002 Webb
6,409,027 B1 6/2002 Chang et al.
6,409,028 B2 6/2002 Nickerson
6,419,100 B1 7/2002 Menz et al.
6,428,123 B1 * 8/2002 Lucht et al. ..... 312/138.1
6,435,359 B1 8/2002 Primiano
6,439,402 B2 8/2002 Robertson
6,464,089 B1 10/2002 Rankin, VI
6,471,053 B1 10/2002 Feibelman
6,484,891 B2 11/2002 Burke
6,497,326 B1 12/2002 Osawa
6,505,747 B1 1/2003 Robertson
6,523,702 B1 2/2003 Primiano et al.
6,523,703 B1 2/2003 Robertson
6,527,127 B2 3/2003 Dumontet
6,533,131 B2 3/2003 Bada
D472,411 S 4/2003 Burke
6,554,143 B1 4/2003 Robertson
6,571,498 B1 6/2003 Cyrluk
6,598,754 B2 7/2003 Weiler
6,604,638 B1 8/2003 Primiano et al.
6,615,995 B2 9/2003 Primiano et al.
6,622,874 B1 9/2003 Hawkinson
6,637,604 B1 10/2003 Jay
6,648,151 B2 * 11/2003 Battaglia et al. ..... 211/59.2
6,651,828 B2 * 11/2003 Dimattio et al. ..... 211/59.2
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 1/2004 Robertson et al.
6,691,891 B2 2/2004 Maldonado
6,695,152 B1 2/2004 Fabrizio et al.
6,715,621 B2 4/2004 Boron
6,722,509 B1 4/2004 Robertson et al.
6,739,461 B1 5/2004 Robinson
6,745,905 B2 6/2004 Bernstein
6,749,070 B2 6/2004 Corbett, Jr. et al.
6,756,975 B1 6/2004 Kishida et al.
6,758,349 B1 7/2004 Kwap et al.
6,769,552 B1 8/2004 Thalenfeld
6,772,888 B2 8/2004 Burke
6,779,670 B2 8/2004 Primiano et al.
6,786,341 B2 * 9/2004 Stinnett et al. ..... 211/59.2
6,796,445 B2 9/2004 Cyrluk
6,799,523 B1 10/2004 Cunha
6,820,754 B2 11/2004 Ondrasik
6,824,009 B2 11/2004 Hardy
6,843,382 B2 1/2005 Kanouchi et al.
6,860,046 B1 3/2005 Squitieri
6,866,156 B2 3/2005 Nagel et al.
6,867,824 B2 3/2005 Eiraku et al.
6,874,646 B2 4/2005 Jay
6,889,854 B2 5/2005 Burke
6,889,855 B2 5/2005 Nagel
6,902,285 B2 6/2005 Eiraku et al.
6,918,495 B1 7/2005 Hoy
6,918,736 B2 7/2005 Hart et al.
6,919,933 B2 7/2005 Zhang et al.
6,923,330 B1 8/2005 Nagel
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh et al.
7,028,450 B2 4/2006 Hart et al.
7,028,852 B2 4/2006 Johnson et al.
7,063,217 B2 6/2006 Burke
7,080,969 B2 7/2006 Hart et al.
7,083,054 B2 8/2006 Squitieri
7,086,541 B2 8/2006 Robertson
7,093,546 B2 8/2006 Hardy
7,104,026 B2 9/2006 Welbom et al.
7,104,410 B2 9/2006 Primiano
7,108,143 B1 9/2006 Lin
7,111,914 B2 * 9/2006 Avendano ..... 312/405.1
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,579 B2 1/2007 Richter et al.
7,182,209 B2 2/2007 Squitieri
7,195,123 B2 3/2007 Roslof et al.
7,198,340 B1 4/2007 Ertz
7,201,281 B1 4/2007 Welker
7,216,770 B2 5/2007 Mueller
7,229,143 B2 6/2007 Gilman
7,293,663 B2 11/2007 Lavery, Jr.
7,299,934 B2 11/2007 Hardy et al.
7,318,532 B1 1/2008 Lee
7,347,335 B2 3/2008 Rankin
1,786,392 A1 4/2008 Kemp
7,357,469 B2 * 4/2008 Ertz ..... 312/408

(56) References Cited

U.S. PATENT DOCUMENTS 7,395,938 B2 7/2008 Merit et al.
7,404,494 B2 7/2008 Hardy
7,419,062 B2 9/2008 Mason
7,424,957 B1 * 9/2008 Luberto ..... 211/59.3
7,451,881 B2 11/2008 Hardy et al.
7,458,473 B1 12/2008 Mason
7,478,731 B1 1/2009 Mason
7,497,342 B2 3/2009 Hardy
7,500,571 B2 * 3/2009 Hawkinson ..... 211/59.3
7,621,409 B2 11/2009 Hardy et al.
7,626,913 B2 12/2009 Usami
7,631,771 B2 12/2009 Nagel et al.
7,641,057 B2 1/2010 Mueller et al.
7,681,743 B2 3/2010 Hanretty et al.
7,681,744 B2 3/2010 Johnson
7,703,614 B2 4/2010 Schneider et al.
7,717,276 B2 5/2010 Alves
7,784,623 B2 8/2010 Mueller et al.
7,784,644 B2 8/2010 Albert et al.
7,823,734 B2 11/2010 Hardy
7,828,158 B2 11/2010 Colelli
7,882,969 B2 2/2011 Gerstner et al.
7,918,353 B1 * 4/2011 Luberto ..... 211/59.3
7,931,156 B2 4/2011 Hardy
7,934,609 B2 * 5/2011 Alves et al. ..... 211/59.2
7,980,398 B2 7/2011 Kahl
8,016,139 B2 9/2011 Hanners et al.
8,025,162 B2 9/2011 Hardy
8,038,017 B2 10/2011 Close
8,096,427 B2 1/2012 Hardy
8,113,360 B2 2/2012 Olson
8,113,601 B2 2/2012 Hardy
D655,107 S 3/2012 Clark
8,127,944 B2 3/2012 Hardy
8,162,154 B2 4/2012 Trulaske
8,167,149 B2 5/2012 Wamsley
8,177,076 B2 5/2012 Rataiczak, III et al.
8,215,520 B2 * 7/2012 Miller et al. ..... 221/129
8,225,946 B2 7/2012 Yang
8,267,258 B2 9/2012 Allwright et al.
8,333,285 B2 12/2012 Kiehnau et al.
8,360,253 B2 1/2013 Hardy
8,397,922 B2 3/2013 Kahl
8,485,391 B2 7/2013 Vlastakis
8,556,092 B2 10/2013 Valiulis et al.
8,579,123 B2 11/2013 Mueller
8,622,227 B2 1/2014 Bird
8,657,126 B1 * 2/2014 Loftin et al. ..... 211/59.2
8,763,819 B2 7/2014 Theisen et al.
2001/0002658 A1 6/2001 Parham
2001/0010302 A1 8/2001 Nickerson
2001/0019032 A1 9/2001 Battaglia et al.
2001/0020604 A1 9/2001 Battaglia
2001/0020606 A1 * 9/2001 Battaglia et al. ..... 211/59.2
2001/0042706 A1 11/2001 Ryan, Jr. et al.
2001/0045403 A1 11/2001 Robertson
2002/0036178 A1 3/2002 Tombu
2002/0066706 A1 6/2002 Robertson
2002/0088762 A1 7/2002 Burke
2002/0108916 A1 8/2002 Nickerson
2002/0148794 A1 10/2002 Marihugh
2002/0170866 A1 11/2002 Johnson et al.
2002/0179553 A1 12/2002 Squitieri
2002/0182050 A1 12/2002 Hart et al.
2002/0189201 A1 12/2002 Hart et al.
2002/0189209 A1 12/2002 Hart et al.
2003/0000956 A1 1/2003 Maldonado
2003/0007859 A1 1/2003 Hart et al.
2003/0010732 A1 1/2003 Burke
2003/0057167 A1 3/2003 Johnson et al.
2003/0061973 A1 4/2003 Bustos
2003/0066811 A1 * 4/2003 Dimattio et al. ..... 211/59.2
2003/0080075 A1 5/2003 Primiano et al.
2003/0085187 A1 5/2003 Johnson et al.
2003/0132178 A1 7/2003 Jay et al.
2003/0132182 A1 7/2003 Jay
2003/0136750 A1 7/2003 Fuji et al.
2003/0141265 A1 7/2003 Jo et al.
2003/0168420 A1 9/2003 Primiano
2003/0217980 A1 11/2003 Johnson et al.
2003/0226815 A1 12/2003 Gaunt
2004/0000528 A1 1/2004 Nagel
2004/0004046 A1 1/2004 Primiano et al.
2004/0020879 A1 2/2004 Close
2004/0065631 A1 4/2004 Nagel
2004/0079715 A1 4/2004 Richter et al.
2004/0084390 A1 5/2004 Bernstein
2004/0094493 A1 5/2004 Higgins
2004/0104239 A1 6/2004 Black, Jr. et al.
2004/0105556 A1 6/2004 Grove
2004/0118793 A1 6/2004 Burke
2004/0140278 A1 7/2004 Mueller et al.
2004/0140279 A1 7/2004 Mueller et al.
2004/0182805 A1 9/2004 Harper
2004/0200793 A1 10/2004 Hardy
2004/0206054 A1 10/2004 Welborn et al.
2004/0232092 A1 11/2004 Cash
2004/0245197 A1 12/2004 McElvaney
2005/0040123 A1 2/2005 Ali
2005/0072747 A1 4/2005 Roslof et al.
2005/0076817 A1 4/2005 Boks et al.
2005/0098515 A1 5/2005 Close
2005/0127014 A1 6/2005 Richter et al.
2005/0133471 A1 6/2005 Squitieri
2005/0139560 A1 6/2005 Whiteside
2005/0189310 A1 9/2005 Richter et al.
2005/0199563 A1 9/2005 Richter et al.
2005/0199564 A1 9/2005 Johnson et al.
2005/0199565 A1 9/2005 Richter et al.
2005/0218094 A1 10/2005 Howerton
2005/0224437 A1 10/2005 Lee
2005/0249577 A1 11/2005 Hart et al.
2005/0258113 A1 11/2005 Close et al.
2005/0263465 A1 12/2005 Chung
2006/0001337 A1 1/2006 Walburn
2006/0032827 A1 2/2006 Phoy
2006/0049122 A1 3/2006 Mueller et al.
2006/0049125 A1 3/2006 Stowell
2006/0104758 A1 5/2006 Hart et al.
2006/0163180 A1 7/2006 Rankin et al.
2006/0163272 A1 7/2006 Gamble
2006/0186064 A1 8/2006 Merit et al.
2006/0186066 A1 8/2006 Johnson et al.
2006/0196840 A1 9/2006 Jay et al.
2006/0213852 A1 9/2006 Kwon
2006/0226095 A1 10/2006 Hardy
2006/0237381 A1 10/2006 Lockwood et al.
2006/0260518 A1 11/2006 Josefsson et al.
2006/0263192 A1 11/2006 Hart et al.
2006/0273053 A1 12/2006 Roslof et al.
2006/0283150 A1 12/2006 Hart et al.
2006/0283151 A1 12/2006 Welbom et al.
2007/0006885 A1 1/2007 Shultz et al.
2007/0029270 A1 2/2007 Hawkinson
2007/0068885 A1 3/2007 Busto et al.
2007/0108142 A1 5/2007 Medcalf et al.
2007/0108146 A1 * 5/2007 Nawrocki ..... 211/119.003
2007/0138114 A1 * 6/2007 Dumontet ..... 211/59.3
2007/0170127 A1 7/2007 Johnson
2007/0175839 A1 8/2007 Schneider et al.
2007/0175844 A1 8/2007 Schneider
2007/0251905 A1 11/2007 Trotta
2007/0267364 A1 11/2007 Barkdoll
2008/0011696 A1 1/2008 Richter et al.
2008/0017598 A1 1/2008 Rataiczak et al.
2008/0129161 A1 6/2008 Menz et al.
2008/0156751 A1 7/2008 Richter et al.
2008/0156752 A1 7/2008 Bryson et al.
2008/0164229 A1 7/2008 Richter et al.
2008/0314852 A1 12/2008 Richter et al.
2009/0272705 A1 11/2009 Francis
2010/0012602 A1 1/2010 Valiulis et al.
2010/0089847 A1 4/2010 Rataiczak, III et al.
2010/0096345 A1 4/2010 Crawbuck

(56) References Cited

U.S. PATENT DOCUMENTS

| | | | |
|---|---|---|---|
| 2010/0252519 | A1 | 10/2010 | Hanners et al. |
| 2011/0168652 | A1 | 7/2011 | Barkdoll |
| 2011/0174750 | A1 | 7/2011 | Poulokefalos |
| 2011/0284571 | A1 | 11/2011 | Lockwood et al. |
| 2012/0118840 | A1 | 5/2012 | Howley |
| 2013/0026117 | A1 | 1/2013 | Hardy |

FOREIGN PATENT DOCUMENTS

| | | | |
|---|---|---|---|
| CH | 412251 | | 4/1966 |
| DE | 969003 | | 4/1958 |
| DE | 1819158 | | 10/1960 |
| DE | 2002720 | | 7/1971 |
| DE | 7311113 | | 8/1973 |
| DE | 2232398 | | 1/1974 |
| DE | 2825724 | A1 | 12/1979 |
| DE | 8308485 | | 9/1983 |
| DE | 8426651 | | 7/1985 |
| DE | 8717386.7 | U1 | 4/1988 |
| DE | 3707410 | A1 | 9/1988 |
| DE | 29902688 | | 7/1990 |
| DE | 9300431.1 | | 3/1993 |
| DE | 29618870 | U1 | 1/1997 |
| DE | 19808162 | A1 | 9/1999 |
| DE | 202007011927 | U1 | 11/2007 |
| DE | 202013102529 | U1 | 6/2013 |
| EP | 0004921 | | 4/1979 |
| EP | 69003 | A1 | 1/1983 |
| EP | 0018003 | | 7/1984 |
| EP | 0176209 | | 4/1986 |
| EP | 0224107 | A2 | 11/1986 |
| EP | 336696 | A2 | 10/1989 |
| EP | 0337340 | | 10/1989 |
| EP | 0408400 | A1 | 7/1990 |
| EP | 0398500 | A1 | 11/1990 |
| EP | 0454586 | A1 | 10/1991 |
| EP | 478570 | A1 | 4/1992 |
| EP | 555935 | A1 | 8/1993 |
| EP | 0568396 | A1 | 11/1993 |
| EP | 0587059 | A2 | 3/1994 |
| EP | 782831 | A1 | 7/1997 |
| EP | 270016 | | 6/1998 |
| EP | 0979628 | | 2/2000 |
| EP | 986980 | | 3/2000 |
| EP | 0779047 | B1 | 4/2000 |
| EP | 1174060 | | 1/2002 |
| EP | 1208773 | A1 | 5/2002 |
| EP | 1256296 | | 11/2002 |
| EP | 1312285 | A1 | 5/2003 |
| EP | 1372436 | A1 | 1/2004 |
| EP | 1406527 | A1 | 4/2004 |
| EP | 1420669 | A2 | 5/2004 |
| EP | 1462035 | A2 | 9/2004 |
| EP | 1395152 | | 2/2005 |
| EP | 1510156 | | 3/2005 |
| EP | 1549182 | A1 | 7/2005 |
| EP | 1662944 | A1 | 6/2006 |
| EP | 1806076 | A2 | 7/2007 |
| EP | 1857021 | | 11/2007 |
| EP | 1864597 | A1 | 12/2007 |
| EP | 1940263 | A2 | 7/2008 |
| EP | 2005402 | A2 | 12/2008 |
| EP | 2282660 | A1 | 2/2011 |
| EP | 2338384 | A1 | 6/2011 |
| EP | 2398358 | A1 | 12/2011 |
| EP | 2415371 | A1 | 2/2012 |
| EP | 2531077 | A1 | 12/2012 |
| EP | 2625987 | A1 | 8/2013 |
| FR | 2385365 | | 10/1978 |
| FR | 2526338 | | 11/1983 |
| FR | 2617385 | | 1/1989 |
| FR | 2724098 | | 3/1996 |
| GB | 697994 | | 10/1953 |
| GB | 881700 | | 11/1961 |
| GB | 1082150 | | 9/1967 |
| GB | 2027339 | A | 2/1980 |
| GB | 2037553 | | 7/1994 |
| GB | 2281289 | | 1/1995 |
| GB | 2283407 | A | 5/1995 |
| GB | 740311 | | 11/1995 |
| GB | 2290077 | | 12/1995 |
| GB | 2297241 | A | 7/1996 |
| GB | 2386116 | | 10/2003 |
| GB | 2392667 | A | 3/2004 |
| GB | 1088654 | | 4/2008 |
| JP | 54168195 | | 11/1979 |
| JP | 1-86856 | U | 2/1982 |
| JP | 59218113 | | 8/1984 |
| JP | 62060521 | A | 3/1987 |
| JP | 6329463 | | 2/1988 |
| JP | 63-97114 | A | 4/1988 |
| JP | S63-099810 | A | 5/1988 |
| JP | 02-191413 | | 7/1990 |
| JP | 3-45766 | U | 4/1991 |
| JP | 4-23463 | U | 2/1992 |
| JP | 05-277023 | | 10/1993 |
| JP | 6202945 | | 7/1994 |
| JP | 6-77614 | U | 11/1994 |
| JP | H08507447 | A | 8/1996 |
| JP | 3005457 | | 3/1997 |
| JP | 9-238787 | A | 9/1997 |
| JP | 10263710 | | 10/1998 |
| JP | 11-18889 | A | 1/1999 |
| JP | 11006284 | | 1/1999 |
| JP | 11018889 | A | 1/1999 |
| JP | 11313737 | | 11/1999 |
| JP | 11342054 | | 12/1999 |
| JP | 2000023802 | A | 1/2000 |
| JP | 2000106988 | A | 4/2000 |
| JP | 2000157378 | | 6/2000 |
| JP | 2000350642 | | 12/2000 |
| JP | 2001104117 | | 4/2001 |
| JP | 2003210286 | | 7/2003 |
| JP | 3099639 | U | 11/2003 |
| JP | 3115289 | Y | 9/2005 |
| JP | 3115812 | U | 10/2005 |
| JP | 2007307244 | A | 11/2007 |
| JP | 4708539 | B2 | 6/2011 |
| NL | 106617 | A | 11/1963 |
| NL | 8520125 | | 1/1986 |
| NL | 1018330 | | 7/2002 |
| SE | 394537 | | 6/1977 |
| SU | 1600615 | | 10/1990 |
| WO | 9115141 | A | 10/1991 |
| WO | 9201614 | | 2/1992 |
| WO | 9806305 | | 2/1998 |
| WO | 00/48488 | A1 | 8/2000 |
| WO | 00/54632 | A1 | 9/2000 |
| WO | 0071004 | | 11/2000 |
| WO | 0165981 | | 9/2001 |
| WO | 02089104 | A2 | 11/2002 |
| WO | 02091885 | | 11/2002 |
| WO | 02091885 | A1 | 11/2002 |
| WO | 03005862 | | 1/2003 |
| WO | 03013316 | | 2/2003 |
| WO | 03032775 | A2 | 4/2003 |
| WO | 2004105556 | A | 12/2004 |
| WO | 2005021406 | A2 | 3/2005 |
| WO | 2006019947 | | 2/2006 |
| WO | 2006094058 | | 8/2006 |
| WO | 2007073294 | A1 | 6/2007 |
| WO | 2007133086 | | 11/2007 |
| WO | 2008/153561 | A1 | 12/2008 |
| WO | 2009029099 | A1 | 3/2009 |
| WO | 2010014742 | A1 | 2/2010 |
| WO | 2011018059 | A1 | 2/2011 |
| WO | 2012047480 | A1 | 4/2012 |

(56) References Cited

FOREIGN PATENT DOCUMENTS

| | | | |
|---|---|---|---|
| WO | 2012125301 | A1 | 9/2012 |
| WO | 2013066686 | A1 | 5/2013 |

OTHER PUBLICATIONS

*RTC Industries, Inc.* v. *Henschel-Steinau, Inc.*, Plaintiff's Notice of Dismissal Pursuant to Fed. R Civ. P. 41(a)(1)(a)(i) Case: 1:11-cv-05497 Document #: 15 Filed: Oct. 21, 2011 p. 1 of 3 Page ID #:51.
*RTC Industries, Inc.* v. *Henschel-Steinau, Inc.*, Complaint, Case: 1:10-cv-07460 Document #:1 Filed Nov. 19, 2010.
http://www.posexpert.pl/public/files/PDF/Popychacze%20produkt%C3%B3w.pdf; Sep. 2006.
http://www.hl-display.sk/eng/Catalogue2005/Optimal-eng.pdf; 2005.
http://www.trionline.com/trionshelfworks/sw2.php; May 2007.
http://web.archive.org/web/20070516135906/http://www.trionline.com/productlines/wonderBar.php; May 2007.
http://www.lpportal.com/feature-articles/item/15-product-protection%E2%80%94beyond-eas.html; Mar. 2004.
http://www.posexpert.pl/public/files/PDF/Zarz%C4%85dzanie%20p%C3%B3%C5%82K%C4%85%20(ang.).pdf; 2006.
http://www.postuning.de/fileadmin/PDF-Downloads/Prospekte/EN_Tabak.pdf; 2006.
http://www.postuning.de/fileadmin/PDF-Downloads/Prospekte/$EN_{13}$ ePusher.pdf: Feb. 2005.
Vue 3040 Sanden; Apr. 2005.
http://www.storereadysolutions.com/srs.nsf/t_rinc/A56F52CF98E12B9386257449006D11DD!OpenDocument; 2006.
http://ers.rtc.com/SRSFiles/SRS_Flyer_ProfitPusher.pdf; 2006.
Box-to-Shelf Pusher System—http://www.displaypeople.com/pdf/BOX_TO_SHELF_SELL_SHEET_Jan_19_V3.pdf. dated Jan. 19, 2011.
Shelf Works—Expandable Wire Tray System—http://www.trionline.com/pdf/ExpWTray.pdf. dated Jan. 6, 2003.
FFR DSI—Power Zone Trak-Set Self-facing System—http://www.ffr-dsi.com/sell-sheets/Power%20Zone%20Trak-Set%20Self-facing%20System.pdf.—dated Jan. 6, 2011.
International Search Report & Written Opinion for PCT/US2012/053374 mailed Nov. 27, 2012. (12 pages).
International Search Report & Written Opinion for PCT/US2012/053357 mailed Nov. 22, 2012. (13 pages).
Final Office Action dated Nov. 5, 2013 for Japanese Application No. 2012-8725, 8 pages.
European Search Report for Application No. 14164097 dated Jun. 11, 2014, 6 pages.
Office Action for European Application No. 10838083.3 dated May 23, 2014, 4 pages.
*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.
*RTC* vs. *Fasteners for Retail*, Case No. 05C 6940, Document No. 26, filed Apr. 25, 2006.
*RTC Industries, Inc.*, v. *HMG Worldwide Corporation*, Complaint, Civil Action No. 00C 3300, dated May 31, 2000.
*RTC Industries, Inc.* v. *HMG Worldwide Corporation*, Amended Complaint, dated Jan. 19, 2001.
*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.
*RTC Industries, Inc.*, v. *Fasteners for Retail, Inc., and SuperValu, Inc. d/b/a Cub Foods*, Complaint, Civil Action No. 05C 6940.
*RTC Industries, Inc.* v. *HMG Worldwide Corporation*, Notice of Motion, Civil Action No. 00 Civ. 3300 (JHL), dated Feb. 22, 2001.
*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.
*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.
*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.
*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc., and CVS Corporation*, Amended Complaint, Civil Action No. 03C 3137, dated Aug. 6, 2003.
*RTC Industries, Inc.* v. *Semasys, Inc., and Uni-Sun, Inc.*, Complaint, Civil Action No. 04C 4081, dated Jun. 17, 2004.
*RTC Industries, Inc.* v. *Display Specialties, Inc.*, Complaint, Civil Action No. 04C 3370, dated May 12, 2004.
*RTC Industries, Inc.* v. *William Merit & Associates, Inc.*, Complaint, Civil Action No. 04C 1254, dated Feb. 18, 2004.
*RTC Industries, Inc.* v. *William Merit & Associates, Inc.*, Defendant's Notice of Motion for Partial Summary Judgment of Non-Infringement that Claims 1-8 of U.S. Patent No. 4,830,201 are Not infringed, Civil Action No. 04C 1254, dated Apr. 29, 2004.
*RTC Industries, Inc.*, v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.
*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.
*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.
*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Industries, Inc.*, v. *William Merit & Associates, Inc.*, Memorandum Opinion, Civil Action No. 04 C 1254, dated Jul. 15, 2004.
*RTC Industries, Inc.* v. *Fasteners for Retail Inc., and CVS Corporation*, Reply, Civil Action No. 03C 3137, dated Sep. 17, 2003.

(56) References Cited

OTHER PUBLICATIONS

*RTC Industries, Inc.* v. *Fasteners for Retail, Inc. and CVS Pharmacy, Inc.*, to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.* to Rexam Cosmetic Packaging, Inc., Subpoena in a Civil Case, Case No. 03C 3137 N.D. Illinois, dated Nov. 11, 2003.
*RTC Industries, Inc.*, v. *William Merit & Associates, Inc.*, Index of Exhibits, Civil Action No. 04 C 1254, dated Jun. 18, 2004.
*RTC Industries, Inc.* v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc. and CVS Pharmacy, Inc.*, Defendants' Opposition to Plaintiff's Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc., and CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc.* v. *Fasteners for Retail*, Minute Order of Dec. 12, 2003 by Honorable Joan B. Gottschall, Case No. 1:03-cv-03137.
*RTC Industries, Inc.*, v. *William Merit & Associates, Inc.*, RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.
FFR Yellow pages, 2003 product Catalog, "Merchandising Ideas Made Easy for Every Retain Environment," dated 2003. pp. 1-14.
*RTC Industries, Inc.* v. *William Merit & Associates, Inc.*—Complaint—dated Feb. 18, 2004 p. 1-11.
*RTC Industries, Inc.* v. *Fasteners for Retail Inc.*,Complaint, dated May 12, 2003 p. 1-6.
*RTC Industries, Inc.* v. *HMG Worldwide Corporation*—Complaint—dated May 31, 2000 p. 1-10.
*RTC Industries, Inc.* v. *Display Specialities, Inc.*—Complaint dated May 12, 2004 p. 1-19.
*RTC Industries, Inc.* v. *Semasys, Inc.*—Complaint, dated Jun. 17, 2004, p. 1-12.
*RTC Industries, Inc.* v. *Fasteners for Retail, Inc., and Super Valu, Inc. d/b/a Cub Foods*, Complaint, dated Dec. 18, 2005 ; p. 1-25.
*VIDPRO International, Inc.* v. *RTC Industries, Inc.*—Original Complaint—dated Jun. 2, 1995, p. 1-28.
Jan. 6, 2015—(JP) Office Action—App 2014-528646.

* cited by examiner

FIG. 3
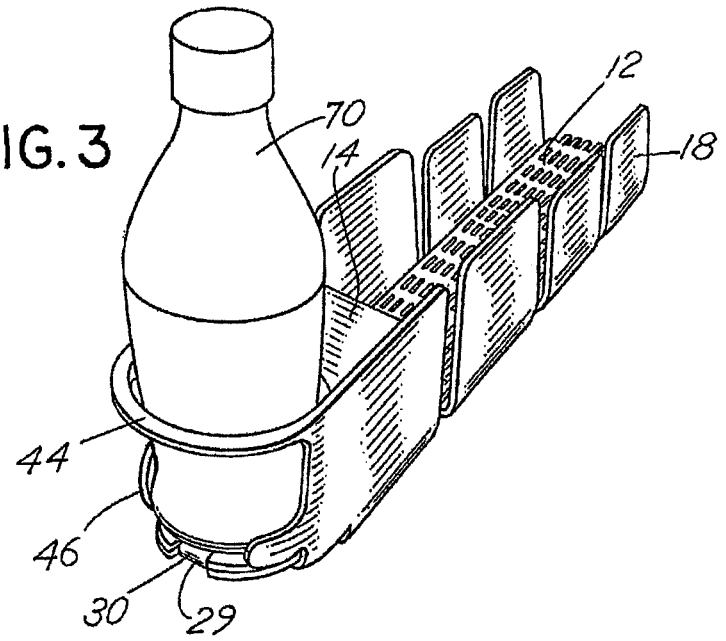
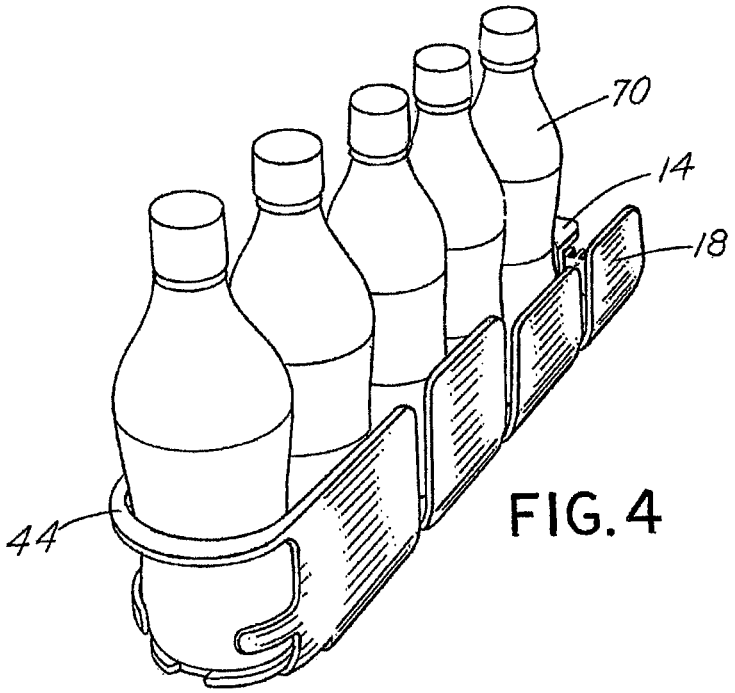
FIG. 4

FIG.9
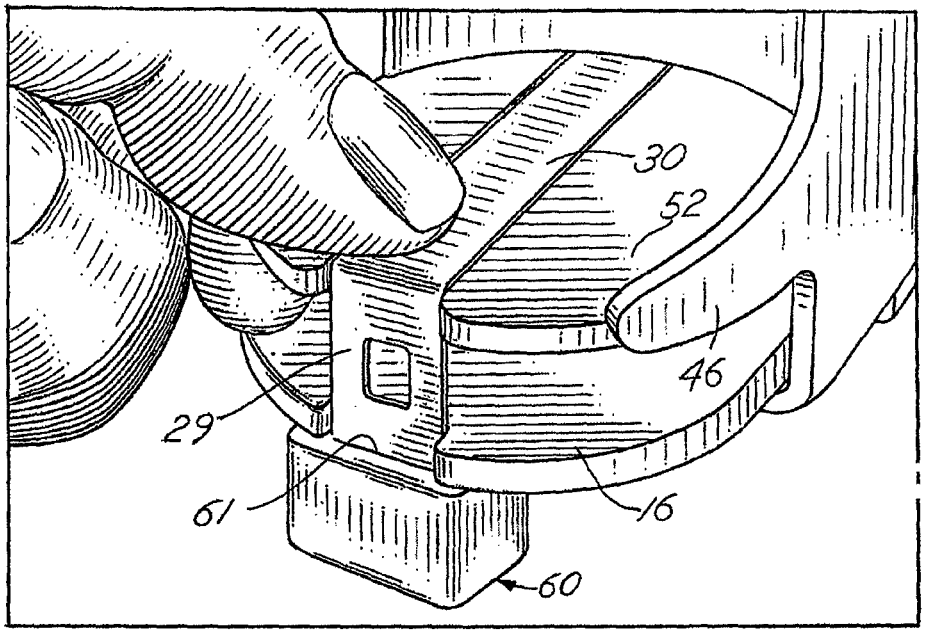
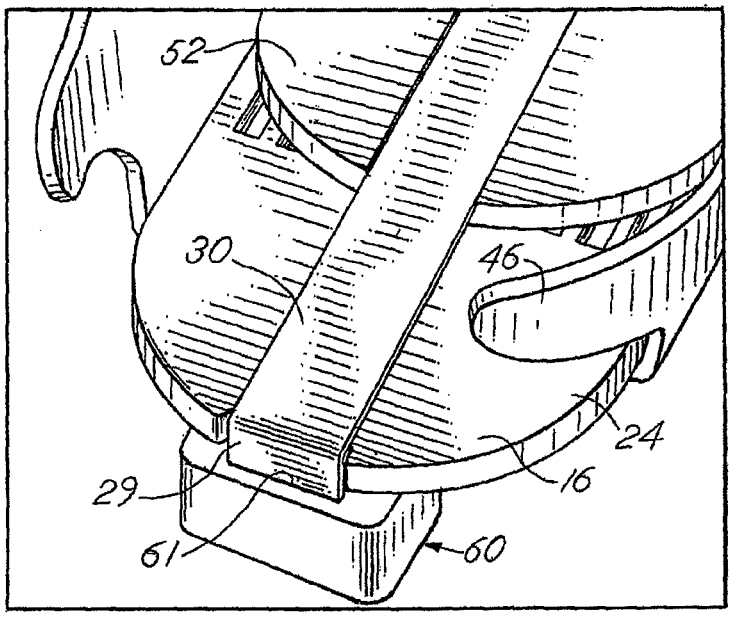
FIG.10

FIG.11
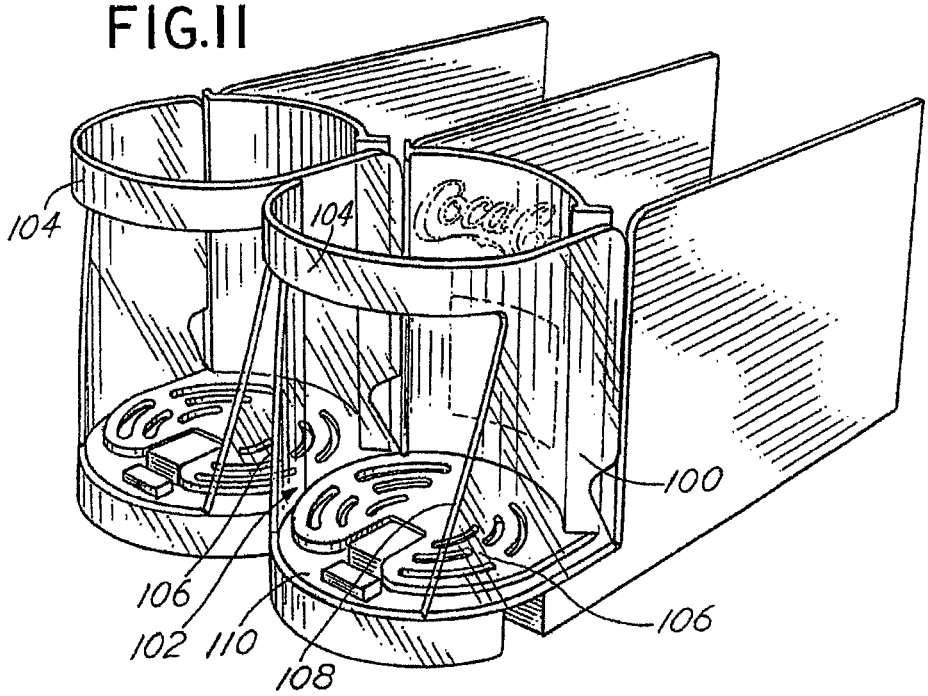
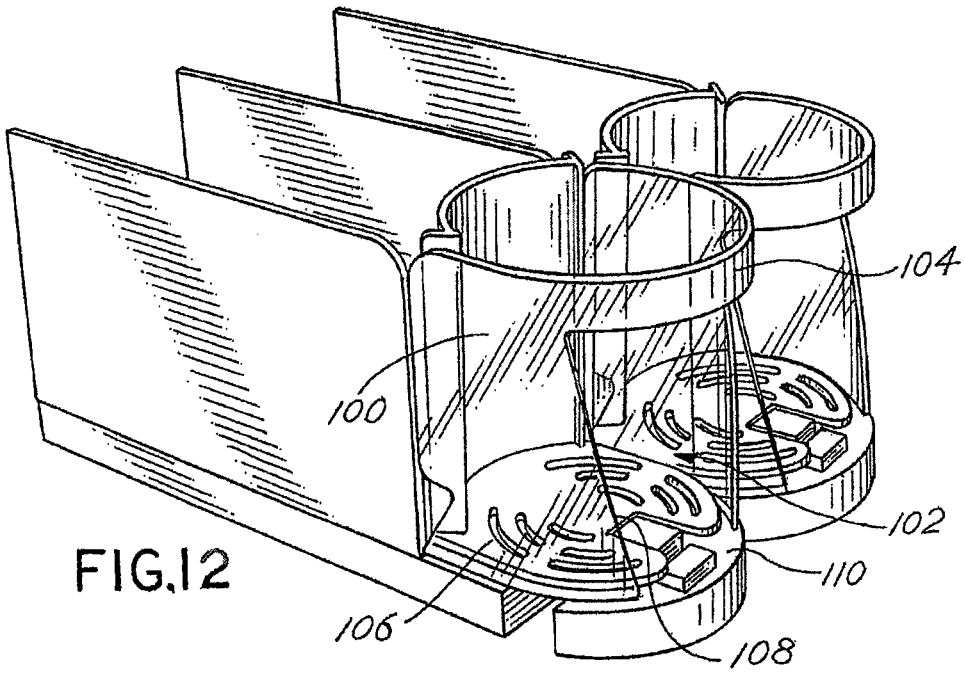
FIG.12

FIG.13
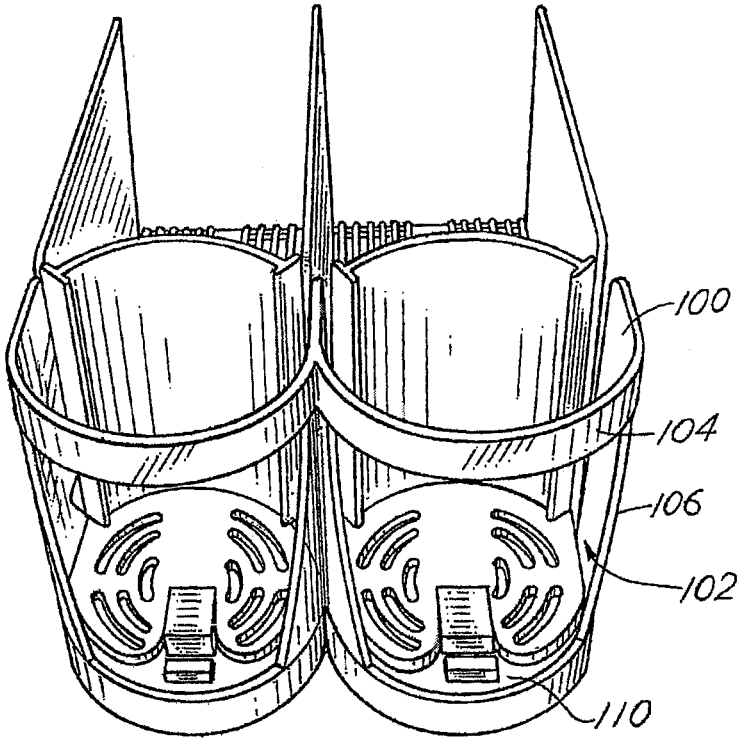
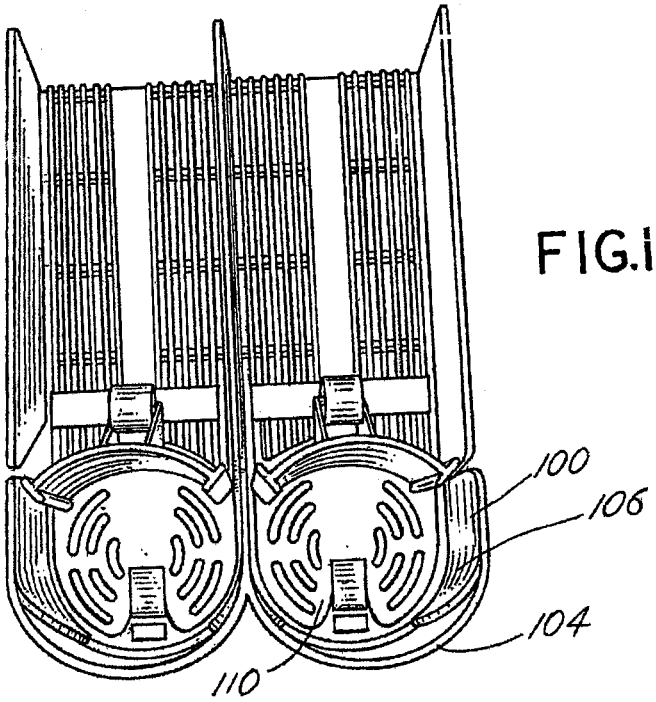
FIG.14

FIG.21
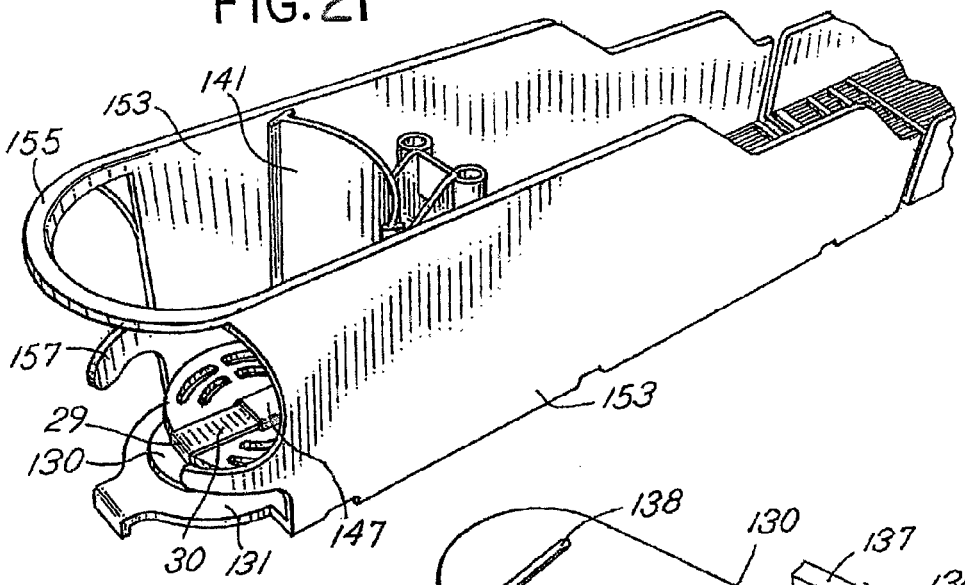
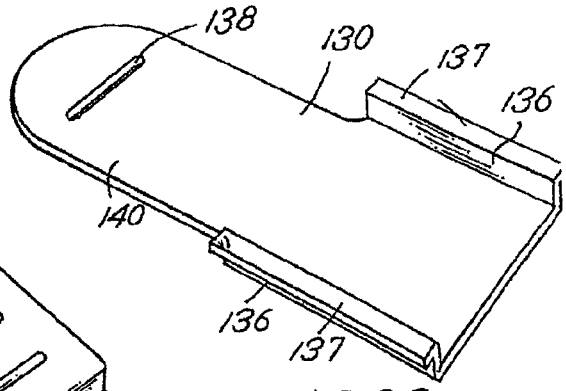
FIG.22
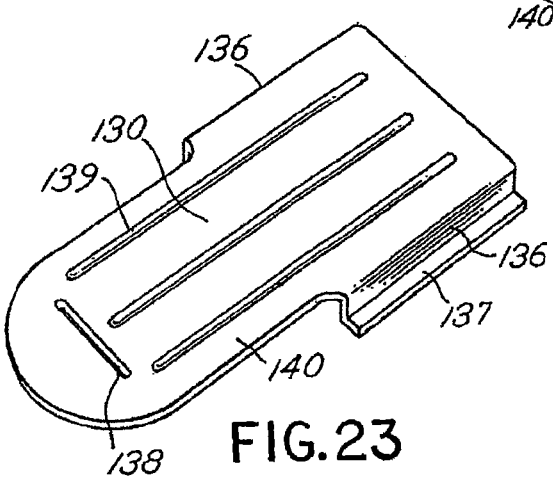
FIG.23

FIG. 28
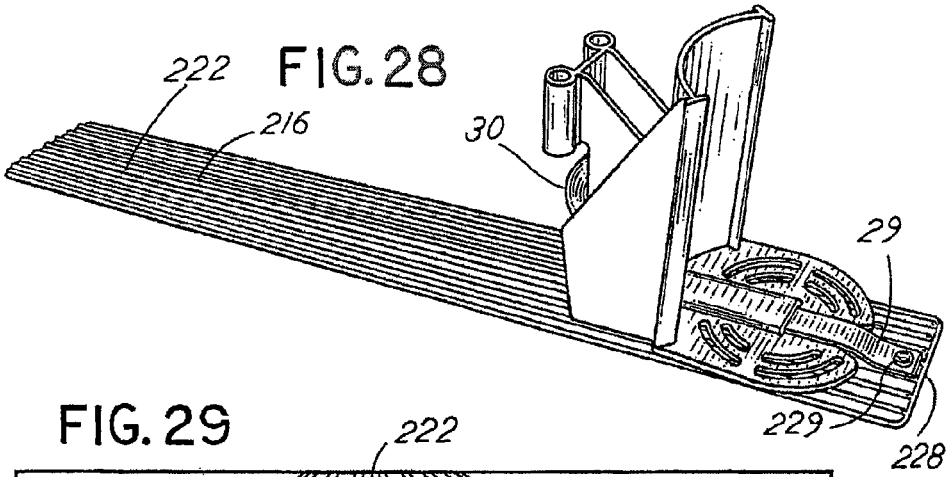
FIG. 29
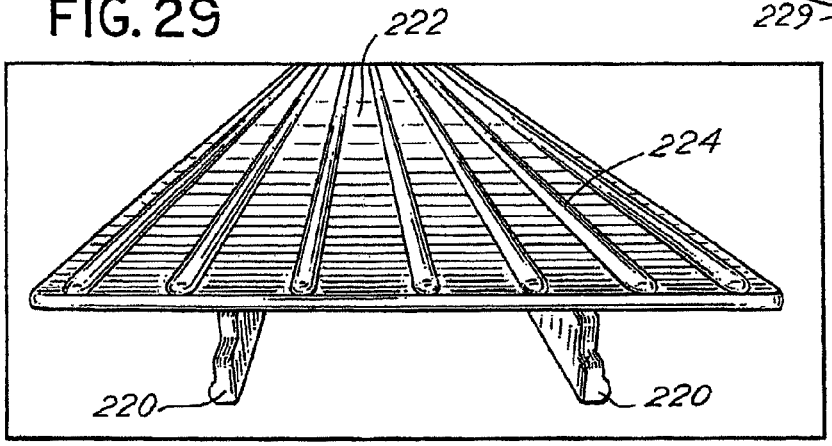
FIG. 29 A
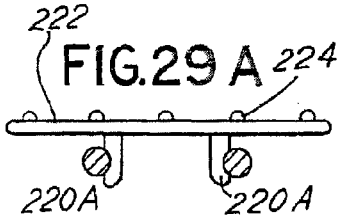
FIG. 29B
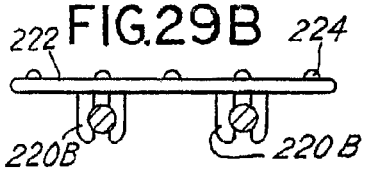
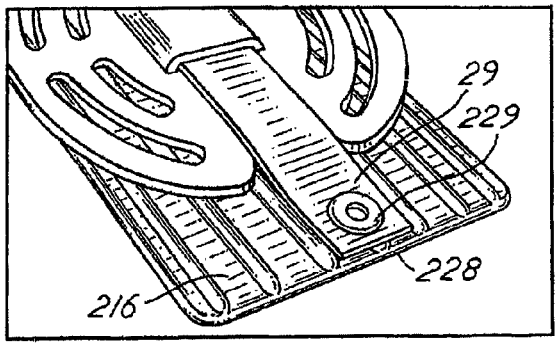
FIG. 30

FIG.31
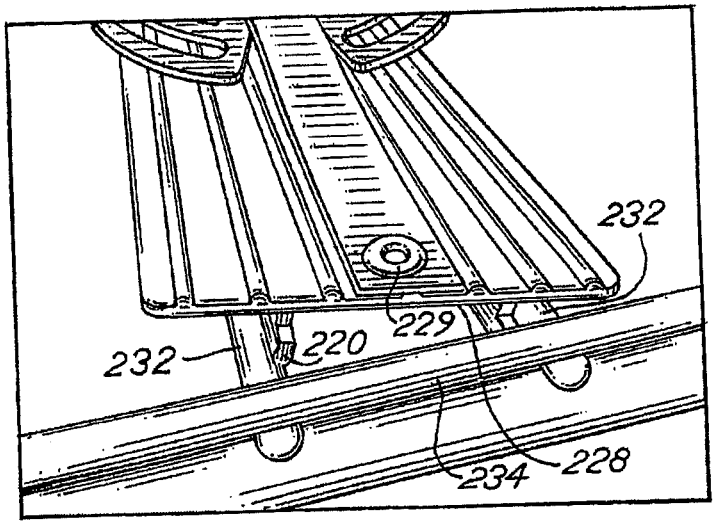
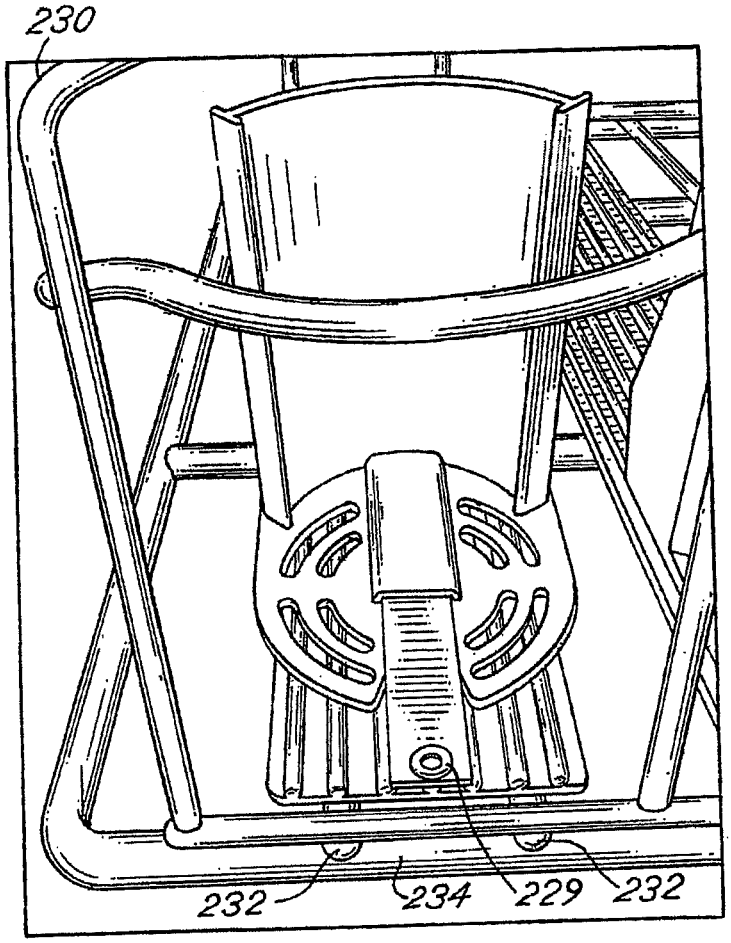
FIG.32

PRODUCT MANAGEMENT DISPLAY SYSTEM

CROSS REFERENCE TO RELATED APPLICATION

This application is a continuation-in-part application of U.S. application Ser. No. 13/839,674, filed Mar. 15, 2013, which is a continuation-in-part application of U.S. application Ser. No. 13/542,419, filed Jul. 5, 2012, which is a continuation-in-part application of U.S. application Ser. No. 12/639,656 filed Dec. 16, 2009, now U.S. Pat. No. 8,322,544, which is a continuation-in-part application of U.S. application Ser. No. 12/357,860, filed Jan. 22, 2009, now U.S. Pat. No. 8,453,850, which is a continuation-in-part application of U.S. application Ser. No. 11/760,196, filed Jun. 8, 2007, now U.S. Pat. No. 8,312,999, which is a continuation-in-part application of U.S. application Ser. No. 11/411,761, filed Apr. 25, 2006, now U.S. Pat. No. 7,823,734, which claims benefit to U.S. Provisional Application Nos. 60/716,362, filed Sep. 12, 2005, and 60/734,692, filed Nov. 8, 2005, all of which are incorporated herein by reference. U.S. application Ser. No. 13/542,419 also claims benefit to U.S. Provisional Application Nos. 61/530,736 filed Sep. 2, 2011, 61/542,473 filed Oct. 3, 2011, and 61/553,545 filed Oct. 31, 2011, all of which are incorporated herein by reference. This application also claims priority to U.S. Provisional Application Ser. No. 61/861,843, filed on Aug. 2, 2013, which is incorporated herein by reference.

FIELD

The exemplary embodiments relate generally to a shelf assembly for use in merchandising product and more particularly to a shelf assembly having improved mechanisms for displaying and pushing product on the shelves.

BACKGROUND

It is known that retail and wholesale stores, such as convenience stores, drug stores, grocery stores, discount stores, and the like, require a large amount of shelving both to store product and to display the product to consumers. In displaying product, it is desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it is desirable for these products to also be situated toward the front of the shelf and visible and accessible to the consumers.

To accomplish this placement of product, known systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. However, over time, these surfaces can become obstructed with debris or sticky substances that inhibit the product from properly sliding, sometimes causing several products to tip over thus blocking additional product from moving to the front of the shelf.

Other systems include the use of a pusher system to push the product toward the front of the shelf as the product at the front of the shelf is removed. The known pusher systems are typically mounted to a track and include a pusher paddle and a coiled spring to urge the product forward. Occasionally, as the system is used, and over time, the track becomes obstructed with dirt or sticky materials that hinder the proper operation of the pusher system in the track. In addition, depending on the size, shape and weight of the product to be merchandised, the known pusher paddles may occasionally tip or bend backwards, thereby causing a binding of the pusher mechanism in the track. In those situations, the pusher mechanism may not properly push product toward the front of the shelf.

One exemplary embodiment is directed at improving upon existing merchandising systems by providing a trackless pusher system that works with gravity-fed merchandise systems (i.e., inclined shelves or trays) and non-gravity-fed merchandise systems.

SUMMARY

One exemplary embodiment is directed to a product management display system for merchandising product on a shelf. This embodiment includes using a trackless pusher mechanism that travels along a surface on which product is placed. The trackless system overcomes the known problems with the use of tracks to hold and guide the known pusher mechanisms. It should be understood however that the teachings of this embodiment may be used with systems that include tracks for mounting a pusher mechanism or the like.

The pusher mechanism can include a pusher paddle and a floor that extends forward of the pusher paddle. A flat coiled spring or other biasing element can be operatively connected behind the pusher paddle and extend across the floor of the pusher mechanism and to the front of the shelf. Alternatively, the flat coiled spring or biasing element can extend across the divider to the front of the shelf assembly. With this configuration, the pusher paddle is prevented from tipping or bending backwards during operation.

An exemplary embodiment also includes the use of a pushing mechanism with the merchandising of product on horizontal or non-inclined shelves or surfaces, as well as with gravity-fed systems, or systems that use gravity as a mechanism to urge product toward the front of the shelf.

In accordance with an exemplary illustrative embodiment of the invention, the pusher paddle may define a concave pushing surface for pushing cylindrical products, such as soft drink bottles or cans, and to keep the paddle centered on the track and behind the product. Alternatively, the pusher paddle may define a flat pushing surface that may further include at its upper edge a curved rib or similar structure that can also be used to push cylindrical products.

In accordance with another exemplary illustrative embodiment of the invention, the floor of the pusher mechanism can include a notched or cut-out portion to align the pusher mechanism relative to the coiled spring. Also, the floor of the system also can include a notch or cut-out portion for receiving and mounting a flat end of the coiled spring to the floor. A spring tip may be placed on the end of the coiled spring to mount the coiled spring to the floor of the system. Alternatively, the end of the coiled spring can mount to the divider of the assembly.

In accordance with yet another exemplary embodiment, an adaptor for a product management display system may be positioned on a floor surface of the display system. The adaptor may include a planar surface with at least two ribs extending outwardly from the planar surface and across the planar surface in a substantially parallel manner. A coiled spring may be positioned between the parallel extending ribs. With this configuration, product to be merchandised may sit on the ribs, and not directly on the coiled spring, to enhance the forward movement of certain types of product, such as cans of a beverage.

In yet another alternative aspect, a mounting member may be used to mount the end of the coiled spring to the floor of the system. For those systems that include spaced-apart glide rails that are joined together by connecting ribs, the mounting member may be snap-fit to or otherwise mounted on the floor and between the glide rails.

In yet another alternative aspect, the trackless pusher system is retrofitted into an existing shelf assembly. This allows for the placement of the trackless pusher system in an existing shelving system as a low cost alternative to purchasing the entire trackless pusher assembly.

In another exemplary embodiment, the coil spring can be mounted to the retainer. An end of the coil spring can be directly mounted to the retainer or alternatively the end can be mounted to the retainer via an adapter. The adapter can have a curved portion which is received in a correspondingly shaped curved slot in the retainer to secure the end of the spring to the display assembly.

In another exemplary embodiment, the trays can be attached via a dovetail connection to form a shelf assembly. Additionally the dividers can be adjusted such that the width of the product rows can be adapted to receive different sized products.

In accordance with yet another exemplary embodiment, the product management display system can be arranged in a stackable arrangement. The assembly can be provided with a first tray and a second tray each having a first wall and a second wall. The first and second trays are each adapted to receive a pusher mechanism, and a retainer mechanism. First and second spacers are mounted to the first and second trays for stacking the first and second trays on top of one another. The first and second spacer can be provided with a plurality of detents, and the first tray and the second tray can each be provided with a plurality of correspondingly shaped sockets for receiving the plurality of detents.

In accordance with yet another exemplary embodiment, a product management display system for merchandising product on a shelf includes using a trackless pusher mechanism that travels along a surface on which product is placed and one or more dividers for separating product into rows. The one or more dividers may be attached and releasably engaged to a front rail. When the one or more dividers are not engaged and held in position to the front rail, the one or more dividers and product positioned on the display system may be moved in a lateral direction, or may be lifted away from the front rail. This permits ease of replanogramming of product on the shelf. The one or more dividers may releasably engage to the front rail through the use of corresponding teeth, resilient surfaces, a locking tab, a locking bar, a cam and/or through a friction or press fit.

In an example, a merchandise display system includes a front rail and at least one divider configured to engage the front rail. The at least one divider includes a barrier and the at least one divider further includes a divider wall. The at least one divider also includes a divider floor perpendicular to the divider wall, wherein the divider floor is configured to hold product. The merchandise display system also includes a cam coupled to the divider, wherein the cam is configured to move between a first position and a second position. The at least one divider is (a) movable in a lateral direction parallel to the front rail and (b) secured in a direction perpendicular to the front rail when the at least one divider is engaged with the front rail and the cam is in the first position. The at least one divider is (a) fixed in the lateral direction parallel to the front rail and (b) secured in the direction perpendicular to the front rail when the at least one divider is engaged with the front rail and the cam is in the second position.

In an example, a merchandise display system includes a front rail and a plurality of dividers configured to attach to the front rail and separate product into rows. Each of the plurality of dividers includes a divider wall extending in a direction perpendicular to the front rail, a divider floor perpendicular to the divider wall, wherein the divider floor is configured to hold product, and a cam coupled to the divider, wherein the cam is configured to move between a first position and a second position. Each of the plurality of dividers is (a) movable in a lateral direction parallel to the front rail and (b) secured in a direction perpendicular to the front rail when each of the plurality of dividers is engaged with the front rail and the cam for each of the plurality of dividers is in the first position. In addition, each of the plurality of dividers is (a) fixed in the lateral direction parallel to the front rail and (b) secured in the direction perpendicular to the front rail when each of the plurality of dividers is engaged with the front rail and the cam for each of the plurality of dividers is in the second position.

In an example, a merchandise display system includes a front rail and at least one divider configured to attach to the front rail, the at least one divider including a barrier, a divider wall extending in a direction perpendicular to the front rail, a divider floor perpendicular to the divider wall, wherein the divider wall separates the divider floor into a first portion and a second portion and each of the first portion and the second portion are configured to hold product. The merchandise display system also includes a first pusher mechanism configured to slide along at least part of the first portion, a second pusher mechanism configured to slide along at least part of the second portion, and a cam coupled to the at least one divider, the cam configured to move between a first position and a second position. The at least one divider is movable in a lateral direction parallel to and along the front rail when the cam is in the first position, and the at least one divider resists movement in the lateral direction parallel to and along the front rail when the cam is in the second position.

In an example, a merchandise display system includes a front rail and at least one divider configured to attach to the front rail, the at least one divider including a barrier configured to engage the front rail, a divider wall extending in a direction perpendicular to front rail, a divider floor perpendicular to the divider wall, wherein the divider floor configured to hold product. The display system also can include a resilient tab coupled to the divider, the resilient tab configured to move between a first position and a second position. The at least one divider is fixed in a lateral direction parallel to the front rail when the resilient tab is in the first position. The at least one divider is movable in the lateral direction parallel to the front rail when the resilient tab is in the second position.

In an example, a merchandise display system includes a front rail, the front rail comprising at least one first projection and at least one first recess, and at least one divider configured to attach to the front rail, the at least one divider comprising a divider wall and a divider floor perpendicular to the divider wall, the at least one divider further comprising at least one second recess and at least one second projection, the at least one second projection of the divider configured to move between a first position and a second position, The at least one divider is (a) movable in a lateral direction parallel to the front rail and (b) secured in a direction perpendicular to the front rail when the at least one first projection of the front rail is engaged with the at least one second recess of the divider and the at least one second projection of the divider is in the first position. The at least one divider (a) resists movement in the lateral direction parallel to the front rail and (b) is secured in a direction perpendicular to the front rail when the at least one first projection of the front rail is engaged with the at least one second recess of the divider and the at least one second projection of the divider is in the second position.

In an example, a merchandise display system includes a front rail, the front rail including at least one first projection and at least one second projection, the at least one second projection of the front rail configured to move between a first position and a second position. The merchandise display system also includes at least one divider configured to attach to the front rail, the at least one divider comprising a divider wall and a divider floor perpendicular to the divider wall, the at least one divider further comprising at least one recess. The at least one divider is (a) movable in a lateral direction parallel to the front rail and (b) secured in a direction perpendicular to the front rail when the at least one first projection of the front rail is engaged with the at least one recess of the divider and the at least one second projection of the front rail is in the first position. The at least one divider is (a) fixed in the lateral direction parallel to the front rail and (b) secured in the direction perpendicular to the front rail when the at least one first projection of the front rail is engaged with the at least one recess of the divider and the at least one second projection of the front rail is in the second position.

In an example, a merchandise display system includes a front rail, the front rail comprising a first projection and a second projection. The merchandise display system also includes at least one divider configured to attach to the front rail, the at least one divider comprising a divider wall and a divider floor perpendicular to the divider wall, the at least one divider further comprising a recess and a third projection. The at least one of the second projection or the third projection is a movable projection that is movable between a first position and a second position. The at least one divider is (a) movable in a lateral direction parallel to the front rail and (b) secured in a direction perpendicular to the front rail when the first projection of the front rail is engaged with the recess of the divider and the movable projection is in the first position. The at least one divider is (a) fixed in the lateral direction parallel to the front rail and (b) secured in the direction perpendicular to the front rail when the first projection of the front rail is engaged with the recess of the divider and the movable projection is in the second position.

In an example, a merchandise display system includes a front rail, the front rail comprising at least a first engaging member. The merchandise display system also includes at least one divider configured to attach to the front rail, the at least one divider comprising a divider wall and a divider floor perpendicular to the divider wall, the at least one divider further comprising at least a second engaging member. The merchandise display system also includes a third engaging member configured to move between a first position and a second position. The at least one divider is (a) movable in a lateral direction parallel to the front rail and (b) secured in a direction perpendicular to the front rail when the first engaging member of the front rail is engaged with the second engaging member of the divider and the third engaging member is in the first position. The at least one divider is (a) fixed in the lateral direction parallel to the front rail and (b) secured in the direction perpendicular to the front rail when the first engaging member of the front rail is engaged with the second engaging member of the divider and the third engaging member is in the second position.

In an example, a merchandise display system includes a front rail and at least one divider configured to engage the front rail, the at least one divider including a barrier, the at least one divider further including a divider wall, the at least one divider further including a divider floor perpendicular to the divider wall, wherein the divider floor is configured to hold product. The merchandise display system also includes a cam coupled to the divider, wherein the cam is configured to move between a first position and a second position. The at least one divider can be secured in a direction perpendicular to the front rail when the at least one divider is engaged with the front rail. The cam can inhibit movement of the at least one divider in the lateral direction parallel to the front rail when the cam in the first position and the cam can allow movement of the divider in the lateral direction parallel to the front rail when the cam is in the second position. The merchandise display system can include a handle to rotate the cam between the first position and the second position. The merchandise display system can include a handle to slide the cam between the first position and the second position.

In another exemplary embodiment, a merchandise display system includes a front rail defining a rail groove and a divider configured to engage the front rail. The divider includes a barrier, a divider wall, and a divider floor extending perpendicular to the divider wall. The divider floor further includes a top surface to hold product and a bottom surface. The merchandise display system also includes a cam rotatably coupled to the divider. The cam is configured to rotate between a first position and a second position. The cam defines a cam glide that extends beneath the bottom surface of the divider floor and contacts the front rail when the cam is in the first position. In operation, the divider is movable in a lateral direction parallel to the front rail when the cam is in the first position and the cam glide contacts the front rail, and the divider is fixed in the lateral direction parallel to the front rail when the cam is in the second position and in contact with the rail groove of the front rail. With this embodiment, the cam is at all times in contact with the front rail, regardless of whether the cam is in the first position or the second position, or in a position in-between the first and second positions.

In an alternative aspect, the cam includes a handle to rotate the cam between the first position and the second position, and the cam can include one or more cam surfaces configured to engage one or more groove walls in the rail groove when the cam is in the second position. Additionally, the cam glide may define an elongated planar surface. Also, the merchandise display system may include a pusher mechanism having a pusher surface and a pusher floor extending forwardly from the pusher surface. A coiled spring having a coiled end may be positioned behind the pusher surface and a free end of the spring may attach the pusher mechanism to the merchandise display system. Alternatively, the barrier may be configured to receive the free end of the coiled spring. In yet another alternative aspect, the front rail may define a ridge configured to engage a groove in the divider.

In another exemplary embodiment, a merchandise display system includes a front rail and at least one divider configured to attach to the front rail. The at least one divider may include a barrier and a divider wall extending in a direction perpendicular to the front rail. The divider may include a divider floor perpendicular to the divider wall and the divider wall separates the divider floor into a first portion and a second portion and each of the first portion and the second portion are configured to hold product. Additionally, the merchandise display system includes a first pusher mechanism configured to slide along at least part of the first portion and a second pusher mechanism configured to slide along at least part of the second portion. The merchandise display system includes a cam coupled to the at least one divider. The cam defines a cam glide and is configured to move between a first position and a second position. In operation, the at least one divider is movable in a lateral direction parallel to and along the front rail when the cam is in the first position and the cam glide is in contact with the front rail, and the at least one divider resists movement in the lateral direction parallel to and along the front rail when the cam is in the second position and the cam glide is not in contact with the front rail.

In an aspect, the first and second pusher mechanisms each include a pusher surface, a pusher floor extending forwardly from the pusher surface, and a coiled spring having a coiled end and a free end. The coiled end is positioned behind the pusher surface and the free end attaches the first and second pusher mechanisms to the merchandise display system.

In an alternative aspect, the at least one divider may define a divider engaging member and the at least one front rail may define a front rail engaging member. The divider engaging member is configured to engage the front rail engaging member. The divider engaging member may define divider teeth on at least one surface of the divider engaging member. The front rail engaging member may define front rail teeth on at least one surface of the front rail engaging member. The divider teeth are configured to engage the front rail teeth.

In another exemplary embodiment, a merchandise display system includes a front rail and at least one divider configured to engage the front rail. The at least one divider includes a barrier, a divider wall, and a divider floor perpendicular to the divider wall. The divider floor is configured to hold product. The merchandise display system also includes a cam coupled to the divider. The cam is configured to move between a first position and a second position. The cam defines a cam glide for lifting the divider up off of the front rail when the cam is in the first position. The at least one divider is secured to the front rail when the cam is in the second position and the cam glide is moved away from the front rail. In an aspect, the at least one divider is movable in the plane of a shelf only in the lateral direction parallel to the front rail and the at least one divider is fixed in the plane of the shelf in all directions other than the direction parallel to the front rail when the at least one divider is engaged with the front rail. In another aspect, the cam may include a handle to rotate the cam between the first position and the second position. Additionally, the cam glide may define an elongated planar surface having an edge that permits slidable movement of the cam glide relative to the front rail.

In another exemplary embodiment, the merchandise display system may include a front rail and at least one divider configured to engage the front rail. The divider may include a barrier, a divider wall, and a divider floor perpendicular to the divider wall configured to hold product. A front lock may be coupled to the divider. In an aspect, the front lock may be configured to rotate, pivot or move between a first position and a second position. When in the first position, the front lock may permit slidable movement of the divider relative to the front rail. In an alternative aspect, the front lock may lift the divider up off of the front rail. When in the second position, the front lock locks the divider to the front rail and prevents slidable movement between the divider and the front rail.

In another exemplary embodiment, the merchandise display system may include a divider secured to a support structure. The divider may include a divider wall and a divider floor. The divider wall may extend upwardly from the divider floor and the divider floor may include a top surface. The system may further include a barrier that is moveable by rotation between a folded position and an upright position without a rotation biasing element. A product positioned on a top surface of the divider floor can contact the barrier when the product moves toward the forward end of the divider and rotate the barrier from the folded position to the upright position. The barrier may be configured to cease the forward movement of the product when the barrier is in the upright position. The system may include a rotational mounting structure to which the moveable barrier is connected. The rotational mounting structure may be removably connected to the forward end of the divider.

In another exemplary embodiment, the merchandise display system may be used in conjunction with a product tray for restocking of the system with product. The product tray may include a bottom surface, right side wall, left side wall, and an alignment flap. The alignment flap may include a proximate end, distal end, right edge, and left edge. A flap width of the alignment flap may be defined in between the right edge and the left edge. The proximate end of the alignment flap may be connected to the bottom surface of the product tray and the alignment flap may be configured such that a least a portion of the flap width is about equal to a width of product stored in the product tray. The alignment flap may be positioned in between opposing divider walls of a merchandise display system in which a product pocket is defined in between the opposing divider walls. The alignment flap aligns the product tray and the product stored in the product tray with the product pocket so that the product stored in the product tray can be slid from in the product tray into the product pocket of the merchandise display system.

BRIEF DESCRIPTION OF THE DRAWINGS

FIG. 3 depicts another isometric view of the system of FIG. 2 with product placed in the system.

FIG. 4 depicts another isometric view of the system of FIG. 2 with multiple product placed in the system.

FIG. 9 depicts the exemplary tip of FIG. 7 being mounted to an end of a coiled spring.

FIG. 10 depicts the exemplary tip of FIG. 7 mounted to an end of a coiled spring.

FIG. 11 depicts an isometric view of an alternative exemplary embodiment of a product management display system of the present invention.

FIG. 12 depicts another isometric view of the system of FIG. 11.

FIG. 13 depicts a front view of the system of FIG. 11.

FIG. 14 depicts a top view of the system of FIG. 11.

FIG. 21 depicts an isometric view of an alternative exemplary embodiment of a product management display system of the present invention.

FIG. 22 depicts an isometric bottom view of an exemplary mounting member that may be used to mount the end of the coiled spring to the floor of the display system.

FIG. 23 depicts an isometric top view of the exemplary mounting member of FIG. 22.

FIG. 28 depicts an isometric view of an alternative exemplary embodiment of a product management display system of the present invention.

FIG. 29 depicts a close-up isometric view of the tray of the exemplary embodiment of FIG. 28.

FIG. 29A depicts a cross-sectional view of the exemplary embodiment of FIG. 28 illustrating a first securing method.

FIG. 29B depicts a cross-sectional view of the exemplary embodiment of FIG. 28 illustrating a second securing method.

FIG. 30 depicts a close-up isometric view of the embodiment of FIG. 28 illustrating a rivet attaching the spring to the tray.

FIG. 31 depicts an isometric view of the embodiment of FIG. 28 being assembled in a preexisting wire shelf.

FIG. 32 depicts an isometric view of the embodiment of FIG. 28 assembled in a preexisting wire shelf.

FIG. 104C is a bottom, right perspective view of aspects of example components of a rotational mounting structure of a merchandise display system.

FIG. 104D is a front view of aspects of example components of a rotational mounting structure of a merchandise display system.

FIG. 104E is a top view of aspects of example components of a rotational mounting structure of a merchandise display system.

FIG. 104F is a left side view of aspects of example components of a rotational mount structure of a merchandise display system.

FIG. 104G is a bottom view of aspects of example components of a rotational mount structure of a merchandise display system.

FIGS. 105A-D are side views of aspects of example components of a merchandise display system.

Figure 106A:
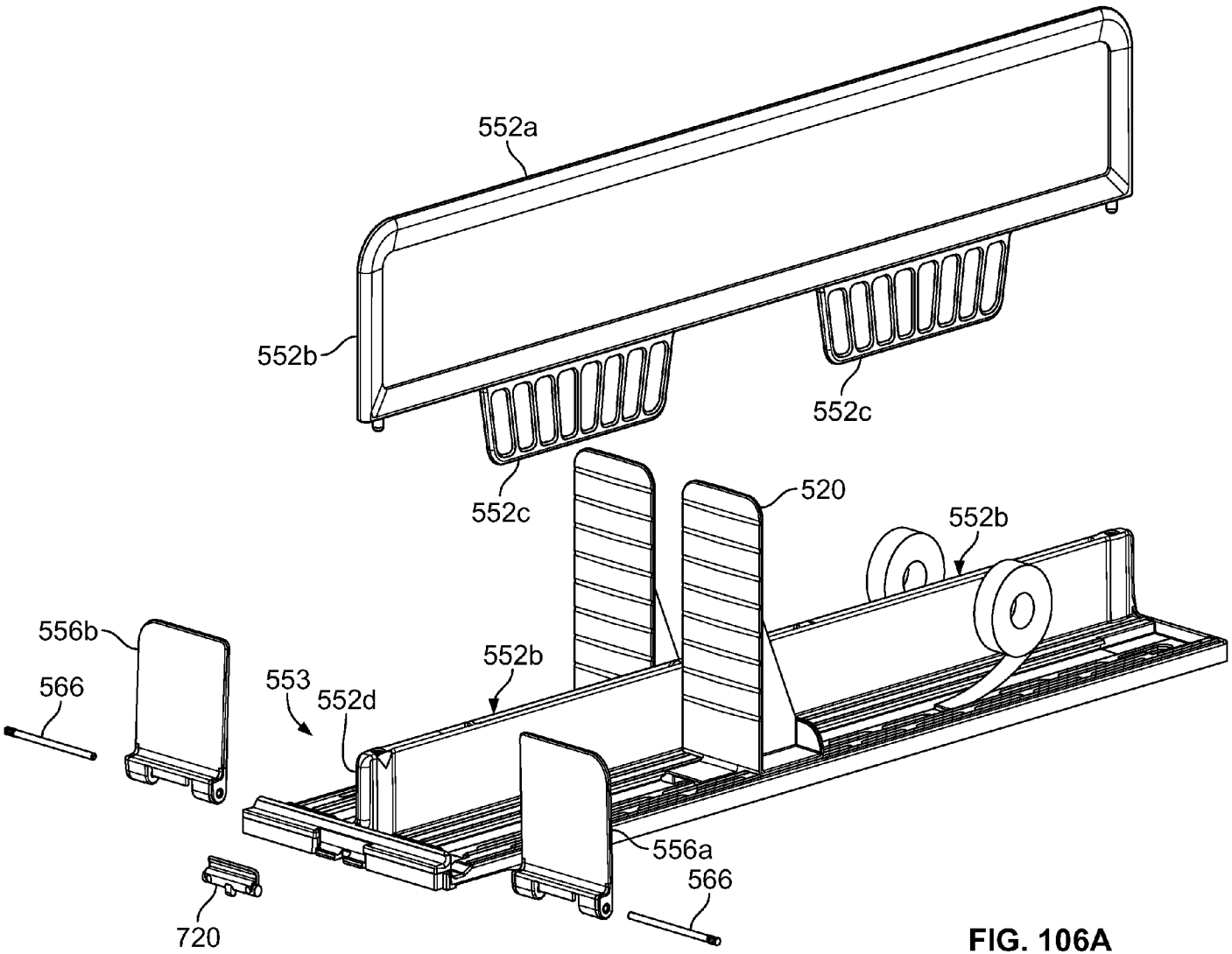

FIG. 106A is a top, right perspective exploded view of aspects of example components of a merchandise display system.

Figure 106B:
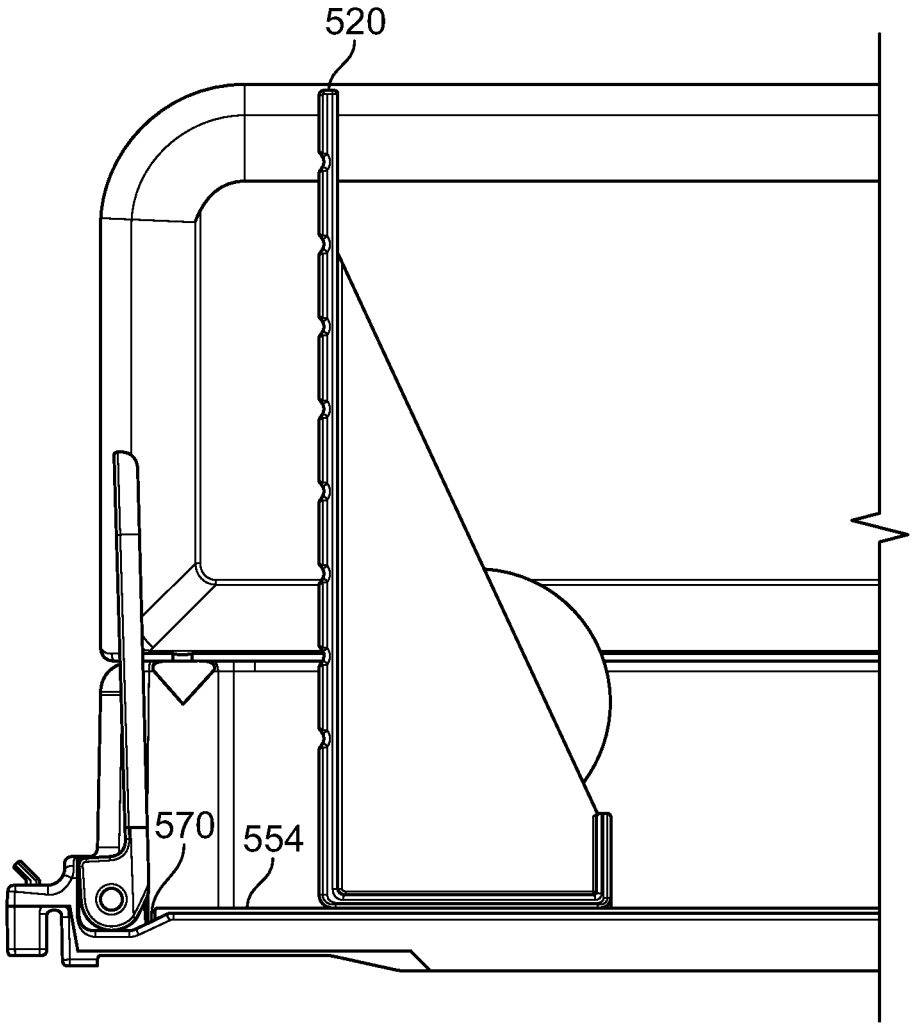

FIG. 106B is a side view of aspects of example components of a merchandise display system.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION

Figure 1:
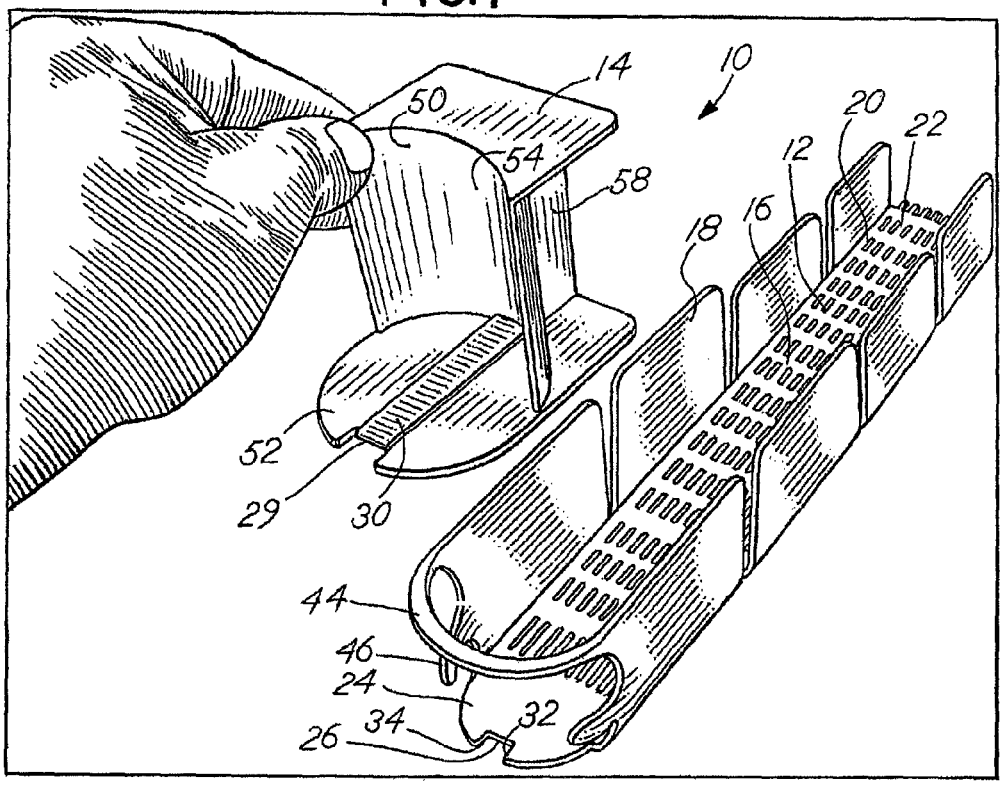
FIG. 1 depicts an isometric exploded view of an exemplary embodiment of a product management display system of the present invention.

The invention may be embodied in various forms. Referring to the Figures wherein like numerals indicate like elements, there is depicted in FIG. 1 an isometric exploded view of an exemplary embodiment. Exemplary merchandise system 10 includes a product dispensing tray 12 in which is mounted an exemplary trackless pusher mechanism 14. As described in more detail below, the pusher mechanism 14 will fit in the tray 12 and will slide along the surface of the tray without the use of tracks, rails, or guides typically used to hold a conventional pusher mechanism to the tray or floor of the tray. The pusher mechanism defines a pusher paddle and a pusher floor that extends forward of the pusher paddle. A coiled spring may extend across the pusher floor and operatively connect to the tray at a forward position on the tray. In one aspect of the invention, product to be merchandised may be placed in the tray in front of the pusher paddle and may sit on the pusher floor as well as the coiled spring. With this configuration, the weight of the product will prevent the pusher paddle from tipping to ensure proper pushing of the product. In addition, the problems associated with debris or sticky materials hindering the effectiveness of known pusher systems that use tracks, rails or guides have been eliminated. Other aspects, embodiments and features of the invention and its teachings are set forth in more detail below.

The exemplary tray 12 may define a surface 16 and one or more dividing panels or dividers 18 to separate the tray into numerous rows for placement of product. In an alternative aspect, the tray 12 may be a shelf or any other surface on which products may be placed for merchandising. The surface 16 may be a solid surface or a surface defining a plurality of spaced-apart apertures 20 separated by a plurality of support ribs 22. The apertures 20 and ribs 22 provide a surface that permits the slidable movement of product placed on this surface and also permits liquids and dirt to pass through the apertures 20 so that they do not collect on the surface 16. The surface 16 may be made of any suitable material that permits the slidable movement of product on the surface 16. Other surface or floor configurations are known and may be used with the principles of the invention.

As depicted in FIGS. 9 and 10, the surface 16 may define a rounded end portion 24 that includes a notch or cut-out portion 26. The end portion 24 may be rounded to match the shape of the product that is placed on the tray. For example, the depicted end portion 24 is rounded or defines a semi-circular shape to match the contour of a bottle or can that may be placed in the tray and on the end portion 24. Other shapes of the end portion may be used with the invention depending on the product to be merchandised.

The notch 26 may be used to receive and mount an end 29 of a coiled spring 30 or similar biasing element. The notch 26 may define opposing angled edge surfaces 32 that are joined by edge 34. The edge 34 is preferably centered across the width of the product row formed in the tray 12 and extends perpendicular to the length of the tray. This configuration will center the coiled spring 30 relative to the tray 12 and will permit the spring to extend in a substantially parallel manner relative to the length of the tray. In other words, the depicted edge 34 of the notch 26 will permit the spring 30 to extend along the length of the tray 12 at or near the center of the product row formed by the tray. One skilled in the art will appreciate that the location and configuration of the notch may vary depending on the desired placement of the spring.

The coiled spring 30 may define an end 29 that is configured to be placed across the notch 26 and onto the edge 34. In one aspect, the end 29 of the coiled spring may be V-shaped and function as a hook such that the end 29 will wrap around the edge 34 with a portion of the end 29 of the coiled spring extending beneath the end portion 24 of the surface 16. This configuration permits an easy installation of the coiled spring onto the tray.

Figure 7:
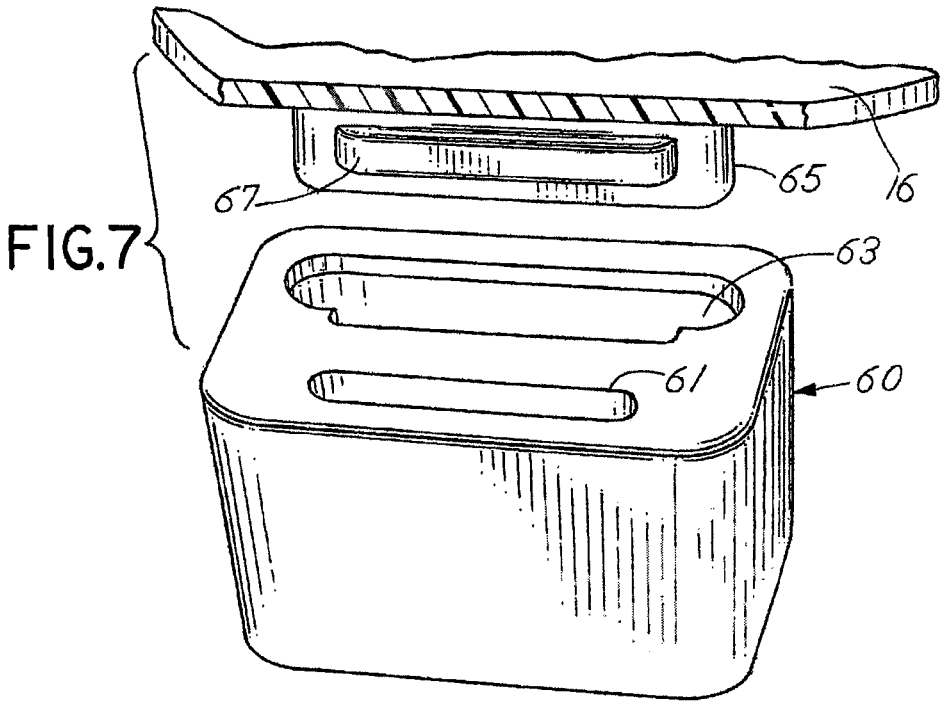
FIG. 7 depicts an exemplary tip for an end of a coiled spring that may be used with the product management display system of the invention.

In another aspect, and referring to FIG. 7, a spring tip 60 may be added to the end 29 of the spring 30 to assist with the mounting of the spring to the system. The spring tip 60 may define numerous shapes and configurations depending on the configuration of the tray and the surface on which the spring end needs to attach. The spring tip 60 may be permanently attached to the end 29 of the coiled spring 30 or it may be detachable to permit the interchange or replacement of the spring tip 60. The spring tip 60 may be made of plastic and may define one or more apertures. Aperture 61 may be used to receive the end 29 of the coiled spring 30. A second aperture 63 may be used to receive a mating tongue or mounting member 65 extending from the surface 16 of the tray 12, as discussed below. With this configuration, the end 29 of the coiled spring 30 may be operatively connected to the tray 12.

In another aspect, the end 29 of the coiled spring may snap-fit into an aperture formed in the surface 16, or may be otherwise inserted and secured to an aperture or opening in the tray, thereby securing the end 29 of the coiled spring 30 in position.

Referring back to FIG. 1, dividers 18 may also be used to separate product into rows. The dividers 18 extend substantially upwardly from the surface 16 and as illustrated in FIG.

1, may be positioned on opposing sides of the surface 16. Alternatively, the dividers 18 may be positioned at any desired position on the tray 12 or to the surface 16. The dividers 18 may be formed as a unitary structure with the surface 16, or the dividers 18 may be detachable to provide added flexibility with the system. The dividers may be attached to a front or back rail depending on the system. The dividers 18 may define numerous configurations and may extend upwardly any desired distance to provide the desired height of the dividers between the rows of product to be merchandised. This height may be adjustable by adding divider extenders or the like.

Figure 6:
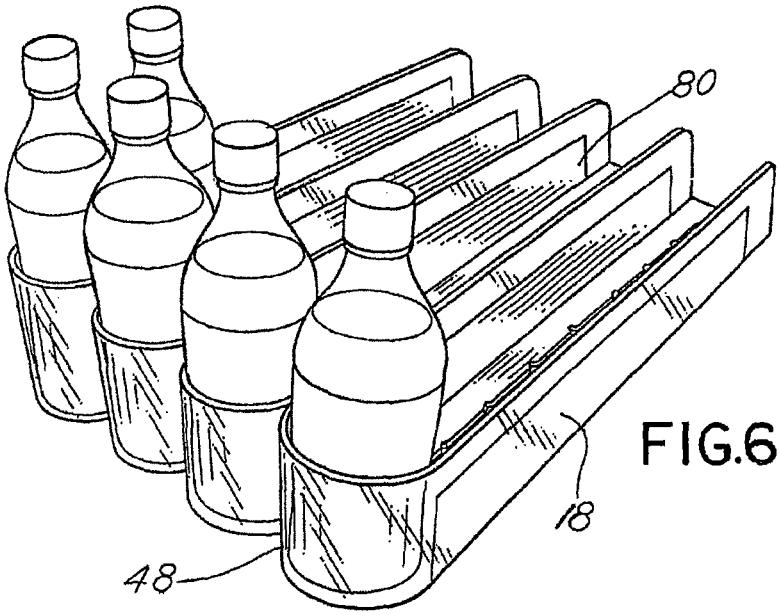
FIG. 6 depicts an alternative embodiment of the tray or product channel of the present invention.

Located at the front of the tray 12 and extending between the dividers 18 may be one or more product-retaining members 44. The product-retaining members 44 serve as a front retaining wall or bar to hold the product in the tray 12 and to prevent the product from falling out of the tray 12. These members are also configured to permit the easy removal of the forward-most product positioned in the tray 12. The product-retaining member 44 may be one or more curve-shaped retaining ribs as depicted in FIG. 1. These illustrated retaining ribs may extend from one divider to another divider thereby joining the dividers. The retaining ribs may also extend part-way between the dividers, as also shown in FIG. 1 as rib 46, to also assist in retaining the product in the tray. Alternatively, and as shown in FIG. 6 the product-retaining member 44 may be a curve-shaped solid retaining wall 48 that extends between dividers. The retaining wall 48 may be transparent or semi-transparent to permit visualization of the product on the shelf. In another aspect, the retaining wall 48 may also extend part-way between the dividers 18. In yet another embodiment depicted in FIGS. 11-15, the retaining wall 100 may be attached to the surface of the tray and not connect to the dividers. In this embodiment, the retaining wall 100 may form an opening 102 defined by an upper member 104, opposing, curved side walls 106 that further define an angled edge 108, and a floor member 110. The side walls 106 may also be straight and not curved depending on the system. The end of the coiled spring may also snap-fit into the floor 110 or otherwise attached to the tray using any of the techniques described herein. One of skill in the art will readily appreciate that there are numerous shapes and configurations possible for the product-retaining member 44 and that the depicted configurations are merely exemplary embodiments of these numerous configurations.

Referring back to FIG. 1, the exemplary trackless pusher mechanism 14 defines a pusher paddle 50 and a pusher floor 52. The pusher paddle 50 and pusher floor 52 may be formed as a single, unitary structure or may be separate structures that are joined together using known techniques. In addition, the pusher paddle 50 and pusher floor 52 may be made of any known suitable plastic or metal material. The pusher paddle and pusher floor may be reinforced using any known reinforcing techniques.

Figure 5:
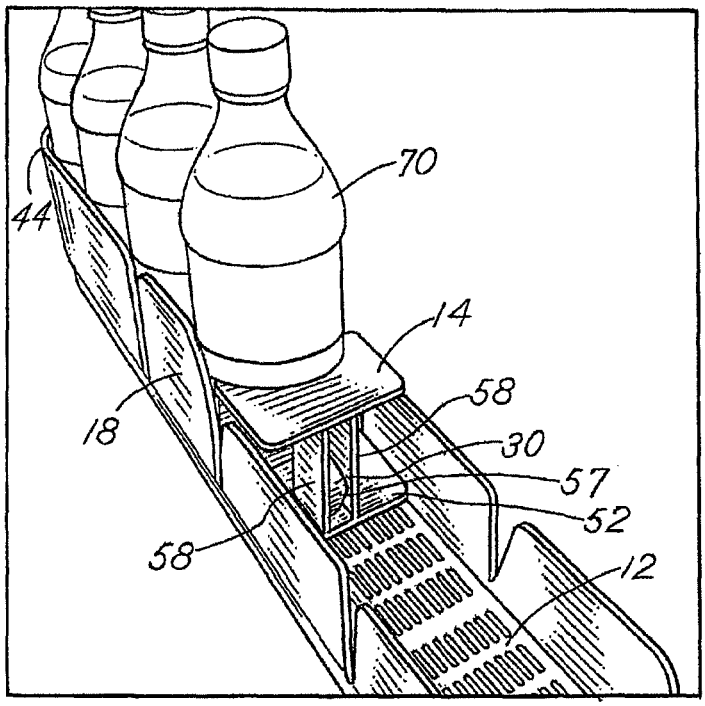
FIG. 5 depicts an isometric rear view of the system of FIG. 4.

In one aspect, the pusher paddle 50 forms a curved-shape pusher surface or face 54 that is configured to match the shape of the product to be merchandised, such as plastic bottles or cans containing a beverage, as depicted in FIGS. 3-5. The curve-shaped pusher surface 54 permits the pusher to remain centrally aligned with the last product in the tray. This configuration reduces friction and drag between the pusher and the divider walls. In an alternative aspect, the pusher surface or face may be a flat surface. In yet another aspect, the flat pusher surface may be accompanied by a curved shaped rib that is positioned near or on the top of the pusher paddle and that may be used to center and align product in the tray, in a manner similar to the curve-shaped pusher surface 54 depicted in FIG. 1. The curve shaped rib may define other shapes and configurations that permit cylindrical or similar shaped products to be properly pushed in the tray. Advertisement, product identification or other product information may be placed on the pusher surface 54.

Positioned behind the pusher surface or face 54 may be one or more support members 58, such as ribs, walls, or gussets. The support members 58 are configured to support the pusher surface 54 and further connect the pusher paddle 50 to the pusher floor 52. As can be seen in FIG. 5, positioned between the support members 58 is the coiled spring 30, and more specifically the coiled end 57 that is used to urge the pusher paddle 50 forward and along the tray 12, as understood in the art. Any technique used to operatively connect the coiled spring to the pusher paddle 50 may be used with the invention.

As shown in FIG. 1, the pusher floor 52 may be positioned below the pusher paddle 50 and may extend forward of the pusher surface 54 of the pusher paddle. The pusher floor 52 may extend any predetermined distance and at any predetermined angle. For example, the pusher floor 52 may extend substantially perpendicular to the pusher surface 54. In the exemplary embodiment, the pusher floor 52 may extend a sufficient distance to permit one product, such as a single bottle or can, to be placed on the pusher floor. In another aspect, the pusher floor 52 may be configured to permit more than one product to be placed on the pusher floor. The pusher floor 52 may define any shape, including the depicted round shape and may define any product retaining features on the surface of the pusher floor, such as ribs, walls, or the like, to further hold the product on the pusher floor.

Figure 2:
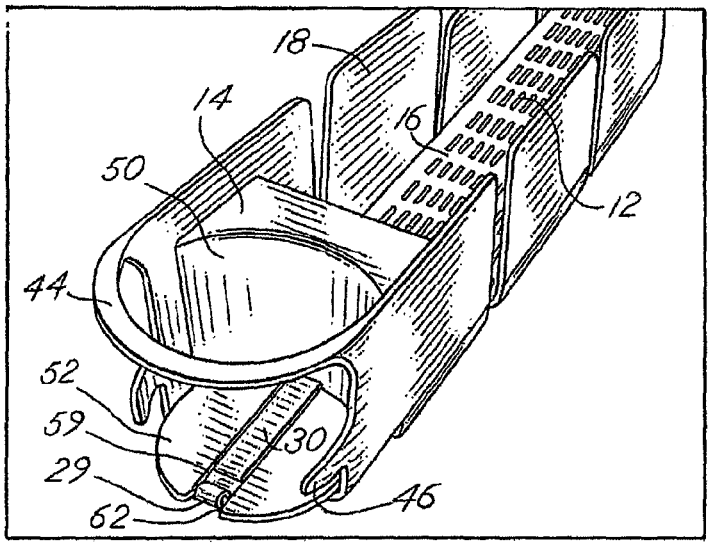
FIG. 2 depicts an isometric view of an exemplary pusher mechanism mounted to an exemplary tray or product channel of the present invention.
Figure 19:
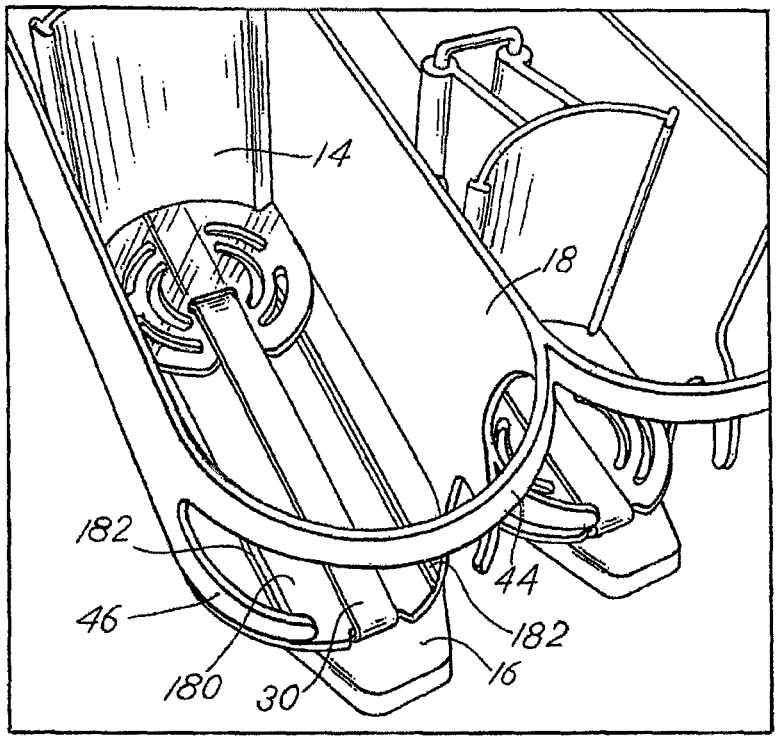
FIG. 19 depicts an isometric view of an installed adaptor of the invention.
Figure 20:
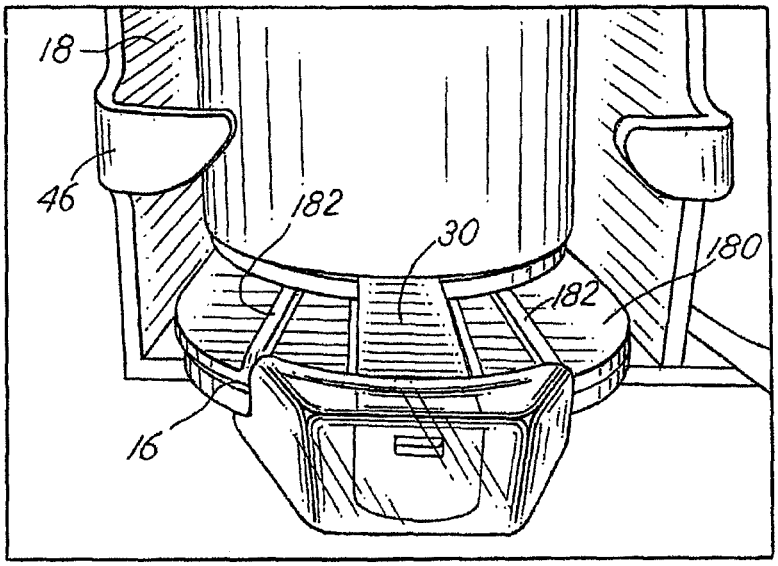
FIG. 20 depicts a front view of an installed adaptor of the invention.

As can be seen in FIG. 2, the pusher floor 52 may define an elongated channel, groove or recessed portion 59 that is sized, shaped and configured to seat the coiled spring 30. In the exemplary embodiment, the channel or groove 59 may extend across the floor 52 and in a substantially perpendicular manner relative to the pusher paddle 50. In an alternative aspect, the groove or channel may extend part-way or across the entire pusher floor 52, as shown in FIG. 19. Such configuration permits the proper alignment and positioning of the pusher paddle 50 in the tray. The groove 59 may define a depth that matches or exceeds the thickness of the coiled spring 30. With this configuration, the coiled spring 30 will seat at or below the pusher floor surface such that product will not sit directly on the coiled spring, rather, such product will sit on the pusher floor surface. As shown in FIG. 19, the pusher floor may include apertures and openings through which debris or other items may pass. Alternatively, the floor may be a solid surface.

Figure 16:
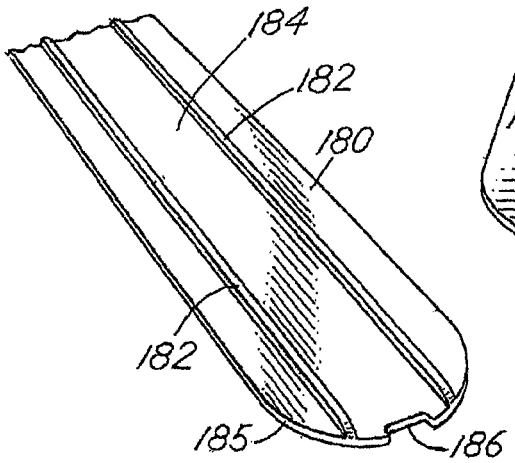
FIG. 16 depicts an isometric view of an adaptor that may be used with the invention.
Figure 17:
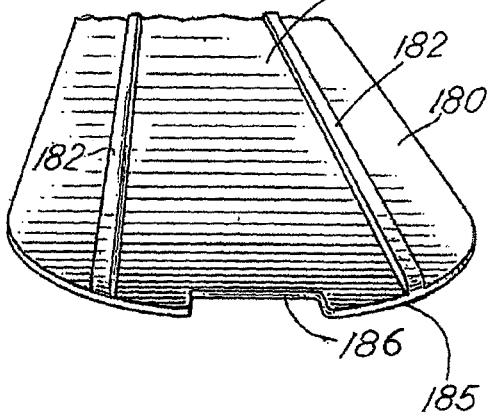
FIG. 17 depicts a front view of the adaptor of FIG. 16.

In an alternative aspect of the invention, as shown in FIGS. 16-20, an adaptor 180 may be positioned on the surface 16. Referring to FIGS. 16 and 17, the adaptor 180 may include one or more raised ribs 182 on which a product may sit. The raised ribs 182 may extend longitudinally along the length of the adaptor 180. The adaptor 180 may be a flat extrusion of plastic material (or any other suitable material) defining a planar surface 184 with the one or more ribs 182 extending outwardly from the planar surface 184. The adaptor 180 may define a rounded end 185 and include a notch or cut-away portion 186 through which or across which the coiled spring may extend. The rounded end 185 may be configured to match the shape of the product that is placed on the tray. Other shapes of the end 185, notch 186 and adaptor 180 may be used with the invention depending on the product to be merchandised. The adaptor 180 may be a separate, insertable piece or, alternatively, a piece formed integral with the surface 16.

Figure 18:
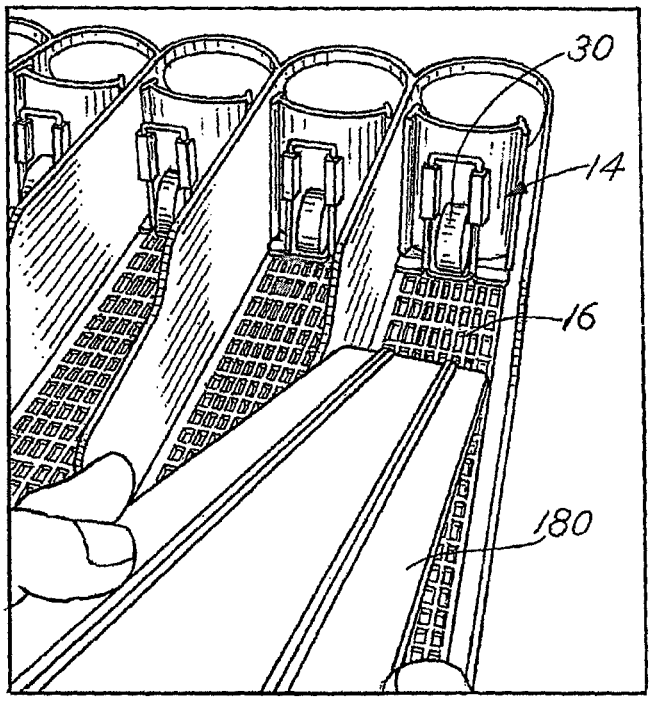
FIG. 18 depicts an exemplary installation of the adaptor of the invention.

Referring to FIG. 18, the adaptor 180 may be easily insertable onto the surface 16 and between the dividers 18. Referring to FIG. 19, once the adaptor 180 is installed, the pusher mechanism 14 may be positioned on top of the adaptor 180 and may slide freely across the ribs 182 of the adaptor 180. The coiled spring 30 may extend in a parallel manner between the ribs 182 and may seat at or below the top surface of the ribs 182, as more clearly shown in FIG. 20. With this configuration, the product to be merchandised may sit on, and slide along, the ribs 182 and not on the coiled spring 30.

In an alternative aspect, the ribs 182 may be a raised bead or raised beads, or a series of fingers that may be used to facilitate the movement of the product on the surface 16. In yet another alternative embodiment, the ribs 182 may be product moving members, such as runners or one or more rollers or rolling members that permit the product to roll across the rolling members and toward the front of the product display system. Exemplary roller assemblies include those disclosed and described in U.S. application Ser. No. 11/257,718 filed Oct. 25, 2005 and assigned to RTC Industries, Inc, which application is incorporated herein by reference. As should be appreciated by those skilled in the art, there are many possible techniques that may be used with the described pusher mechanisms for facilitating the movement of the product on the shelf or floor.

The underneath side of the pusher floor 52 may be a smooth planar surface that will slide freely along the surface 16. Alternatively, and similar to above, the pusher floor 52 may include beads, runners, rollers or the like that will permit the pusher floor to slide along the surface yet raise the pusher floor up off of the surface 16. In another alternative embodiment, the underneath side of the pusher floor may be configured with rail mounting members to permit the mounting of the pusher to a track or rail, as understood in the art.

The pusher floor further defines a notch or cut-out portion 62 through which will pass the coiled spring 30. The end 29 of the coiled spring 30 will pass through the notch 62 and through the notch 26 of the surface 16 and will mount to the tray using any of the techniques described above.

In use, as the pusher mechanism 14 is urged rearward in the tray 12, the end 29 of the coiled spring 30 will be held in position as described above and the coiled end 57 of the spring 30 will begin to uncoil behind the pusher paddle 50. If the pusher 14 is allowed to move forward in the tray 14, such as when product is removed from the front of the tray, the coiled end 57 of the spring 30 will coil and force the pusher paddle 50 forward in the tray 12, thereby urging product toward the front of the tray.

In an alternative embodiment, the coiled spring 30 may extend below and underneath the pusher floor 52 as opposed to above and across the pusher floor, as depicted in the figures. With this configuration, the groove 59 and notch 62 may not be necessary.

The coiled spring 30 may be any biasing element including, without limitation, a flat coil spring commonly used with pusher systems. The present invention may use one or more coiled springs to urge the pusher mechanism 14 forward depending on the desired application. The coil tension of the spring 30 may also vary depending on the particular application.

Referring to FIG. 2, the trackless pusher mechanism 14 is shown mounted to the tray 12. As illustrated, the pusher mechanism 14 fits in the tray 12 between the dividers 18. End 29 of the coiled spring 30 extends through the notch in the pusher floor and mounts to the tray as described above. In use, the pusher mechanism 14 will slide along the surface 16 of the tray 12 without the use of tracks, rails, or guides. As depicted in FIG. 2, the pusher mechanism 14 is shown in a forward position.

Referring to FIG. 3, the pusher mechanism 14 is shown merchandising one product 70 in the merchandise system 10. The product is prevented from tipping out of the tray by the product-retaining member 44. The product 70 may be any product to be merchandised including the depicted soft drink bottle. As shown in this Figure, the product 70 sits on the pusher floor 52 and the coiled spring 30 that extends below the product. The weight of the product on the floor 52 and the positioning of the product across the spring 30 prevent the paddle 50 from tipping in the tray 12.

Referring to FIG. 4, the pusher mechanism 14 is shown merchandising multiple products 70 in the merchandise system 10. As shown in this Figure, the product next to the pusher paddle 50 sits on the pusher floor 52 and the coiled spring 30 that extends below the product. The other products will sit on the coiled spring 30 that will extend below these products. Alternatively, the adaptor 180 may be positioned in the system in which case the product may sit on the ribs 182 of the adaptor as opposed to the coiled spring. Again, the weight of the product on the pusher floor 52 and the positioning of the products across the spring 30 prevent the paddle 50 from tipping in the tray. In use, as one product is removed from the front of the tray near the product-retaining member 44, the pusher mechanism 14 (through the urging of the coiled spring 30) will push the remaining product forward in the tray 12 until the forward-most product contacts the product-retaining member 44. As additional products are removed, the pusher mechanism 14 will continue to push the remaining product toward the product-retaining member 44.

Referring to FIG. 5, a rear view of the pusher mechanism 14 shows the pusher mechanism 14 merchandising multiple products 70 in the merchandise system 10. Again, the product next to the pusher paddle 50 sits on the pusher floor 52 and the coiled spring 30 that extends below the product. The other products will sit on the coiled spring that will extend below these products. Alternatively, the adaptor 180 may be positioned in the system in which case the product may sit on the ribs 182 of the adaptor as opposed to the coiled spring. As one product is removed from the front of the tray near the product-retaining member 44, the coiled end 57 of the spring 30 will urge the pusher paddle 50 of the pusher mechanism 14 forward in the tray 12 until the forward-most product contacts the product-retaining member 44. As can be seen in this Figure, the coiled end 57 may be positioned between two support members 58. The support members will retain the coiled spring between these members. As can be seen in this Figure, the pusher floor 52 may also extend below the support members 58.

Referring to FIG. 6, an alternative embodiment of the pusher tray is depicted. With this embodiment, multiple trays 12 may be formed into a single multi-tray assembly 80. The multi-trays may have a common floor with dividers 18 extending upwardly from the floor to create the multiple trays or rows. In this embodiment, the product-retaining member 44 may be a solid member that extends between two dividers, as discussed above. One or more of the multi-tray assemblies 80 may be coupled or joined together in a side-by-side manner using any known technique, including clips, dovetailing, fasteners, or the like. With this configuration, numerous rows of product can be provided for the merchandising of numerous products.

As stated above, the trackless pusher mechanism 14 may be used with gravity-fed systems, that is, systems having trays or product channels that are mounted on an incline to permit gravity to assist with the merchandising of the product. Alternatively, the trackless pusher mechanism 14 may be used with systems that are mounted in a non-inclined or in a horizontal manner where gravity will provide little or no assistance with the merchandising of the product. The trackless pusher mechanism 14 may also be used to push various shaped products.

FIG. 7 depicts an exemplary tip 60 for the end 29 of a coiled spring 30 that may be used with the merchandise system 10. As illustrated, the tip 60 defines an aperture 61 for receiving the end 29 of the coiled spring and an aperture 63 for mounting to the surface 16 of the tray. As can be seen in FIG. 7, in one aspect of an alternative embodiment, extending beneath the surface 16 may be a tongue or mounting member 65 that may be configured to mate with the aperture 63 and to snap-fit the tip 60 onto the tongue 65 and thus to the surface 16.

Figure 8:
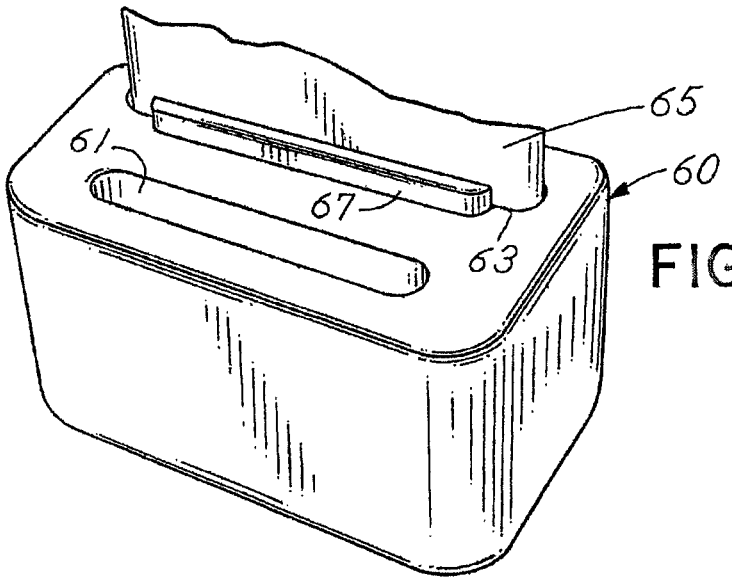
FIG. 8 depicts the exemplary tip of FIG. 7 being mounted to a surface of a tray or product channel.
Figure 15:
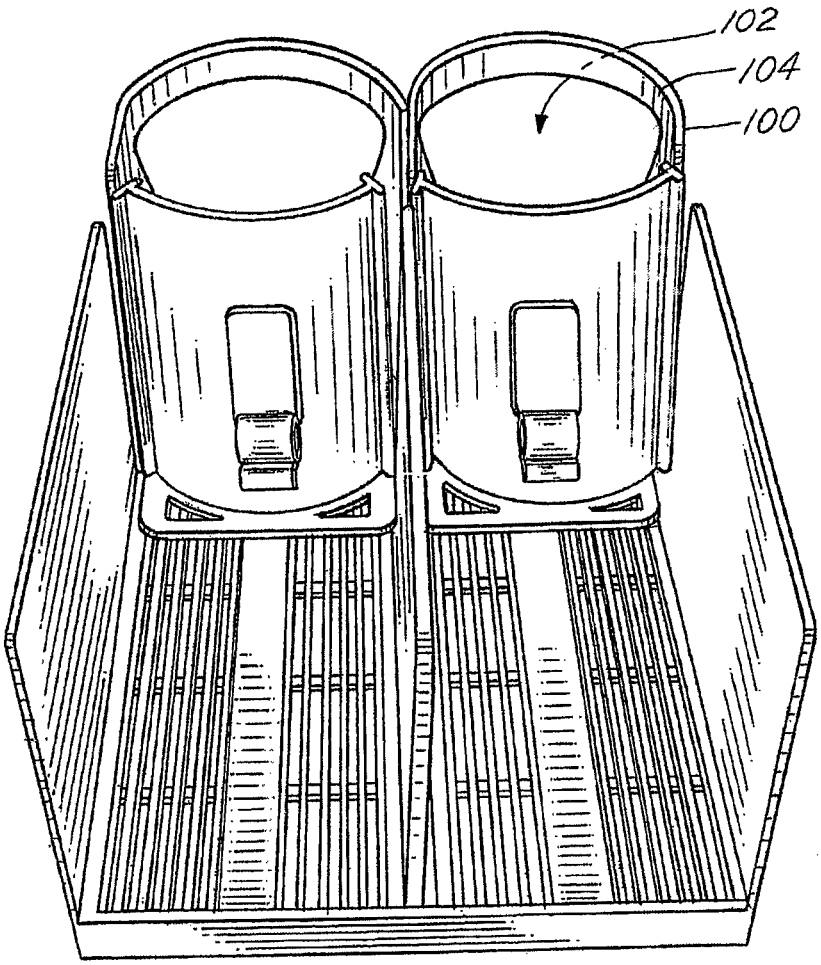
FIG. 15 depicts a rear view of the system of FIG. 11.

Referring to FIG. 8, the exemplary tip 60 of FIG. 7 is shown being mounted to the tongue or mounting member 65. The tongue 65 may include an elongated outwardly extending rib 67 that is used to snap-fit the tip 60 onto the tongue 65. One skilled in the art will appreciate that other techniques may be used to mount the tip 60 to the surface 16 and that the depicted technique is merely an exemplary embodiment of one such technique.

Referring to FIG. 9, the exemplary tip 60 is shown fully mounted in a snap-fit manner to the surface 16, and more specifically to the end portion 24 of the surface 16 of the tray 12. Also depicted is the mounting of the end 29 of the coiled spring 30 to the aperture 61 of the tip 60. As shown in FIG. 9, the end 29 of the coiled spring may be inserted into the aperture 61. The aperture 61 is configured to receive the end 29 of the coiled spring and hold the end 29 in position, and to also permit the removal of the end 29 of the coiled spring from the aperture 61 in those circumstances where it is desirable to disconnect the coiled spring from the tip to permit the removal of the pusher mechanism 14 from the system.

Referring to FIG. 10 there is shown the end 29 of the coiled spring fully mounted to the exemplary tip 60. As illustrated in this figure, the coiled spring 30 is now operatively connected to the surface 16 of the tray 12. As a result, the pusher mechanism 14 is now mounted to the tray 12.

Referring to FIGS. 21-27 there is shown an alternative technique for mounting the end 29 of the coiled spring 30 to the merchandise display system. A mounting member 130 may be used to mount the end 29 of the coiled spring to the floor 131 of the system. For those systems that include spaced-apart glide rails 132 that are joined together by connecting ribs 134 (FIGS. 26-27), the mounting member 130 may be snap-fit to or otherwise mounted on the floor 131 and between the glide rails 132. The mounting member will thus hold the end of the coiled spring in position and to the floor of the system.

Figure 26:
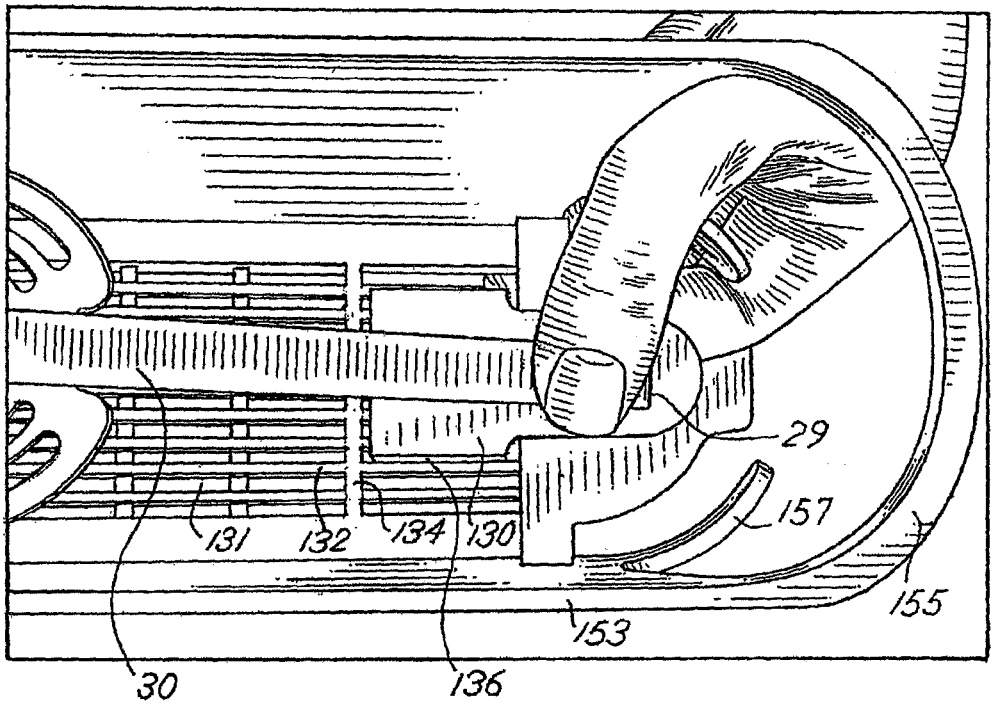
FIG. 26 depicts the exemplary mounting member of FIG. 22 with attached coiled spring being mounted to the floor of the system.
Figure 27:
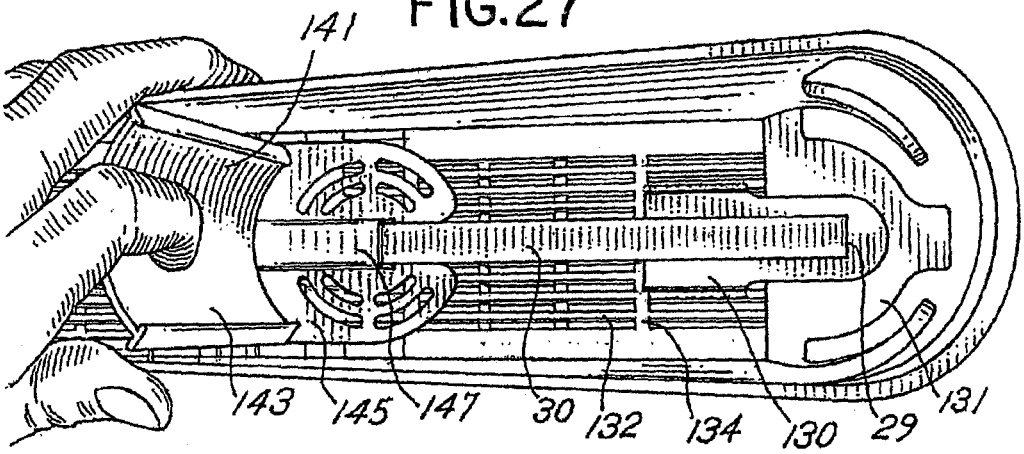
FIG. 27 depicts the exemplary mounting member of FIG. 22 installed on the floor of the system.

Referring to FIGS. 22-23, the mounting member 130 may include one or more legs 136 on one or more sides of the member 130. The legs may be configured to snap-fit to the underside of the rails 132 to thereby hold the mounting member 130 to the floor of the system. The legs 136 may include legs ends 137 defining an L-shape or angled surfaces that are configured to contact the underside of the rail 132 and prevent the mounting member 130 from being lifted up from the floor, except by the intentional flexing of the legs out from the underside of the rail 132. The legs 136 may contact the connecting ribs 134 which will prevent slidable movement of the mounting member 130 relative to the floor. Referring to FIG. 26, the mounting member 130 is shown being mounted to the floor of the system and more specifically to the rails. FIG. 27 illustrates that the mounting member 130 remains in position as the pusher paddle 141 is pulled away from the front of the system. The mounting member 130 may be connected to this type of system floor 131 using other techniques. For example, a separate mounting clip, one or more fasteners, adhesives, or other techniques may be used to secure the mounting member 130 to the floor 131.

Referring to FIGS. 22-23, the mounting member 130 may also include an aperture or opening or slot 138 that will receive the end 29 of the spring. The spring may be mounted using any of the techniques described herein, or other techniques. The configuration of the aperture 138 and mounting member 130 will hold the spring in position on the mounting member 130, similar to the technique described above.

The mounting member 130 may also include glide ribs 139 on a top surface that allow product placed thereon to slide more easily across the mounting member after the mounting member is installed to the floor of the system. The mounting member 130 may also include an elongated flat body 140 that extends forward of the location of the legs 136 to provide stability to the mounting member 130 after it is mounted to the floor of the system.

Figure 24:
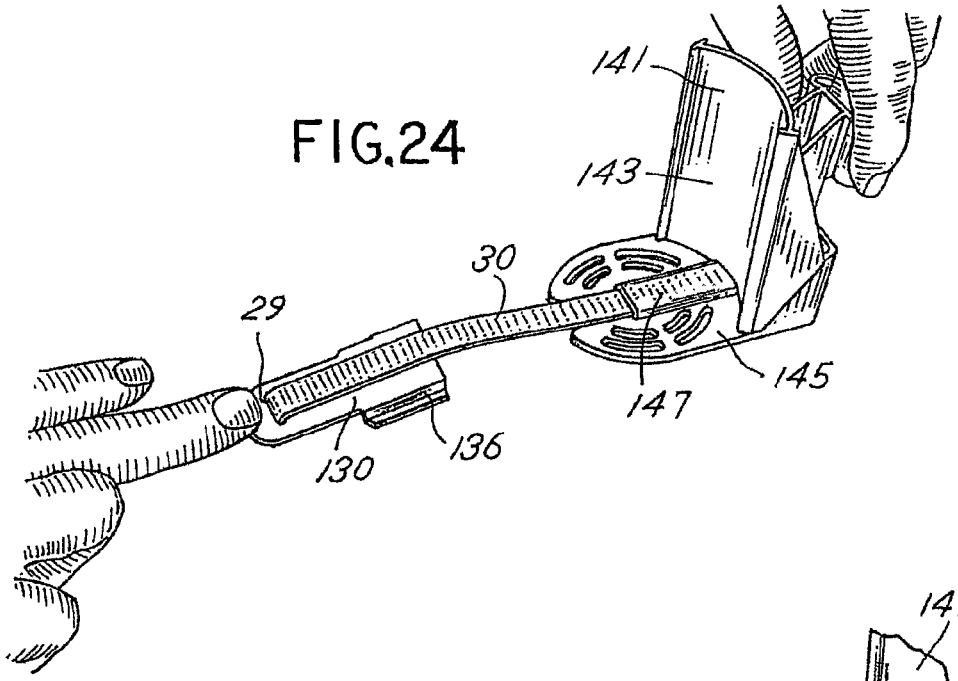
FIG. 24 depicts the exemplary mounting member of FIG. 22 mounted to the end of the coiled spring with the coiled spring mounted to an exemplary pusher paddle.
Figure 25:
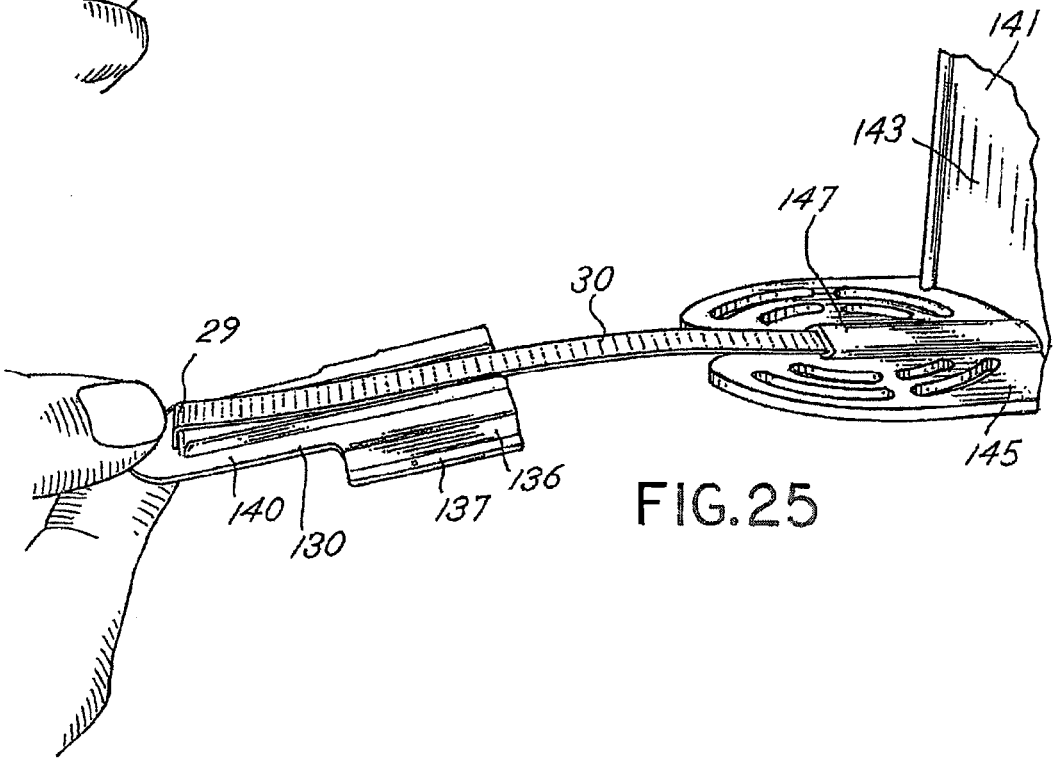
FIG. 25 depicts another view of the exemplary mounting member of FIG. 22 mounted to the end of the coiled spring with the coiled spring mounted to an exemplary pusher paddle.

Referring to FIGS. 24-25 and 27, the pusher paddle or pusher mechanism 141 may include a pusher face 143 configured to match the shape of the product against which it pushes. As illustrated, the pusher face 143 may be curve shaped to match the shape of a bottle or other cylindrical object. The pusher paddle 141 may also include a pusher floor 145 similar to the pusher floor configurations described above. The pusher floor 145 may further include a spring sleeve 147 that receives the coiled spring 30 to shield and protect the spring. The spring sleeve 147 may extend partly or fully across the pusher floor 145 and in the direction of the spring 30. The spring sleeve 147 may have a relatively short height and a flat surface 149 to permit product to sit thereon without significant tipping or leaning of the product.

The pusher paddle 141 may be positioned on top of the floor 131 to glide on top of the surface, as described above. The pusher paddle may be positioned between two product divider walls 153 that are joined together by a product retaining member 155. Additional product retaining members 157 may extend outwardly from the product dividers.

Referring to FIGS. 28 and 29 there is shown yet another alternative technique for mounting the end 29 of the coiled spring 30 to the merchandise display system. In this embodiment, the end 29 is riveted to the tray 216.

Referring to FIGS. 28-32 in an alternative embodiment, the trackless pusher system may be retrofitted to an existing shelf assembly 230, which may have product dividers already built in. For example, in one embodiment, the trackless pusher system may be retrofitted to an existing wire shelf assembly. Referring to FIGS. 30-32, a tray or adaptor 216 may have a glide floor 222 that may be sized to a single lane of the shelf 234 or sized to an entire shelf width. The glide floor 222 may include several raised ribs 224, which help to reduce friction for the products merchandised on the tray 216. It should be understood that one or more raised ribs 224 may be used with the glide floor 222. Alternatively, the glide floor 222 may be a flat, planar surface without raised ribs. The tray or adaptor 216 may be configured similar to the adaptor 180 of FIG. 16.

As shown in FIGS. 28 and 30, the end 29 of coiled spring 30 may be riveted, via a rivet 229, to the front end 228 of the tray 216, or may be attached by any other attachment technique. The tray 216 can be retained to the shelf by any attachment technique suitable for the particular shelf. In one embodiment, and as illustrated in FIGS. 29-32, the tray 216 may include one or more outwardly extending fingers or snaps 220, which may engage one or more individual wires 232 of the shelf 234 to retain the tray 216 on the shelf 234. The fingers or snaps 220 may extend longitudinally along the length of the tray 216, or may be spaced apart along the length of the tray. The snaps 220 may be used to snap-fit the tray 216 to the existing wire shelf. As depicted in FIGS. 29A and 29B, the snaps 220A and 220B may define numerous configurations that permit the tray 216 to be snap fit to the shelf. The embodiment depicted in FIGS. 28-32 allows for the placement of the trackless pusher system in an existing shelving system, such as a wire shelf system, as a low cost alternative to the entire trackless pusher assembly. It should be understood that with this embodiment, any pusher mechanism described herein may be used.

Figure 33:
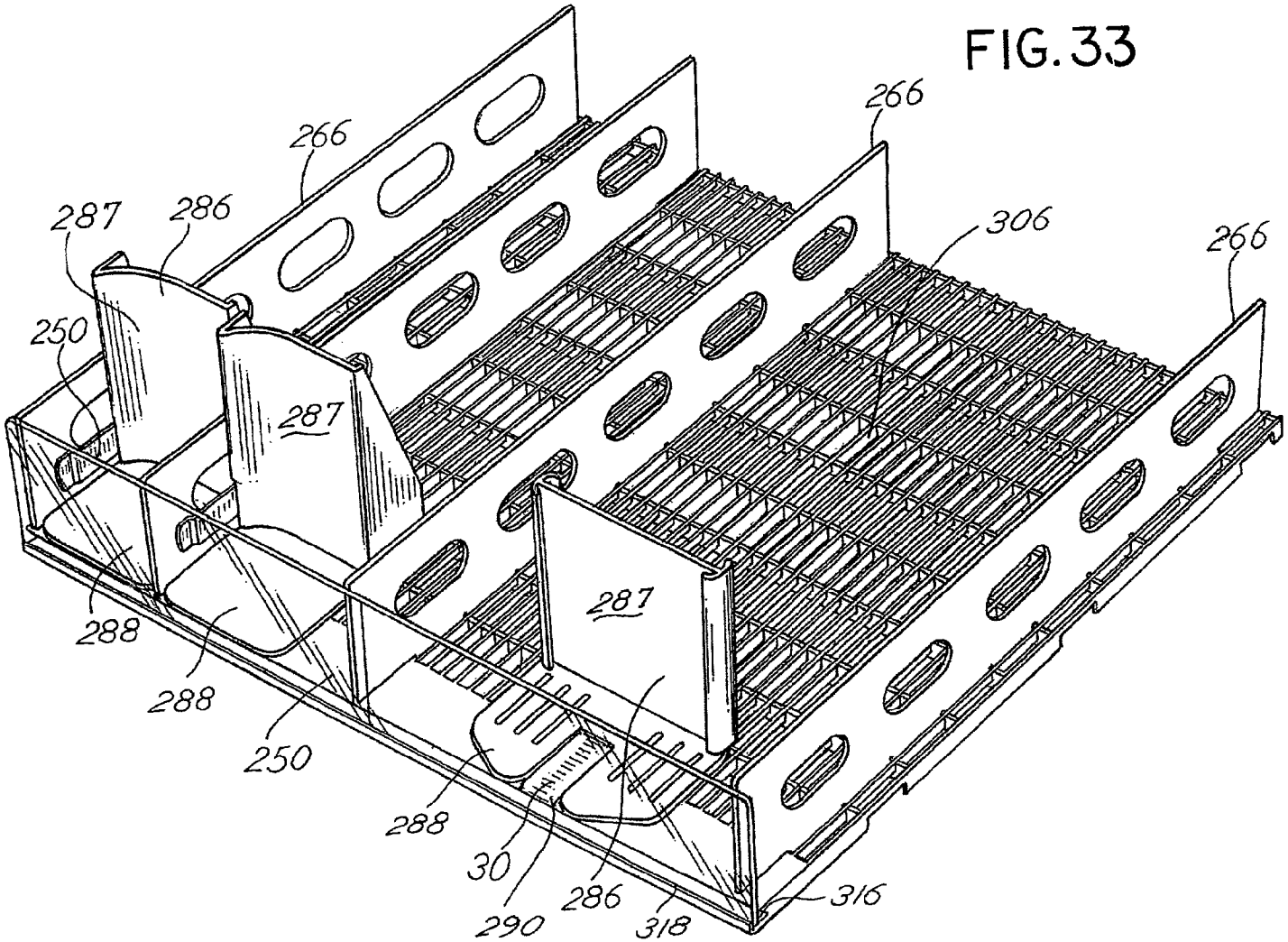
FIG. 33 depicts an isometric view of an exemplary embodiment of the display system.
Figure 44:
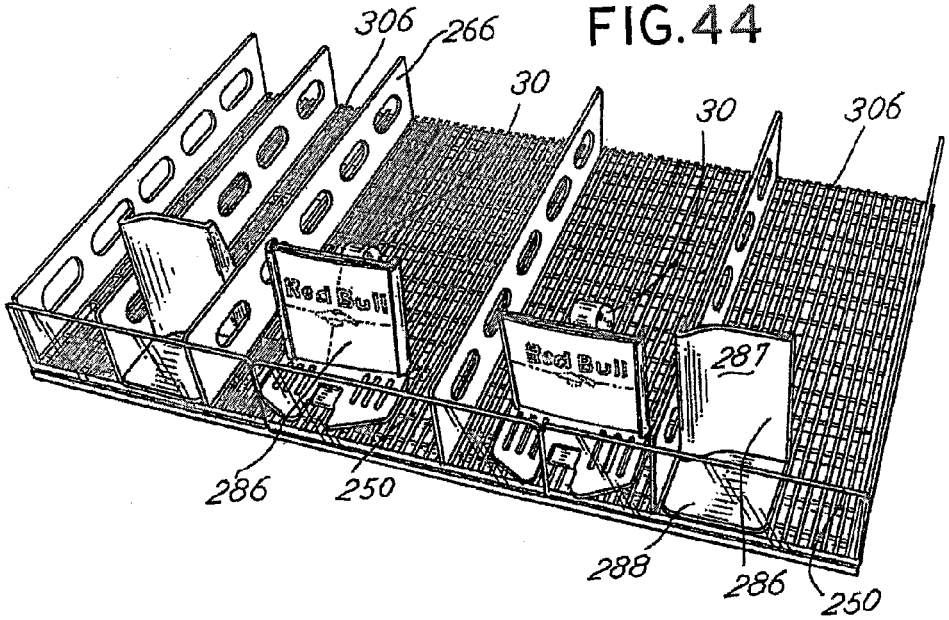
FIG. 44 depicts an isometric view of an exemplary embodiment of a product management display system.

As depicted in FIGS. 33 and 44, in another exemplary embodiment, the display management system comprises one or more pusher mechanisms 286, one or more dividers 266, one or more trays 306, and one or more retainers 250. The pusher mechanisms 286 can be formed of a pusher paddle 287 and a pusher floor 288. Product is placed on the pusher floor 288 and guided to the front of the display management system via the dividers 266 and the pusher paddle 287. The coiled spring 30 biases the pusher mechanism 286 toward the retainer 250 such that product moves to the front of the system.

Figure 34:
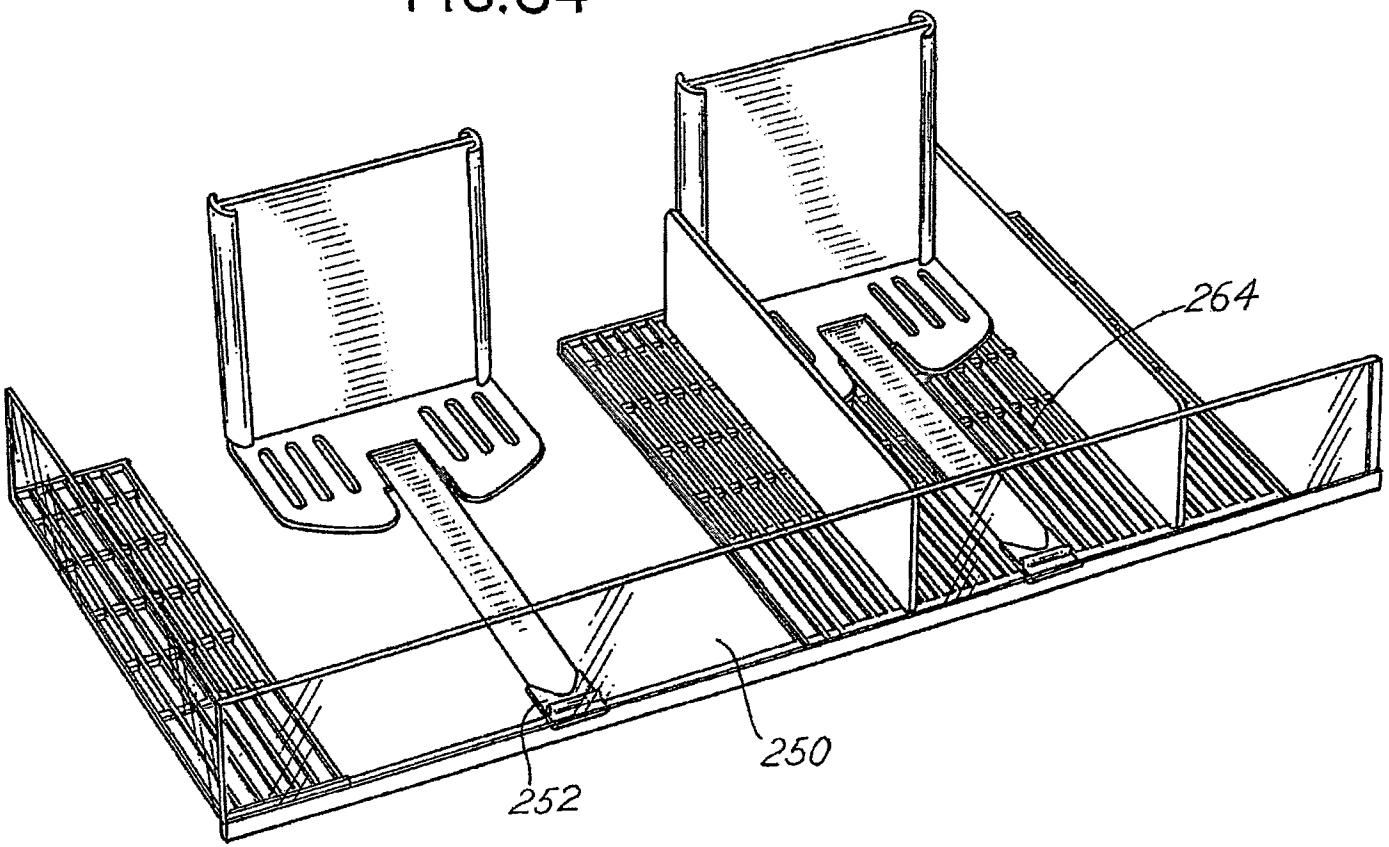
FIG. 34 depicts an isometric view of an exemplary embodiment of the display system.
Figure 48:
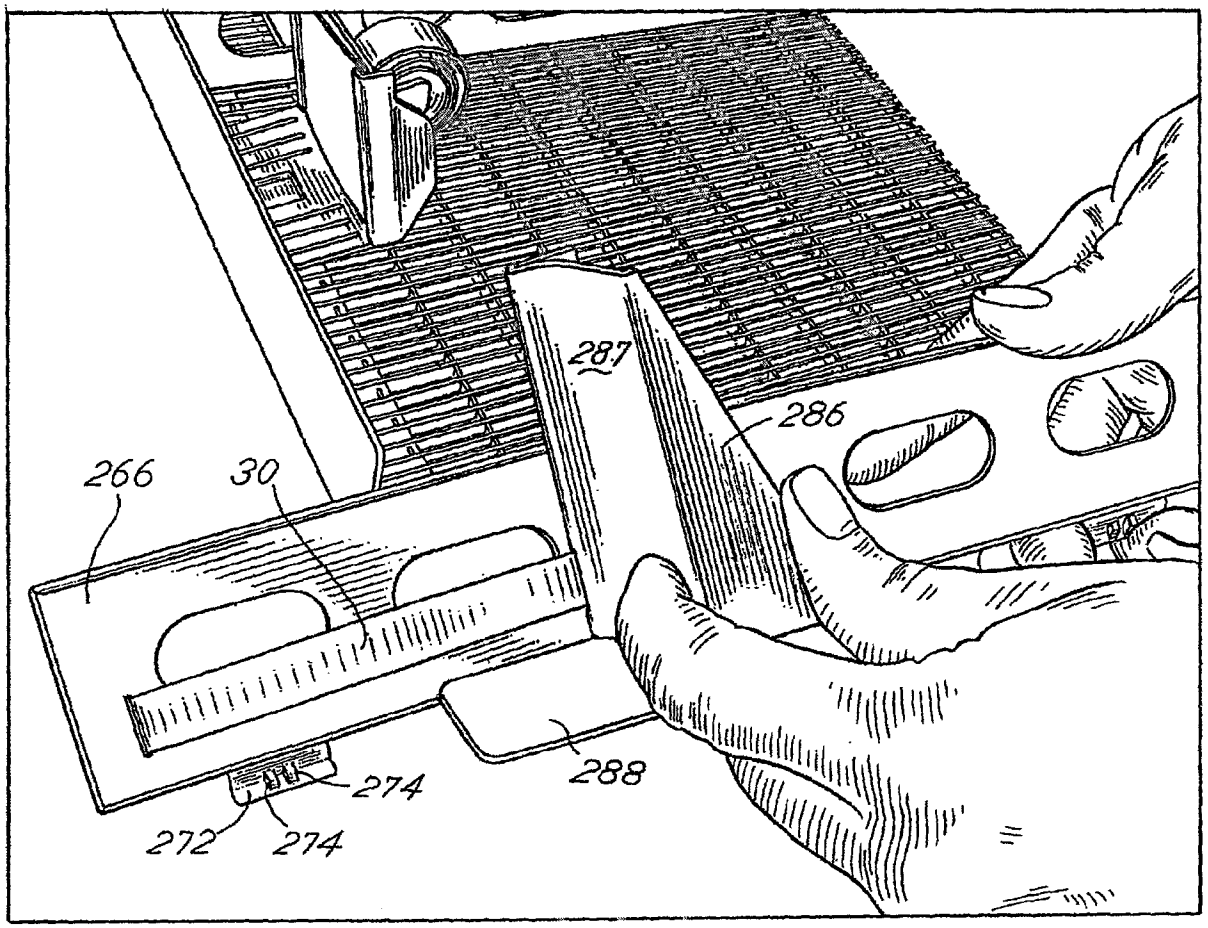
FIG. 48 depicts an isometric view of an exemplary embodiment of the pusher mechanism mounted to a divider.
Figure 49:
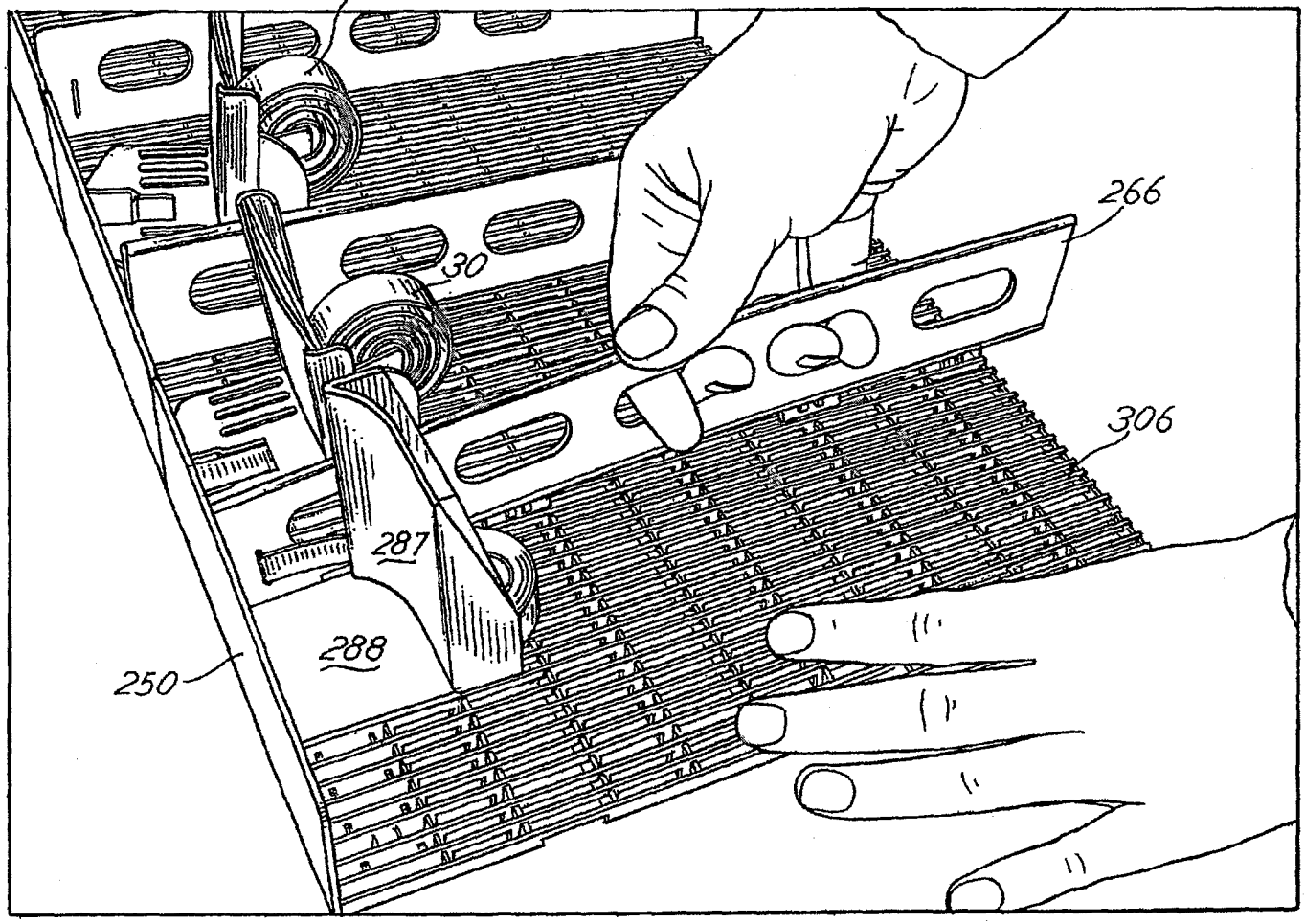
FIG. 49 depicts another isometric view of the divider and pusher mechanism being assembled to the product management display system.

In one exemplary embodiment, depicted in FIG. 33, the coiled spring 30 can be mounted to the retainer 250. Alternatively, the coiled spring 30 can be mounted to a divider 266 (also shown in FIGS. 48 and 49). The coiled spring 30 can be directly mounted to the retainer 250, as depicted in FIG. 33, or can be mounted to the retainer 250 via a separate adapter 252, as depicted in FIG. 34.

Figures 35, 36:
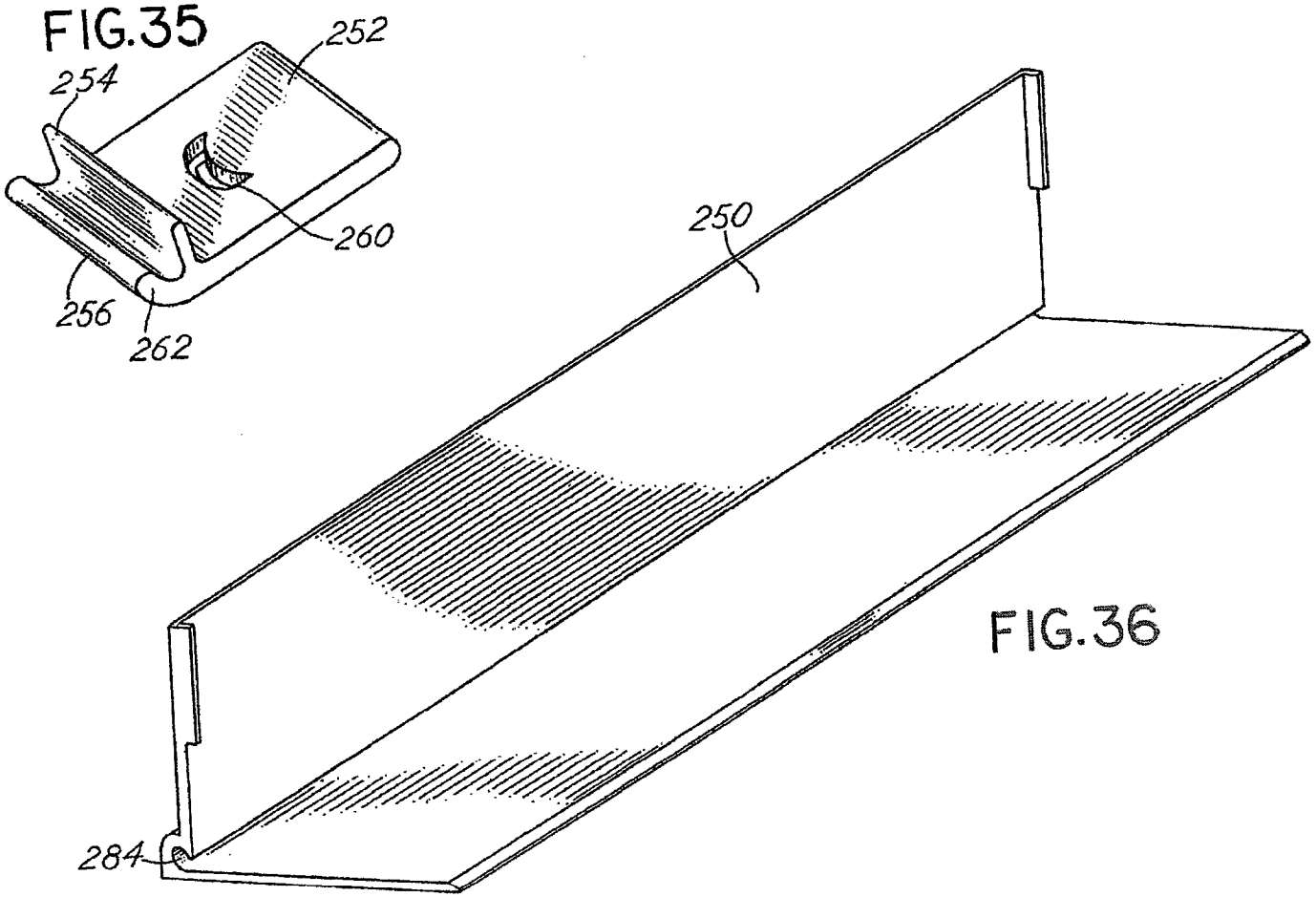
FIG. 35 depicts an isometric view of an exemplary embodiment of an adapter.
FIG. 36 depicts an isometric view of an exemplary embodiment of a retainer.

As depicted in FIG. 35, the adapter 252 has a wall 254 proximate a first end 256. The first end 256 has a curved portion 262, which curves upwardly. The middle portion of the adapter 252 may be provided with a curved slot 260, which is adapted to receive a correspondingly shaped spring end (not shown).

The coiled spring 30 at one end can be secured to the middle portion of the adapter 252. In an exemplary embodiment, the curved slot 260 corresponds in shape and size of the first spring end. Additionally, the first spring end of the coiled spring 30 can be crimped or bent to provide for additional fastening. Nevertheless, any sufficient fastening method can be used to fix the first spring end of the coiled spring 30 to the adapter 252.

Figure 37:
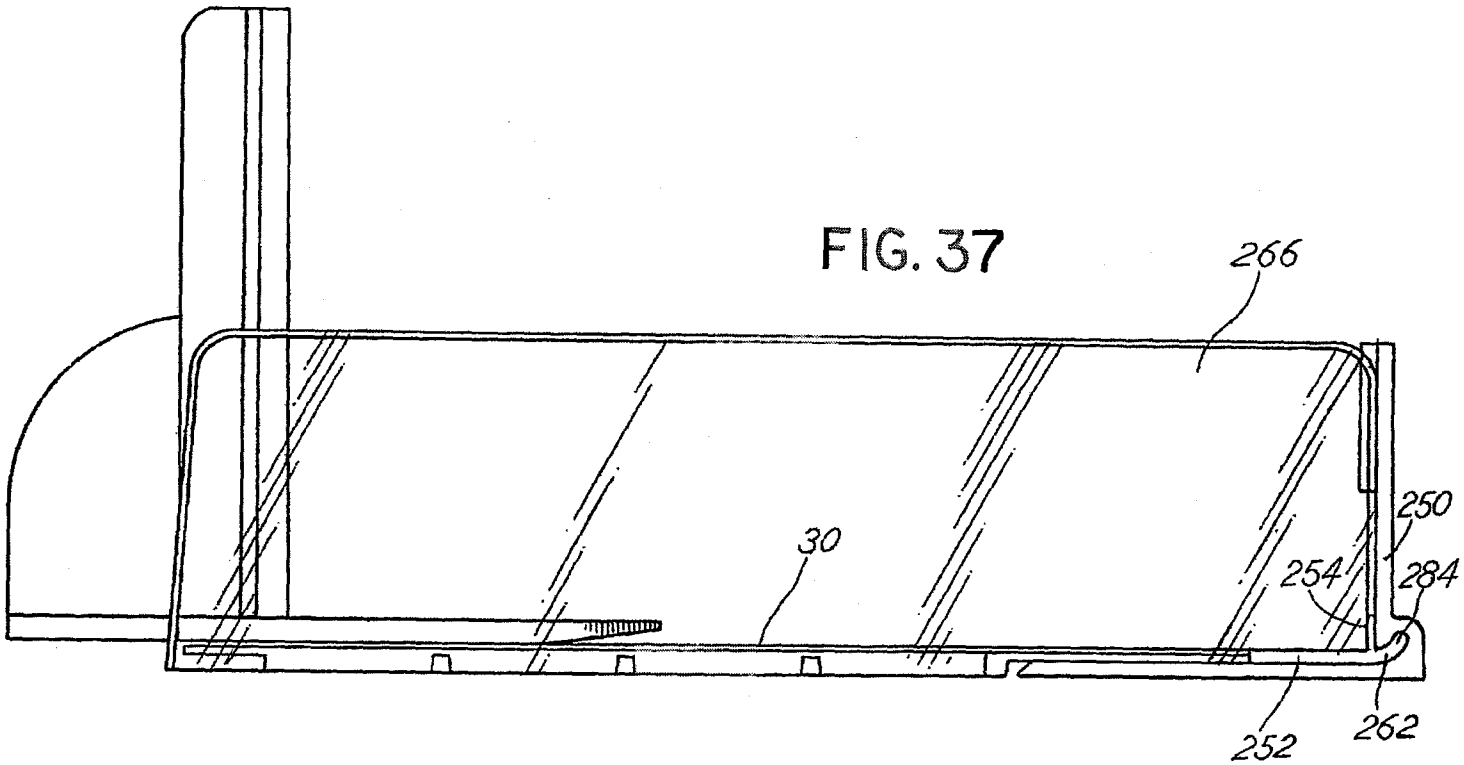
FIG. 37 depicts a side view of an exemplary embodiment of the display system.
Figure 38:
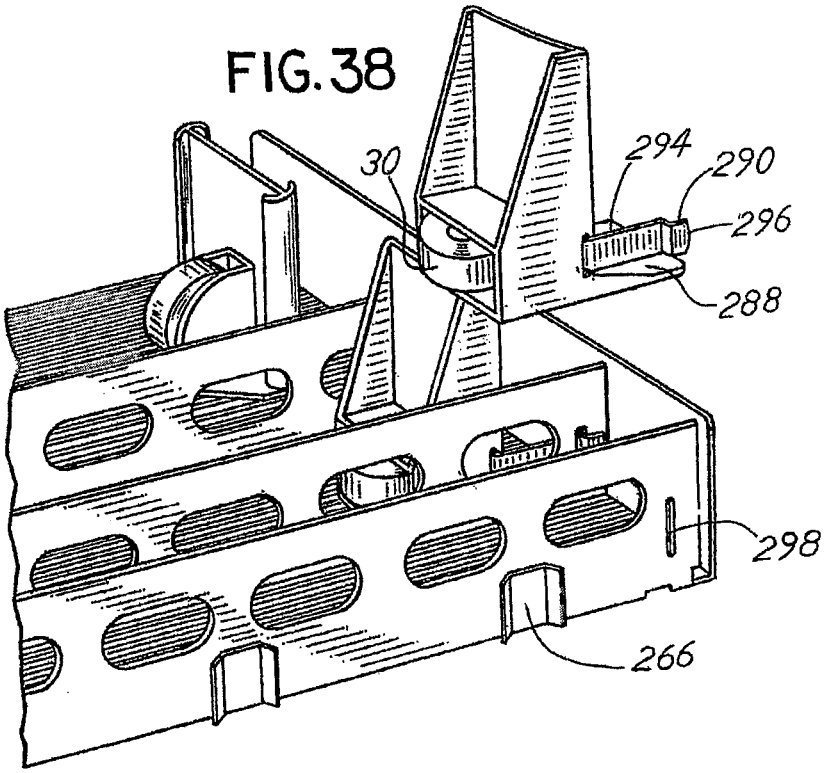
FIG. 38 depicts an isometric view of an exemplary embodiment of the display system.
Figure 39:
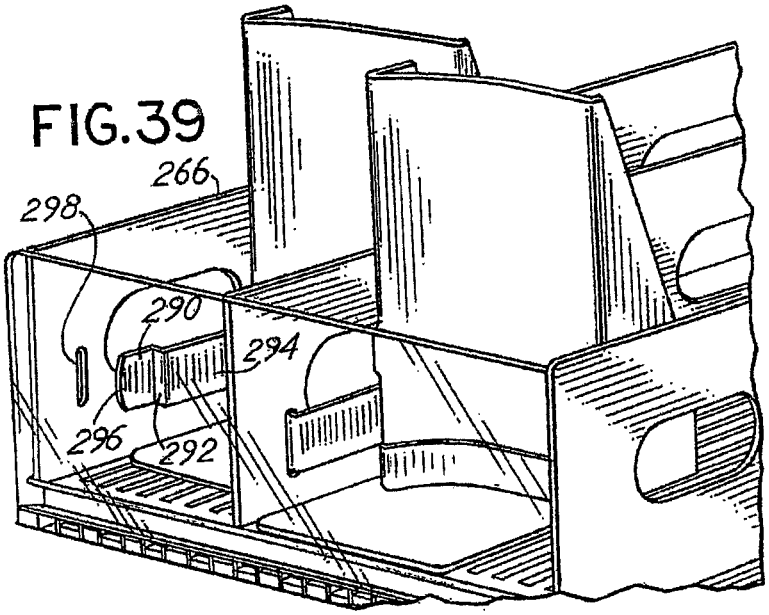
FIG. 39 depicts an isometric view of an exemplary embodiment of the display system.

In an exemplary embodiment, shown in FIGS. 36 and 37, the retainer 250 has a curved slot 284 corresponding in shape and size to the curved portion 262 of the adapter 252. The curved slot 284 extends the length of the retainer to allow for unlimited positioning of the adapter 252 along the length of the retainer 250.

To secure the first spring end of the coiled spring 30 to the retainer 250, the curved portion 262 of the adapter 252 is placed into the curved slot 284 of the retainer 250. The curved slot 284 secures the adapter 252 and the first spring end of the coiled spring 30 to the retainer 250 and provides for a quick and easy assembly of the display system. The wall 254 provides additional stability in the connection between the retainer 250 and the adapter 252. Other methods, however, can be used to secure the adapter 252 and/or the first spring end of the coiled spring 30 to the retainer 250.

Alternatively, as depicted in FIGS. 33 and 44 the coiled spring 30 of the pusher paddle 287 can be mounted directly to the front of the tray 306. The first spring end 290 of the coiled spring 30 is provided with a curved portion. The curved portion curves downwardly from the pusher floor 288 and is adapted to be received in a recess 316 (shown in FIG. 33) defined by a lip 318 of the front surface of the dispensing tray 306 and the retainer 250. A vertically oriented surface of the retainer 250 and the lip 318 are spaced such that a gap is formed between the vertically oriented surface and a front edge of the lip 250. To secure the coiled spring 30 and the pusher mechanism 286 to the assembly, the first spring end 290 is inserted into the gap formed between the vertically oriented surface of the retainer 250 and the front edge of the lip 318 and placed into the recess 316 formed by the lip 318 of the dispensing tray 306 and the retainer 250.

In another exemplary embodiment depicted in FIGS. 38, 39, 48 and 49, the coiled spring 30 can be directly mounted to a divider 266. In addition, in this exemplary embodiment the coiled spring 30 can be mounted perpendicular to the pusher floor 288 such that the axis, about which the coiled spring 30 is coiled, is perpendicular to the pusher floor 288. This orientation has the benefit of preventing the pusher paddle from tipping back. The first spring end 290 can be provided with an angled portion 292 and a tip portion 296. In one exemplary embodiment, the angled portion 292 can be bent perpendicular to the coiled spring body 294. The divider can be provided with a slot 298, which is adapted to receive the tip portion 296 of the first spring end 290.

To secure the coiled spring to the divider, the tip portion 296 is inserted into the slot 298. Once the tip portion 296 is fully inserted into the slot 298, the angled portion 292 engages the slot 298 so as to secure the first spring end 290 to the divider 266.

As depicted in FIG. 33, various pusher mechanism designs can be implemented. The pusher paddle 287 can be formed flat to accommodate correspondingly shaped product. Alternatively, the pusher paddle 286 can have a curved first end and a flat second end. This serves to accommodate a variety of cylindrical products having a variety of different sized diameters and to facilitate the operation of the pusher mechanism 286. During operation, the product in the pusher mechanism 286 and the curved first end together force the pusher mechanism against the divider 266, such that the coil spring 30 remains flat against the divider 266 holding the first spring end 290, while in tension or in operation. This allows for a smoother operation of the pusher mechanism and ensures that the product is properly dispensed as users remove the product from the system.

Figure 40:
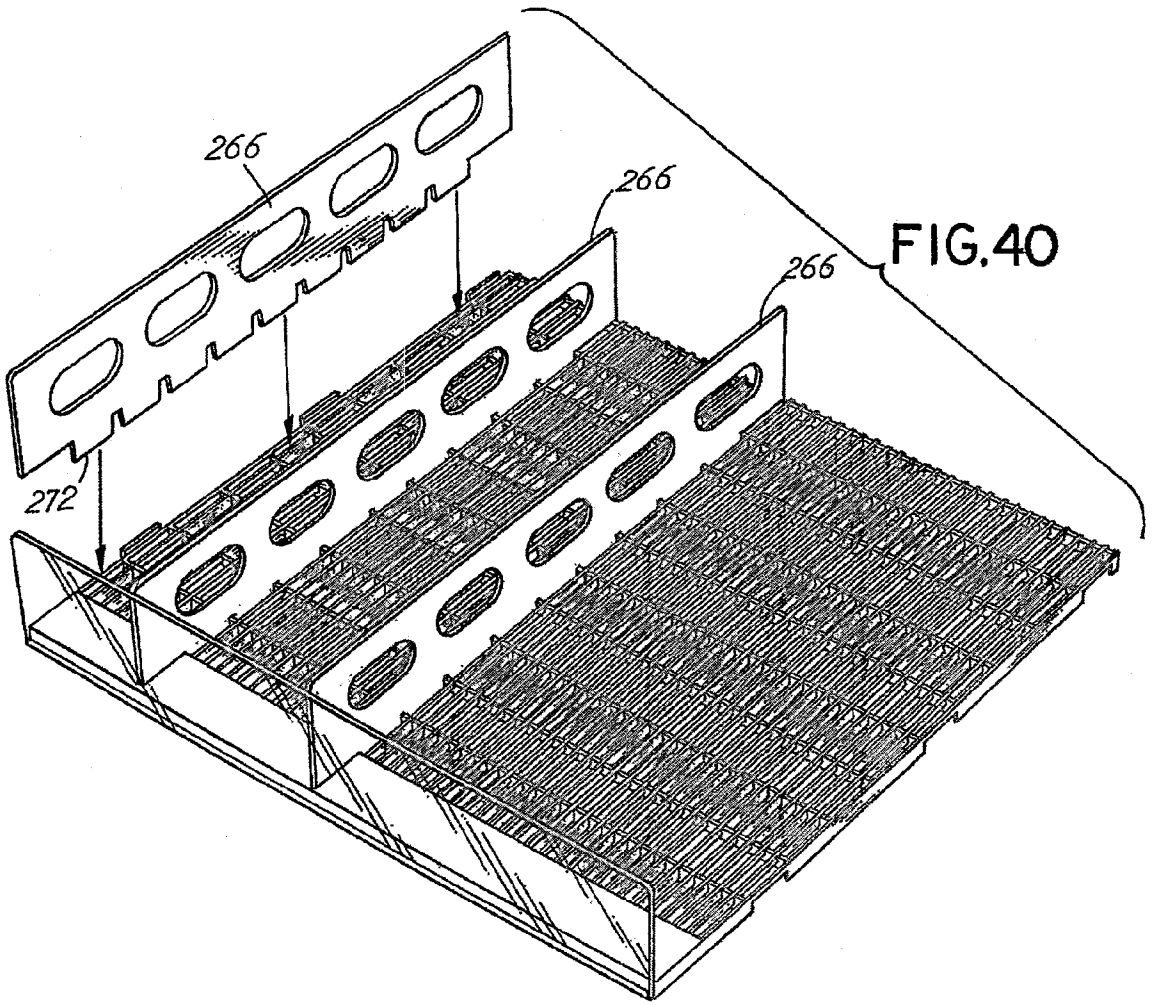
FIG. 40 depicts an isometric view of an exemplary embodiment of the display system.
Figure 41A:
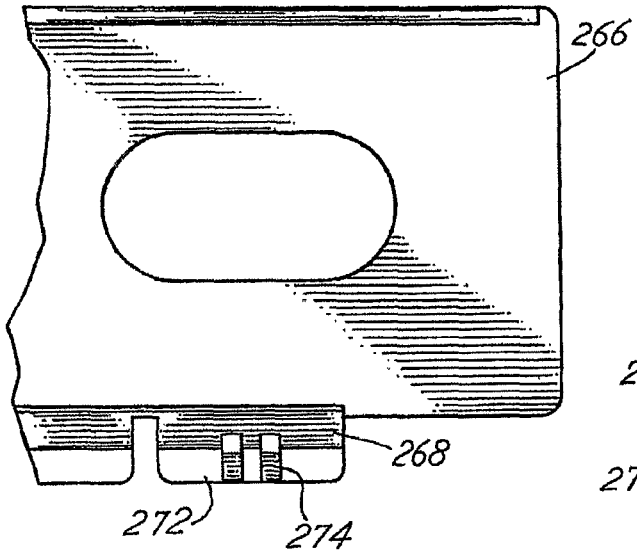
FIG. 41A depicts a sectional side view of an exemplary embodiment of a divider.
Figure 41D:
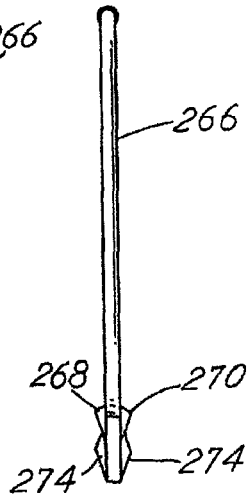
FIG. 41D depicts a front view of an exemplary embodiment of a divider.

In another exemplary embodiment depicted in FIGS. 40-41D, the distance between the dividers 266 can be adjusted to accommodate different sized containers. The dividers 266 can be provided with connecting portions 272. The connecting portions 272 can be provided with a first elongated angled surface 268 and a second elongated angled surface 270. Additionally, the connecting portions 272 can be provided with a plurality of projections 274. As depicted in FIG. 41B, the rails can be formed of teeth 278 having face surfaces 280 and flank surfaces 282.

Figure 41C:
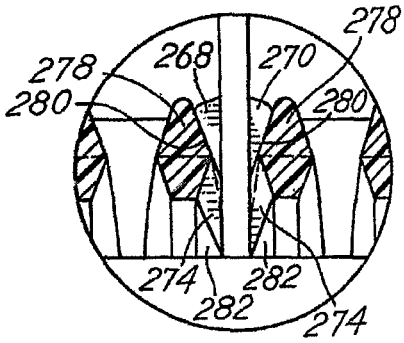
FIG. 41C depicts a close up view of a section of FIG. 41B.
Figure 41B:
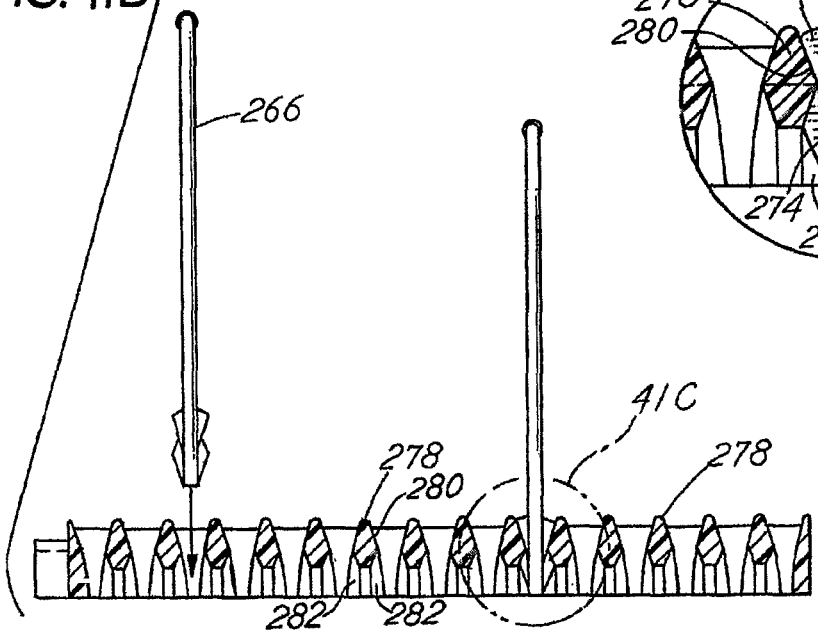
FIG. 41B depicts a front view of an exemplary embodiment of the display system.

When assembled, as depicted in FIG. 41C, the connecting portions 272 are received between the teeth 278 of the rails. Additionally, the elongated angled surfaces 268 and 270 and the projections 274 are wedged between the teeth 278. Also as shown in FIG. 41C, the elongated angled surfaces 268 and 270 engage the face surfaces 280, and the projections 274 engage the lower surfaces of the teeth 278. Flank surfaces 282 contact the connecting portion 272.

Figure 42:
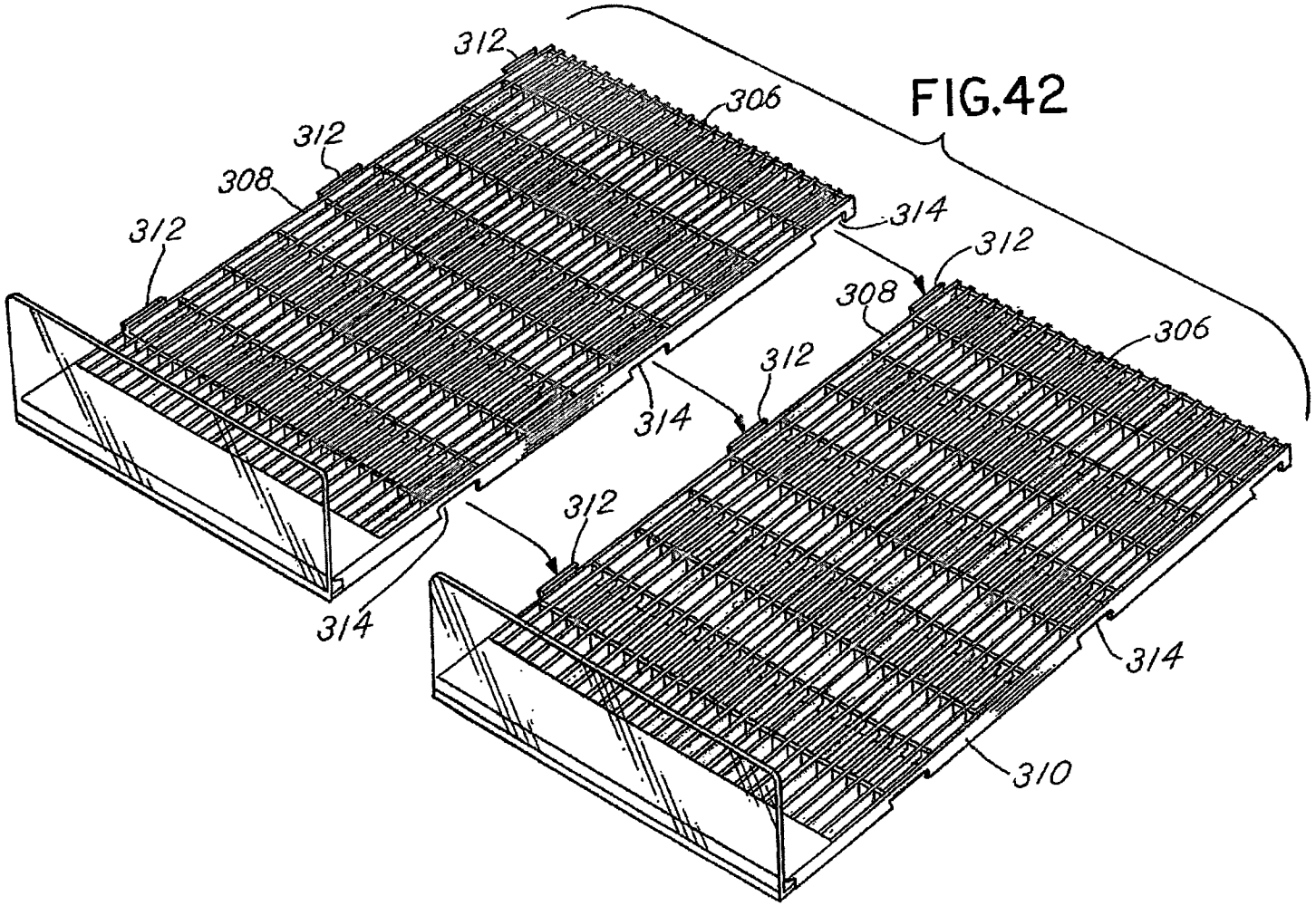
FIG. 42 depicts an isometric view of an exemplary embodiment of the display system.

In an exemplary embodiment depicted in FIG. 42, the trays 306 are provided with dovetail connections. A first side 308 of the trays 306 is provided with tongues 312 adapted to fit within grooves 314 located on a second side 310 of the trays 306. To connect the trays, the grooves 314 are aligned with tongues 312 such that the tongues 312 are firmly secured within the grooves 314.

Figure 43:
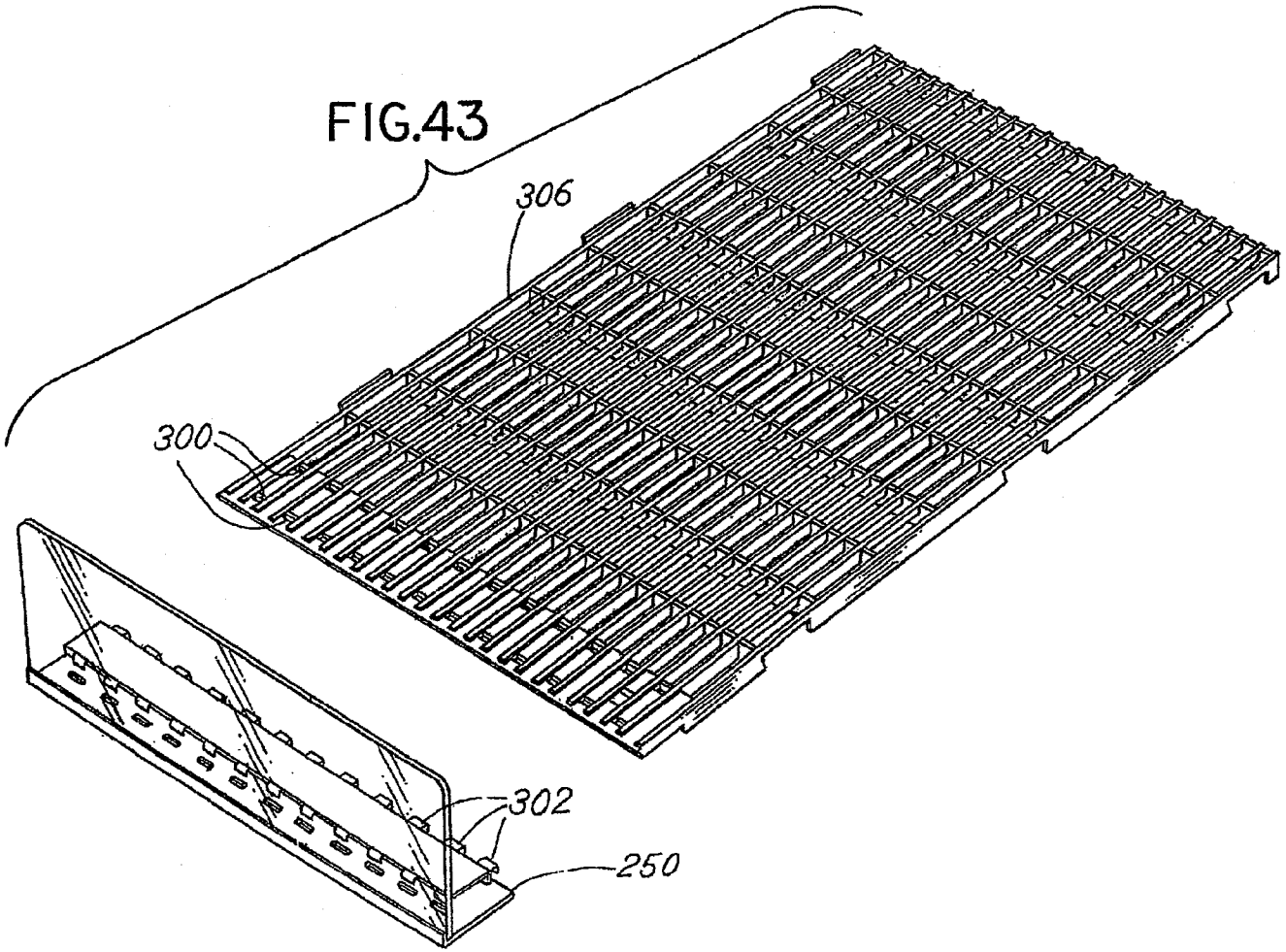
FIG. 43 depicts an isometric view of an exemplary embodiment of the display system.

In an exemplary embodiment depicted in FIG. 43, the trays 306 are configured to receive the retainer 250 at a front end.

The retainer can be provided with rectangular holes 300, and the retainer is provided with correspondingly shaped and sized projections 302. To secure the retainer 250 to the tray 306, the projections 302 fit into holes 300 to lock the retainer into place on the tray 306.

Figure 45:
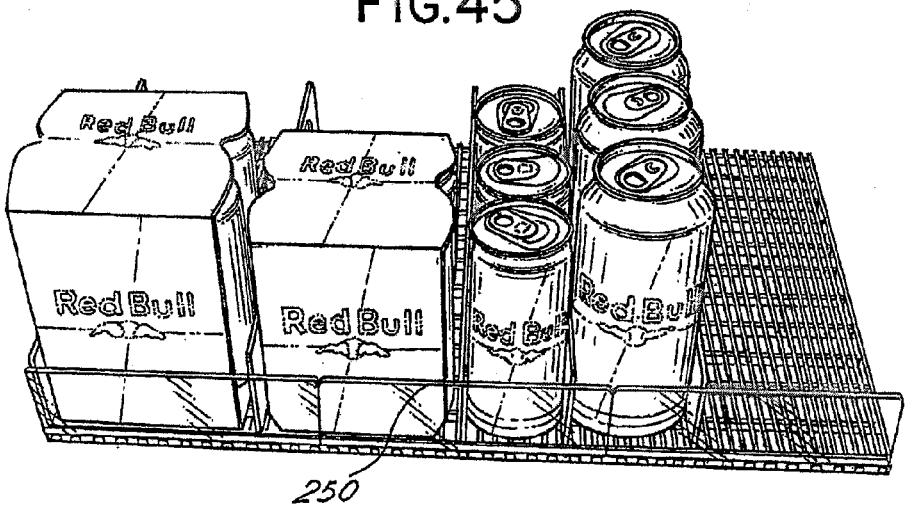
FIG. 45 depicts another isometric view of an exemplary embodiment of a product management display system with product in the system.
Figure 46:
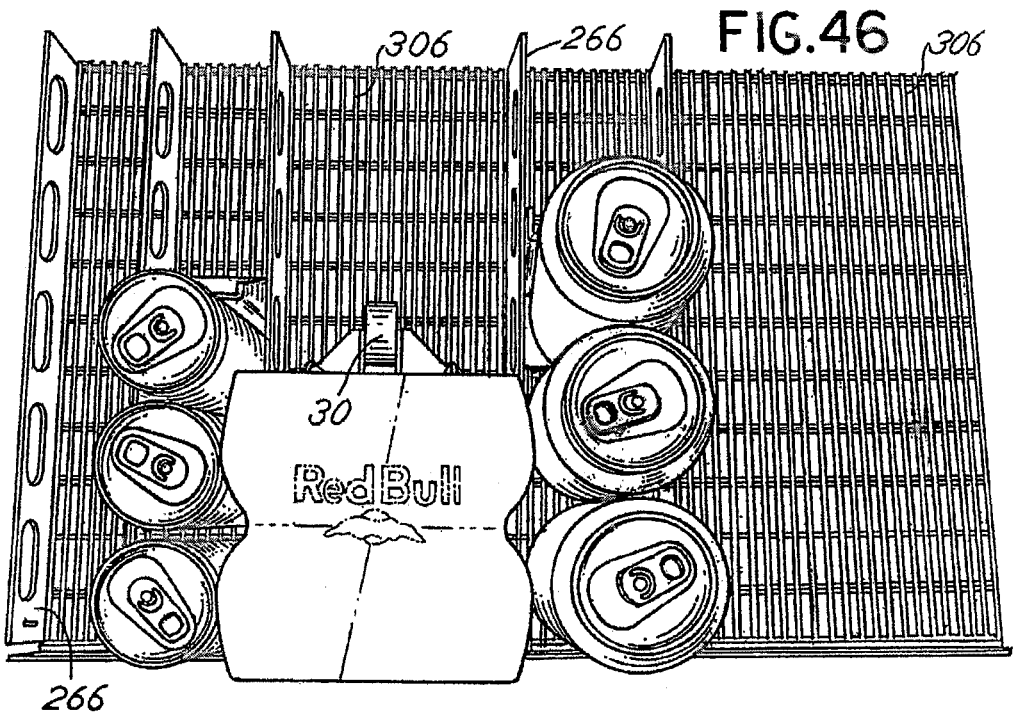
FIG. 46 depicts a top view of another exemplary embodiment of a product management display system with product in the system.
Figure 47:
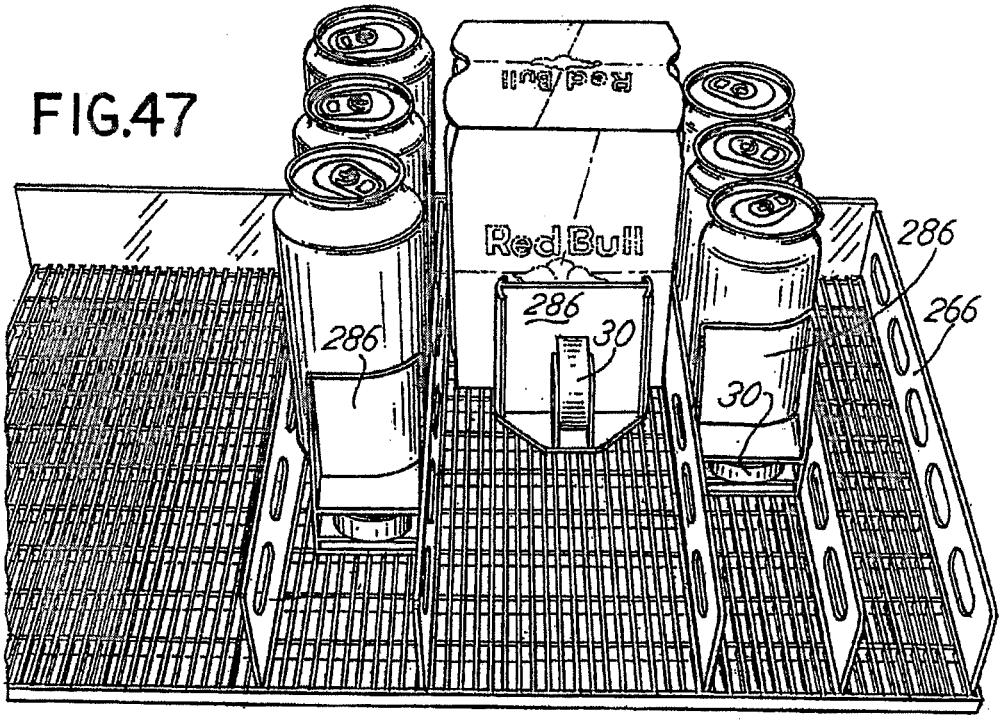
FIG. 47 depicts an isometric-rear view of an exemplary embodiment of a product management display system with product in the system.

As depicted in FIGS. 45-47, after the product management display system is assembled, product is loaded into the system. By adjusting the dividers 266 a wide variety of product sizes and shapes can be loaded into the system. As shown in FIGS. 46 and 47, the coil spring 30 in conjunction with the pusher paddle 287 push the product toward the retainer 250. As a user takes product out of the system, the pusher paddle 287 pushes the remaining product such that the product slides along the floor 264 to the retainer 250. This assures that all product remains at the front of the display system.

Figure 50:
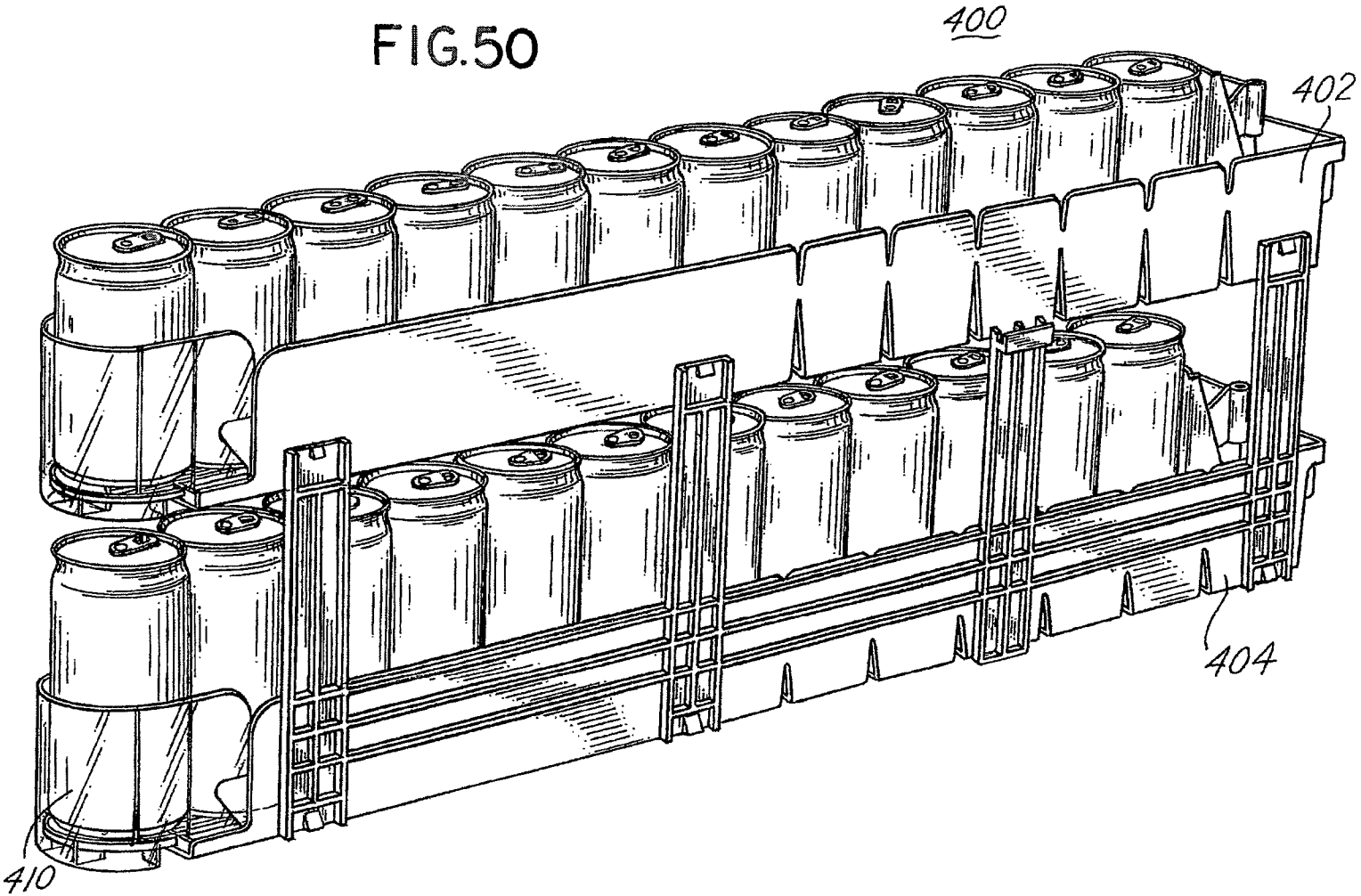
FIG. 50 depicts an isometric view of yet another exemplary embodiment of the product management display system.
Figure 51:
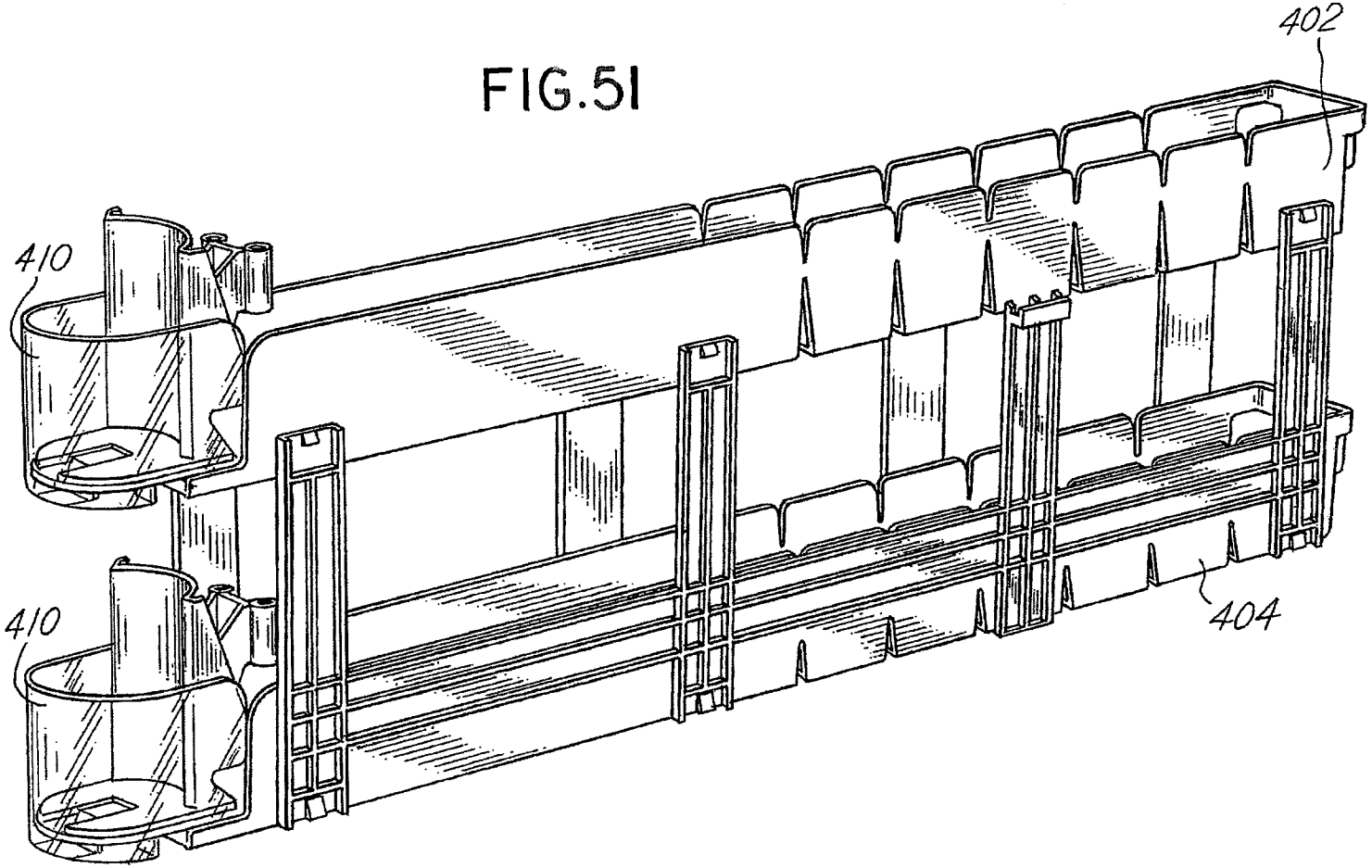
FIG. 51 depicts another isometric view of the exemplary embodiment of the product management display system of FIG. 50 without product.
Figure 52:
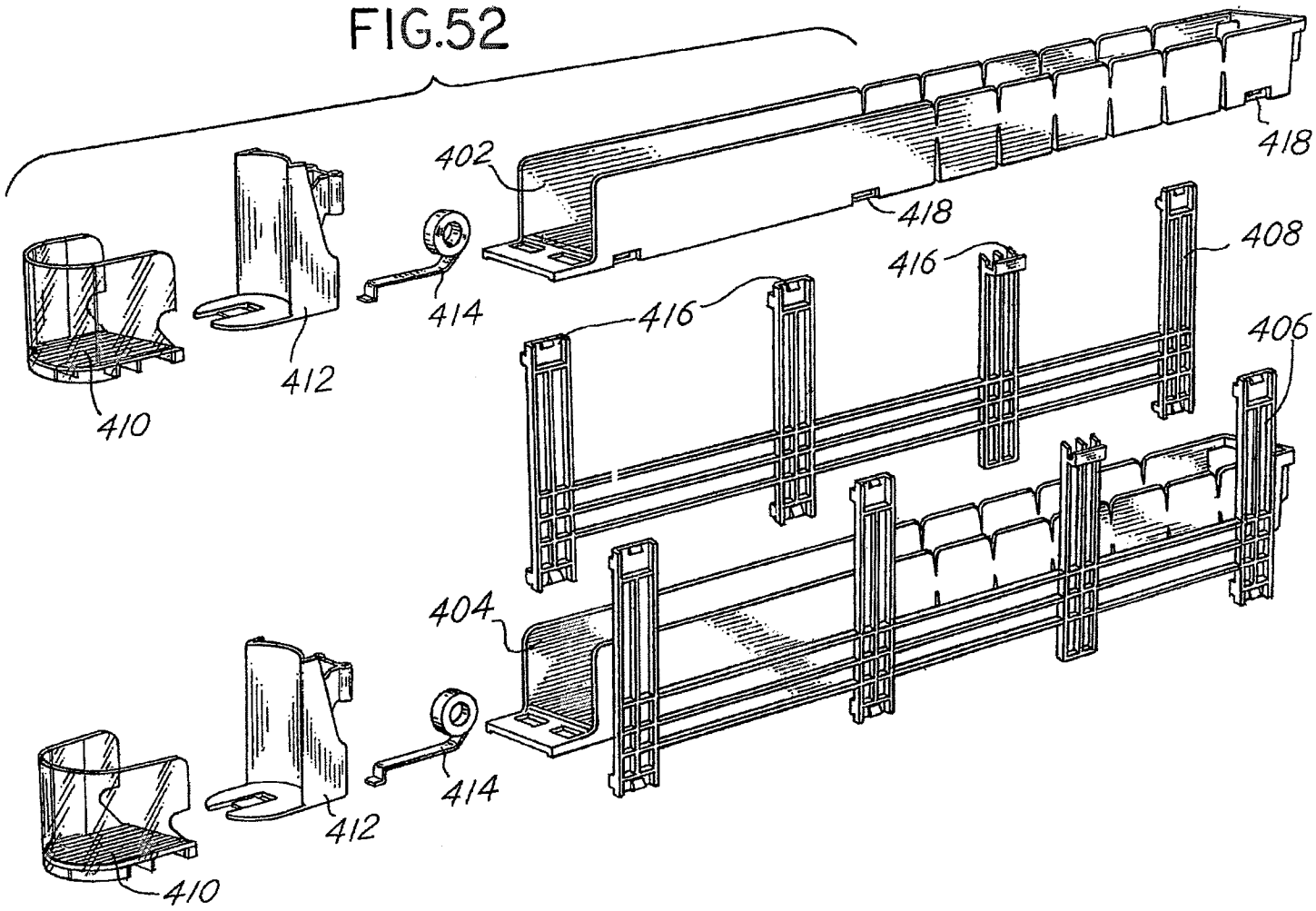
FIG. 52 depicts an exploded isometric view of the exemplary embodiment of the product management display system of FIG. 50.
Figure 53:
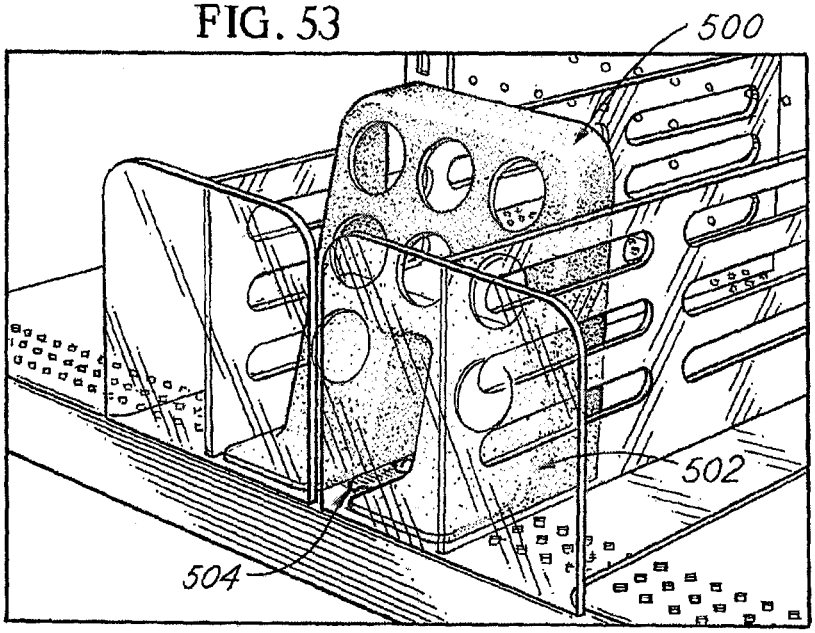
FIG. 53 depicts an isometric view of yet another exemplary embodiment of the product management display system.

As depicted in FIGS. 50-52, the product management display system 400 can be arranged such that trays 402, 404 can be stacked on top of one another. This embodiment can consist generally of a first tray 402, a second tray 404, a first spacer 406, and a second spacer 408.

The trays 402, 404 are each arranged to house product to be dispensed. The first tray 402 and the second tray 404 can be each provided with a clear retainer 410, a pusher mechanism 412, first and second guiding walls, and a coil spring 414.

The pusher mechanism 414 is arranged in a similar fashion as the embodiments discussed above, such that it slides product along the surface of the trays 402, 404, while product is removed. Additionally, any of the alternative arrangements of the pusher mechanism discussed above may be implemented in a stackable tray arrangement.

To provide for an easy assembly and disassembly, the stackable product management display system can be provided with a dovetail connection or any other suitable connection, such as a snap-fit connection, screw-thread connection, or a rivet connection. The first and second trays are provided with detents 416 for assembling the first and second spacers 406, 408 to the first and second trays 402, 404. Each of the first and second trays 402, 404 can be provided with sockets 418 on their respective outside surfaces for receiving the correspondingly shaped detents 416 located on the first and second spacers 406, 408.

To assemble the stackable product management display system, the detents 416 located on the first and second spacers 406, 408 are placed into the correspondingly shaped sockets 418 on the outside surfaces of the first and second trays 402, 404 in a locking arrangement. This provides for a stackable arrangement that can be implemented in conjunction with any of the embodiments discussed above.

In another exemplary embodiment depicted in FIGS. 53-57, a pusher paddle 500 may be mounted directly to a shelf 508 and held to the shelf by the end of the coiled spring 504. The pusher paddle 500 will slide along and on top of the surface of the shelf. One or more dividers 502 that define a T-shaped configuration may be positioned next to the pusher paddle 500. In an alternative aspect, the base of the divider 502 may be positioned on the shelf such that the base is located underneath the pusher paddle 500. With this configuration, the pusher paddle 500 may slide along the base of the divider. If the dividers 502 are positioned sufficiently far away from the paddle 500, the paddle 500 will slide directly on the surface of the shelf 508. The dividers 502 may define numerous configurations including those described herein and may be secured to the shelf using any known technique, including push pins, rivets, fasteners, adhesives and the like.

In one aspect, the end 510 of the coiled spring 504 is positioned within a hole or aperture 506 located on the shelf 508. The end 510 may define a spring tip that may further define any suitable configuration that permits the spring end to pass into the hole 506 and remain secured to the hole. For example, the spring tip of end 510 may define a hook-shaped configuration that permits the end 510 to wrap around the edges of the hole 506. Alternatively, the spring tip may define one or more catches that hook onto the edges of the hole 506. Still other spring tip configurations are possible.

Figure 54:
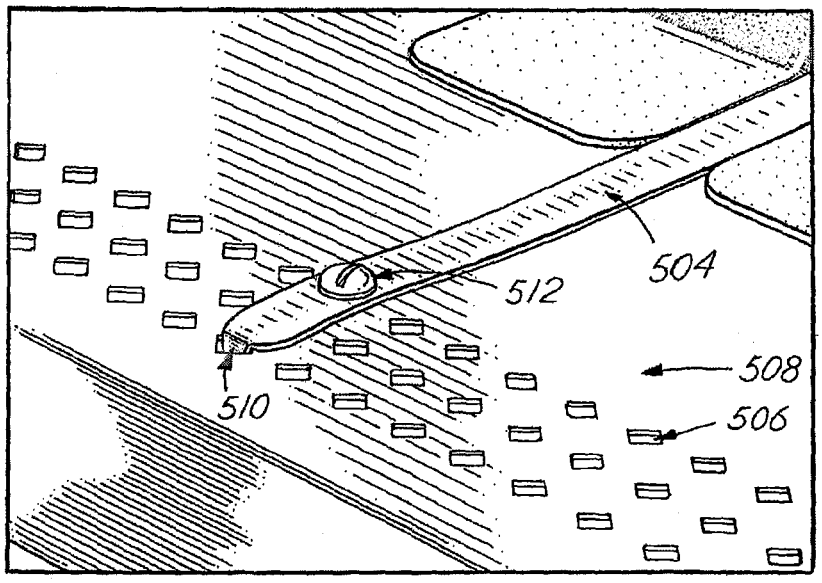
FIG. 54 depicts an isometric view of an exemplary attachment of the pusher spring to a shelf of the product management display system of FIG. 53.

As shown in FIG. 54, to further secure the spring 504 to the shelf 508, a fastener 512, pin, rivet or the like may be used. This fastener 512 will provide a second spaced-apart anchoring point for the spring that will hold the spring in the desired alignment during the full operation of the spring 504 as the paddle 500 moves back and forth on the shelf 508. It will be appreciated that depending on the shelf type and the number and spacing of existing holes on the shelf, even more anchoring points are possible.

Figure 55:
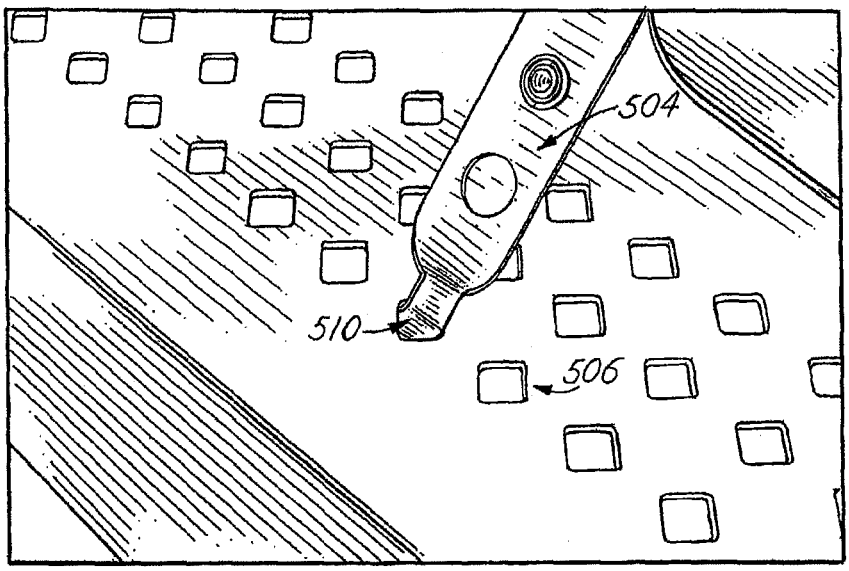
FIG. 55 depicts an isometric view of an exemplary attachment of the pusher spring to a shelf of the product management display system of FIG. 53.
Figure 56:
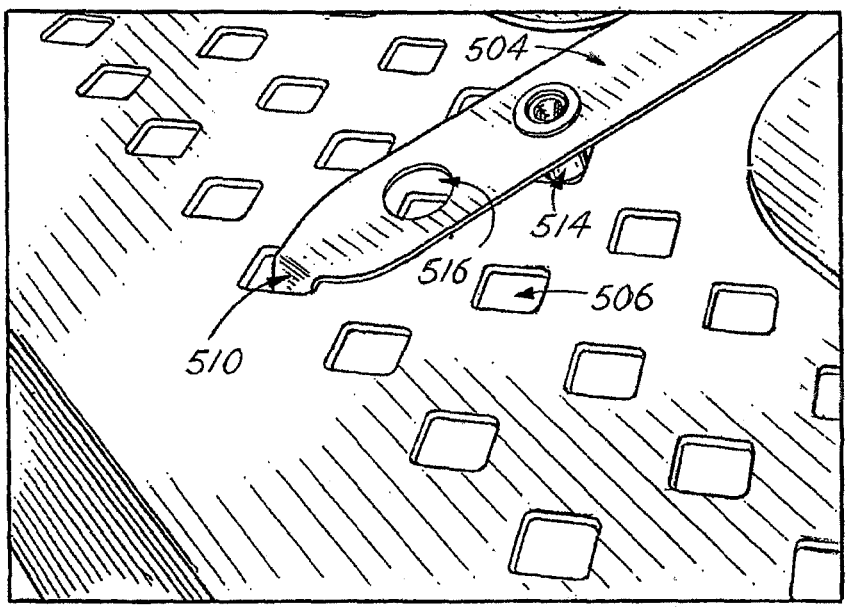
FIG. 56 depicts an isometric view of an exemplary attachment of the pusher spring to a shelf of the product management display system of FIG. 53.
Figure 57:
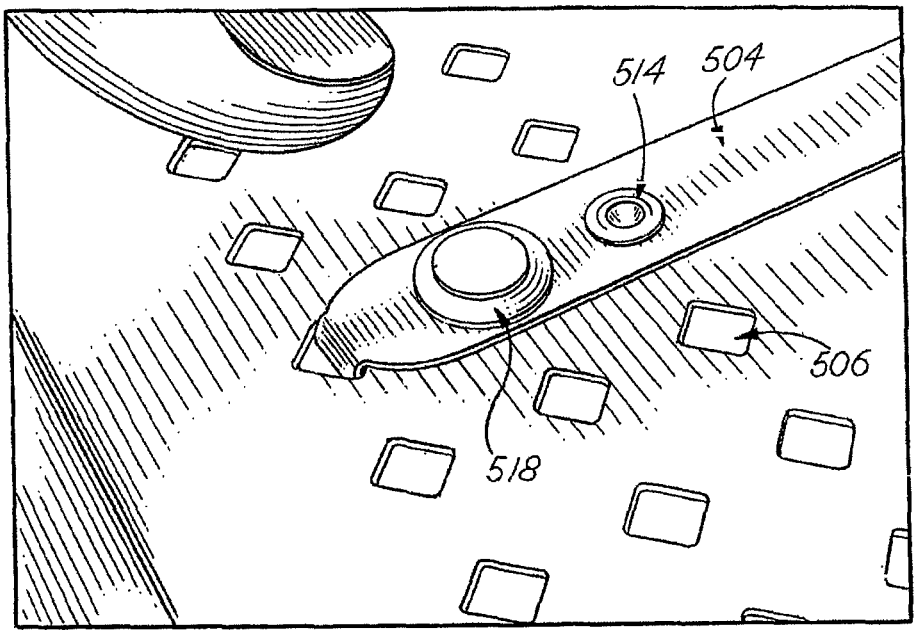
FIG. 57 depicts an isometric view of an exemplary attachment of the pusher spring to a shelf of the product management display system of FIG. 53.

Referring to FIGS. 55-57, there is depicted an exemplary mounting technique for mounting the spring 504 of the paddle 500 onto a shelf. As shown in FIG. 55, the end 510 of the spring 504 is inserted into the hole 506 on the shelf. The end 510 may define a spring tip as described herein to hold the end 510 to the edges of the hole 506. As shown in FIG. 56, the spring 504, which in this embodiment includes a rivet or stud 514, is lowered onto the shelf such that the rivet or stud 514 fits within another hole 506 located on the shelf. This rivet or stud provides another anchoring point for the spring. As shown in FIGS. 56 and 57, the spring 504 may define an aperture 516 for receiving yet another rivet or stud 518 to even further secure the spring 504 to the shelf. With these multiple anchoring points, the spring 504 will be secured to the shelf, and thus the paddle will be secured to the shelf. Also, with these multiple anchoring points, the spring will retain the desired alignment during the full operation of the spring as the paddle moves back and forth on the shelf. It should be understood that other anchoring techniques are possible to secure the end of the spring 504 to the shelf, including any of the technique described herein, or any combination of the techniques described herein. It should be appreciated that if a shelf does not have pre-existing holes that could be used to anchor the spring 504, one or more holes could be drilled into the shelf at the desired locations.

With the embodiment depicted in FIG. 53-57, it can be appreciated that a trackless pusher paddle may be retrofitted directly onto existing store shelves with very minimal effort or extra mounting pieces. Additionally, this embodiment is easily removable to permit the repositioning of the pusher paddle at any location on the shelf to accommodate any size and type of product being merchandised on the shelf. One of skill in the art will also appreciate that any of the pusher paddles described herein may be mounted directly to the shelf using the techniques described herein, or by using any combination of the techniques described herein.

Figure 58:
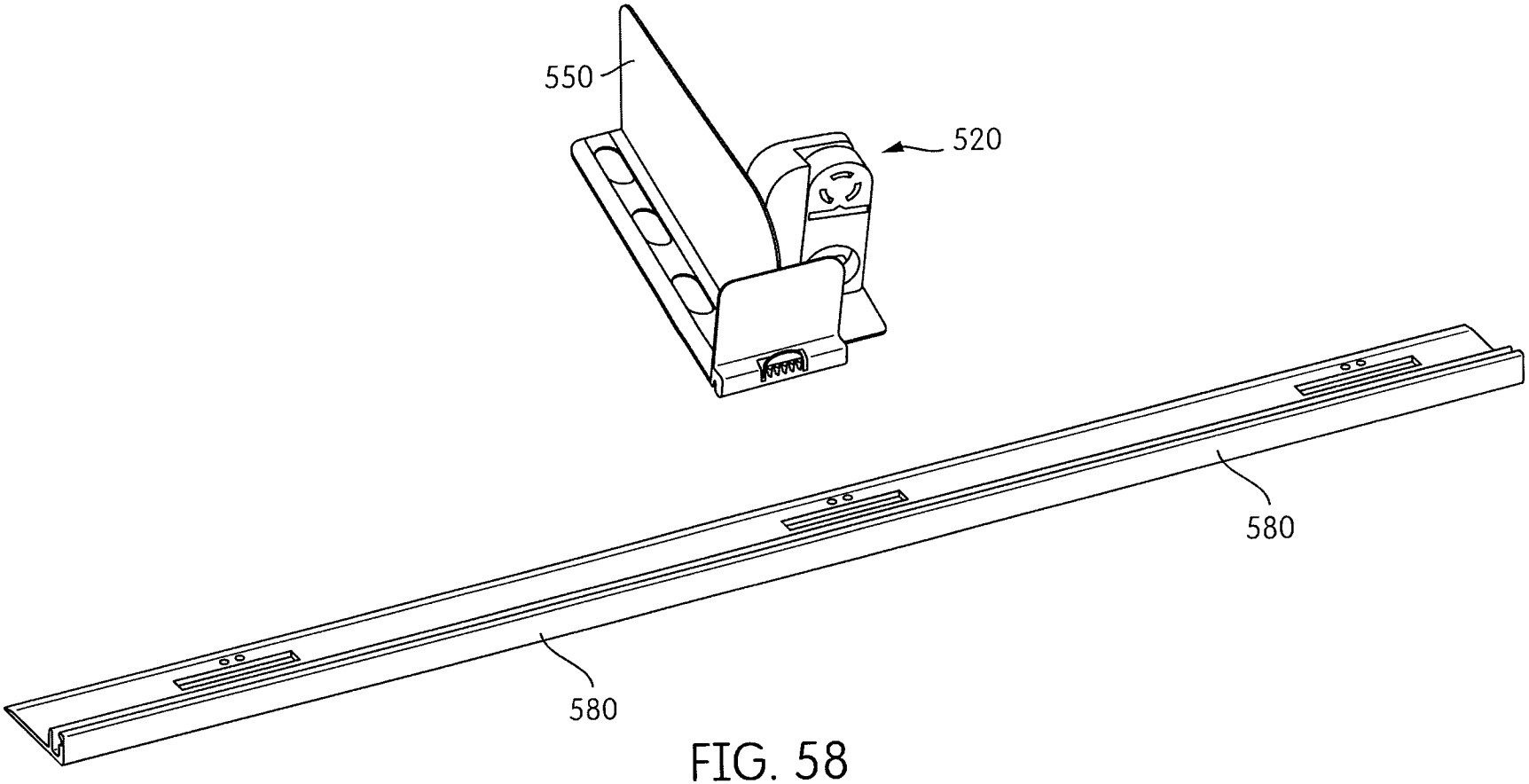
FIG. 58 depicts an isomeric view of an exemplary embodiment of the product management display system in accordance with one or more aspect of the disclosure.
Figure 59:
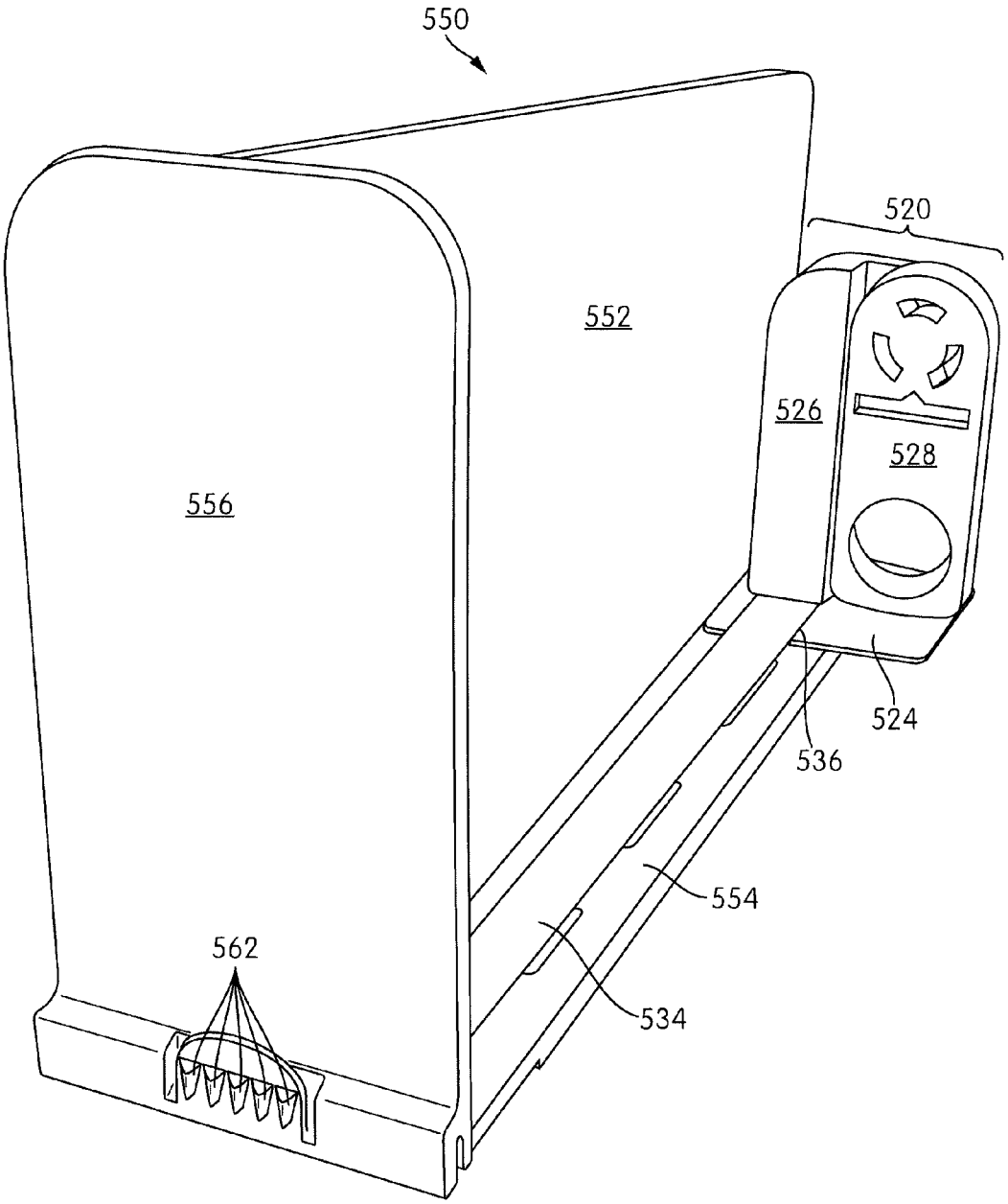
FIG. 59 depicts an isometric view of the exemplary product management display system of FIG. 58.
Figure 60:
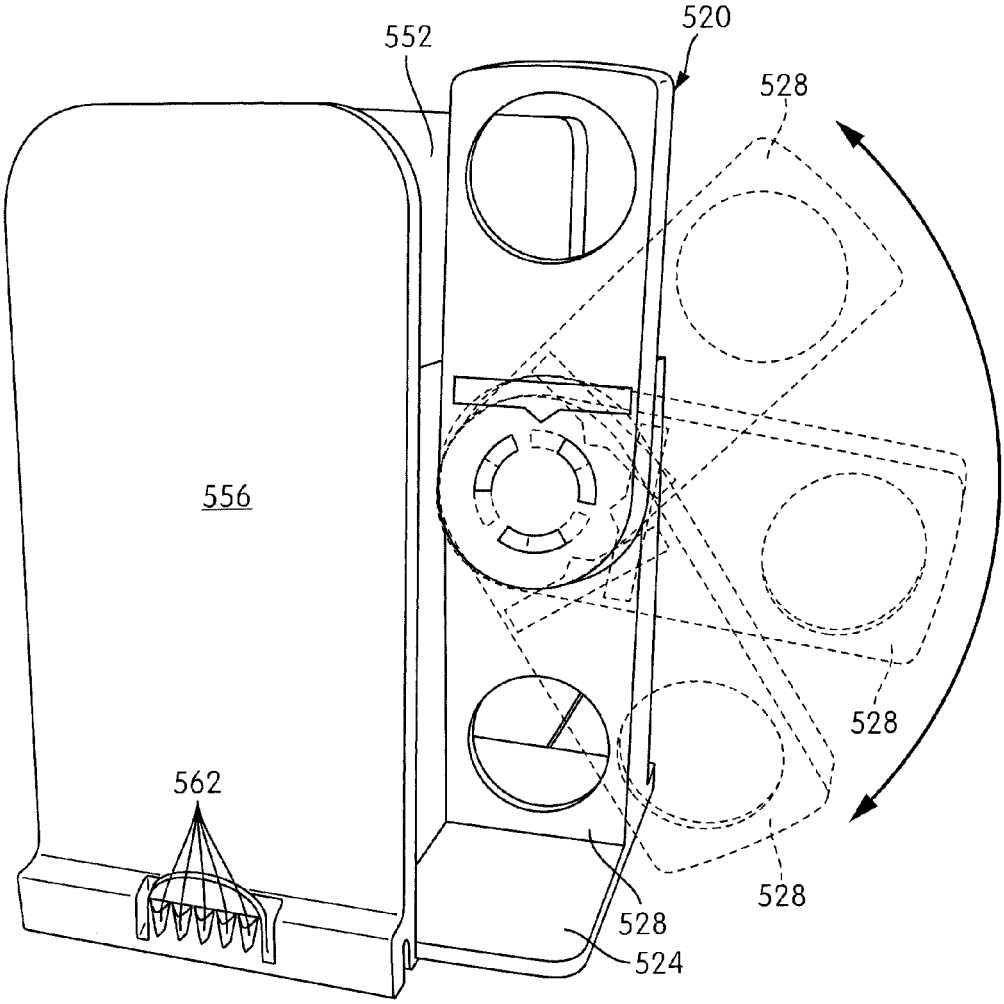
FIG. 60 depicts an isometric view of an exemplary pusher mechanism in accordance with one or more aspects of the disclosure.

In an alternative embodiment, as depicted in FIG. 58, a display management system is comprised of one or more pushers 520, one or more dividers 550, and a front rail 580. The divider 550 and the front rail 580 can sit on a shelf. The pusher 520 can include a pusher face 522 and a pusher floor 524, as illustrated in FIG. 59. The pusher face 522 can be divided into a non-adjustable portion 526 and pusher extender 528. The non-adjustable portion 526 and pusher extender 528 both may define a surface that may be used to contact product on the shelf. Both the non-adjustable portion 526 and the pusher extender 528 may define similar heights and depths. The pusher extender 528 can adjust from a position that is flush with and adjacent to the non-adjustable portion 526, as shown in FIG. 59. The pusher extender 528 can be directed downward toward the pusher floor 524 as in FIG. 60. The pusher extender 528 can be adjusted to a variety of positions as shown in FIG. 60, including a position that is parallel to the pusher floor 524 and a position that is directed upward away from the pusher floor 524 and a position that is directed downward toward the pusher floor 524. In this manner, the width or the height of the pusher 520 can be effectively extended for wider or taller products.

The pusher extender 528 can rotate about an axis on the upper portion of the pusher 520. A notched wheel 532 (see FIG. 77) can be located behind the pusher extender 528. The pusher extender 528 includes a protrusion (see, e.g. protrusion 530 in FIG. 77) that fits within the notches in the notched wheel 532. As the pusher extender 528 rotates, about the axis, the protrusion rotates into the various spaces within the notches in the notched wheel 532, similar to a pawl and ratchet mechanism. Each notch represents a separate position for the pusher extender 528. In each separate position, the pusher extender 528 can remain stationary, such that a force is required to move the pusher extender 528 to a different position. In exemplary aspects of the embodiment, the pusher extender may rotate from a first position that is adjacent to the non-adjustable portion 526 to one of numerous second positions that may be located within a range of approximately 180 degrees relative to the first position. The degree of adjustment may vary depending on the number, size and spacing of the notches on the notched wheel. The pusher extender may define a lightener aperture through the wall of the pusher extender to reduce the weight of the pusher extender and to reduce the moment created around the axis of the pusher extender. The pusher extender may define a smooth or textured pusher face.

Referring back to FIG. 59, a biasing element, such as a coiled spring 534, can be maintained in a rear portion of the pusher 520. In an embodiment, the coiled spring 534 can be positioned adjacent the non-adjustable portion 526 of the pusher face 522. The coiled spring 534 can extend across the pusher floor 524 as shown in FIG. 59. In an embodiment, the pusher floor 524 can include a channel 536 in which the coiled spring 534 sits. The channel 536 allows for product to sit on the pusher floor 524 with limited contact with the spring. The weight of the product rests on the pusher floor 524 in this embodiment. The pusher floor 524 also can comprise a surface with no channel.

Figure 77:
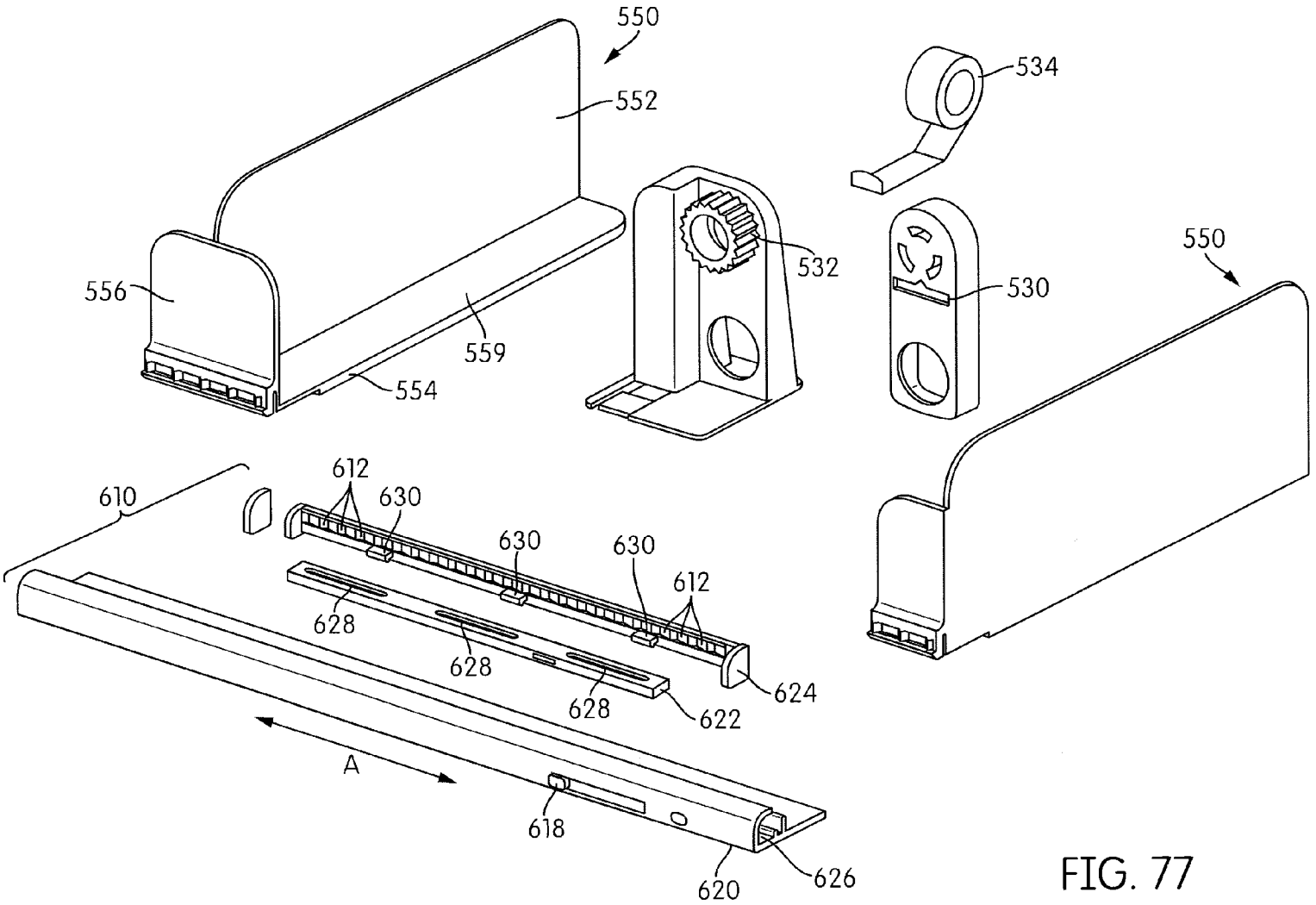
FIG. 77 depicts a front exploded view of an exemplary product management display system in accordance with one or more aspects of the disclosure.

In an example, a divider 550 can be comprised of a divider wall 552, a floor 554 and a barrier 556, as illustrated in FIG. 59. In an example, a divider 550 can include no barrier. In an example, a divider 550 can include no floor. The divider wall 552 can divide the divider floor 554 into two portions, 559 and 551 (see FIG. 78) with one portion on each side of the divider wall 552. The divider wall 552 also can have a divider floor 554 on only one side of the divider wall 552. As illustrated in FIG. 77, the divider wall 552 can extend perpendicularly from the divider floor 554. The divider floor 554 can be a planar surface. In an embodiment, the divider floor 554 can include a channel within a portion of the divider floor 554. The coiled spring 534 can extend across the divider floor 554. In an embodiment, the coiled spring 534 can extend across the divider floor 554 within a channel in the divider floor 554. In this embodiment, product will not rest on the coiled spring 534 and instead will rest on the portions of the divider floor 554 that are adjacent the channel in the divider floor 554. In another embodiment, the divider floor 554 does not include a channel. In an example, a single pusher 520 can be located on one portion of the divider floor 554 and a second pusher (see FIG. 84F) can be located on a second portion of the divider floor 554. Thus, one divider 550 can contain two pushers 520, one on each side of the divider wall 552.

The barrier 556 can be configured to restrain product that is being pushed by the pusher 520 and the biasing element contained therein. The barrier 556 can be located at the front of the divider wall 552, as illustrated in FIG. 59. The barrier 556 may also be located at the rear of the divider wall to prevent overstocking of product on the shelf. As shown in FIGS. 59 and 77, the divider wall 552 can divide the barrier 556 into two portions. The barrier 556 can be perpendicular to the front end of the divider wall 552. In an embodiment, the barrier 556, the divider wall 552 and the divider floor 554 are a single integrated device. These three elements can also be integral with each other. In an example, the barrier is separate from the divider. In an example, the barrier is not integral with or integrated with the divider. In another example, the barrier is configured to engage with the divider. In an example, the divider wall and the divider floor are separate devices from each other and are not integral with each other or part of a single integrated device. In an example, the divider wall and the divider floor are configured to engage with each other. In further examples, a barrier can be connected to the front rail 580 or comprise a portion of the front rail 580.

Figure 61:
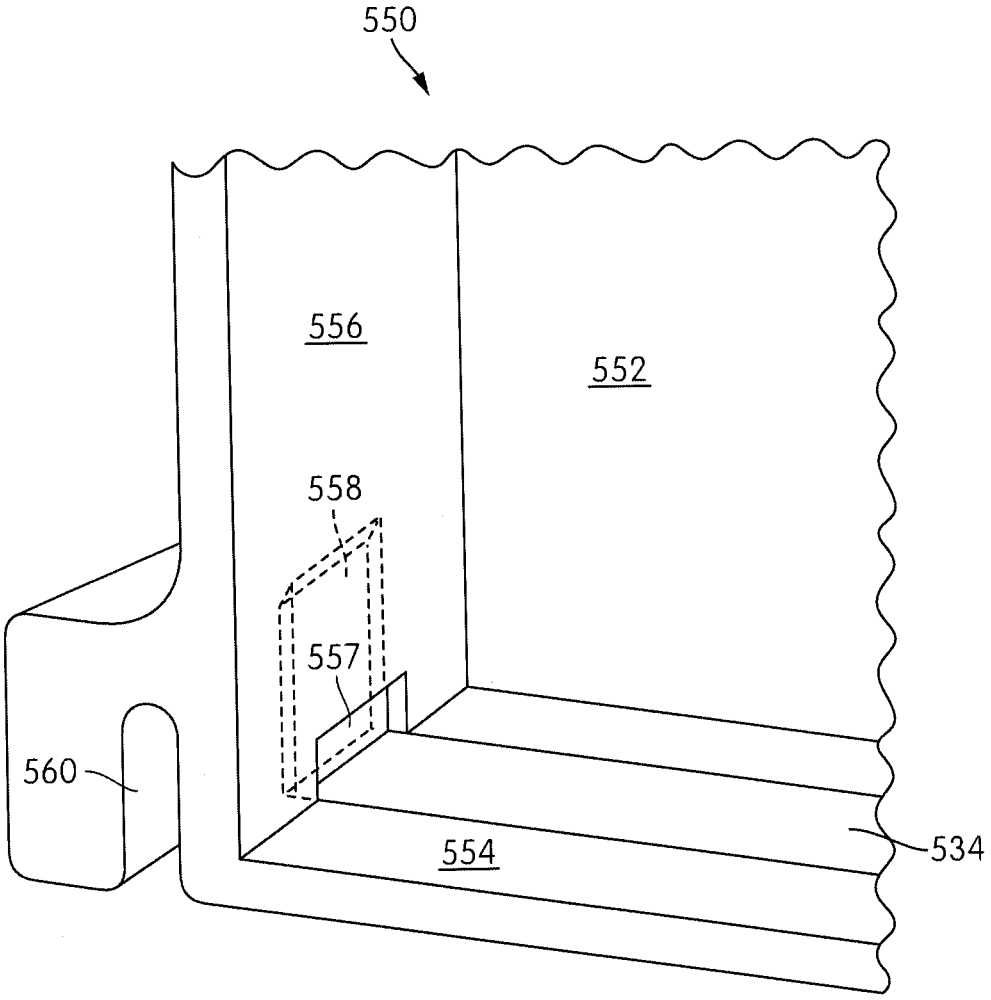
FIG. 61 depicts a partial isometric view of an exemplary divider in accordance with one or more aspects of the disclosure.

As illustrated in FIG. 61, an end 557 of a coiled spring 534 can be positioned within the barrier 556. The end 557 of the spring can be folded at an angle to the remainder of the spring. This angle can be 90 degrees or any other suitable angle that may be less than or greater than 90 degrees. The end 557 of the coiled spring can then be placed into a slot 558 within the barrier 556. Once in the slot 558, the end of the spring 557 will remain in place and will assist in biasing the pusher 520 toward the barrier 556. An end 557 of the coiled spring 534 can include a plurality of portions, each with bends that place a subsequent portion of the end of the coiled spring at an angle to a previous portion of the coiled spring (not shown). The plurality of bends can engage a plurality of slots or apertures in the barrier 556 or other connection point on the divider 550 or front rail 580. The plurality of slots or apertures can conform to the shape of the plurality of bends in the end 557 of the coiled spring 534. The coiled spring 534 can include a catch (not shown) at one end. The catch in the coiled spring 534 can be configured to prevent the coiled spring 534 from disengaging with the pusher 520, such as, for example, when the coiled spring 534 is extended.

Figure 62:
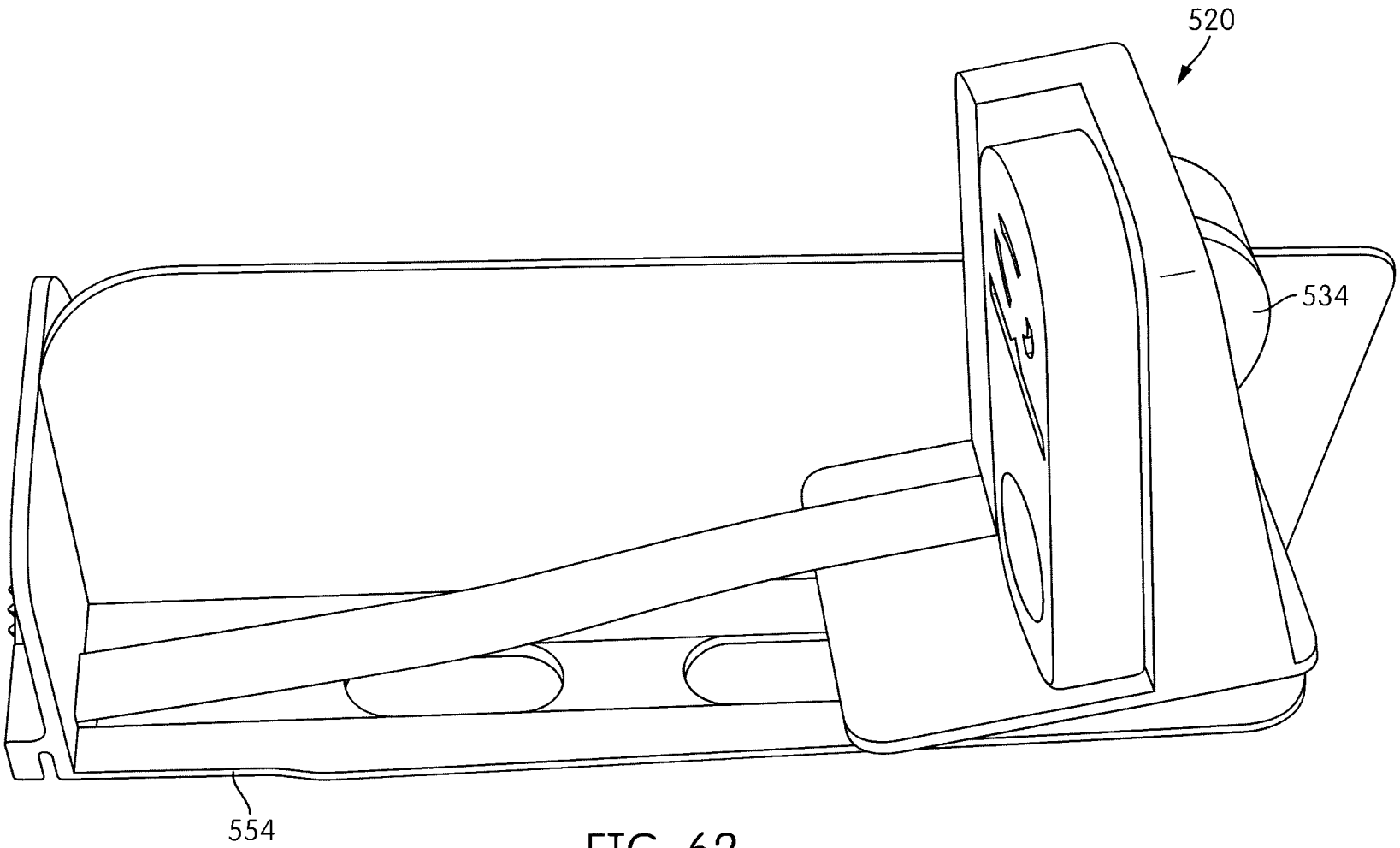
FIG. 62 depicts an isometric view of an exemplary divider and pusher mechanism in accordance with one or more aspects of the disclosure.

The pusher 520 may be connected to the divider 550 by only the coiled spring 534. The pusher 520 can sit on top of the divider floor 554 and can slide across the divider floor. The pusher 520 can be configured to rest entirely above the divider floor 554 as shown in FIG. 59 and not go below the divider floor 554. In this embodiment, the pusher 520 can be picked up off the divider floor 554 as shown in FIG. 62. Gravity and the weight of product sitting on the pusher floor 524 maintain the pusher 520 on the divider floor 554. Product sitting on the coiled spring 534 also maintains the pusher 520 on the divider floor 554. The only integrated connection between the pusher and the divider can be the end of the coiled spring 557 that is maintained within a slot 558 in the barrier 556. The divider wall 552 may be used to guide the pusher 520 as the pusher 520 moves front to back, and vice versa, on the divider floor 554.

The divider 550 can define a groove 560 or other recess in an underside portion of the divider. This groove 560 or other recess can be in the shape of an upside down "u" as shown in FIG. 61 or can take another shape. The groove 560 or other recess can extend across the full width of the underside portion of the divider 550. The groove 560, or other recess in an example, may extend along only a portion of the width of the underside portion of the divider. The groove 560 or other recess may be used to engage a front rail, front wall of a tray, or other structure. The term recess as used herein can mean a groove, slot, channel, indentation, depression or other recess that extends inwardly.

The divider 550 also can define a plurality of teeth 562 or other projection. The teeth 562 or other projection can be located at the front portion of the barrier 556. As illustrated in an exemplary embodiment in FIG. 63, the teeth 562 may define a series of outwardly-extending, angled surfaces that meet or join at an apex. As used herein, the term teeth can mean any uniform, non-uniform, continuous, non-continuous, evenly-spaced, or non-evenly-spaced outwardly-extending surfaces that may or may not be angled and that may or may not meet or join at an apex. Additionally, the teeth may define at an apex pointed, blunt, rounded, flat, or polygonal ends, or any other suitable shape. Also, the surfaces that define the shape of the teeth may be flat, convex, concave, smooth or textured, or any other suitable configuration. In an embodiment, the teeth 562 are placed on an extension from the front portion of the barrier 556. The divider 550 also can define a resilient tongue or tab 564. The teeth 562 or other projection can be located on the resilient tab 564. When a force is applied to the resilient tab 564, the teeth 562 or other projection can move in the direction of the force. When the force is removed, the teeth or other projection will move back to their original position. The term projection as used herein can mean a protrusion, resilient tab, tongue, bump, tooth or plurality of teeth, ridge, knob or other projection that extends outwardly. A plurality of teeth can include a plurality of projections where the teeth extend outwardly and can include a plurality of recesses that extend inwardly between the portions of the plurality of teeth that extend outwardly.

Figure 63:
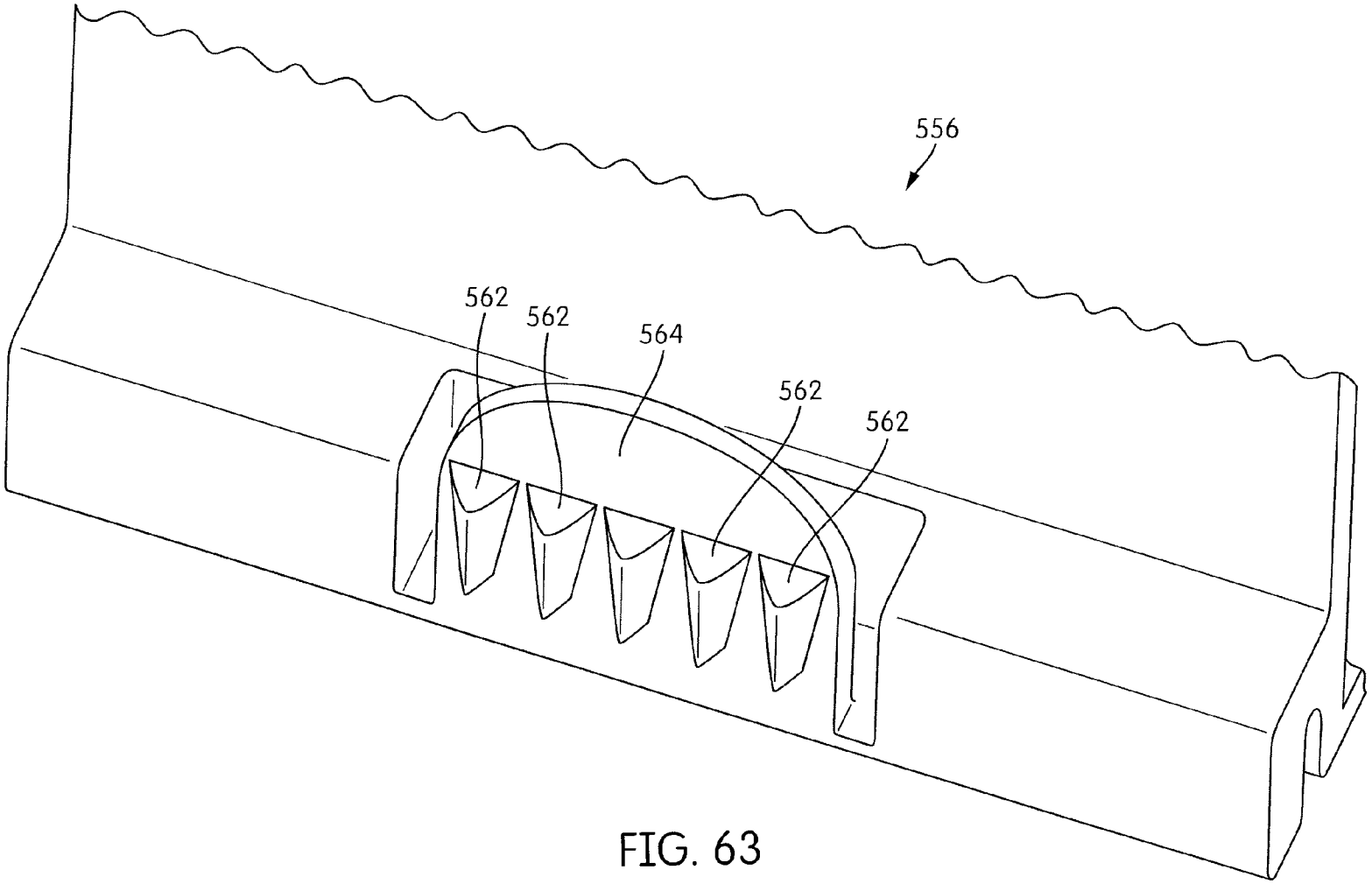
FIG. 63 depicts a partial isometric view of an exemplary front portion of a divider in accordance with one or more aspects of the disclosure.
Figure 65:
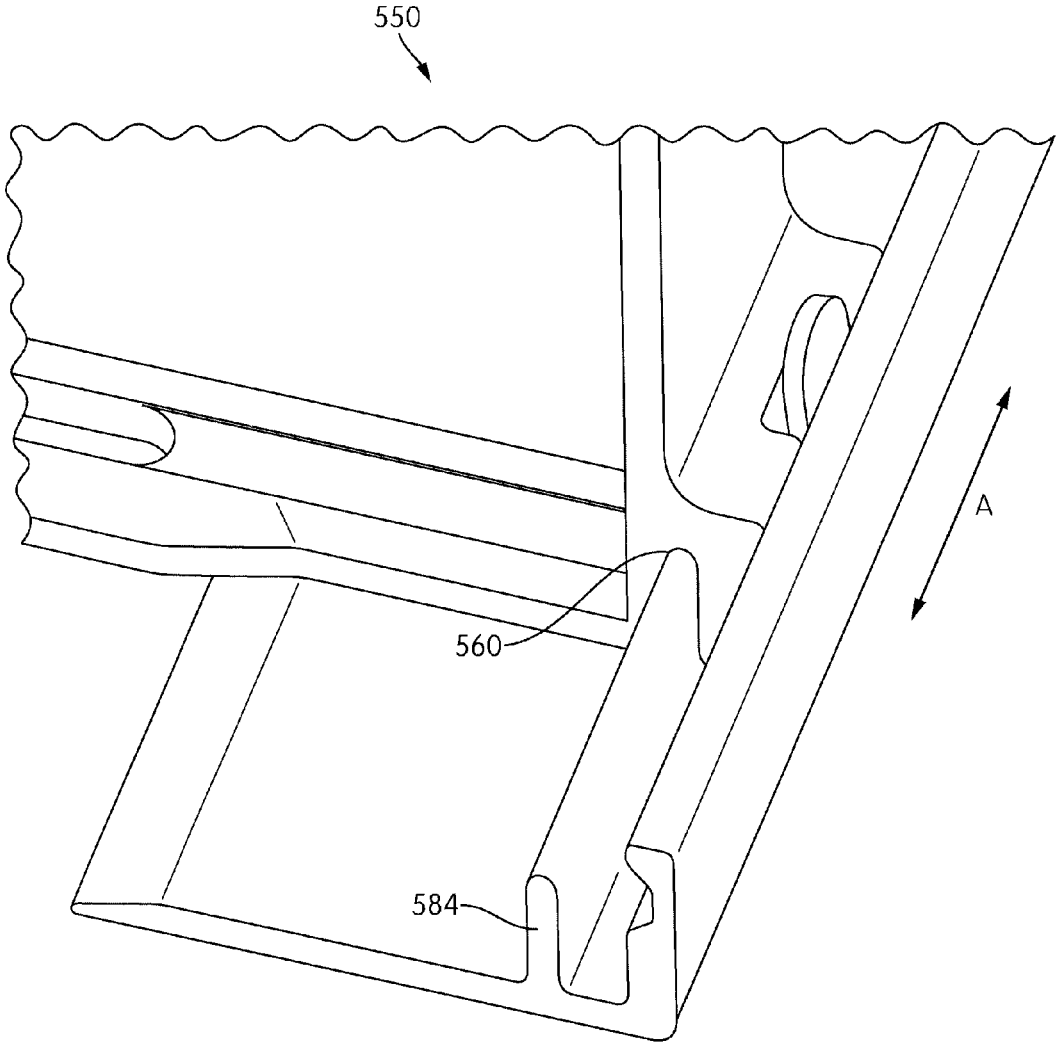
FIG. 65 depicts a partial isometric view of an exemplary connection between a divider and a front rail in accordance with one or more aspects of the disclosure.

A front rail 580 can define a planar surface 582, a ridge or tongue 584 or other projection or engaging member, a channel or groove 586 or other recess or engaging member and a plurality of teeth 588 or other engaging member. The ridge or tongue 584 or other projection or engaging member of the front rail 580 can be configured to engage the groove 560 or other recess or engaging member of the divider. The ridge 584 or other projection or other engaging member can fit within the groove 560 or other recess or engaging member and inhibit the divider 550 from moving in a direction perpendicular to the ridge 584 or front rail 580 or at an angle (i.e., out of perpendicular) to the ridge 584 or front rail 580. The teeth 588 or other engaging member of the front rail 580 can be spaced apart. The teeth 588 or other engaging member of the front rail can engage the teeth 562 or other engaging member of the divider 550, which teeth 562 are illustrated in FIG. 63, so as to prevent the divider from moving in a lateral direction parallel to the front rail 580. The teeth 588 or other engaging member of the front rail 580 are engaged with the teeth 562 or other engaging member of the divider 550 and prevent the divider 550 from moving in the lateral direction shown by arrow "A" in FIG. 65. The term engaging member as used herein can mean a projection, recess, planar surface, near-planar surface, or other item of structure that can engage with another item of structure. The front rail may be a separate structure that is attached or coupled to a shelf. Alternatively, the front rail may be part of a tray that defines one or more of a front, back and opposing side walls. In this configuration, the front rail, as described herein, may be formed as part of a front or back wall of a tray and still achieve the objectives of the invention. That is, the front rail may be formed as part of the tray walls (or attached to the tray walls) and receive and engage the dividers and pusher mechanisms using any of the various techniques described herein. The front rail also need not be located in the absolute front of a shelf. The front rail can be located near the front of the shelf or in a location a distance back from the front of the shelf. In an example, the front rail can be located at or near the rear of the shelf, away from the front of the merchandise display system. The front of the shelf can include no rail in an example.

When the resilient tab 564 of the divider 550 is pressed or a force is placed on the resilient tab in a direction away from the teeth 588 in the front rail 580, the teeth 562 of the divider can become disengaged with the teeth 588 on the front rail. When the teeth 588 on the front rail and the teeth 562 on the resilient tab 564 on the divider 550 are disengaged, the divider 550 can be moved in a lateral direction to the teeth 588 in the front rail 580 (i.e., the direction shown by arrow "A" in FIG. 65). Through the use of this resilient tab 564, products contained on the merchandise system 10 can be replanogrammed. When the divider 550 is moved in a lateral direction, the divider need not be rotated. Instead, the divider 550 remains in a plane parallel to the planar surface 582 of the front rail 580. In addition, the divider 550 need not be lifted. The divider 550 can simply be moved in the direction noted by arrow "A" in FIG. 65.

In an example, a merchandise display system includes a front rail 580 and at least one divider 550 configured to engage the front rail 580. The at least one divider 550 includes a barrier 556 and the at least one divider 550 further includes a divider wall 552. The at least one divider also includes a divider floor 554 perpendicular to the divider wall 552, wherein the divider floor 554 is configured to hold product. The merchandise display system also includes a cam 720 coupled to the divider 550, wherein the cam 720 is configured to move between a first position and a second position. The at least one divider 550 is (a) movable in a lateral direction parallel to the front rail 580 and (b) secured in a direction perpendicular to the front rail 580 when the at least one divider 550 is engaged with the front rail 580 and the cam 720 is in the first position. The at least one divider 550 is (a) fixed in the lateral direction parallel to the front rail 580 and (b) secured in the direction perpendicular to the front rail 580 when the at least one divider 550 is engaged with the front rail 580 and the cam 720 is in the second position.

In an example the cam 720 includes a handle to rotate the cam 720 between the first position and the second position. In another example, the cam 720 can include a handle that allows the cam 720 to slide between a first position and a second position (not shown). The cam 720 also can include one or more cam walls configured to engage one or more groove walls in the front rail 580 when the cam 720 is in the second position. The cam 720 also can include a plurality of cam teeth configured to engage a plurality of front rail teeth on a surface of the front rail 580 when the cam 720 is in the second position. The front rail teeth can be on an inner surface of the front rail 580. The merchandise display system also can include a pusher mechanism having a pusher surface, a pusher floor extending forwardly from the pusher surface, and a coiled spring having a coiled end and a free end. The coiled end of the spring can be positioned behind the pusher surface and the pusher mechanism can be attached to the merchandise display system only by the coiled spring. The barrier can be configured to receive the free end of the coiled spring. The front rail can define a front rail groove and the divider can define a divider ridge configured to engage the front rail groove.

In an example, a merchandise display system includes a front rail 580 and a plurality of dividers 550 configured to attach to the front rail 580 and separate product into rows. Each of the plurality of dividers 550 includes a divider wall 552 extending in a direction perpendicular to the front rail 580, a divider floor 554 perpendicular to the divider wall 552, wherein the divider floor 554 is configured to hold product, and a cam 720 coupled to the divider 550, wherein the cam 720 is configured to move between a first position and a second position. Each of the plurality of dividers 550 is (a) movable in a lateral direction parallel to the front rail 580 and (b) secured in a direction perpendicular to the front rail 580 when each of the plurality of dividers 550 is engaged with the front rail 580 and the cam 720 for each of the plurality of dividers 550 is in the first position. In addition, each of the plurality of dividers 550 is (a) fixed in the lateral direction parallel to the front rail 580 and (b) secured in the direction perpendicular to the front rail 580 when each of the plurality of dividers 550 is engaged with the front rail 580 and the cam 720 for each of the plurality of dividers 550 is in the second position.

In an example, each of the plurality of dividers 550 is configured to move in the lateral direction parallel to the front rail 580 when product is positioned on the divider floor 554. A force on an outermost divider of the plurality of dividers 550 can cause each of the plurality of dividers 550 to move in the lateral direction parallel to the front rail 580 when the cams 720 for each of the plurality of dividers 550 is in the first position, and wherein the force is in a direction parallel to the front rail 580 and perpendicular to the divider wall 552 of the outermost divider.

In an example, a merchandise display system includes a front rail 580 and at least one divider 550 configured to attach to the front rail 580, the at least one divider 550 including a barrier, a divider wall 552 extending in a direction perpendicular to the front rail, a divider floor 554 perpendicular to the divider wall 552, wherein the divider wall 552 separates the divider floor 554 into a first portion and a second portion and each of the first portion and the second portion are configured to hold product. The merchandise display system also includes a first pusher mechanism configured to slide along at least part of the first portion, a second pusher mechanism configured to slide along at least part of the second portion, and a cam 720 coupled to the at least one divider 550, the cam 720 configured to move between a first position and a second position. The at least one divider 550 is movable in a lateral direction parallel to and along the front rail 580 when the cam 720 is in the first position, and the at least one divider 550 resists movement in the lateral direction parallel to and along the front rail 580 when the cam is in the second position.

In an example, each of the first and second pusher mechanisms of the merchandise display system include a pusher surface, a pusher floor extending forwardly from the pusher surface, and a coiled spring having a coiled end and a free end, wherein the coiled end is positioned behind the pusher surface. The first and second pusher mechanisms are attached to the merchandise display system only by the coiled spring. The at least one divider can define a divider engaging member and the at least one front rail can define a front rail engaging member, and the divider engaging member can be configured to engage the front rail engaging member. The divider engaging member can define divider teeth on at least one surface of the divider engaging member and the front rail engaging member can define front rail teeth on at least one surface of the front rail engaging member. The divider teeth can be configured to engage the front rail teeth.

In an example, a merchandise display system includes a front rail 580 and at least one divider 550 configured to attach to the front rail 580, the at least one divider 550 including a barrier configured to engage the front rail 580, a divider wall 552 extending in a direction perpendicular to front rail 580, a divider floor 554 perpendicular to the divider wall 552, wherein the divider floor 554 is configured to hold product. The display system also can include a resilient tab coupled to the divider 550, the resilient tab configured to move between a first position and a second position. The at least one divider 550 is fixed in a lateral direction parallel to the front rail 580 when the resilient tab is in the first position. The at least one divider 550 is movable in the lateral direction parallel to the front rail 580 when the resilient tab is in the second position.

In an example, the divider 550 includes a plurality of teeth configured to engage the front rail 580. The divider teeth can be configured to engage corresponding teeth on the front rail 580. The divider teeth of the merchandise display system can be configured to engage a resilient surface on the front rail 580.

In an example, a merchandise display system includes a front rail 580, the front rail 580 comprising at least one first projection and at least one first recess, and at least one divider 550 configured to attach to the front rail 580, the at least one divider 550 comprising a divider wall 552 and a divider floor 554 perpendicular to the divider wall 552, the at least one divider 550 further comprising at least one second recess and at least one second projection, the at least one second projection of the divider 550 configured to move between a first position and a second position, The at least one divider 550 is (a) movable in a lateral direction parallel to the front rail 580 and (b) secured in a direction perpendicular to the front rail 580 when the at least one first projection of the front rail 580 is engaged with the at least one second recess of the divider 550 and the at least one second projection of the divider 550 is in the first position. The at least one divider 550 (a) resists movement in the lateral direction parallel to the front rail 580 and (b) is secured in a direction perpendicular to the front rail 580 when the at least one first projection of the front rail is engaged with the at least one second recess of the divider 550 and the at least one second projection of the divider 550 is in the second position.

In an example, the at least one second projection of the divider 550 can comprise a cam 720. The at least one first recess of the front rail 580 can comprise a groove. The at least one second projection of the divider 550 can include a resilient tab. The at least one first projection of the front rail 580 can comprise a tongue. The at least one first projection of the front rail 580 can comprise a plurality of teeth. The at least one second projection of the divider 550 can comprise a tongue. The at least one second projection of the divider 550 can include a plurality of teeth. The merchandise display system also can include a plurality of teeth on the at least one first projection of the front rail 580 and a plurality of teeth on the at least one second recess of the divider 550.

In an example, a merchandise display system includes a front rail 580, the front rail 580 including at least one first projection and at least one second projection, the at least one second projection of the front rail 580 configured to move between a first position and a second position. The merchandise display system also includes at least one divider 550 configured to attach to the front rail 580, the at least one divider 550 comprising a divider wall 552 and a divider floor 554 perpendicular to the divider wall 552, the at least one divider 550 further comprising at least one recess. The at least one divider 550 is (a) movable in a lateral direction parallel to the front rail 580 and (b) secured in a direction perpendicular to the front rail 580 when the at least one first projection of the front rail 580 is engaged with the at least one recess of the divider 550 and the at least one second projection of the front rail 580 is in the first position. The at least one divider 550 is (a) fixed in the lateral direction parallel to the front rail 580 and (b) secured in the direction perpendicular to the front rail 580 when the at least one first projection of the front rail 580 is engaged with the at least one recess of the divider 550 and the at least one second projection of the front rail 580 is in the second position.

In an example, the at least one first projection of the front rail 580 can comprise a tongue and the at least one recess of the divider 550 can comprise a groove.

In an example, a merchandise display system includes a front rail 580, the front rail 580 comprising a first projection and a second projection. The merchandise display system also includes at least one divider 550 configured to attach to the front rail 580, the at least one divider 550 comprising a divider wall 552 and a divider floor 554 perpendicular to the divider wall 552, the at least one divider 550 further comprising a recess and a third projection. The at least one of the second projection or the third projection is a movable projection that is movable between a first position and a second position. The at least one divider 550 is (a) movable in a lateral direction parallel to the front rail 580 and (b) secured in a direction perpendicular to the front rail 580 when the first projection of the front rail 580 is engaged with the recess of the divider 550 and the movable projection is in the first position. The at least one divider 550 is (a) fixed in the lateral direction parallel to the front rail 580 and (b) secured in the direction perpendicular to the front rail 580 when the first projection of the front rail 580 is engaged with the recess of the divider 550 and the movable projection is in the second position.

In an example, the movable projection of the merchandise display system can be a cam 720 or a resilient tab. The first projection of the front rail 580 can be a tongue and the recess of the divider 550 can be a groove.

In an example, a merchandise display system includes a front rail 580, the front rail 580 comprising at least a first engaging member. The merchandise display system also includes at least one divider 550 configured to attach to the front rail 580, the at least one divider 550 comprising a divider wall 552 and a divider floor 554 perpendicular to the divider wall, the at least one divider 550 further comprising at least a second engaging member. The merchandise display system also includes a third engaging member configured to move between a first position and a second position. The at least one divider 550 is (a) movable in a lateral direction parallel to the front rail 580 and (b) secured in a direction perpendicular to the front rail 580 when the first engaging member of the front rail 580 is engaged with the second engaging member of the divider 550 and the third engaging member is in the first position. The at least one divider 550 is (a) fixed in the lateral direction parallel to the front rail and (b) secured in the direction perpendicular to the front rail 580 when the first engaging member of the front rail 580 is engaged with the second engaging member of the divider 550 and the third engaging member is in the second position. In an example, when the first engaging member of the front rail 580 is engaged with the second engaging member of the divider 550 and the third engaging member is in the first position, the at least one divider 550 is movable in the plane of a shelf (such as shelf 596 shown in FIGS. 70 and 71) only in the lateral direction parallel to the front rail 580; the at least one divider 550 is fixed in the plane of the shelf in all directions other than the direction parallel to the front rail 580; the at least one divider 550 may not twist, splay of fish tail in the plane of the shelf; the at least one divider 550 remains perpendicular to the front rail 580.

In an example, the third engaging member can be a portion of the front rail 580 or a portion of the divider 550. In an example, the third engaging member can comprise a cam 720 or an engaging surface. In an example, the first engaging member of the front rail 580 is a projection. The merchandise display system also can include a pusher mechanism 520 having a pusher surface 528, a pusher floor 524 extending forwardly from the pusher surface 528, and a coiled spring 534 having a coiled end and a free end. The coiled end can be positioned behind the pusher surface 528 and the pusher mechanism 520 is attached to the merchandise display system only by the coiled spring 534. The merchandise display system also can include a barrier that is configured to receive the free end of the coiled spring 534.

In an example, a merchandise display system includes a front rail 580 and at least one divider 550 configured to engage the front rail 580, the at least one divider 550 including a barrier 556, the at least one divider further including a divider wall 554, the at least one divider further including a divider floor 552 perpendicular to the divider wall 554, wherein the divider floor 552 is configured to hold product. The merchandise display system also includes a cam 720 coupled to the divider 550, wherein the cam 720 is configured to move between a first position and a second position. The at least one divider 550 can be secured in a direction perpendicular to the front rail 580 when the at least one divider 550 is engaged with the front rail 580. The cam 720 can inhibit movement of the at least one divider 550 in the lateral direction parallel to the front rail 580 when the cam 720 is in the first position. The cam 720 can allow movement of the divider 550 in the lateral direction parallel to the front rail 580 when the cam 720 is in the second position. The merchandise display system can include a handle to rotate the cam 720 between the first position and the second position. The merchandise display system can include a handle to slide the cam 720 between the first position and the second position (not shown).

Figure 64:
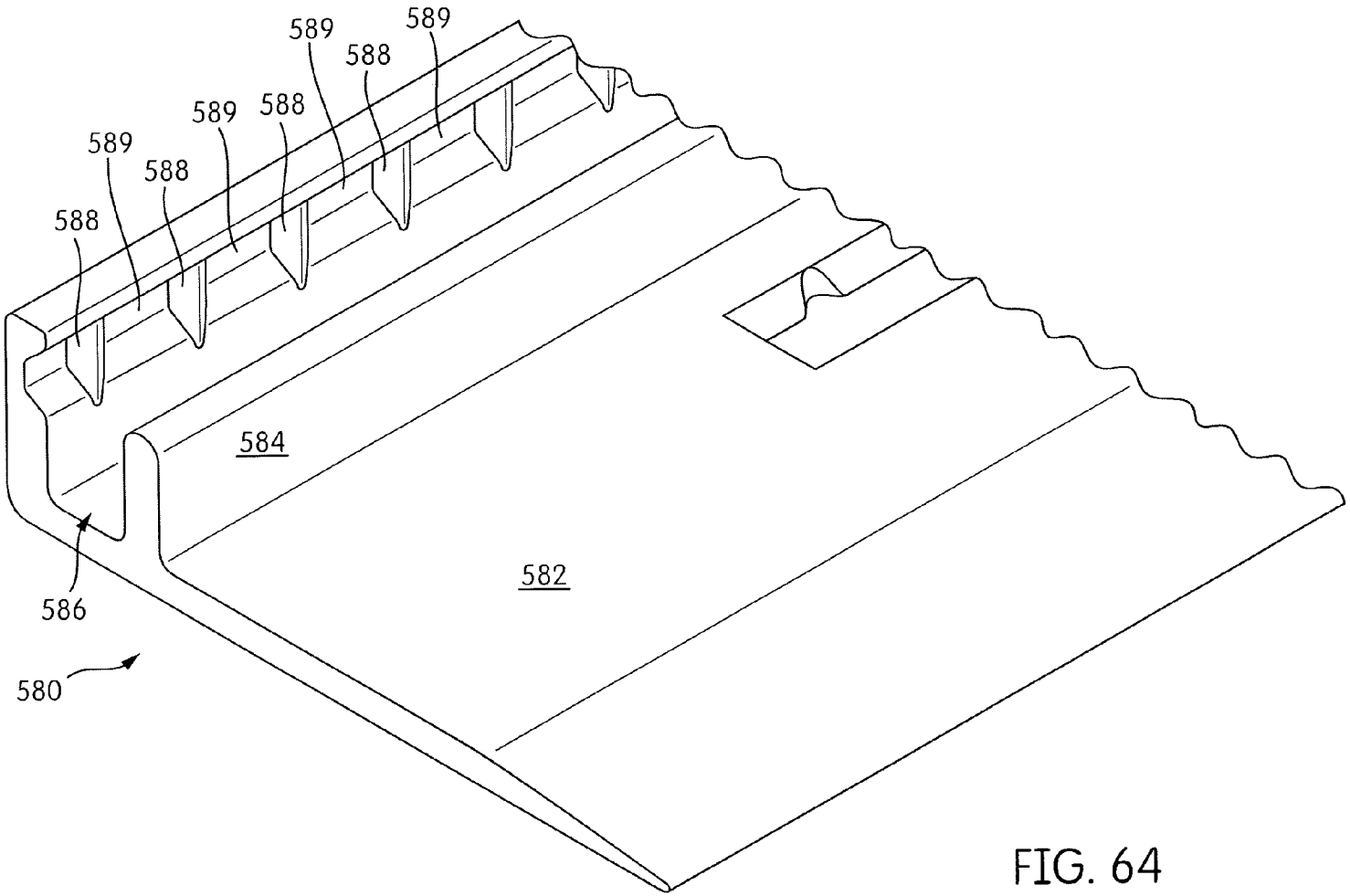
FIG. 64 depicts a partial isometric view of an exemplary front portion of a front rail in accordance with one or more aspects of the disclosure.
Figure 67A:
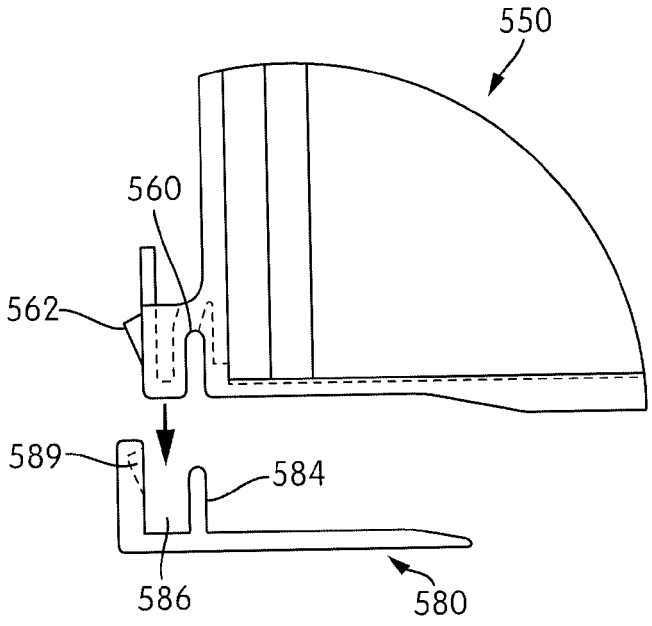
FIGS. 67A-C depict side views of an exemplary divider attaching to a front rail in accordance with one or more aspects of the disclosure.
Figure 67B:
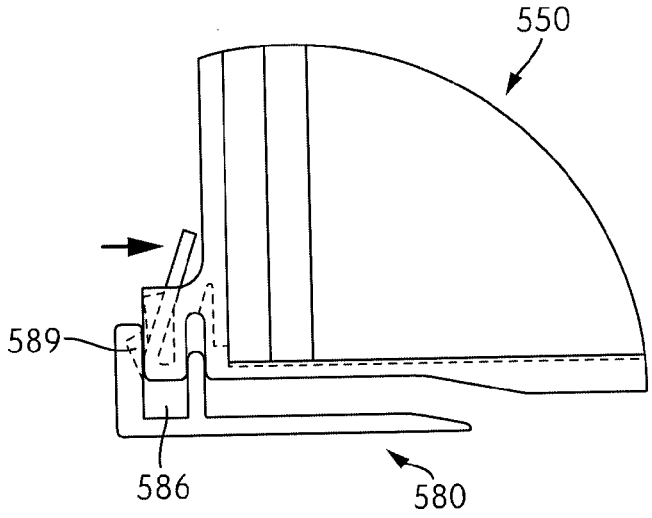
Figure 67C:
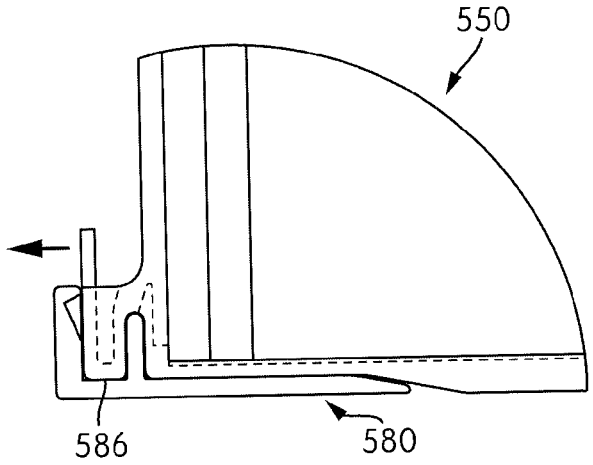

FIGS. 67A-C show an example of a step by step approach to placement of a divider into a front rail. To begin, as illustrated in FIG. 67A, the divider 550 is lowered into the channel 586 defined by the front rail 580. The force of lowering the divider 550 into the channel 586 causes the teeth 562 on the divider 550 to contact the top of the front rail 580 and move in a direction toward the divider 550 and away from the front rail 580, as illustrated in FIG. 67B. The teeth 562 on the divider 550 may be ramped teeth as shown in FIG. 63. The front rail 580 includes recesses 589, as illustrated in FIG. 64, that are shaped to engage the teeth 562 on the divider 550. These recesses 589 are spaced by the teeth 588 present on the front rail 580. When the divider 550 is lowered further into the channel 586 on the front rail 580, as illustrated in FIG. 67C, the teeth 564 of the divider 550 move past the top of the front rail 580 and move into the recesses 589 in the front rail 580. When the teeth 564 on the divider 550 are in the recesses 589 in the front rail 580, the divider 550 is in an engaged position and will not move in a lateral direction under a normal amount of force.

Figure 68A:
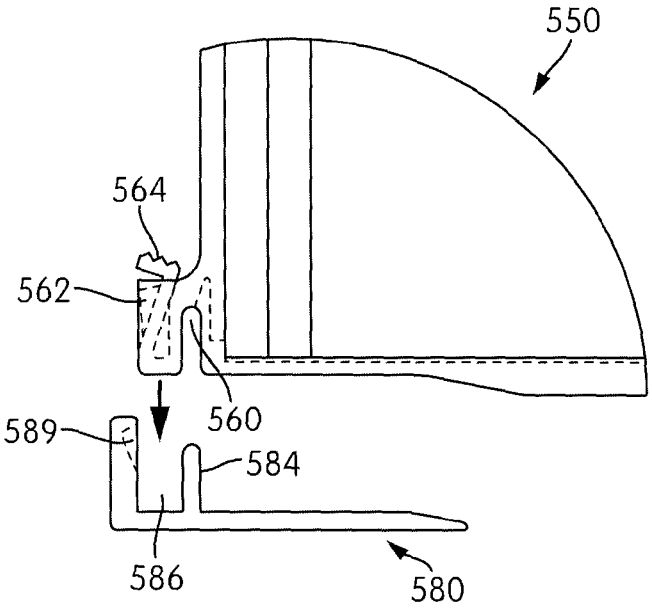
FIGS. 68A-C depict side views of an exemplary divider attaching to a front rail in accordance with one or more aspects of the disclosure.
Figure 68B:
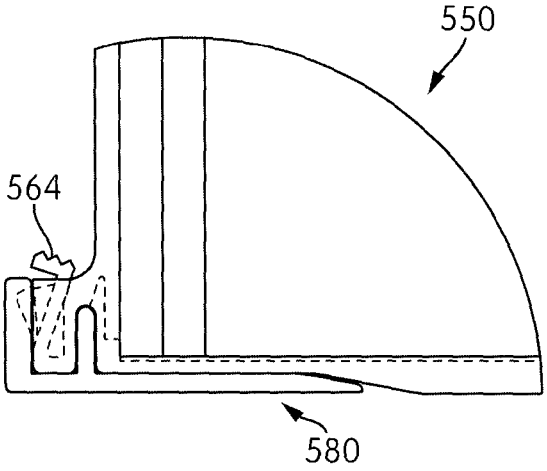
Figure 68C:
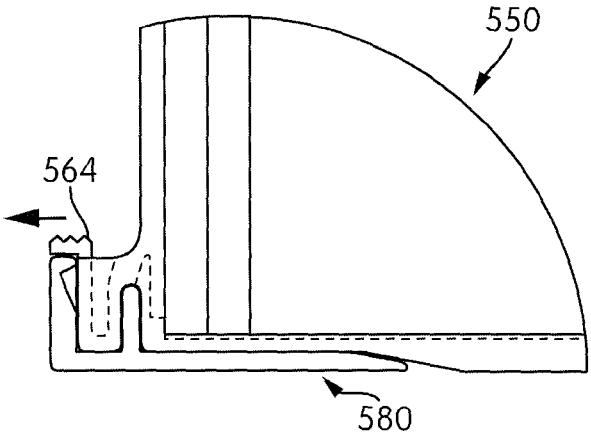

In an example, FIGS. 68A-C show a step by step approach to placement of a divider in a front rail in another embodiment. In the initial step, as illustrated in FIG. 68A, the resilient tongue or tab 564 is manually pushed backward causing the teeth 562 on the tab 564 to move backward toward the divider 550. An axle style pivot allows for the resilient tongue or tab 564 to remain in the pushed back position and allows the teeth 562 to remain in the position toward the divider 550. The divider 550 is then placed in contact with the front rail 580, as illustrated in FIG. 68B. The groove 560 of the divider 550 engages the ridge or tongue 584 of the front rail 580. At this point the divider 550 can be moved in a lateral direction along the front rail and can allow for ease of replanogramming. However, the divider 550 is secured in a direction perpendicular to the front rail 580 (i.e., parallel to the divider 550) and cannot be moved in this direction, other than for an insignificantly small amount of play between the grove 560 of the divider 550 and the ridge or tongue 584 of front rail 580. (The direction perpendicular to the front rail is noted by arrow "B" in FIG. 86H.) This insignificantly small amount of play may not be noticeable to a user of the system. While the divider 550 is in contact with the front rail 580 and the groove 560 of the divider 550 engages the ridge or tongue 584 of the front rail 580, as illustrated in FIG. 68B, the divider 550 can move in the plane of the shelf (the shelf is noted as 596 in FIGS. 70 and 71) only in the lateral direction parallel to the front rail 580 (i.e., the direction noted by arrow "A" in FIG. 65). The divider is fixed and immovable in the plane of the shelf under normal operating forces in all other directions other than the direction parallel to the front rail 580. The divider cannot twist, splay, fish tail or otherwise move in the plane of the shelf in a direction other than the direction parallel to the front rail 580. The divider 550 may, however, be able to move in a direction out of the plane of the shelf, such as the direction noted by arrow "C" in FIG. 87B. The divider 550, with or without product on the divider floor 554, can be slid in the direction previously noted by arrow "A" in FIG. 65, without requiring that the divider 550 be lifted up. In the final step, as illustrated in FIG. 68C, the resilient tongue or tab 564 is manually pulled forward away from the divider 550. This movement causes the teeth 562 on the front divider 550 to fit within recesses 589 in the front rail 580. The recesses 589 in the front rail 580 are spaced by teeth 588 in the front rail. When the teeth 562 of the divider 550 are in contact with the recesses 589 and teeth 588 in the front rail 580, the divider 550 is engaged and cannot move in a lateral direction under a normal amount of force.

In another example, the resilient tongue or tab does not include an axle style pivot that allows for the resilient tongue or tab 564 to remain in the pushed back position. Instead, the resilient tongue or tab 564 is biased toward the front rail 580 and away from the divider 550 such that the tongue or tab 564 automatically returns to its resting position and may engage the front rail 580 when the force manually pushing the resilient tongue or tab 564 backward is removed.

In an example, a divider 550 is placed in contact with a front rail 580. An engaging member of the front rail 580 engages with an engaging member of the divider 550, which secures the divider in a direction perpendicular to the front rail 580 (the direction noted by arrow "B" in FIG. 86H) and renders the divider 550 immovable in a direction perpendicular to the front rail 580, other than for an insignificantly small amount of play or space between the engaging members that may not be noticeable to a user. The divider 550 also is secured in the plane of the shelf in all directions other than the direction parallel to the front rail 580 (the direction noted by arrow "A" in FIG. 65). The divider 550 can move in the plane of the shelf only in the direction parallel to the front rail 580. The divider 550 is fixed, under normal operating forces and conditions, in the plane of the shelf in a direction other than the direction parallel to the front rail 580. The divider, however, may be movable in a direction out of the plane of the shelf, such as a direction noted by arrow "C" in FIG. 87B. When the divider is "secured" in a direction perpendicular to the front rail 580, this means that the divider 550 is immovable, under normal operating forces and conditions, in a direction perpendicular to the front rail 580, other than for an insignificantly small amount of play or space between the engaging members that may not be noticeable to a user. The direction perpendicular to the front rail is noted by arrow "B" in FIG. 86H. A second engaging member of the front rail 580 or the divider 550 is in a first position and the divider is moved laterally, parallel to the front rail. The second engaging member is then moved to a second position, which makes the divider 550 fixed in a lateral direction parallel to the front rail 580 (the direction noted by arrow "A" in FIG. 65) under normal operating conditions and forces. When the divider 550 is "fixed" in a lateral direction parallel to the front rail 580, the divider 550 will not move in the lateral direction parallel to the front rail 580 under normal operating conditions and forces.

Figure 86A:
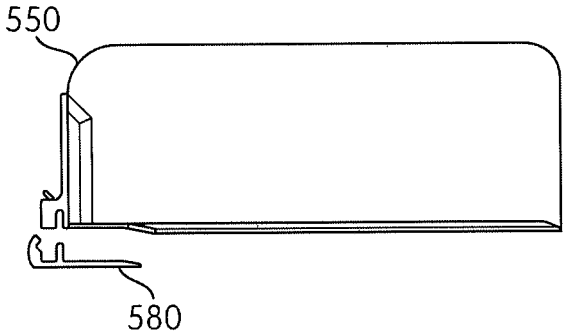
FIGS. 86A-L depict views of components of an exemplary product management display system in accordance with one or more aspects of the disclosure.
Figure 86B:
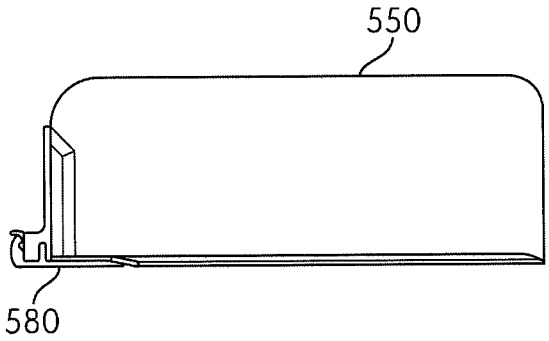
Figure 86C:
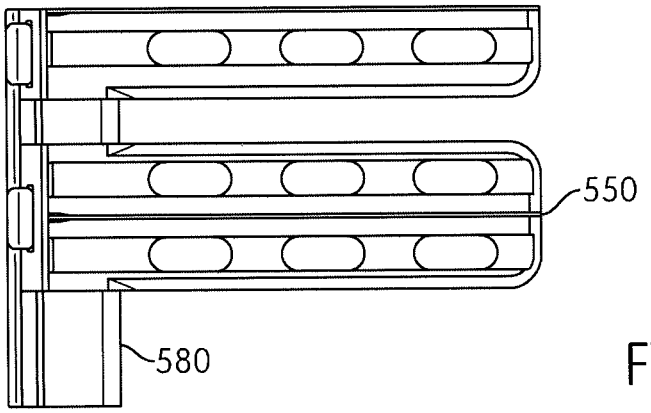
Figure 86D:
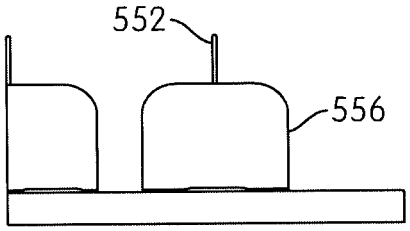
Figure 86E:
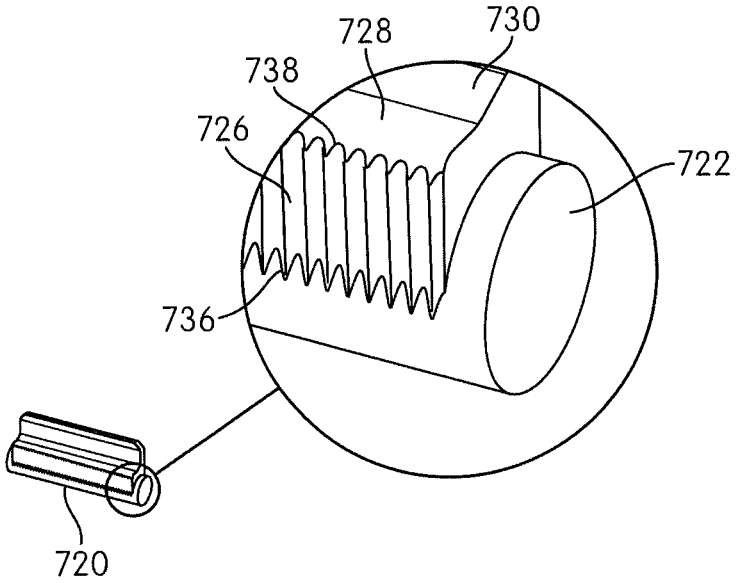
Figure 86F:
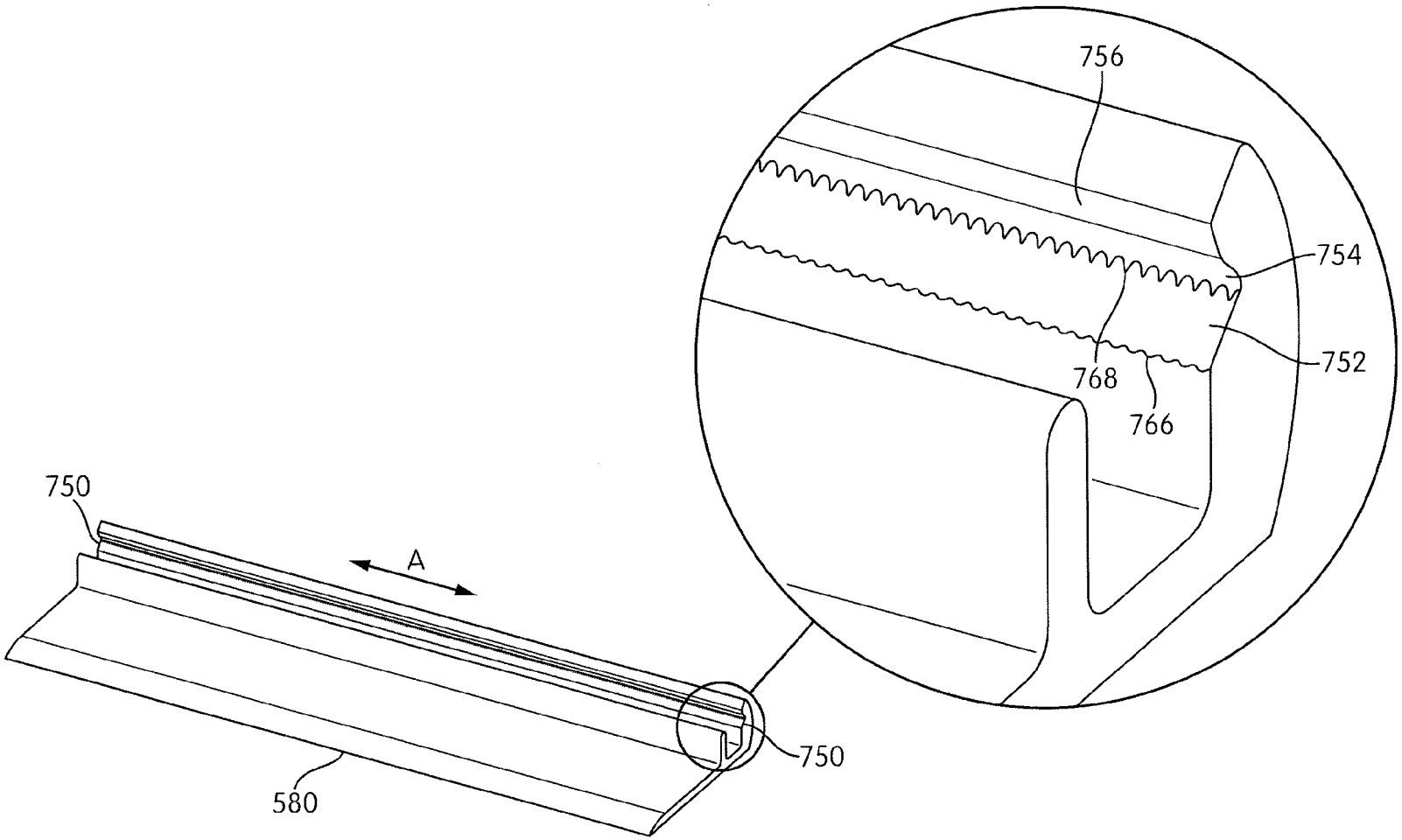
Figure 86G:
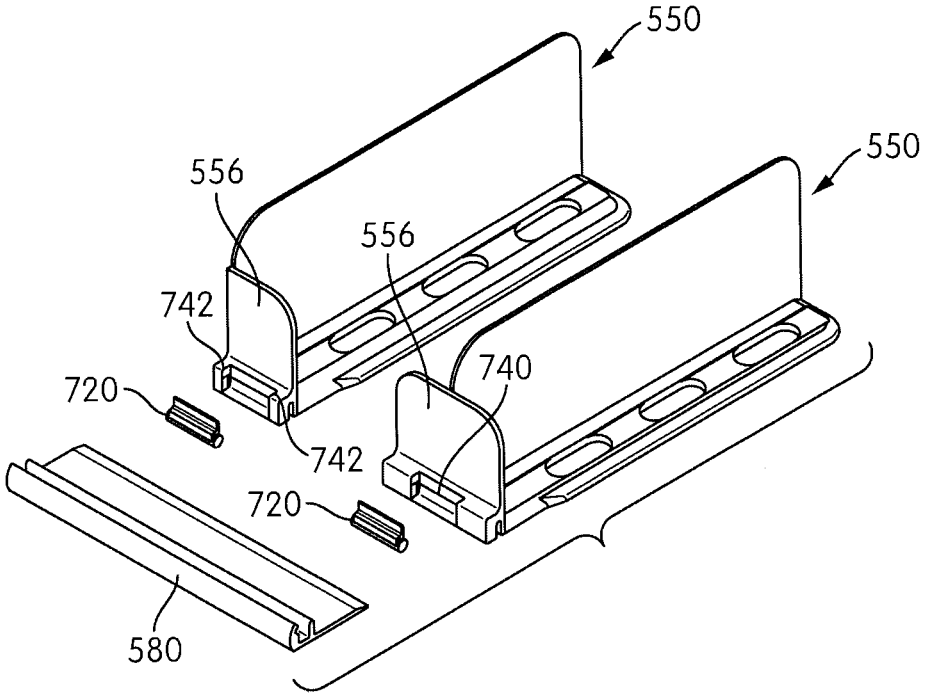
Figure 86H:
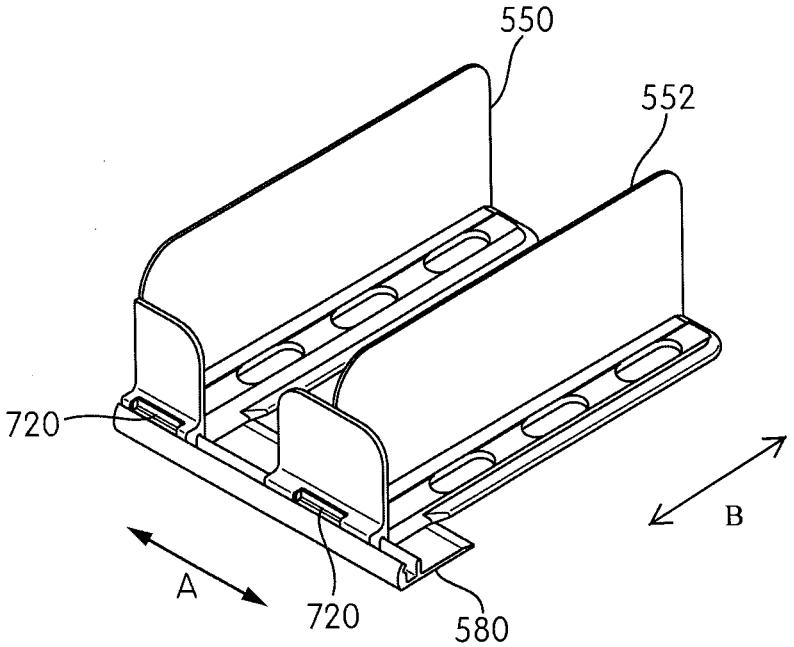

In an example, a plurality of dividers 550 can be moved as a group parallel to the front rail 580 while remaining secured to the front rail 580 in a direction perpendicular to the front rail (the direction noted by arrow "B" in FIG. 86H). Each of a plurality of dividers 550 can be placed in contact with a front rail 580. An engaging member or a plurality of engaging members of the front rail 580 engage(s) with an engaging member on each of the plurality of dividers 550, which secures each of the plurality of dividers 550 in a direction perpendicular to the front rail 580 (the direction noted by arrow "B" in FIG. 86H) and renders each of the plurality of dividers 550 immovable in a direction perpendicular to the front rail 580, other than for an insignificantly small amount of play or space between the engaging members that may not be noticeable to a user. A second engaging member (or a plurality of second engaging members) of the front rail 580 or each of the dividers 550 is in a first position, which allows the plurality of dividers 550 to be moved laterally, parallel to the front rail 580. The plurality of dividers 550 can form rows between the dividers 550 that are configured for holding product. Product can be placed between two of the plurality of dividers 550 as shown in FIGS. 45-47. A force can be applied to a first divider in the direction parallel to the front rail 580. This force can move the first divider in the direction parallel to the front rail 580 and cause the divider 550 to contact a product adjacent the first divider 550. (Product is shown in FIGS. 45-47 as cans or cartons and can take other shapes.) The divider 550 then can force the product to move in the same direction as the first divider 550, i.e., parallel to the front rail 580. The force can move the product to come in contact with a second divider 550 adjacent the product. The product can then force the second divider 550 to move in the same direction as the first divider 550 and the product, i.e., parallel to the front rail 580. The second divider can then force a second product adjacent the second divider 550 to move in a direction parallel to the front rail 580. The second product can force a third divider 550 adjacent the second product to move in a direction parallel to the front rail 580. In this manner, a series of dividers 550 and products all can be moved in a direction parallel to the front rail 580 with a single force acting on only one of the dividers 550 or products in a direction parallel to the front 580. When the second engaging member or members on the front rail 580 or one of the plurality of dividers 550 is moved to a second position, which makes the divider 550 fixed in a lateral direction parallel to the front rail 580 under normal operating conditions and forces, the divider 550 cannot move in the direction parallel to the front rail 580 and the divider 550 will not force other dividers 550 or products to move in a direction parallel to the front rail 580.

In an example, when the second engaging member is moved to a second position, the second engaging member inhibits movement of the divider 550 in a lateral direction parallel to the front rail 580. Under a force equal to or less than a predefined amount of force, the second engaging member prevents the divider 550 from moving in a lateral direction parallel to the front rail 580. When an amount of force above the predefined amount of force is applied to the divider 550 in the lateral direction parallel to the front rail 580, the divider 550 can move in the lateral direction parallel to the front rail 580.

Figure 66:
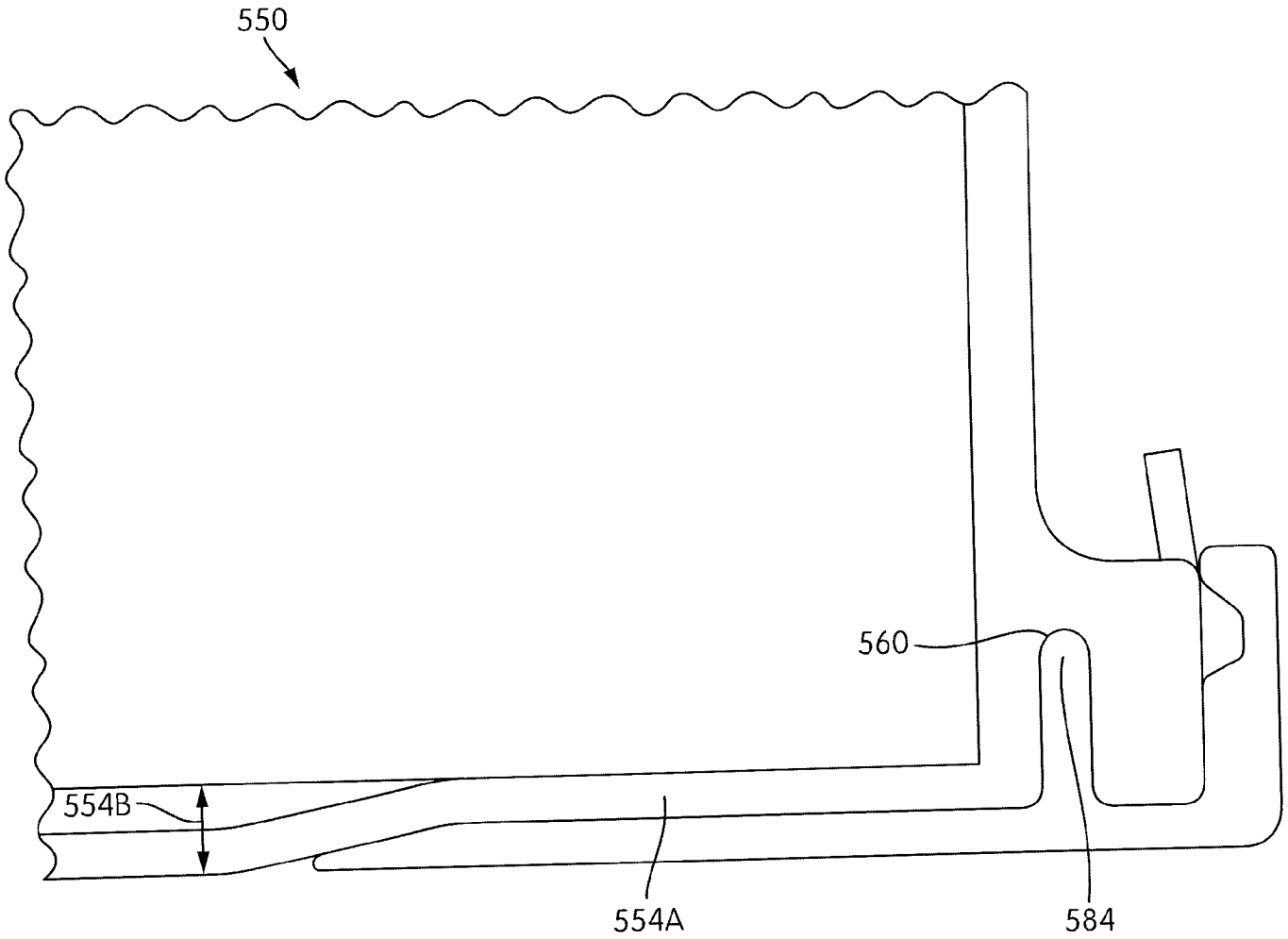
FIG. 66 depicts a side view of an exemplary divider and front rail in accordance with one or more aspects of the disclosure.

In an embodiment as illustrated in FIG. 66, the thickness of the divider floor 554 varies. The thickness of a front portion of the divider floor 554 where it is adjacent the planar surface 582 of the front rail is less than the thickness of a rear portion of the divider floor 554 further back, where it is not adjacent the planar surface 582 of the front rail. As shown in FIG. 67, the portion of divider floor 554A is thinner than the portion of divider floor 554B. In an example, the thickness of the front portion of the divider floor adjacent the planar surface 582 of a front rail 580 is at least 25% less than the thickness of a rear portion of the divider floor 554 that is non-adjacent the planar surface 582 of the front rail 580.

Figure 69A:
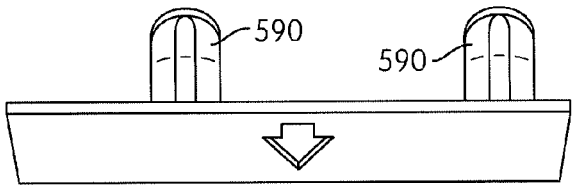
FIG. 69A depicts an isometric view of exemplary rail mounting clips for a front rail in accordance with one or more aspects of the disclosure.
Figure 69B:
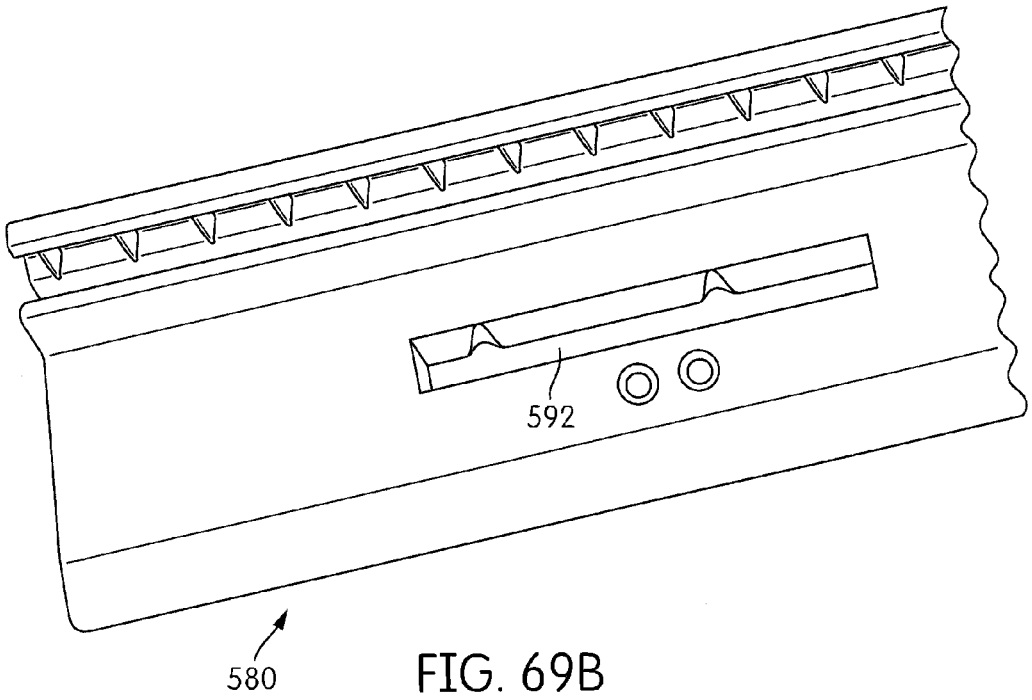
FIG. 69B depicts an isometric view of an exemplary front rail in accordance with one or more aspects of the disclosure.
Figure 70:
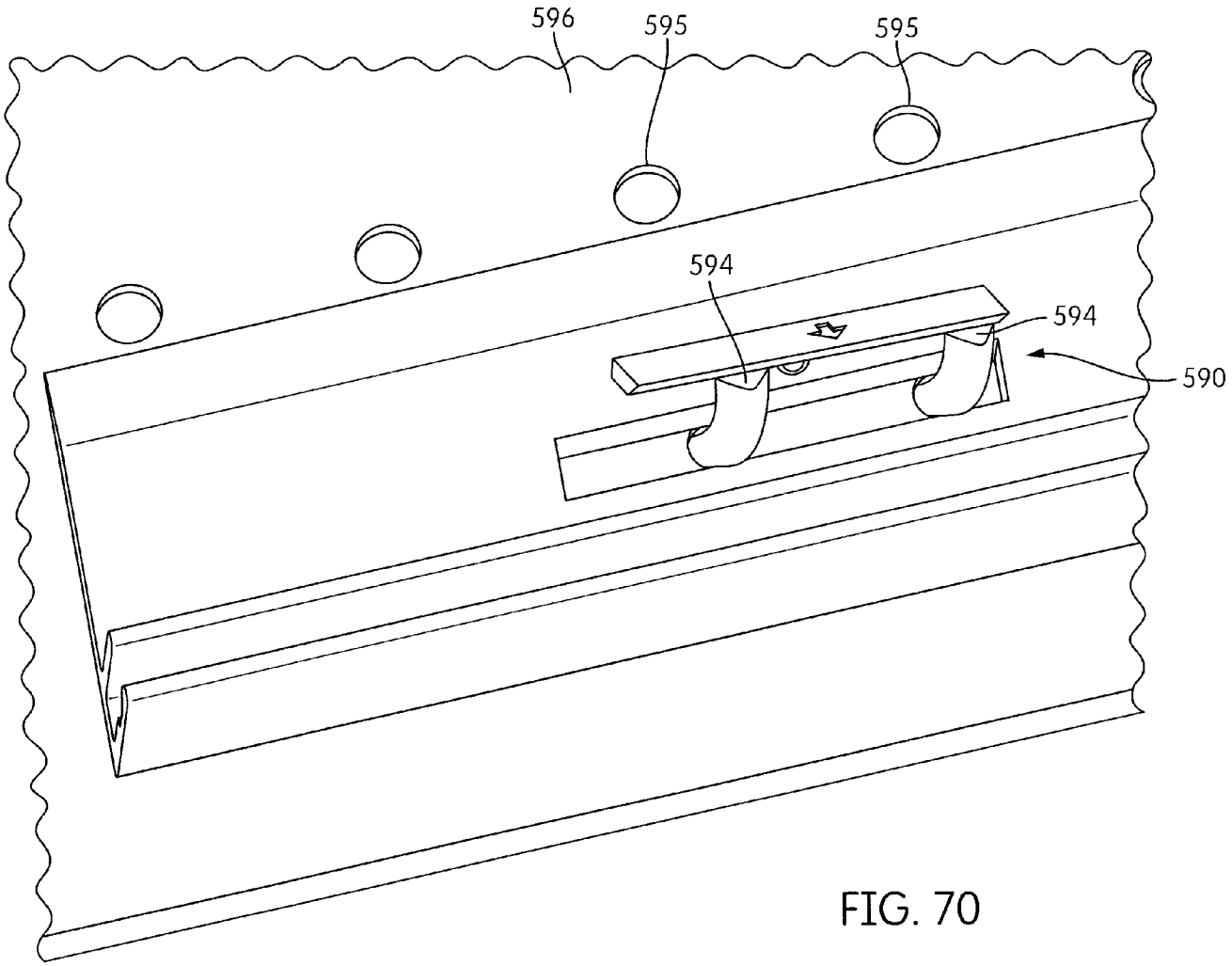
FIG. 70 depicts an isometric view of an exemplary front rail and rail mounting clips in accordance with accordance with one or more aspects of the disclosure.
Figure 71:
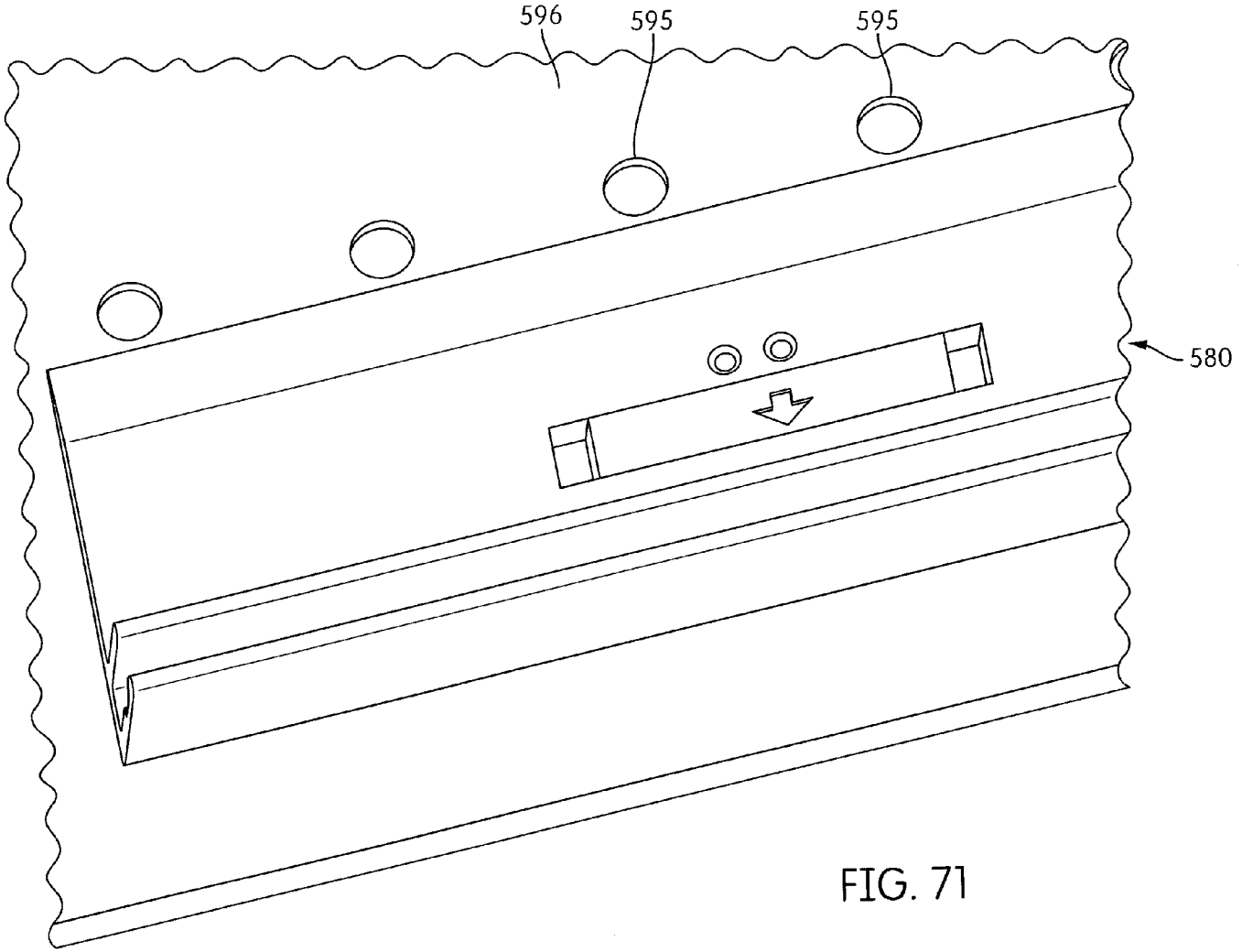
FIG. 71 depicts an isometric view of an exemplary front rail in accordance with one or more aspects of the disclosure.

An embodiment, as illustrated in FIGS. 69A and 69B, includes rail mounting clips 590 for the front rail 580. As illustrated in FIG. 69B, the front rail 580 includes an aperture 592. This aperture 592 can be coordinated to be placed over apertures 595 on a shelf 596 in a retail environment as shown in FIG. 70. The rail mounting clips 590 can be curved. The rail mounting clips 590 also contain a narrow portion 594 at one end of the rail mounting clips 590. The rail mounting clips 590 can be inserted into the wider, round portion of the aperture 592 in the front rail 580 and into apertures 595 on the shelf 596 in the retail environment as shown in FIG. 71. The rail mounting clips 590 can then be shifted laterally to a narrower portion within the aperture 592 in the front rail 580. By shifting the rail mounting clips 590, the wider round portion of the rail mounting clips 590 will engage the narrower portion of the aperture 592 in the front rail and will be locked into place. The rail mounting clips 590 thereby hold the front rail 580 in place and prevent the front rail 580 from movement in the lateral direction. If it is known prior to shipping that a store shelf will have holes, the rail mounting clips 590 can be inserted and locked into the front rail 580 in advance of shipping. Inserting the rail mounting clips 590 in advance of shipping can add to ease of installation of the merchandise system in the store environment.

Figure 72:
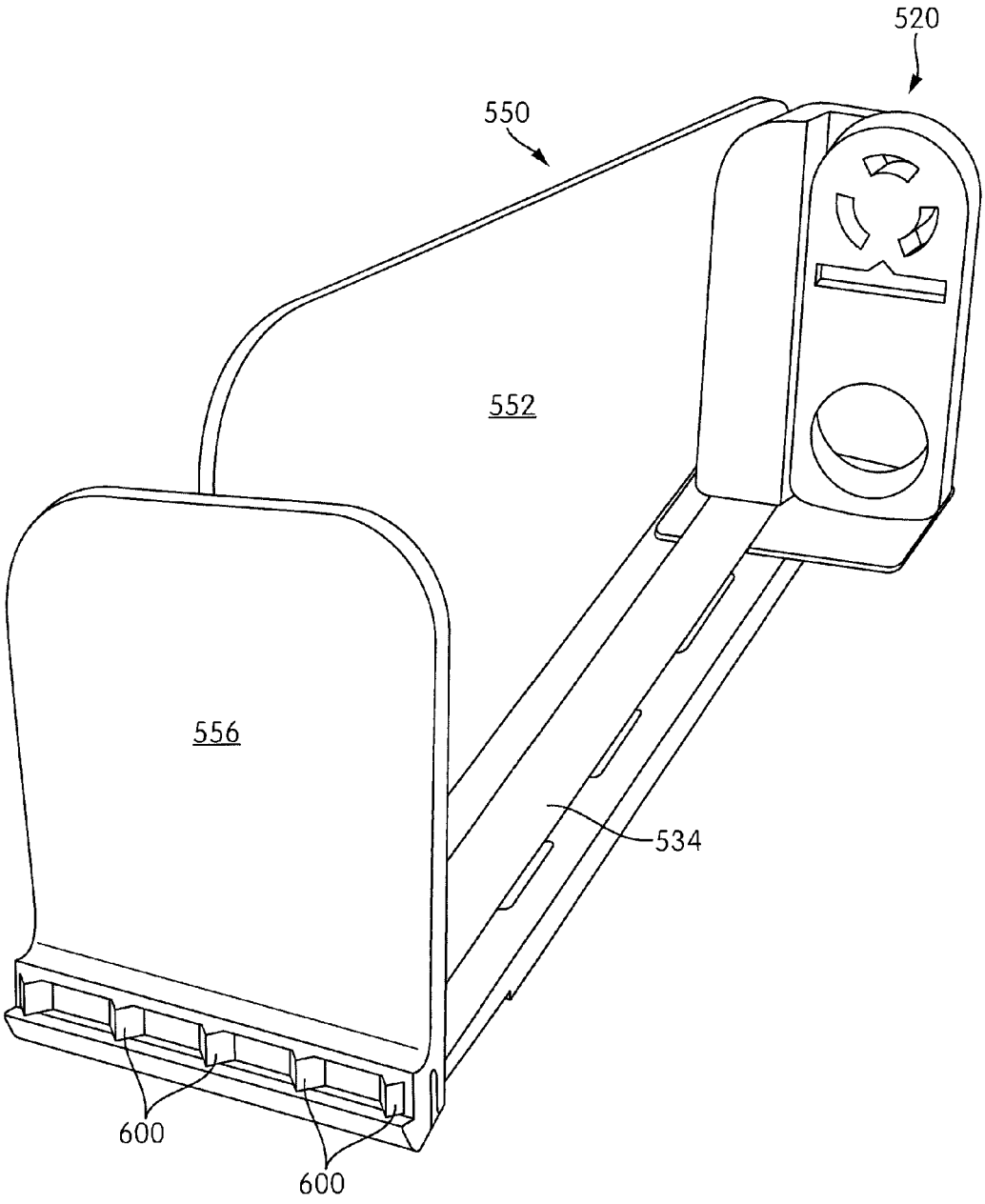
FIG. 72 depicts an isometric view of an exemplary divider and pusher mechanism in accordance with one or more aspects of the disclosure.
Figure 73:
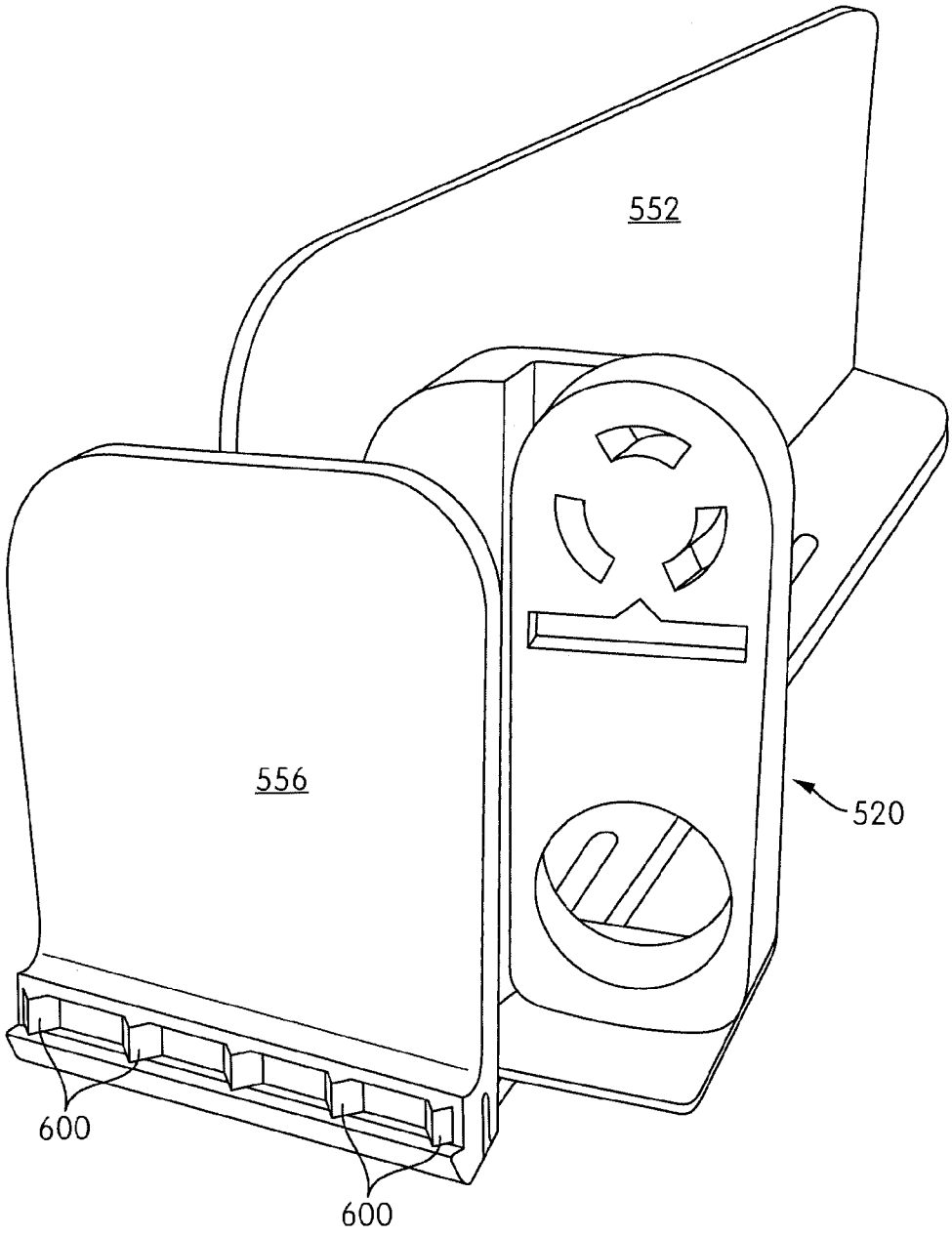
FIG. 73 depicts an isometric view of an exemplary divider and pusher mechanism in accordance with one or more aspects of the disclosure.
Figure 74:
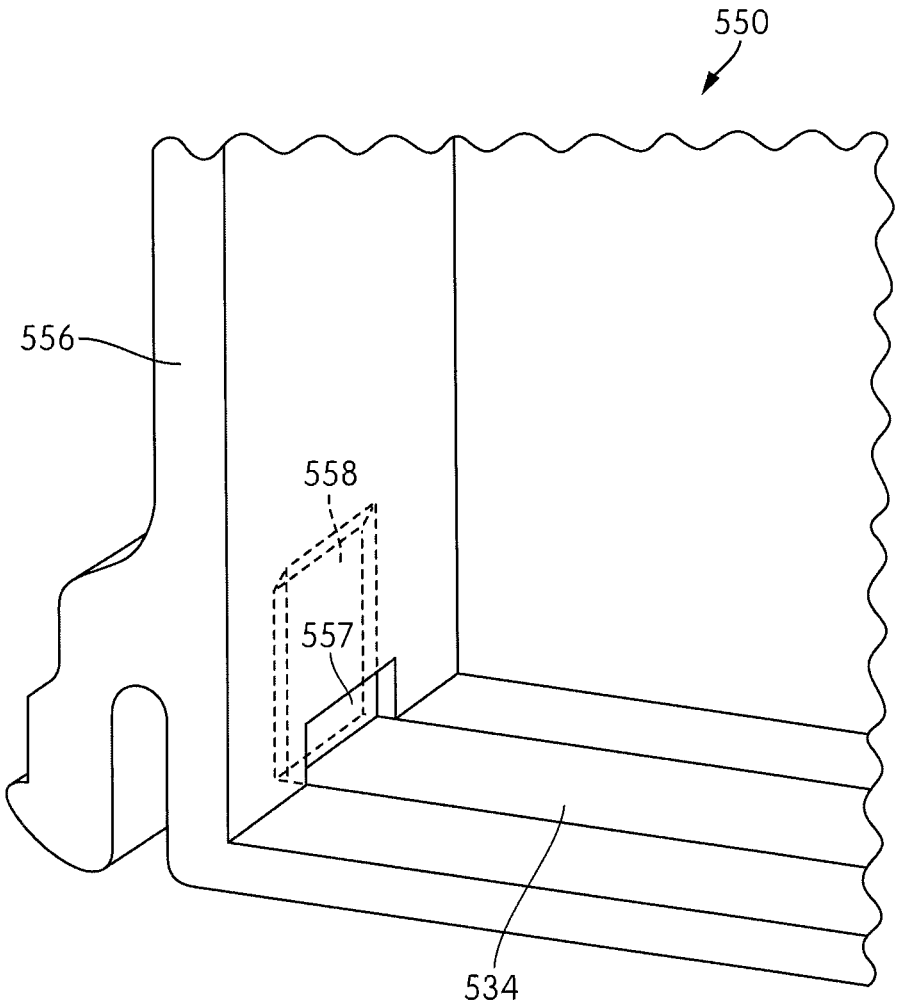
FIG. 74 depicts a partial isometric view of an exemplary divider in accordance with one or more aspects of the disclosure.

In at least one embodiment, the height of the divider wall 552 may be greater than the height of the barrier 556, as shown in FIGS. 72 and 73. FIG. 74 further displays the end 557 of the coiled spring 534 maintained within the barrier 556. The end 557 of the spring 534 is bent at an angle of approximately 90 degrees to the remainder of the spring body 534. The end 557 is placed within a slot 558 maintained within the barrier 556.

In an embodiment, the divider 550 contains teeth 600, as illustrated in FIGS. 72 and 73. These teeth can be molded to be integral with the divider 550. The teeth 600 are not maintained on a resilient tab or tongue as in other embodiments. The teeth 600 are spaced apart from each other. A plurality of teeth 600 can be placed on the divider 550 at the bottom of a front portion of the divider 550 and in front of the barrier 556.

Figure 75:
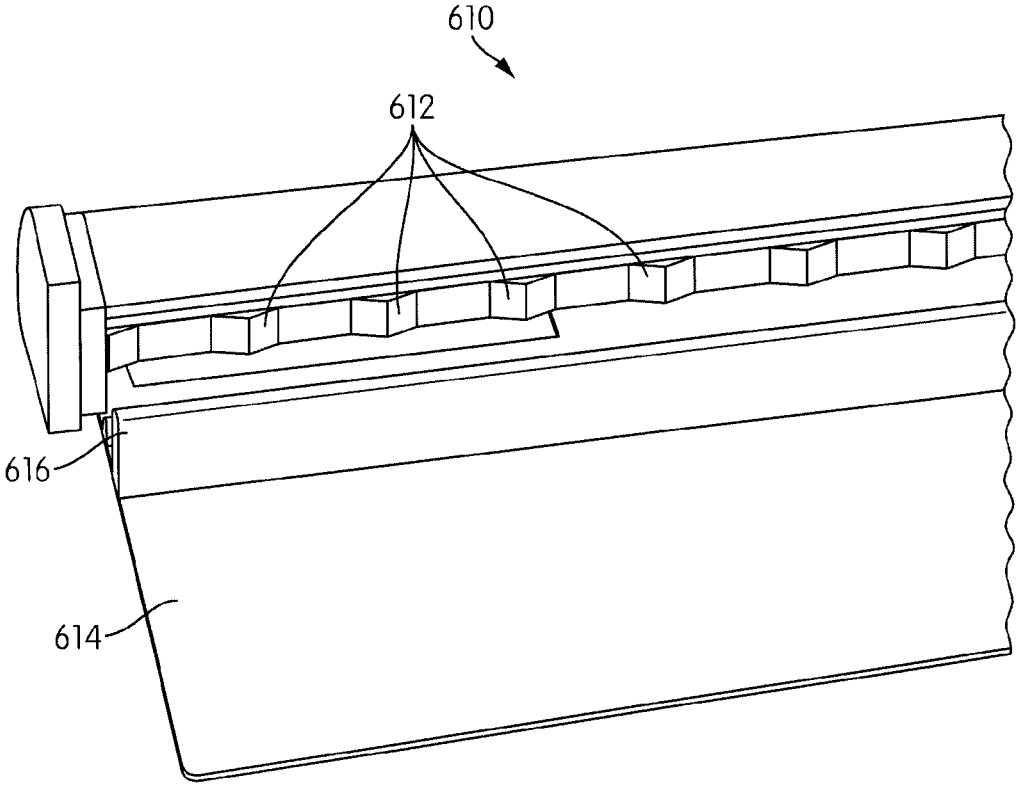
FIG. 75 depicts a partial isometric view of an exemplary front rail in accordance with one or more aspects of the disclosure.
Figure 76A:
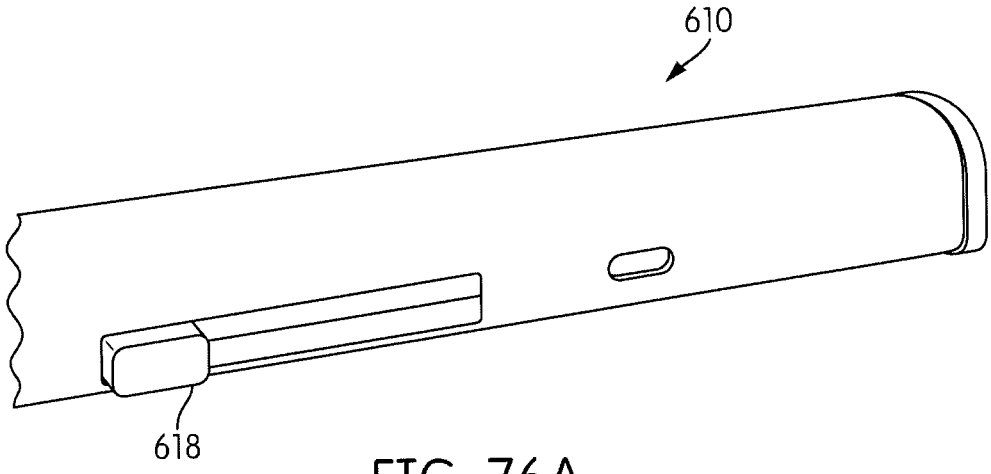
FIGS. 76A and 76B depict partial isometric views of an exemplary front rail and a cam bar lever in accordance with one or more aspects of the disclosure.
Figure 76B:
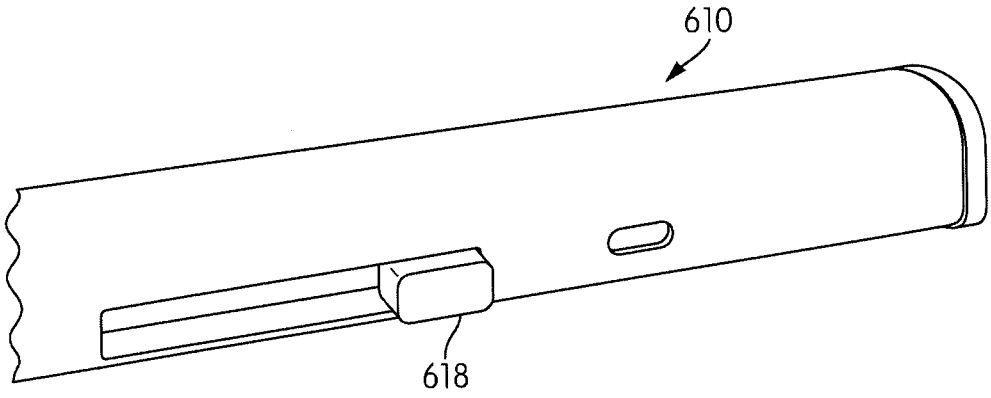

As illustrated in FIG. 75, a front rail 610 can include a plurality of teeth 612. The teeth 612 in the front rail 610 can be designed to releasably engage the teeth 600 of the divider 550 through use of a cam bar 622 in the front rail 610 and camming action, as illustrated in FIG. 76. The front rail 610 also includes a planar surface 614 that is substantially flat or planar and a tongue or ridge 616 that is substantially perpendicular to the planar surface 614, as illustrated in FIG. 75. The front rail 610 further includes a cam bar lever 618 that moves the cam bar 622 within the front rail 610, as shown in FIGS. 76A and 76B. In FIG. 76A, the cam bar lever 618 is in a first position in which the teeth 612 of the front rail 610 are withdrawn into the front rail 610 away from the divider. In FIG. 76B, the cam bar lever 618 is in a second position in which the teeth 612 of the front rail 610 are extended toward the divider 550.

FIG. 77 shows an exploded view of several aspects of an embodiment. Front rail 610 is shown to include an extruded shell 620, a cam bar 622 and a tooth bar 624. The tooth bar 624 contains a plurality of teeth 612. The extruded shell 620 includes a cam area 626 designed to house the cam bar 622 and the tooth bar 624. The cam bar 622 is located on the base of the front rail 610 adjacent to the extruded shell 620. The cam bar 624 is in contact with the cam bar lever 618. The cam bar lever 618 can operate to move the cam bar 622 back and forth in a lateral direction. The cam bar 622 further includes elongated cam reservoirs 628. The cam reservoirs 628 are diagonal with a front end of the cam reservoir 628 closer to the front end of the front rail 610 and a rear end of the reservoir 628 further back from the front end of the front rail 610.

Figure 78:
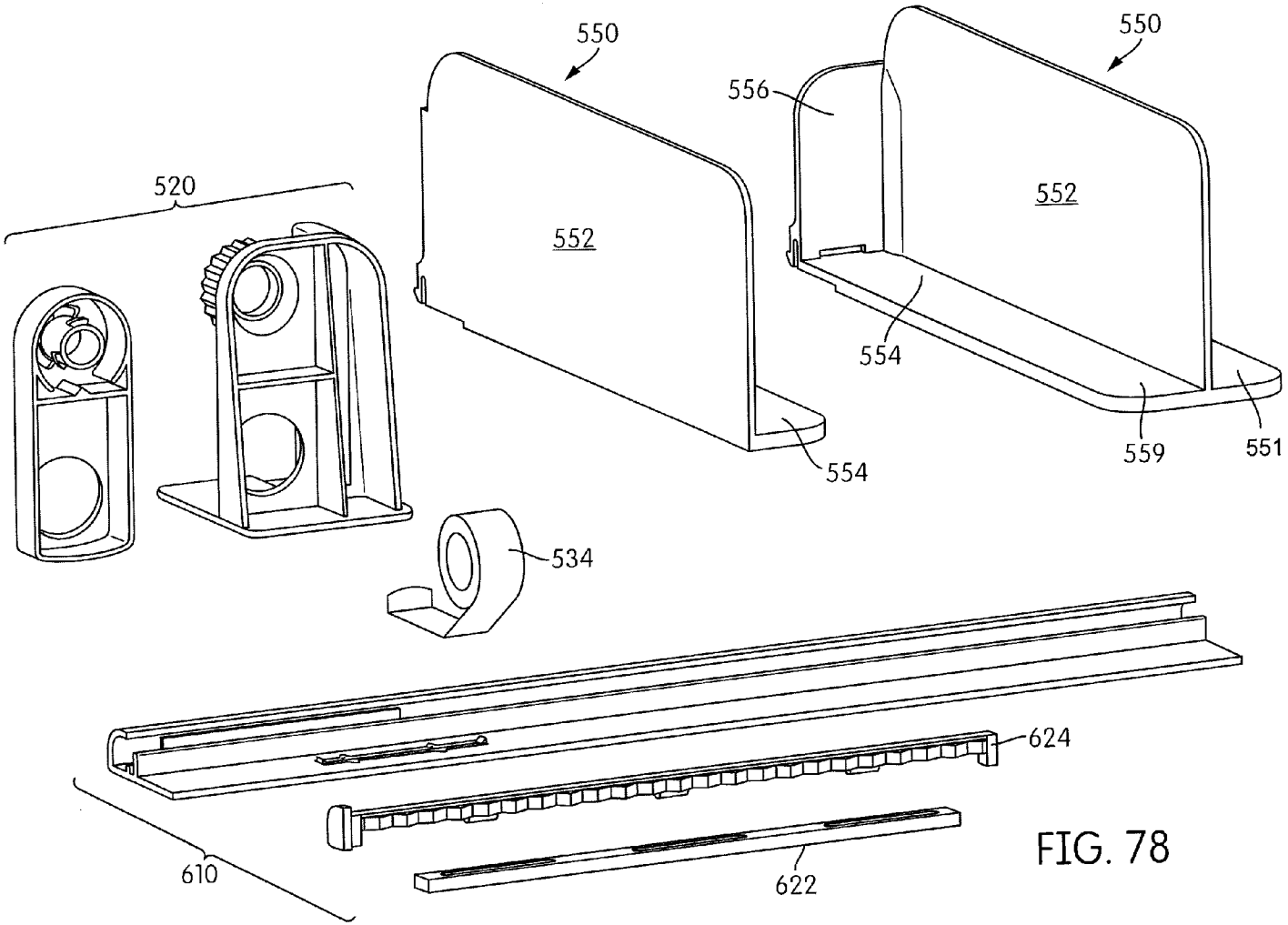
FIG. 78 depicts a back exploded view of an exemplary product management display system in accordance with one or more aspects of the disclosure.

The tooth bar 624 may include cam studs 630. The tooth bar cam studs 630 are placed within the cam bar reservoirs 628 during operation of the front rail 610. When the cam bar 622 and the cam bar reservoirs 628 move laterally, the tooth bar cam studs 630 move in a perpendicular direction to the movement of the cam bar 622. The tooth bar cam studs 630 move toward the front of the front rail 610 (and away from the teeth 600 of the divider) and away from the front of the front rail 610 (and toward the teeth 600 of the divider) as the cam bar 622 moves laterally back and forth within the cam area 626. As the tooth bar cam studs 630 move, the tooth bar 624 also moves. Thus, when the cam bar lever 618 is moved from a first position to a second position, it moves the cam bar 622 laterally along the inside of the front rail 610. This lateral movement of the cam bar 622 causes the tooth bar 624 and the teeth 612 thereon to move in a direction perpendicular to the direction of the cam bar 622; that is, the tooth bar 624 moves in a direction toward or away from the front of the front rail 610 and toward or away from the teeth 600 on the divider 550. FIG. 78 shows a rear exploded view of several aspects of the embodiment shown in FIG. 77

Figure 79A:
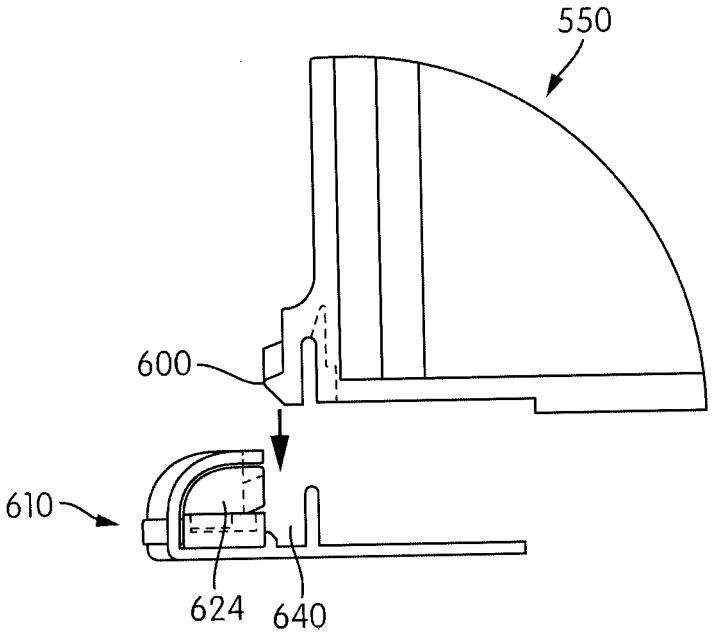
FIGS. 79A-C depict side views of an exemplary front rail and divider in accordance with one or more aspects of the disclosure.
Figure 79B:
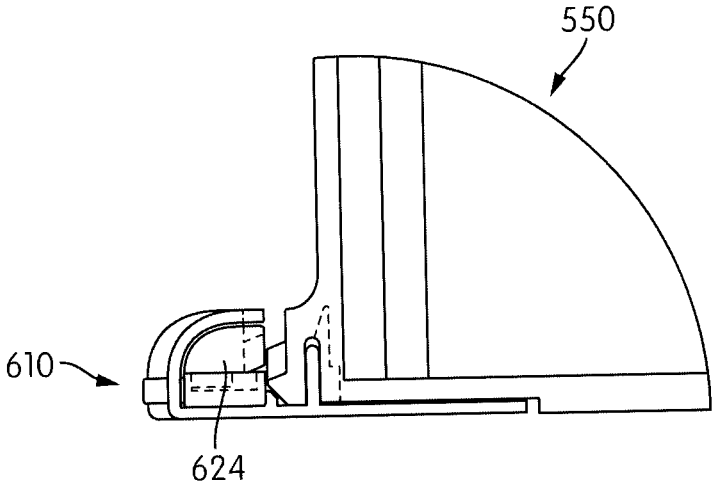
Figure 79C:
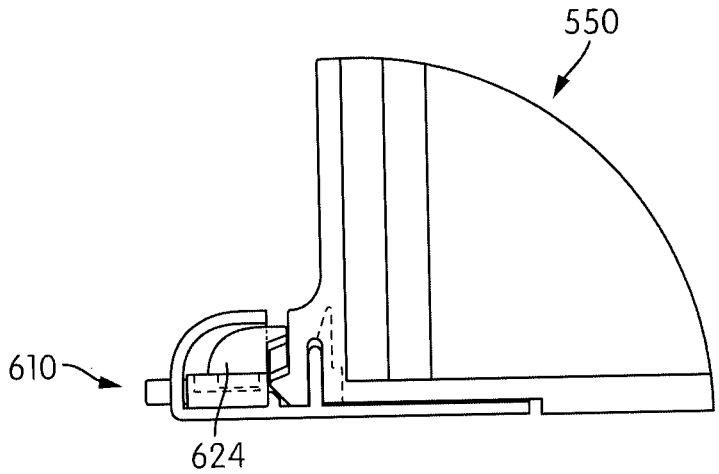

FIGS. 79A-C show an example of a step by step guide to placement of the divider 550 into the front rail 610. The divider 550 including teeth 600 on the divider is lowered into the channel 640 of the front rail 610, as illustrated in FIG. 79A. The tooth bar 624 initially is in a position closer to the front of the front rail 610 and the teeth 612 of the tooth bar 624 are not engaged with the teeth 600 of the divider 550. The cam bar lever 618 is in a first position which maintains the teeth 612 of the tooth bar 624 out of engagement with the divider teeth 600, as illustrated in FIG. 79B. In this position, the divider 550 can be moved laterally along the ridge or tongue 616 of the front rail 610. The divider 550 can have product sit on the divider floor 554 as the divider 550 is moved laterally along the front rail in the direction shown in FIG. 77 by arrow "A". The ridge 584 or other projection in the front rail 580 can engage the groove 560 or other recess in the divider 550 to secure the divider 550 and prevent the divider from movement in a direction perpendicular to the front rail 580, other than for an insignificantly small amount of play (e.g., less than 3 mm) between the ridge 584 and the groove 560, under normal operating conditions and forces. The cam bar lever 618 is then moved from a first position to second position. The movement of the cam bar lever 618 causes the cam bar 622 to move in a lateral direction within the extruded shell 620. The movement of the cam bar 622 includes movement of the diagonal cam bar reservoirs 628 in the lateral direction. Movement of the cam bar reservoirs 628 in turn causes the tooth bar cam studs 630 to move in a direction perpendicular to the direction of the cam bar 622 and in a direction toward the teeth 600 of the divider 550, as illustrated in FIG. 79C. The tooth bar cam studs 630 are coupled to and may be integral with the tooth bar 624. Accordingly, movement of the tooth bar cam studs 630 causes the tooth bar 624 and the teeth 612 contained therein to move toward the teeth 600 of the divider. This movement causes the teeth 612 of the tooth bar 624 to become engaged with the teeth 600 of the divider. When the teeth 612 of the tooth bar are engaged with the teeth 600 of the divider, the divider 550 is releasably engaged and will not move in a lateral direction shown by arrow "A" in FIG. 77 under normal operating forces and conditions.

Figure 80:
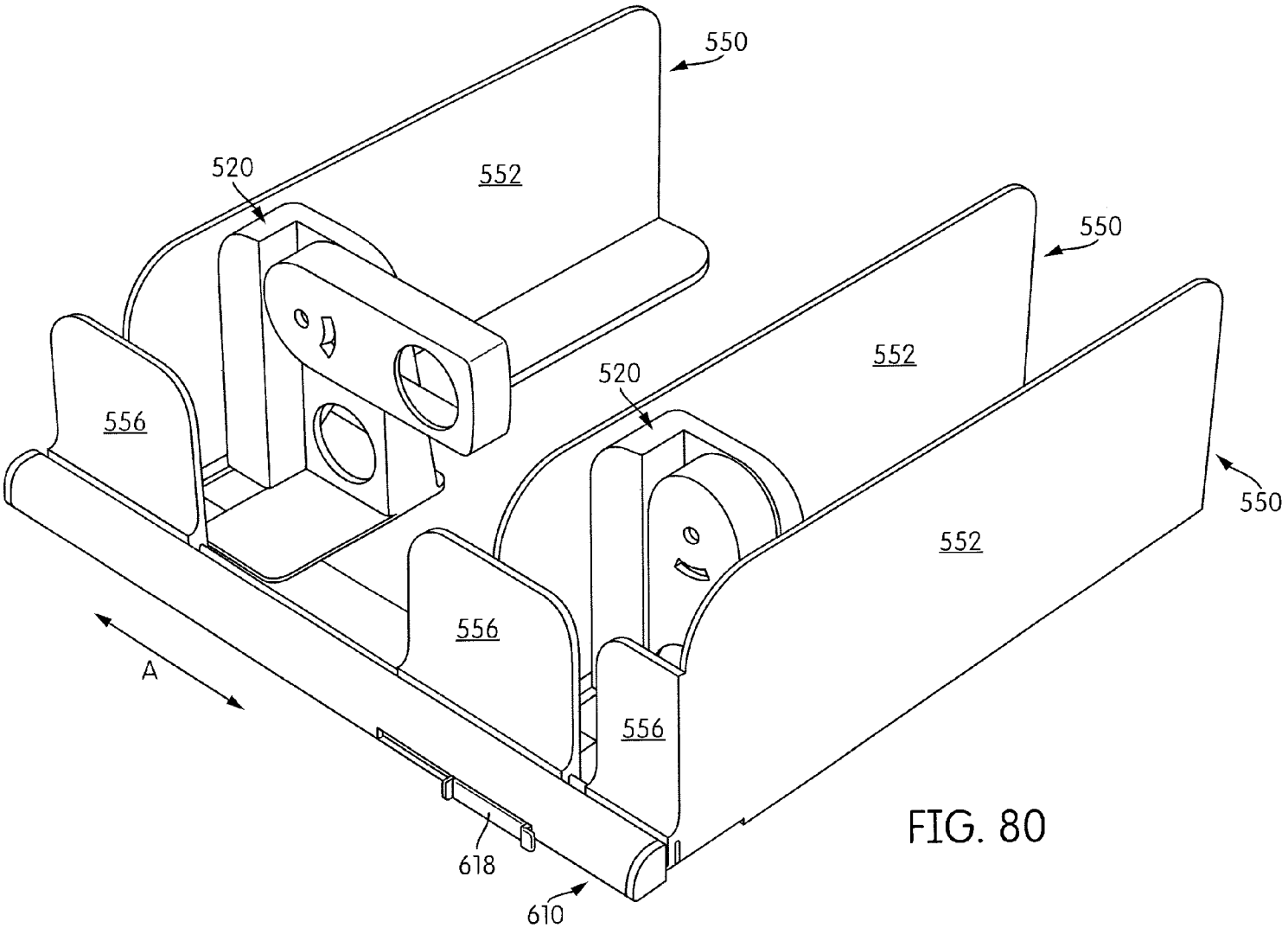
FIG. 80 depicts an isometric view of an exemplary product management display system in accordance with one or more aspects of the disclosure.

The tooth bar 624 is fixed on its ends such that the tooth bar 624 can only move in a direction that is toward or away from the teeth 600 of the divider. The tooth bar 624 cannot move in a lateral direction shown in FIG. 77 by arrow "A". The cam bar 622 operates in the opposite manner. The cam bar 622 is fixed such that the cam bar 622 can only move in a lateral direction shown in FIG. 77 by arrow "A". The cam bar cannot move toward or away from the teeth 600 on the divider FIG. 80 provides an isometric view of aspects of an embodiment. When the teeth 612 of the tooth bar 624 are engaged with the teeth 600 of the divider, the entire merchandise system 10 is locked. The front rail 610 and the divider 550 are releasably engaged with each other and will not move relative to each other. In addition, the pusher 520 is engaged with the divider 550. In this position, the entire merchandise system 10 can be moved. The merchandise system 10 can be set up in a remote location according to a particular planogram and then locked. The merchandise system 10 can then be shipped to the store location. At the store location the merchandise system 10 can be removed from the shipping container and placed on the shelf like a mat. The planogramming of the dividers 550 will remain intact while the merchandise system 10 is locked.

In an example, a display system is assembled in a remote location away from a shelf and then moved as a unit to the shelf and secured to the shelf. A plurality of dividers 550 are engaged with a front rail 580 in a manner in which they are secured and will not significantly move in a direction perpendicular to the front rail 580. The plurality of dividers 550 are adjusted laterally parallel to the front rail 580 according to a pre-panned planogram or other arrangement. The plurality of dividers 550 include engaging members and the front rail 580 includes engaging members. The engaging members on the plurality of dividers 550 and/or the engaging members on the front rail 580 are adjusted from a first position to second position to fix the plurality of dividers 550 to the front rail 580 such that the plurality of dividers cannot move in any direction in relation to the front rail 580. The front rail 580 and the plurality of dividers 550 are then moved as a unit to the shelf. The front rail 580 then is secured to the shelf.

To alter the planogramming of the merchandise system at the store location, the dividers 550 and the product need not be removed from the shelf. The cam bar lever 618 or other engaging member for each of the dividers 550 can be moved to its initial position. By moving the cam bar lever 618 or other engaging member to its initial position, the teeth 612 of the tooth bar 624 release from the teeth 600 of the divider (or one engaging member disengages from another engaging member). In this position, the dividers 550 can be moved laterally in the direction denoted by arrow "A" in FIG. 80. Product can remain in place on the divider floors 554 and the pusher floors 524 while the dividers 550 are being moved. Once the dividers 550 have been moved to the new planogram position, the cam bar lever 618 or other engaging member for each of the dividers 550 can be moved to its second position. The teeth 612 of the tooth bar 622 will then engage the teeth 600 of the divider 550 (or one engaging member will engage with another engaging member) and again cause the merchandise system 10 to become locked.

Figure 81A:
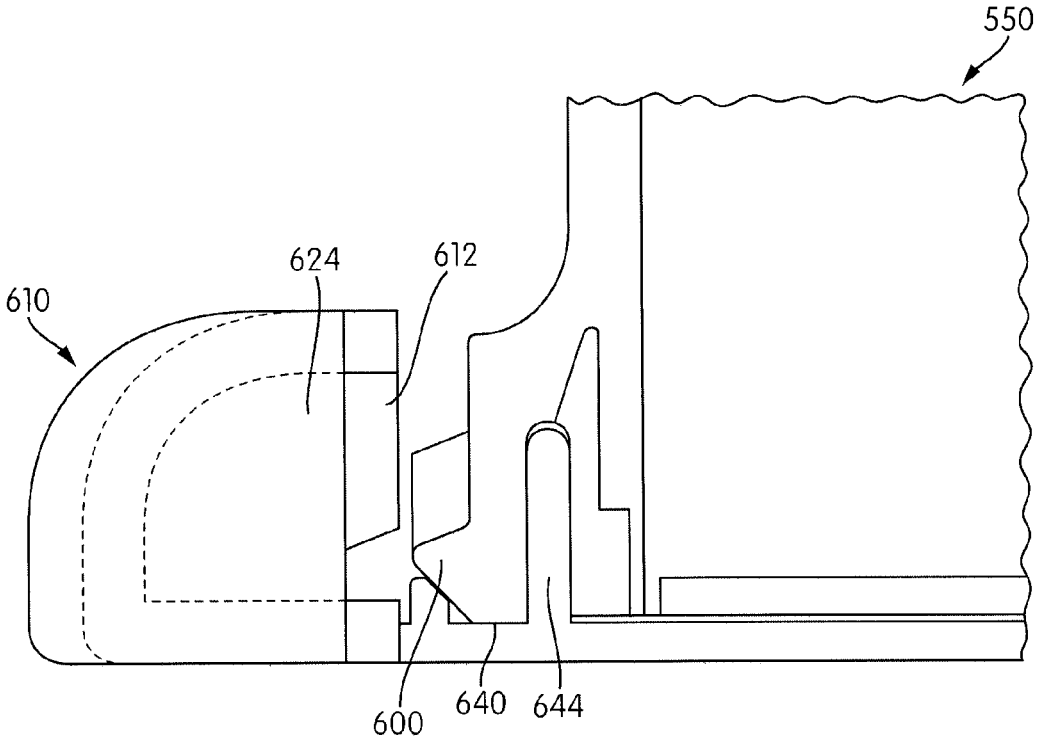
FIGS. 81A-B depict partial side views of an exemplary front rail and divider in accordance with one or more aspects of the disclosure.
Figure 81B:
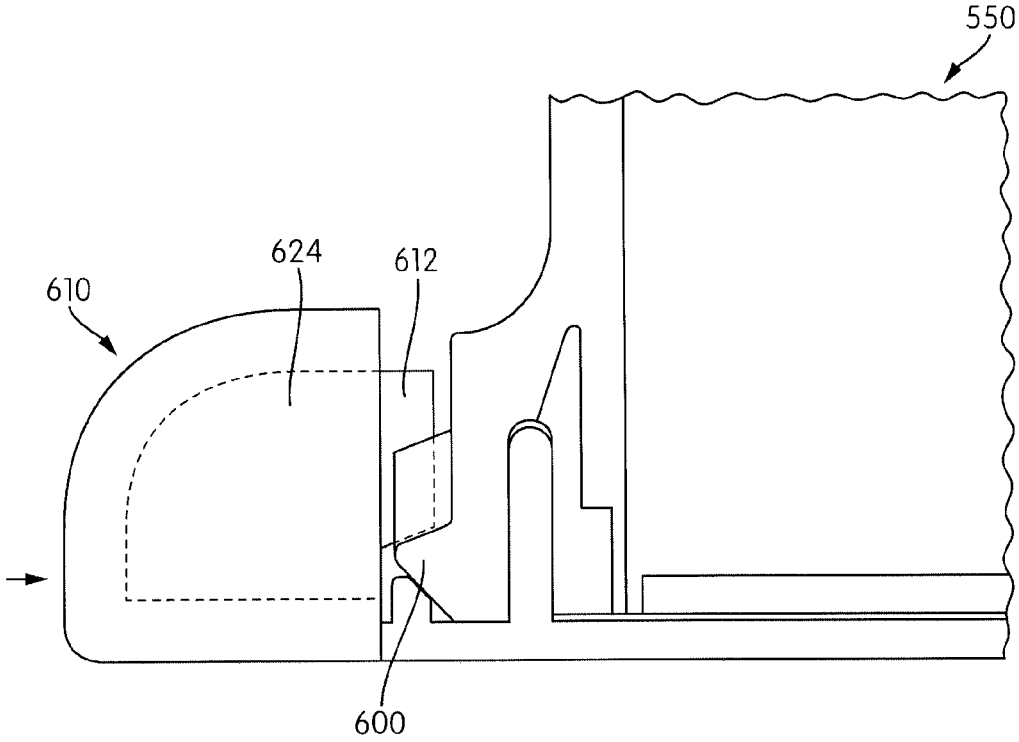

In an example, operation of the camming action is further shown in FIGS. 81A and 81B. FIG. 81A shows the teeth 600 of the divider not engaged with the teeth 612 of the tooth bar 624. In the embodiment, the cam bar 622 is adjacent the front wall of the front rail 610. In FIG. 81B, the cam bar lever 618 has been moved to the second position, the cam bar 622 has moved laterally and the tooth bar cam studs 630 have moved toward the divider 550. The teeth 612 of the tooth bar 624 also have moved toward the divider 550 and have engaged the divider teeth 600.

In an embodiment, a soft rubber pad can be utilized in place of the teeth 612 on tooth bar 624 and can function as an engaging member. In this embodiment, when the tooth bar 624 is adjacent the front portion of the front rail 610, the soft rubber pad and the divider teeth 600 are not in contact with each other. When the cam bar lever 618 is moved to its second position and the cam bar 622 moves the tooth bar 624 in the direction of the divider teeth 600, the divider teeth 600 come into contact with and thereby engage the soft rubber pad. This contact provides resistive interference and maintains the divider teeth 600 in place and prevents the divider 550 from lateral movement in the direct noted in FIG. 77 by arrow "A".

Figure 82A:
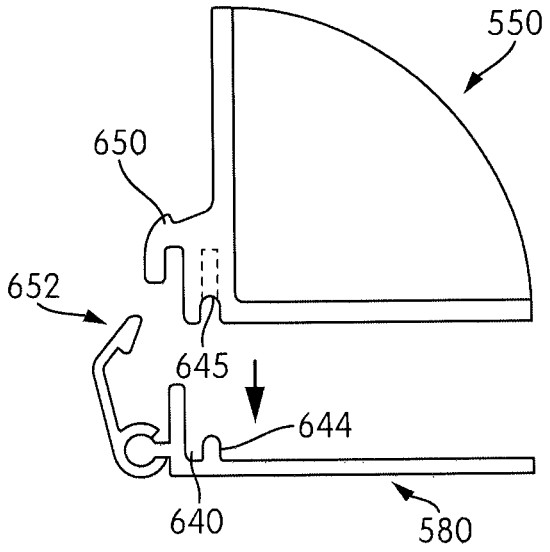
FIGS. 82A-C depict partial side views of an exemplary front rail and divider in accordance with one or more aspects of the disclosure.
Figure 82B:
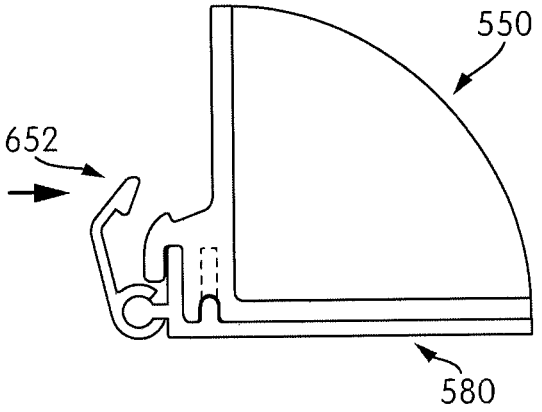
Figure 82C:
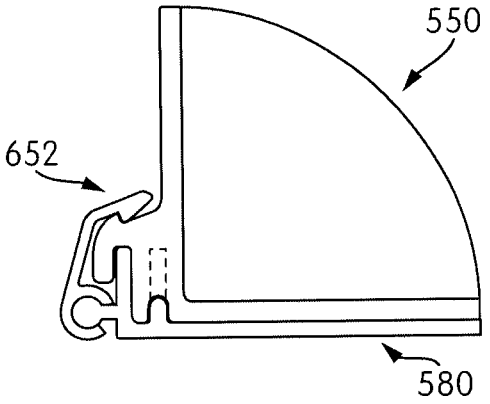

In another embodiment, as shown in FIGS. 82A-C, the divider 550 is held in place in contact with the front rail 580 through use of a clamp. FIG. 82A-C show a step by step process for insertion of the divider 550 into the front rail 580. Initially, as illustrated in FIG. 82A, the divider 550 is lowered into a channel 640 formed in the front rail 580 (or 610). In addition, a ridge or tongue 644 in the front rail 580 contacts a channel 645 in the divider 550. The divider 550 includes a bump or outwardly extending ridge 650 at a front portion of the divider 550. A clamp 652 on the front rail 580 is rotated to engage the bump 650 of the divider 550. The clamp 652 snaps over the bump 650 and locks the bump 650 and the divider 550 into place. Once releasably engaged, the divider 550 cannot move in the lateral direction noted in FIG. 80 by arrow "A". To move the divider 550, the clamp 652 must be pulled to unsnap the clamp 652 from the divider bump 650.

Figure 83A:
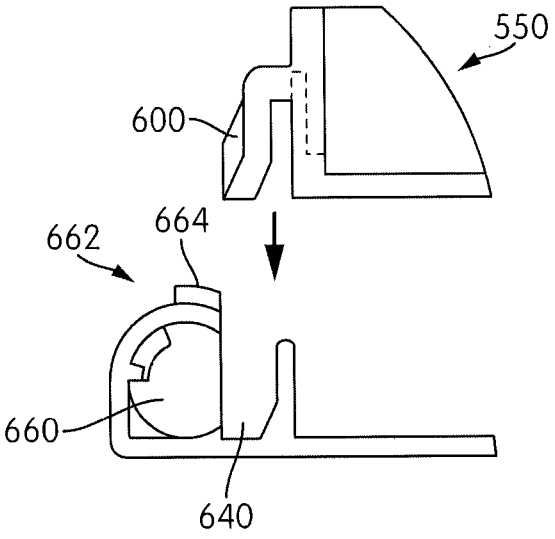
FIGS. 83A-C depict partial side views of an exemplary front rail and divider in accordance with one or more aspects of the disclosure.
Figure 83B:
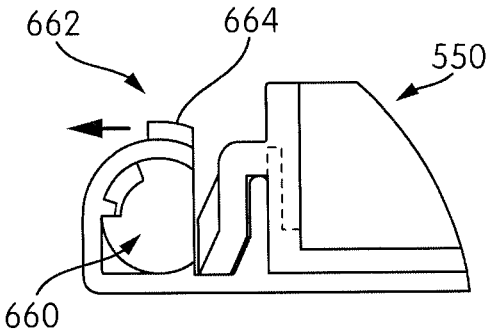
Figure 83C:
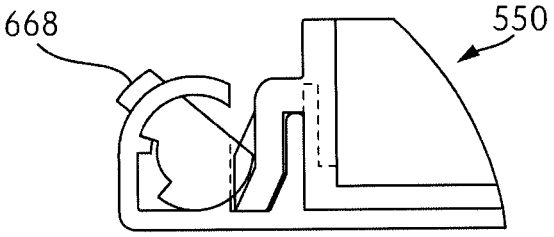

In another embodiment, as shown in FIGS. 83A-C, the divider 550 is held in place in contact with the front rail 580 through use of a rotating rod 660 that includes teeth. FIGS. 83A-C show a step by step process for insertion of the divider 550 into the front rail 580. Initially, as illustrated in FIG. 83A, the divider 550 is lowered into a channel 640 formed in the front rail 580. The front rail 580 includes a rotating rod 660 which itself includes teeth. When the divider 550 initially is lowered into the channel, as illustrated in FIG. 83B, the teeth of the rotating rod 660 are in a first position in which they are not engaged with the teeth 600 of the divider 550. A handle 662 is coupled to the rotating rod 660. When the handle is in a first position 664, the teeth of the rotating rod 660 are in a first position in which they are not engaged with the teeth 600 of the divider 500. When the handle 662 is moved to a second position 668, as illustrated in FIG. 83C, the handle 662 rotates the rotating rod 660 and moves the teeth on the rotating rod 662 into a position in which they engage the teeth 600 on the divider 550. In this position, the rod teeth are in an interfering condition with the divider teeth 600. When the rod teeth and the divider teeth 600 are engaged with each other the divider 550 cannot move in the lateral direction noted in FIG. 80 by arrow "A". To move the divider 550, the rod 660 must be returned to its first position 664 and the teeth of the rod 660 moved out of engagement with the teeth 600 on the divider 550.

Figure 84A:
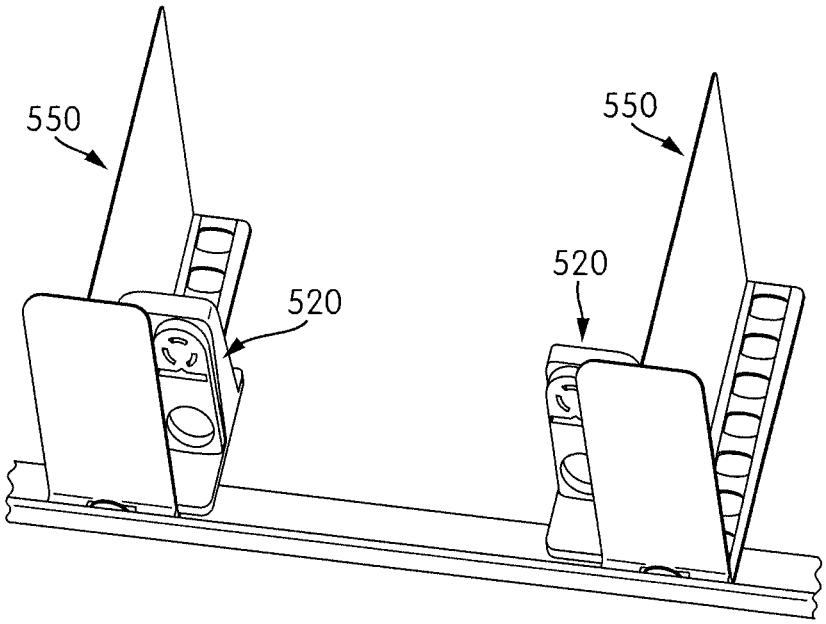
FIGS. 84A-F depict isometric views of an exemplary product management display system in accordance with one or more aspects of the disclosure.
Figure 84B:
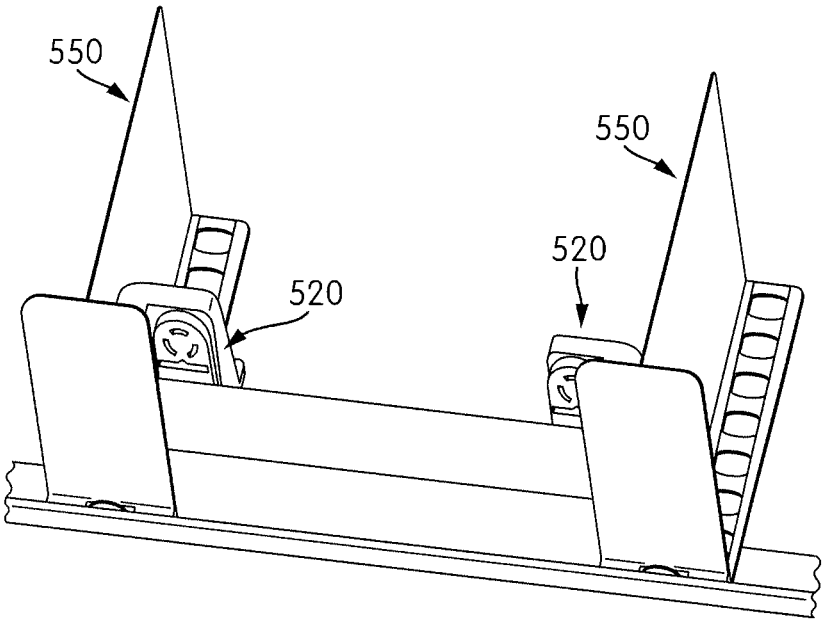
Figure 84C:
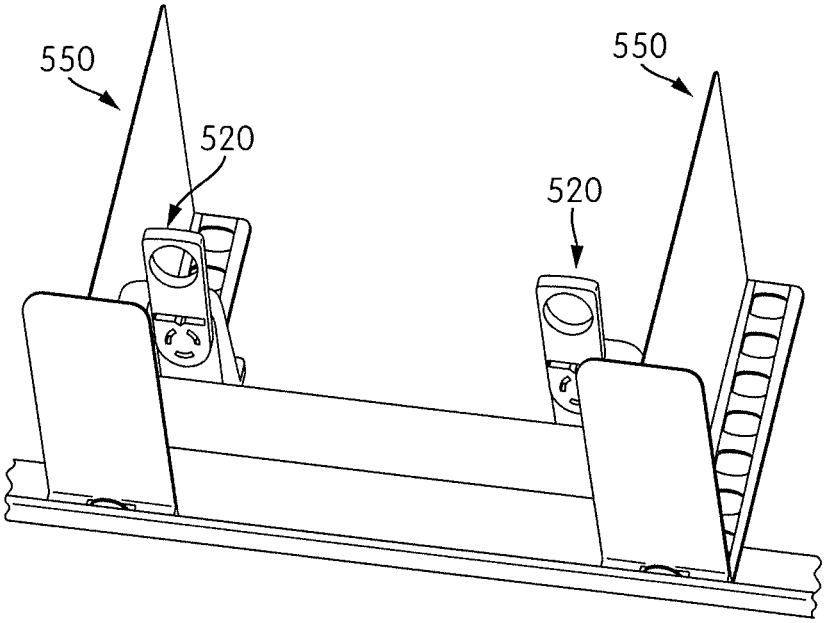
Figure 84D:
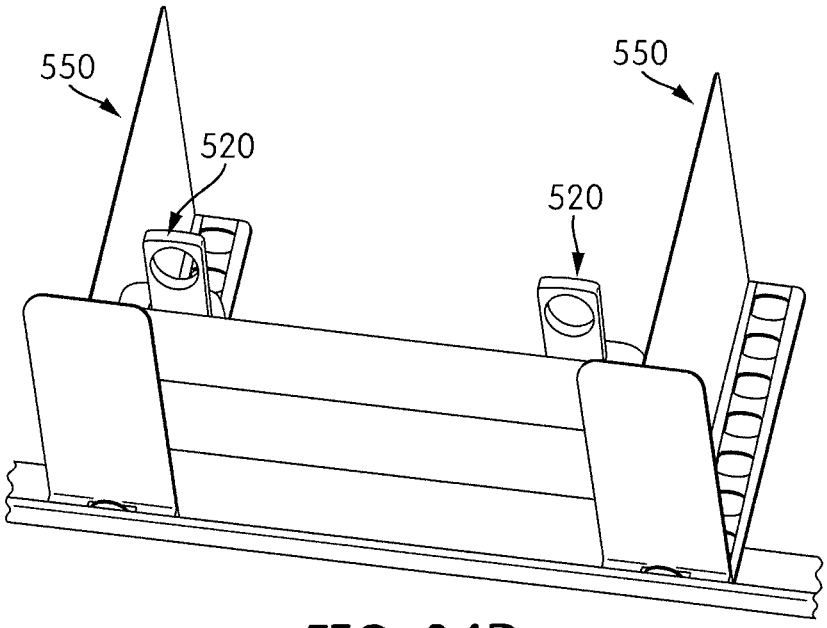
Figure 84E:
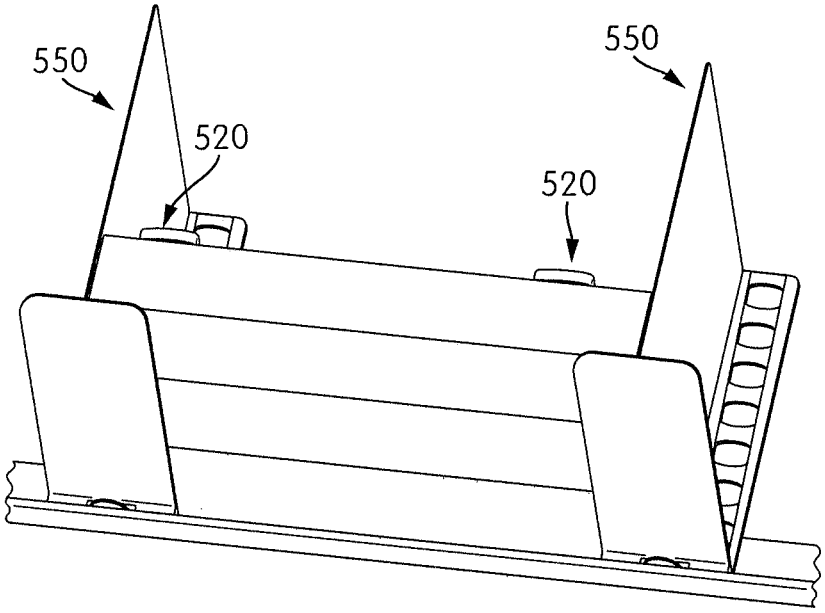
Figure 84F:
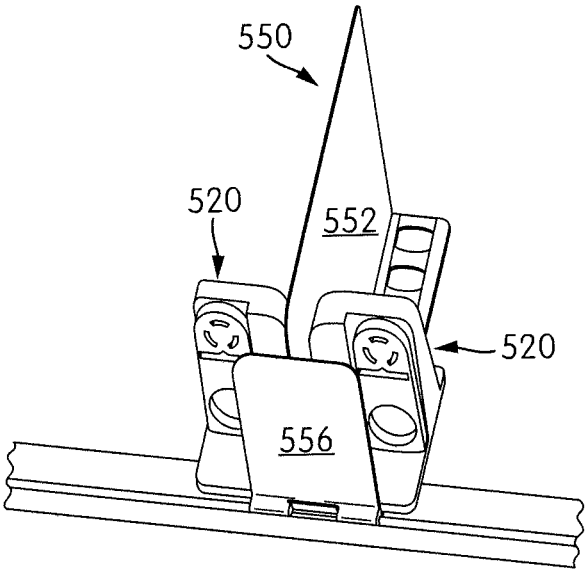

In an embodiment, a plurality of pushers 520 and dividers 550 can be used with a single front rail 580. FIGS. 84A-E show the use of two pushers 520 and two dividers 550 to push product toward the front of the shelf. Use of multiple pushers 520 can allow for pushing of wide product, shown schematically in the figures. In addition, placing the pusher extender 528 in its upwardly extended position can allow the pushers 520 to push taller products or more products as shown in FIGS. 84D and 84E. In an embodiment, a divider 550 can be coupled to two pushers 520. One pusher 520 can be engaged to a portion of the barrier 556 on each side of the divider wall 552 as shown in FIG. 84F. In other examples, the divider can be coupled to one pusher or the divider can be coupled to no pusher.

Figure 85:
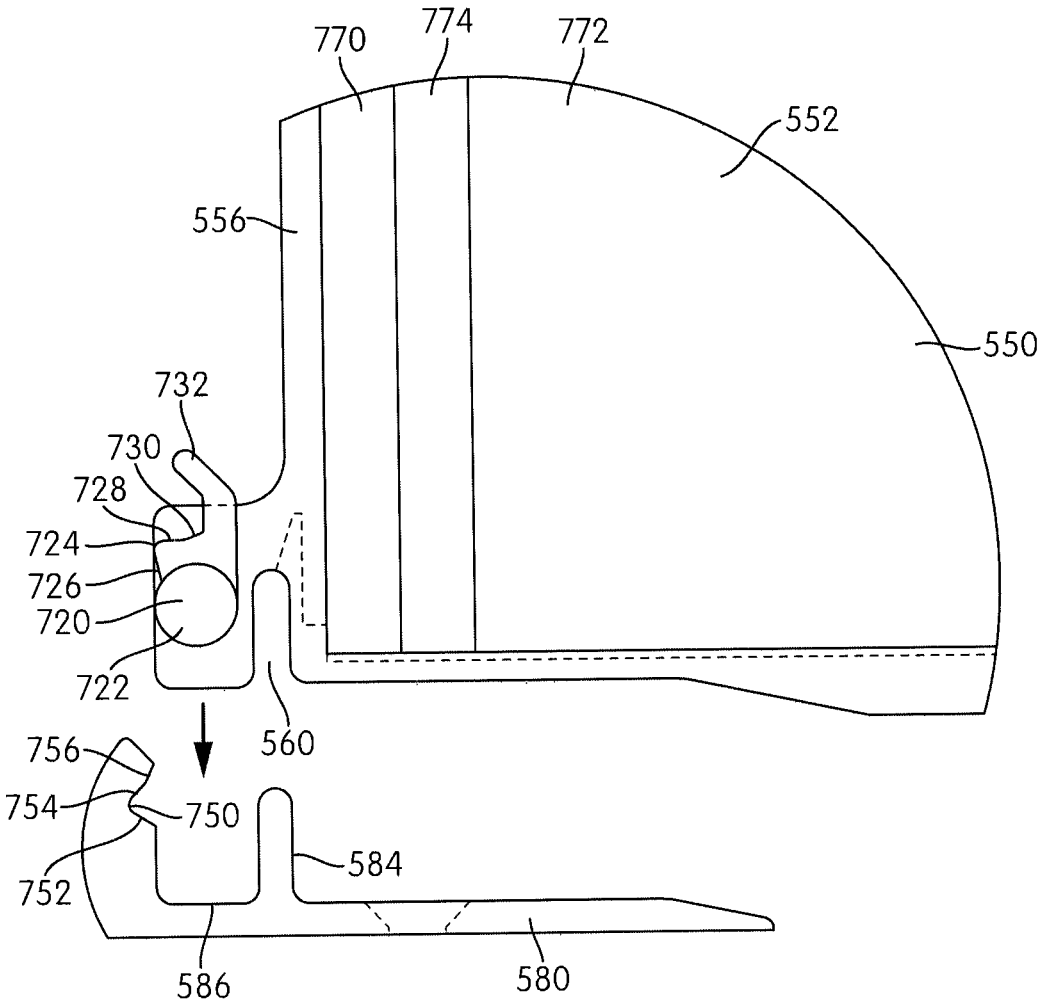
FIG. 85 depicts a side view of an exemplary divider and front rail in accordance with one or more aspects of the disclosure.

In another embodiment, the divider 550 is secured to the front rail 580 in part through the operation of a cam 720, as illustrated in FIG. 85. FIG. 85 illustrates a cam 720 in a side perspective view coupled to the barrier 556. The cam 720 includes a rounded portion 722 that is configured to rotate within a cavity 740 (see FIG. 86G) in barrier 556. The cam 720 also includes a tongue 724 that is comprised of a first cam wall 726, a second cam wall, 728, and a third cam wall 730. In FIG. 85, the cam is in a position where it is not engaged with the front rail. In this position, the first cam wall 726 can be in a substantially vertical alignment. In this position the second cam wall 728 and the third cam wall 730 may also be in a substantially horizontal alignment. The first cam wall 726 connects with the second cam wall 728. The second cam wall 728 connects with the third cam wall 730. The cam also includes a handle 732.

In another embodiment, the tongue 724 only has two cam walls. A first cam wall, such as first cam wall 726, and a second cam wall. The second cam wall is straight and spans the length shown by cam walls 728 and 730. There is no bend in the second cam wall in this embodiment. The cam walls can extend for one or more portions of the width of the divider 550 or can extend the entire width of the divider 550.

In another embodiment shown in FIGS. 92-94, the cam 720 may define a cam glide surface 733 (hereinafter referred to as the cam glide) located on a bottom side of the cam, opposite of the handle 732. The cam glide 733 serves as a low friction glide bump to improve the slidability of the divider relative to the rail. In operation, the cam glide 733 lifts the divider up off of the rail to reduce friction between the divider and the rail, thereby improving the slidability of the divider relative to the rail. As seen in the figures, the cam glide 733 of the cam 720 extends below or beneath the bottom surface of the divider and is the contact point between the divider and the rail. In this configuration, when the divider is moved laterally relative to the rail, the primary contact between the divider and the rail is just the cam glide, and no significant other portions of the divider and rail contact each other. This single contact point therefore reduces the friction between the divider and the rail.

The cam glide may further define a planar surface extending outwardly from the rounded portion 722 of the cam 720. The cam glide 733 may be centrally positioned on the rounded portion 722 of the cam to provide stability and balance to the divider relative to the rail. It should be understood, however, that the cam glide may be located at any other suitable location on the cam. The planar surface of the cam glide may terminate at an elongated edge that is sized and shaped to slide freely in the channel 586 of the rail 580 to thereby permit ease of lateral movement of the divider relative to the rail. The elongated edge of the planar surface may define rounded or contoured edge surfaces to further aid in the free movement of the cam glide relative to the rail. It should be understood that the cam glide may define other configurations that permit the cam glide to fit within or along the rail and also permit the slidable movement of the divider relative to the rail. For example, the cam glide may define a bump or rounded protrusion or a series of bumps or rounded protrusions, which would accomplish the same objective as the planar surface defining an elongated edge. While the cam 720 defining a cam glide 733 are depicted being used with a divider, the cam and cam glide may be used with the pusher or pusher assembly or other components that are mounted to the rail.

In another embodiment, the cam 720 defining the cam glide 733 may be mounted to the rear of the divider or pusher, and may operatively engage a rear rail that is mounted at the rear of the shelf. In this embodiment, the cam 720 may be used to secure and prevent lateral movement of the divider or pusher relative to the rear rail, if used on the shelf. In other words, the cam and cam glide described herein may be used to secure the divider or pusher to a front rail or a back rail, or both, depending on the desired application.

In an exemplary aspect, the cam 720 serves as a lock to lock the divider or pusher to either the front rail or rear rail, or both. The cam 720, when moved to a locked position, will lock the divider or pusher to the rail and prevent lateral movement of the divider or pusher relative to the rail. In an unlocked position, the cam 720 permits slidable movement of the divider or pusher relative to the rail. In an exemplary aspect, the cam 720 is rotatable or pivotable between the locked and unlocked position. In yet another exemplary aspect, the cam 720 defining the cam glide 733 serves the dual function of locking the divider or pusher to the rail and also enhancing the lateral slidability of the divider or pusher relative to the rail when the cam is in the unlocked position.

Figure 92:
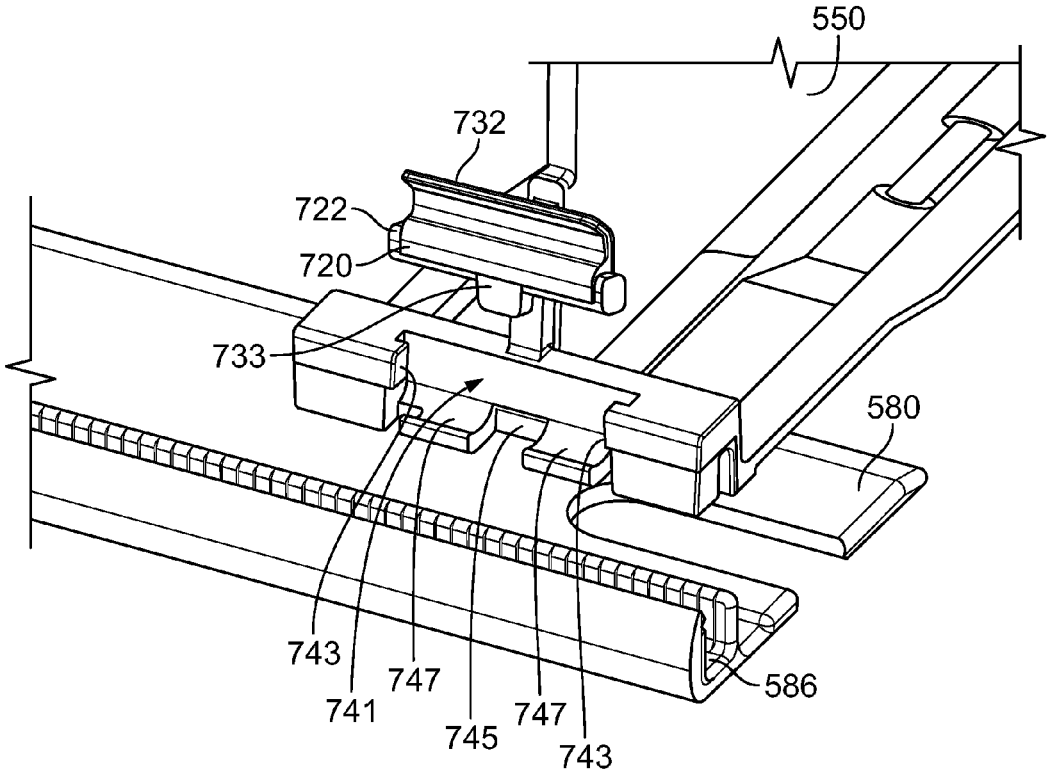
FIG. 92 depicts an exploded view of an exemplary divider and rail in accordance with one or more aspects of the disclosure.

As shown in FIG. 92, the cam 720 may define a rounded portion 722 that is configured to rotate within a cavity 741 in the front of the divider. The cam 720 may also define a cam surface 725 and cam surface 727 that will engage the groove walls 754 and 756 of the front rail, as explained below.

In an embodiment, the cam 720 fits within a cavity 740 of the barrier 556, as illustrated in FIG. 86G. In an embodiment, the cavity 740 is bounded by side walls 742. Side walls 742 render the front of the cavity 740 slightly narrower than the width of cam 720. An amount of force is required to push cam 720 past side walls 742 and into cavity 740. After the cam passes the side walls 742 it snaps into place in the cavity 740. The cam 720 can then rotate in cavity 740 and will not fall out of cavity 740 or detach from cavity 740 during normal use. The cam 720 is rotatably secured within cavity 740. In an embodiment, cavity 740 also is bounded at its front portion by a front wall (not shown).

In another embodiment, the side walls 742 do not render the front of cavity 740 narrower than the width of cam 720. In this embodiment, cam 720 may be placed into cavity 740 and removed from cavity 740 without the need to overcome resistive force caused by side walls 742.

Referring to FIG. 92, in another embodiment, the cam 720 defining a cam glide 733 may fit within the cavity 741 formed at the front end of the divider 550 and may be bounded by side walls 743. Side walls 743 render the front of the cavity 741 slightly narrower than the width of cam 720. An amount of force is required to push cam 720 past the side walls 743 and into cavity 741. After the cam passes the side walls 743 it snaps into place in the cavity 741 and seats on a pair of cavity surfaces 747. The cam 720 can then rotate in the cavity and will not fall out of cavity or detach from the cavity during normal use.

As depicted in FIGS. 92-94, the cam 720 is rotatably secured within cavity 741. In this embodiment, the cavity 741 also defines an opening or slot 745 that is sized and shaped to permit rotatable movement of the cam glide 733 within the cavity. The slot 745 is sized and shaped to permit the planar surface of the cam glide 733 to fit therein and to thereby permit the cam to rotate within the cavity 741. The opening 745 also permits the cam glide 733 to extend past the bottom surface of the divider and into the rail. Once in the rail, the cam glide will lift the divider up and off of the rail and out of contact with the rail, as described above, to permit free slidability of the divider relative to the rail.

The opening 745 also creates a clearance for the rotation of the cam glide away from the rail. When the handle 732 on the cam is rotated toward the front edge of the rail, the cam glide will consequently rotate away from the rail. The opening 745 formed within the cavity 741 permits this rotatable movement.

Figure 93A:
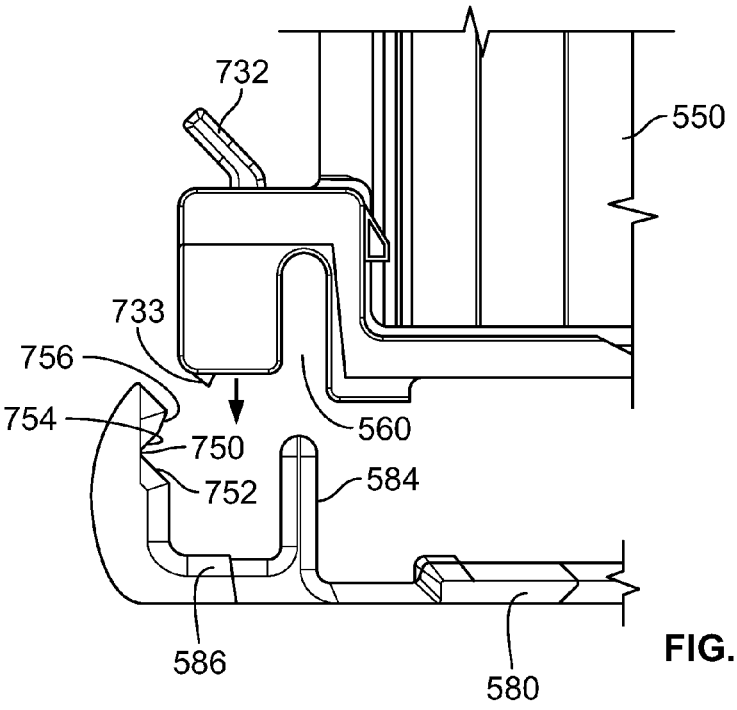
FIGS. 93A-B depict views of an exemplary divider mounting to a front rail in accordance with one or more aspects of the disclosure.
Figure 93B:
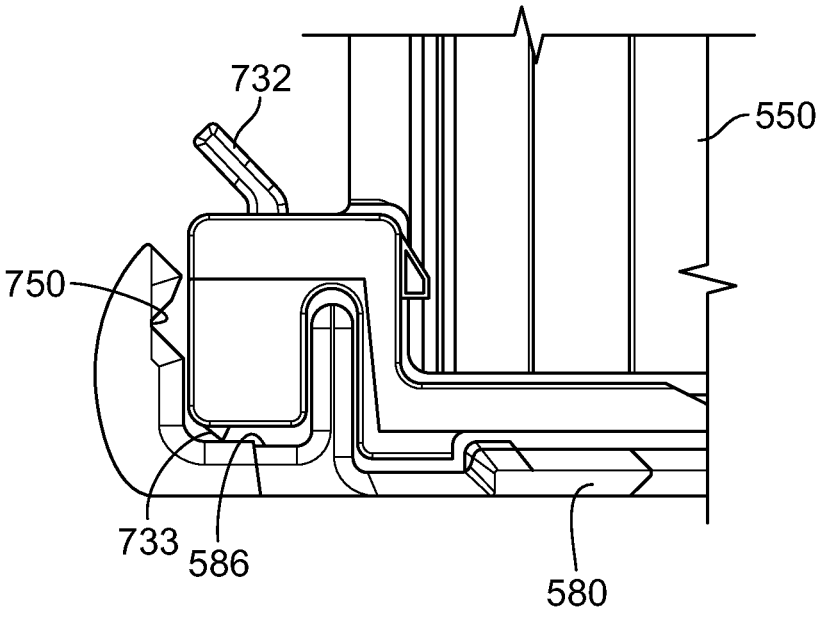

Referring to FIGS. 93A and 93B, the divider 550 is shown being lowered and placed onto the rail 580. More specifically, front portion of the divider 550 is lower into the channel 586 and the groove 560 is placed over the ridge 584. The cam glide 733 will contact the channel 586 and support the divider up and off of the rail 580, as shown in FIG. 93B. In this embodiment, the cam glide 733 supports the divider and permits free slidable movement of the divider relative to the rail. As shown in FIG. 93B, there is a gap between groove 560 and ridge 584 and between the underside surface of the divider and the top surface of rail.

Figure 94A:
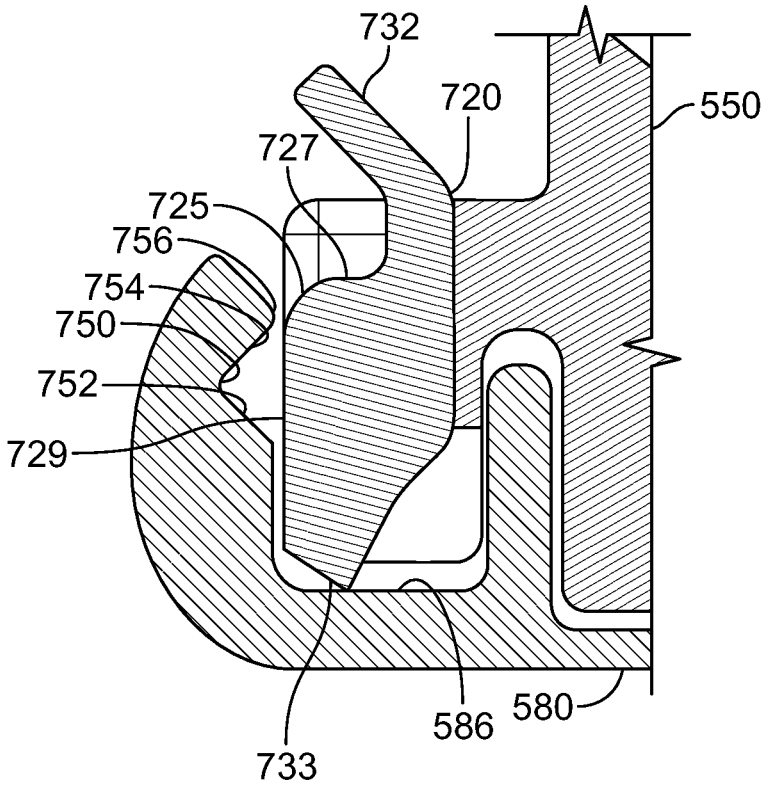
FIGS. 94A-C depict cross-section views of the movement of an exemplary cam used with a divider and front rail in accordance with one or more aspects of the disclosure.
Figure 94B:
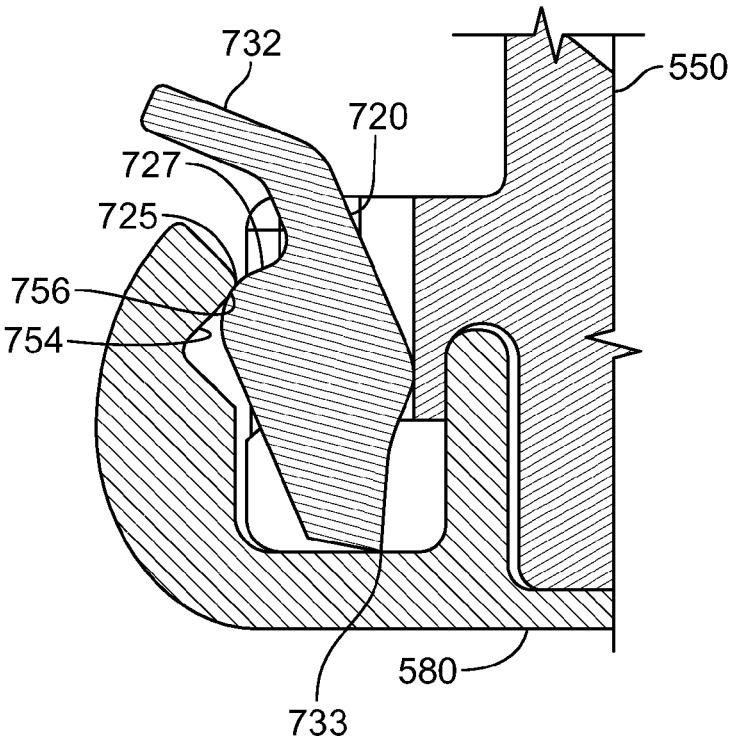
Figure 94C:
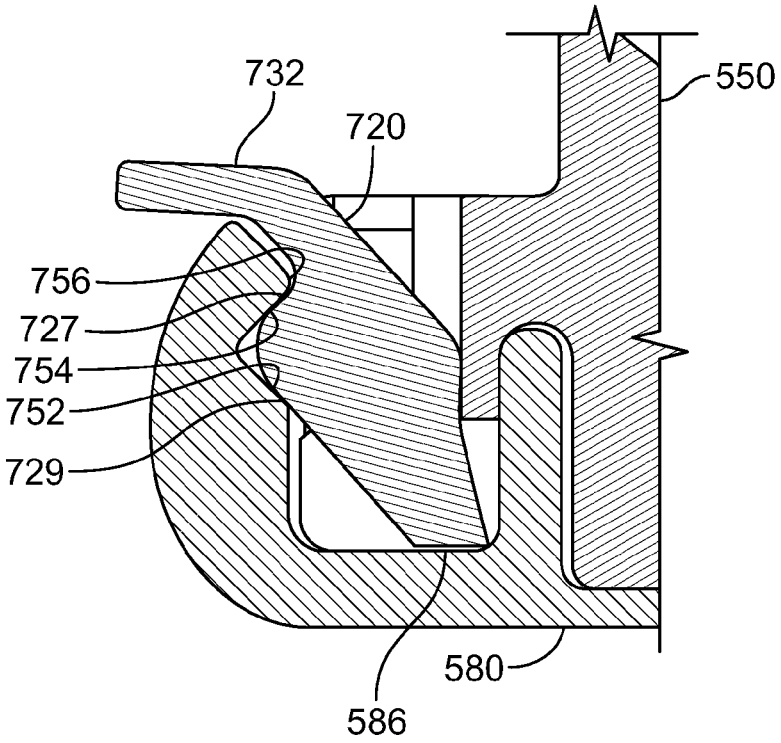
Figure 95:
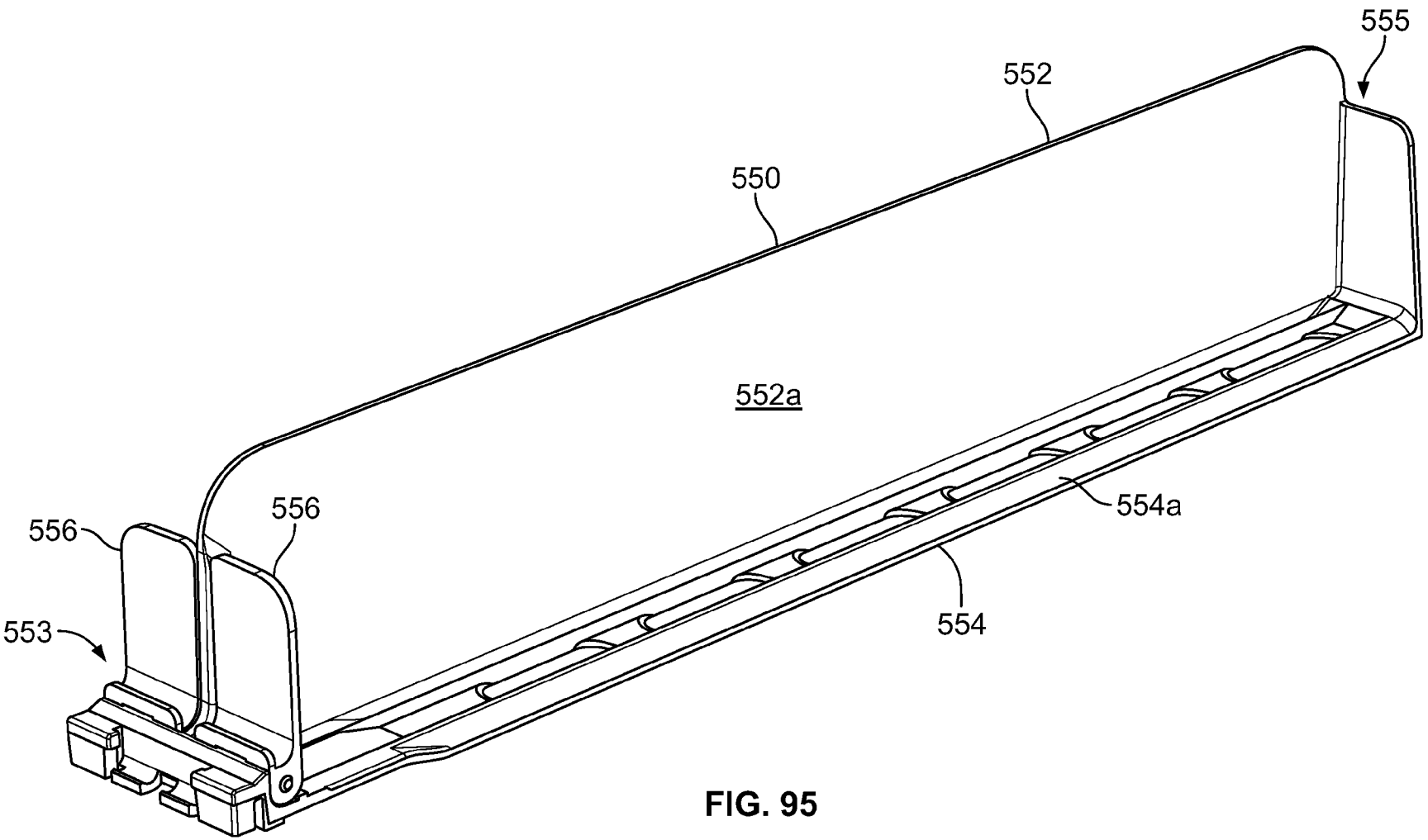
FIG. 95 depicts a top, right perspective view of aspects of example components of a merchandise display system.

Referring to FIGS. 94A-94C, which shows sectional views of the divider, cam and rail, the cam 720 is at all times in contact with the rail 580. As shown in FIG. 94A, when the divider 550 is initially lowered onto the rail 580, the cam glide 733 is in contact with the channel 586 of the rail 580 and lifts the divider up and off of the rail. As shown in FIG. 94A, the cam 720 defines cam surfaces 725, 727 and 729. The cam further defines a cam handle 732 located opposite the cam glide 733. Also shown in FIG. 94A is the front rail 580 defining a rail channel 586 which receives a portion of the divider 550 and is the contact surface for the cam glide 733. The rail 580 further defines a rail groove 750 that further defines groove walls 752, 754 and 756, which as explained below, contact the cam surfaces during operation of the cam.

Referring to FIG. 94B, as the cam is rotated, through operation of the handle 732, the cam glide stays in contact with the channel 586 and the cam surface 725 contacts the groove wall or surface 756 of the front rail. At this point, the cam 720 contacts the rail at two points simultaneously.

Referring to FIG. 94C, as the cam is rotated even further through operation of the handle, the cam surface 725 contacts the groove wall or surface 754 while the cam surface 727 contacts the groove wall or surface 756. Also, the cam surface 729 will contact the groove wall or surface 752. The groove wall 752 serves as a stop to prevent further rotational movement of the cam 720. The handle 732 extends over the top of and even with the front edge of the front rail or past the front edge of the front rail. In an example, front of cam handle 732 is flush with the forward most portion of front rail. Human digital clearance exists between handle 732 and the front rail, sufficient for a human digit (i.e., a finger or thumb) to access the handle. At this point, the cam glide 733 has rotated up and off of the channel 586 of the rail 580 and has rotated into the opening 745. The divider now sits on and directly contacts the rail, while the cam engages the rail and secures the divider to the rail, preventing lateral movement of the divider. In an exemplary aspect, the cam 720 snaps to the rail with an audible notification heard with standard adult human hearing when in the position depicted in FIG. 94C, indicating that the cam is locked to the rail.

To release the cam from the snapped-in-place or locked position, a user simply lifts upward on the handle 732 to release the cam surfaces 725 and 727 from the groove walls 754 and 756. As the cam is being released from the groove walls, the cam glide will rotate back into contact with the rail channel 586 and lift the divider up and off of the rail. The divider then will rest on the rail via the cam glide and may then be moved laterally relative to the rail, and the operation described above can be repeated. As indicated above, during the locking and releasing of the cam relative to the rail groove, the cam is at all times in contact with the rail and is at all times in contact with the divider.

In an exemplary aspect, the merchandise display system may include a front rail and at least one divider configured to engage the front rail. The divider may include a barrier, a divider wall, and a divider floor perpendicular to the divider wall configured to hold product, as set forth herein. A front lock, such as the exemplary cam 720 described herein, may be coupled to the divider. In an aspect, the front lock is configured to rotate, pivot or move between a first position and a second position. When in the first position, the front lock may permit slidable movement of the divider relative to the front rail. In one embodiment, the lock may lift the divider up off of the front rail. When in the second position, the lock locks the divider to the front rail and prevents slidable movement between the divider and the front rail. The cam is in constant contact with the front rail in both the first position and the second position, and all positions in between the first position and second position.

In an example, a lock for the divider, such as cam 720 or other locks, is located at an end of divider. The lock can be located at the front end of the divider (i.e., the end of the divider closest to or in contact with the front rail 580, which also is the end closest to the consumer selecting product). The lock, such as cam 720, can be forward of the divider wall 522. The lock, such as cam 720, can be forward of barrier 556. When located at the front end of the divider and in front of the divider wall 522 and in front of barrier 556, the lock is digitally accessible by an individual providing maintenance to the shelf, restocking the shelf or replanogramming the shelf, even when product is on the divider floor 554 and even when the divider floor 554 is full of product (i.e., no additional product can fit on the divider floor). The lock (such as cam 720) can be located on the divider such that the lock is in front of product when product is on the divider floor 554 and product will not interfere with access to the lock in any position of the product when the product is on the divider floor 554. The cam handle 732 can be flush with the front end of the front rail 580 and can extend beyond the front end of the front rail 580.

In an example, the merchandise display system may include a front rail, at least one divider configured to engage the front rail, and the at least one divider including a barrier. The at least one divider may further include a divider wall, and a divider floor perpendicular to the divider wall where the divider floor is configured to hold product. The merchandise display system also includes a front lock coupled to the front end of the divider. The front lock is in front of the barrier and in front of the divider wall. The front lock is configured to be digitally accessible when product is on the divider floor. The front lock is shiftable between a first position and a second position. The front lock lifts the divider up off of and out of contact with the front rail when in the first position and permits slidable movement of the divider relative to the front rail. The front lock prevents slidable movement of the divider relative to the front rail when in the second position.

In an example, FIGS. 86E and 86F illustrate magnified portions of cam 720 and front rail 580. The cam 720 can include texturing. Cam 720 can include teeth or other engaging members. In an embodiment, first cam wall 726 is textured with teeth 736 and 738. Teeth 736 can form a lower row of teeth. Teeth 738 can form an upper row of teeth. Teeth 736 and teeth 738 in an embodiment are rounded. In at least one embodiment, teeth 736 and teeth 738 form one vertical row of teeth. Eliminating the points on the teeth can provide for better operation and longer-life for the cam teeth. Cam 720 also can be textured in manners other than with teeth, such as through roughening or other texturing.

In an example, front rail 580 includes a groove 750, as illustrated in FIG. 86F. The groove 750 may include a first groove wall 752, a second groove wall 754 and a third groove wall 756. First groove wall 752 is connected to second groove wall 754, which in turn also is connected to third groove wall 756. In another embodiment, the groove 750 only has two groove walls. A first groove wall, such as first groove wall 752, and a second groove wall 754. The second groove wall 754 is straight and spans the length shown by groove walls 754 and 756. There is no bend in the second groove wall 754 in this embodiment.

In an embodiment, groove 750 can be textured. Groove 750 can include teeth. In an embodiment, first groove wall 752 includes teeth 766 and teeth 768. Teeth 766 can form a lower row of teeth. Teeth 768 can form an upper row of teeth. In at least one embodiment, teeth 766 and 768 form one vertical row of teeth. Teeth 766 and 768 can be rounded. Teeth 766 and 768 can be placed along an entire length of groove 750. In addition, teeth 766 and 768 can be placed in sections along groove 750 with additional sections of groove 750 that are smooth and without teeth. Groove 750 also can be textured in manners other than with teeth, such as through roughening or other texturing. In an embodiment, second groove wall 754 is smooth and third groove wall 756 is smooth. In an embodiment, second cam wall 728 is smooth and third cam wall 730 is smooth.

Figure 87A:
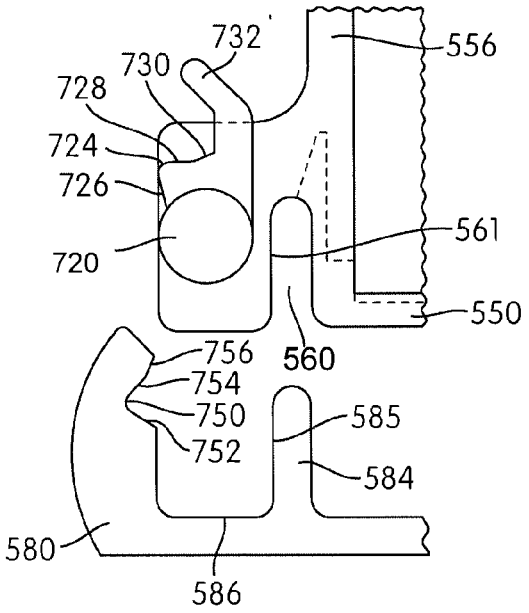
FIGS. 87A-C depict side views of exemplary dividers and front rails in accordance with one or more aspects of the disclosure.
Figure 87B:
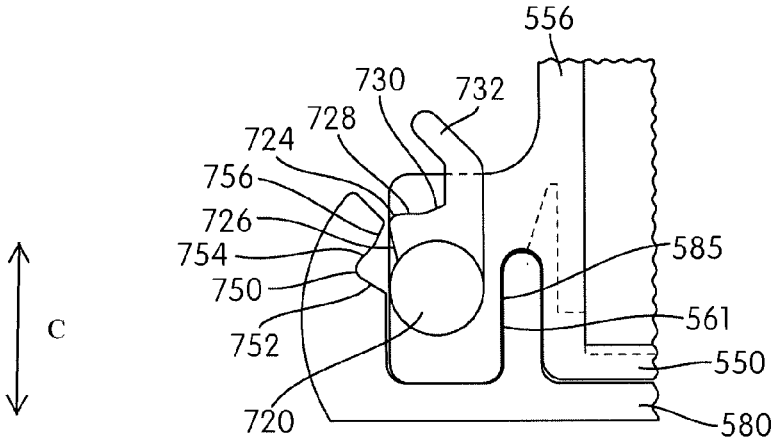
Figure 87C:
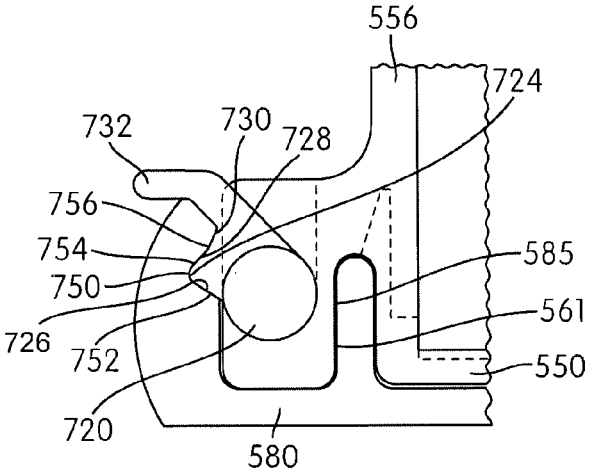

In an embodiment, as shown in FIGS. 87A-C, a merchandise display system 10 comprises a divider 550 and a front rail 580. The divider 550 comprises a divider wall 556, a divider floor 554 and a barrier 554. A cam 720 is rotatably coupled to a front portion of the barrier 556. The cam 720 includes a cam tongue 724, wherein the cam tongue 724 comprises a first cam wall 726, a second cam wall 728 and a third cam wall 730. The cam 720 also includes a handle 732. The front rail 580 comprises a groove 750 that is comprised of a first groove wall 752, a second groove wall 754 and a third groove wall 756. The cam 720 is configured to rotate between a first position and a second position, wherein when the cam 720 is in the second position, the cam tongue 724 is engaged with the front rail groove 750 and the divider wall 5560 is inhibited from moving in a lateral direction. The cam 720 also can be configured to slide between a first position and a second position.

FIGS. 87A-C show a progression in which divider 550 is coupled to front rail 580. The cam 720 is moved between a first position in FIG. 87B to a second position in FIG. 87C. As described below, the cam 720 allows for the divider 550 to be moved laterally along the front rail 580 or otherwise parallel to the front rail 580 when the cam 720 is in the first position shown in FIG. 87B. (In FIG. 87 B the divider 550 is secured in the direction perpendicular to the front rail 580 and cannot move in the perpendicular direction, other than for an insignificantly small amount of play that may exist between the divider and the front rail, which may not be noticeable to a user of the system.) The cam 720 inhibits the divider 550 from moving laterally along the front rail 580 when the cam 720 is in the second position shown in FIG. 87C. In an example, under normal operating conditions and forces, the cam 720 will prevent the divider 550 from moving laterally along front rail 580 (and render the divider 550 immovable along the front rail 580) when the cam 720 is in the second position shown in FIG. 87C. In another example, the cam 720 inhibits movement of the divider 550 by preventing the divider 550 from moving laterally along front rail 580 when a force equal to or less than a predefined amount of force is applied to the divider 550 in a lateral direction parallel to the front rail 580. When an amount of force above the predefined amount of force is applied to the divider 550 in a lateral direction parallel to the front rail 580, the divider 550 moves in the lateral direction parallel to the front rail 580.

FIG. 87A shows divider 550 raised above front rail 580. In FIG. 87B, divider 550 has been lowered and placed into contact with front rail 580. Groove 560 has been placed over ridge 584 and ridge 584 has been placed with groove 560. Groove 560 and ridge 584 may be in contact with each other in this position. Groove 560 and ridge 584 also may not be in contact with each other at all times in this position. Space can exist between the surfaces of groove 560 and ridge 584 in some positions. A front portion of barrier 556 also has been placed within channel or groove 586. In FIG. 87B, the tongue 724 of cam 720 is not engaged with the groove 750 of front rail 580. In FIG. 87B, the divider 550 can move in a lateral direction shown by arrow "A" in FIGS. 86F and 86H. Divider 550 need not be raised above front rail 580 to enable such movement. Divider 550 can remain in contact with front rail 580 and move in direction "A." Product may be placed on the divider floor 554 during the process of moving divider 550. The ability to move divider 550 without separating divider 550 from front rail 580 or removing product provides for ease of replanogramming. In FIG. 87B, the divider 550 can move in the plane of the shelf (the shelf is shown as 596 in FIGS. 70 and 71) only in the lateral direction parallel to the front rail 580 shown by arrow "A" in FIGS. 86F and 86H. In FIG. 87B, the divider 550 is immovable in all other directions in the plane of the shelf, such as the direction shown by arrow "B" in FIG. 86H, under normal operating forces and conditions. The divider 550 cannot swing, rotate, splay or fish tail in the plane of the shelf and the divider 550 remains perpendicular to front rail 580 under normal operating forces and conditions. In FIG. 87B, the divider 550 can move in the direction shown by arrow "C" in FIG. 87B and thereby lift away from the front rail 580. The direction shown by arrow "C" in FIG. 87B is not in the plane of the shelf.

In FIG. 87C, cam handle 732 has been rotated toward front rail 580. In an embodiment, cam handle 732 is in contact with front rail 580. As the cam 720 is rotated from its position in FIG. 87B to its position in FIG. 87C, cam tongue 724 comes into contact with the front rail 580 and slightly deforms the front rail 580 away from cam tongue 724. Cam first wall 726 may be in contact with groove third wall 756 as the cam 720 is being rotated from its position in FIG. 87B to its position FIG. 87C.

As the cam moves into the position shown in FIG. 87C, tongue 724 can snap into place within groove 750 and tongue 724 is engaged with groove 750. In an embodiment, tongue 724 is in perfect fit with groove 750. This perfect fit involves engagement of the tongue 724 and the groove 750. Front rail 580 is not deformed and the cam 720 and the front rail 580 are not in tension with each other. First cam wall 726 is adjacent first groove wall 752. Second cam wall 728 is adjacent second groove wall 754. Third cam wall 730 is adjacent third groove wall 756. In an embodiment, the cam walls and the groove walls are in contact with each other. For example, first cam wall 726 is in contact with first groove wall 752; second cam wall 728 is in contact with second groove wall 754; and third cam wall 730 is in contact with third groove wall 756. In at least one embodiment, while the cam walls and the groove walls are in contact with each other they are not in substantial tension with each other. In another embodiment, one or more of the cam walls are in tension with one or more of the groove walls when the cam walls and groove walls are in contact with each other.

In an embodiment where first cam wall 726 has been placed in contact with first groove wall 752, the teeth of first cam wall 726 engage the teeth of first grove wall 752. Teeth 736 engage teeth 766 and teeth 738 engage teeth 768. The engagement of the teeth of the first cam wall and the teeth of the first groove wall provides resistance to the divider moving laterally along the front rail in the lateral direction shown by arrow "A" (as shown in FIG. 86H).

When cam tongue 724 has been placed in perfect fit with groove 750, there is substantial resistance to movement of the divider 550 laterally along the front rail in the lateral direction shown by arrow "A," (as shown in FIG. 86H) and the divider 550 will not move laterally under the normal forces placed on the divider during operation.

When it is desired to again move the divider 550 along front rail 580, the cam can be unsnapped from the front rail. Handle 732 can be rotated away from front rail 580. Tongue 724 can disengage from groove 750 and return to its position in FIG. 87B.

In an embodiment, the divider wall 552 has sections of different width (see FIG. 85). A front section 770 of the divider wall 552 that can be adjacent barrier 556 can have a greater width than a rear section 772 of divider wall 552 that is adjacent barrier 556. Front section 770 can be connected to rear section 772 by an intermediate section 774. The width of intermediate section 774 gradually changes from the width of the divider front section 770 to the width of the divider rear section 772. In an embodiment, the width of the portion of the intermediate section 774 adjacent section 770 is equal to the width of section 770 and the width of the portion of the intermediate section 774 adjacent section 772 is equal to the width of section 772. The lesser width of rear section 772 of divider wall 552 creates air space between divider walls 552 and assists in preventing product from binding between two divider walls 552 when being pushed and assists in providing for flow of product along the divider floor 554 as product is removed from the front of the merchandise system 10. In an example, the width of the front section 770 of the divider wall 552 is at least 25% greater than the width of the rear section 772 of the divider wall 552.

In the embodiments shown in FIGS. 85-87C one or more dividers 550 can be placed into contact with front rail 580. When the cam 720 or other engaging member is not engaged with front rail 580, the dividers 550 can move parallel to the length of front rail 580 in the lateral direction shown by arrow "A" (see FIG. 86H). The divider 550 can then be fixed into place by snapping the cam 720 or other engaging member into engagement with front rail 580. The divider 550 will remain fixed under normal operating forces until the cam 720 or other engaging member is unsnapped or otherwise placed out of engagement with front rail 580.

Figure 86I:
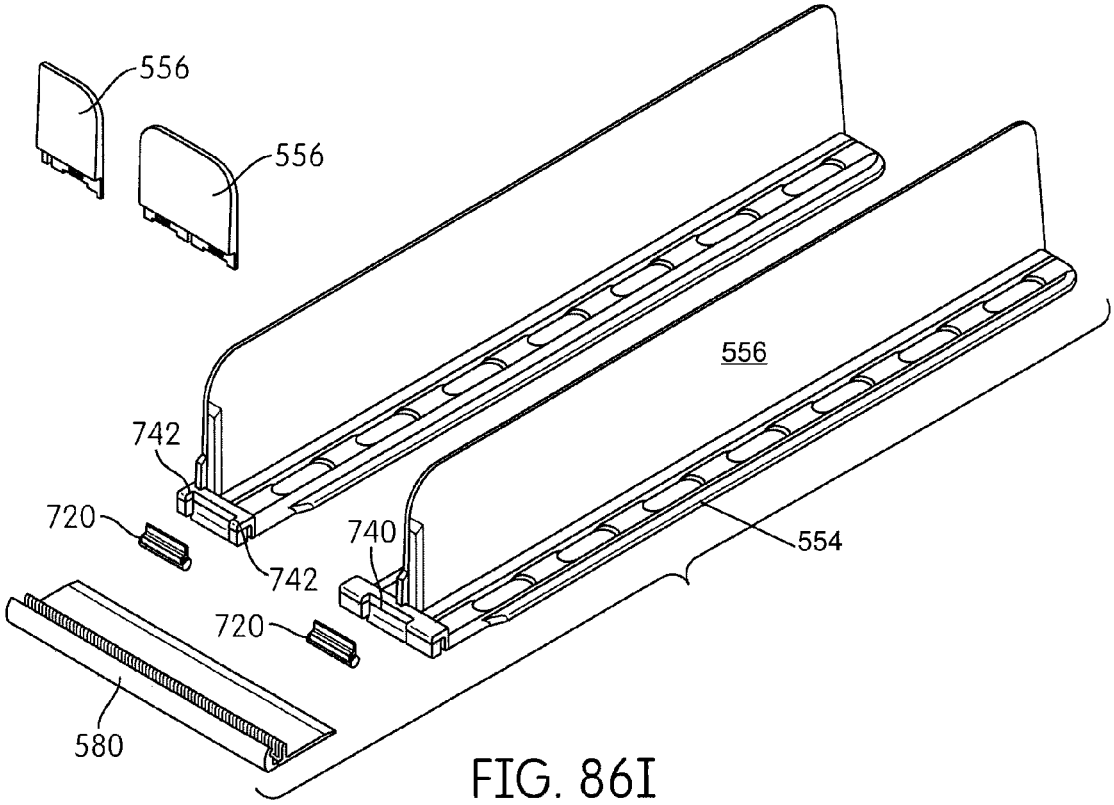
Figure 86J:
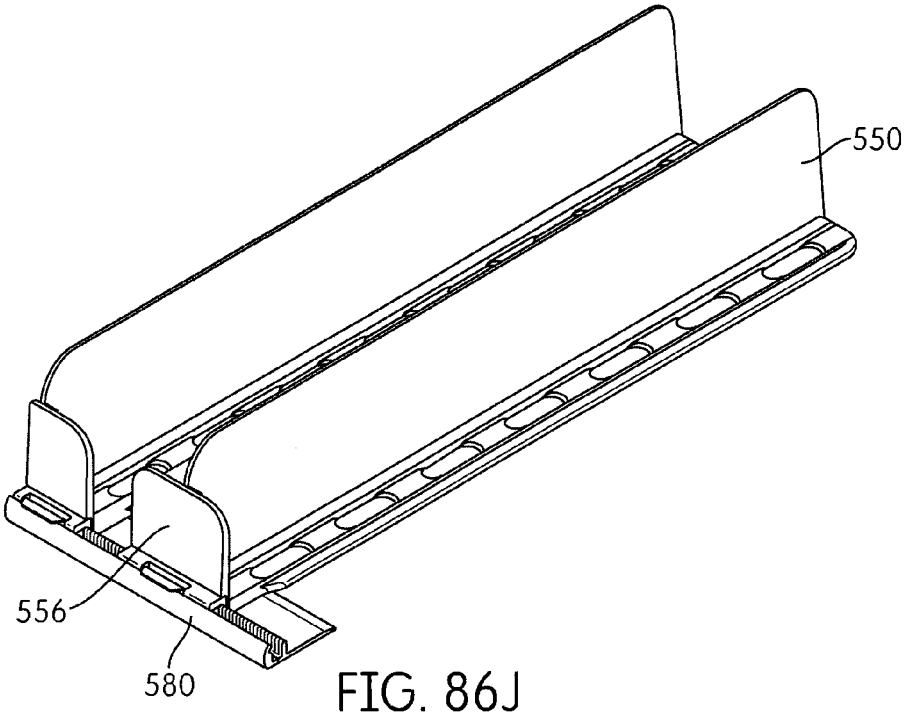
Figure 86K:
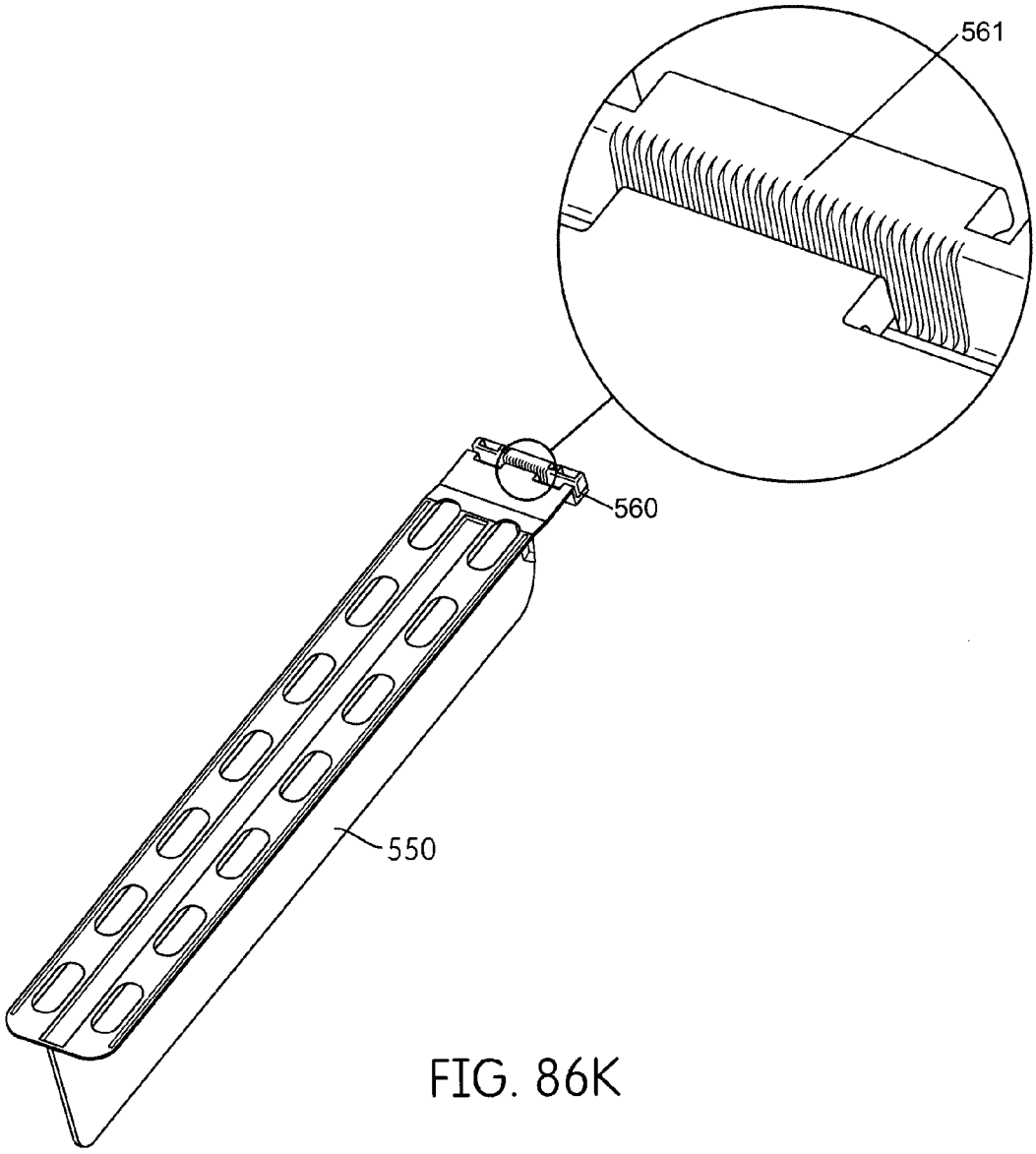
Figure 86L:
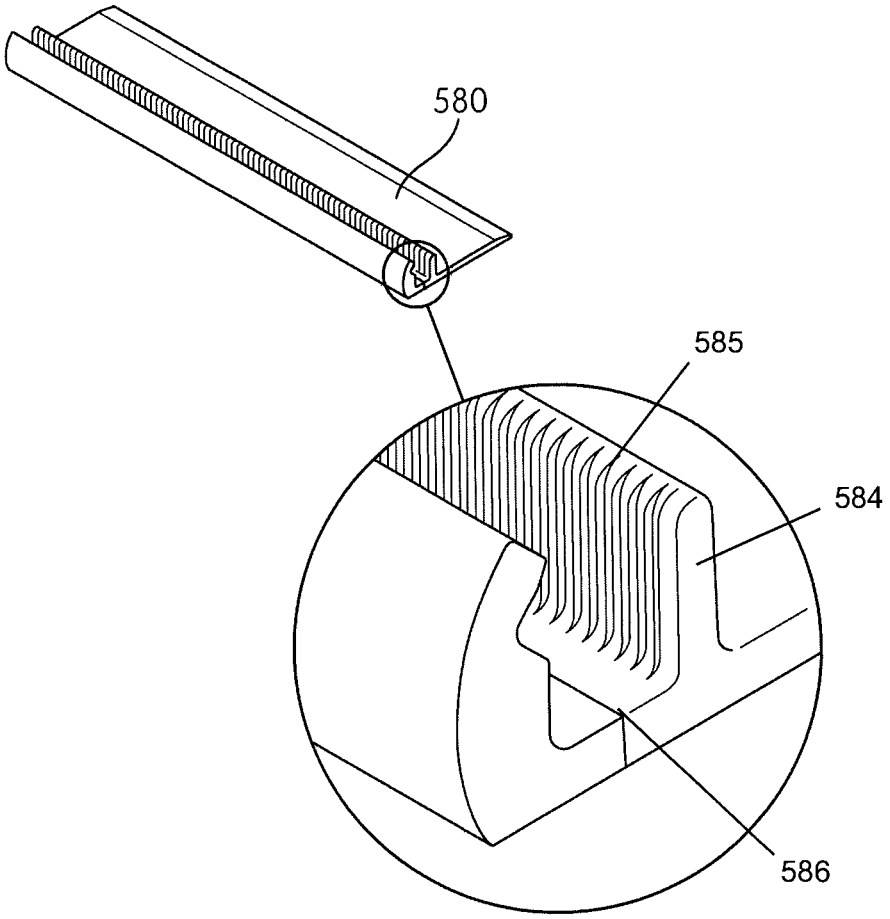

In an embodiment, the front wall 561 of groove 560 is textured, as shown in FIG. 86K. This texturing can be in the form of roughening or small teeth. The texturing causes the surface of the front wall 561 of groove 560 to not be smooth. In an embodiment, front wall 585 of ridge 584 or other protrusion or engaging member is textured, as depicted in FIGS. 86I, 86J, and 86L. This texturing can be in the form of roughening or small teeth and causes the surface of front wall 585 of ridge 584 to not be smooth.

In at least one embodiment, as depicted in FIG. 86I, the barrier 556 is a separate component and may removably attached to the divider 550. In at least one embodiment, the barrier 556 may snap on to the front of the divider 550. In at least one embodiment, the barrier 556 is moveable. The entire barrier 556 may be movable, or a portion or portions of the barrier 556 may be moveable. For example, the portion of the barrier 556 positioned in front of product on the merchandise display system 10 may be movable. In at least one embodiment, the portion of the barrier 556 positioned in front of the product may be configured to slide. In an alternative embodiment, the portion of the barrier 556 positioned in front of the product may be configured to rotate around an axis, to allow the portion of the barrier 556 to open and close. In this embodiment, the axis may be a hinged connection. Additionally or alternatively, the portion of the barrier 556 may be spring mounted to the divider 550, such that the portion of the barrier 556 requires an amount of force to move it away from the divider 550. In this embodiment, upon release of the force, the portion of the barrier 556 will close or return to its original position. Exemplary methods for mounting the barrier 556 are described in further detail in U.S. Pat. No. 8,056,734, which is incorporated by reference herein in its entirety.

In an example, the divider 550 does not include a barrier. Alternatively, one or more barriers may be included in the front rail 580.

In an embodiment, when the divider 550 is placed in contact with the front rail 580, as shown in FIG. 87B, front wall 561 of groove 560 is not in contact with or not in consistent contact with front wall 585 of ridge 584 while the cam 720 is in the position shown in FIG. 87B and the tongue of cam 720 is not engaged with groove 750 of front rail 580. When the cam 720 is moved from a first position shown in FIG. 87B to a second position shown in FIG. 97C, and the tongue 724 engages with groove 750, the tongue can force the divider 550 to move backward. In an embodiment, tension between the tongue 724 and the groove 750 forces divider 550 to move in a rearward direction. When the cam is moved to the second position shown in FIG. 87C front wall 561 of groove 560 comes into contact with front wall 585 of ridge 584. Front wall 561 engages with front wall 585. The texturing on front wall 561 of groove 560 engages with the texturing on front wall 585 of ridge 584. The engagement of front wall 561 of groove 560 with front wall 585 of ridge 584 inhibits movement of the divider 550 along front rail 580 in the direction shown by arrow "A" in FIG. 86H. The engagement of the texturing on front wall 561 of groove 560 with the texturing on front wall 585 of ridge 584 further inhibits movement of the divider 550 along front rail 580 in the direction shown by arrow "A" in FIG. 86H.

In an example, a resilient strip or bead can be included into the top surface of ridge 584, or other protrusion, of front rail 580. When cam 720, or other engaging device, is in a first position, the resilient strip or bead is not compressed. In this first position, the divider 550 can move in a lateral direction parallel to the front rail, but cannot move in a direction perpendicular to the front rail. When cam 720, or other engaging device, is moved to a second position, the resilient strip or bead comes into compression with groove 560, or other recess, of divider 550. When the resilient strip or bead is in compression with groove 560, or other recess, divider 550 becomes fixed under normal operating forces in a direction parallel to the front rail 580. In an example, the portion of the groove 560, or other recess, that comes into contact with the resilient strip or bead of front rail 580 can include a roughening or teeth (not shown).

Figure 88A:
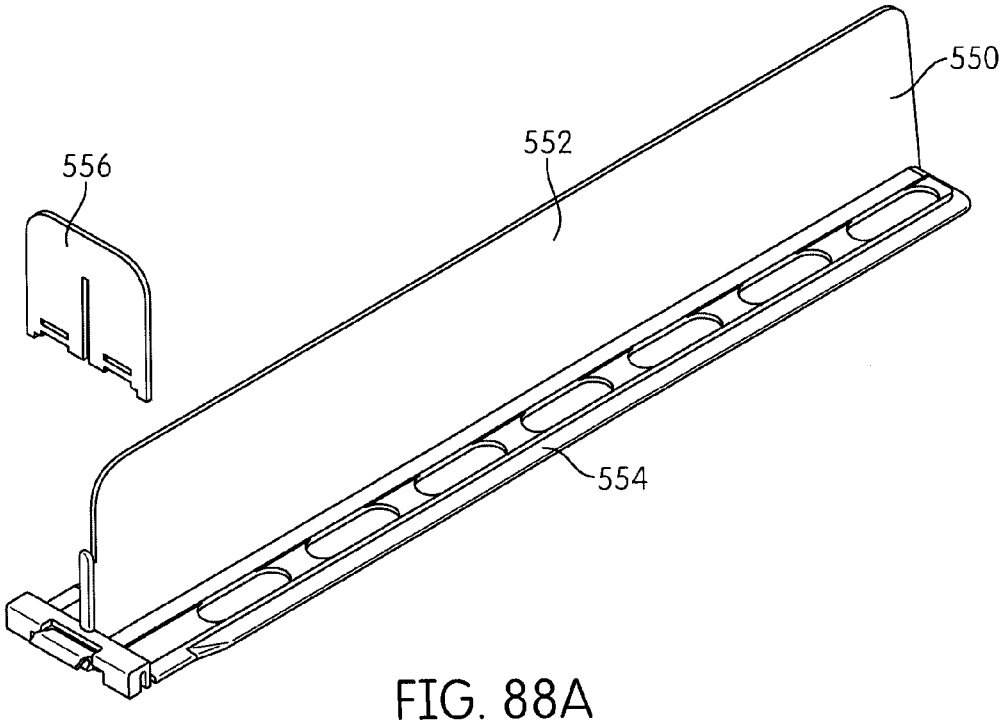
FIGS. 88A-B depict isometric views of an exemplary divider in accordance with one or more aspects of the disclosure.

In an embodiment, barrier 556 is not molded at the same time as divider wall 552 and divider floor 554. Barrier 556 is molded as a separate piece from divider wall 552 and divider floor 556, as shown in FIG. 88A. Barrier 556 may be molded of a clear material, whereas divider wall 552 and divider floor 554 may be molded of an opaque material.

In an example, a divider 550 includes an engaging member that comprises a planar surface. The front rail 580 can include an engaging member that comprises a planar surface. The planar surface of the engaging member on the divider and/or the engaging member on the front rail can comprise a smooth or substantially smooth surface. The planar surface can include a resilient surface. The planar surface can include a rubber strip or a neoprene strip or material that is otherwise compressible. In an example, when the engaging member of the divider 550 is in a first position it is not engaged with the engaging member of the front rail 580 and the divider 550 is movable laterally parallel to the front rail. When the engaging member of the divider 550 is in a second position it is engaged with the engaging member of the front rail 580 and the divider is fixed and not movable laterally parallel to the front rail under normal operating conditions and forces. In an example where the engaging members of the front rail 580 and the divider 550 are smooth or substantially smooth surfaces and do not include teeth or other protrusions, the divider 550 can have additional lateral adjustability and infinite or near infinite lateral adjustability. The lateral adjustability of the divider 550 is not limited by the physical dimensions, such as width, of projections or teeth. Infinite lateral adjustability provides significant benefits to display systems by efficiently utilizing lateral space and limiting or minimizing unused or lost space between product rows and thereby potentially increasing the amount of usable space and lateral product facings on a shelf.

Figure 88B:
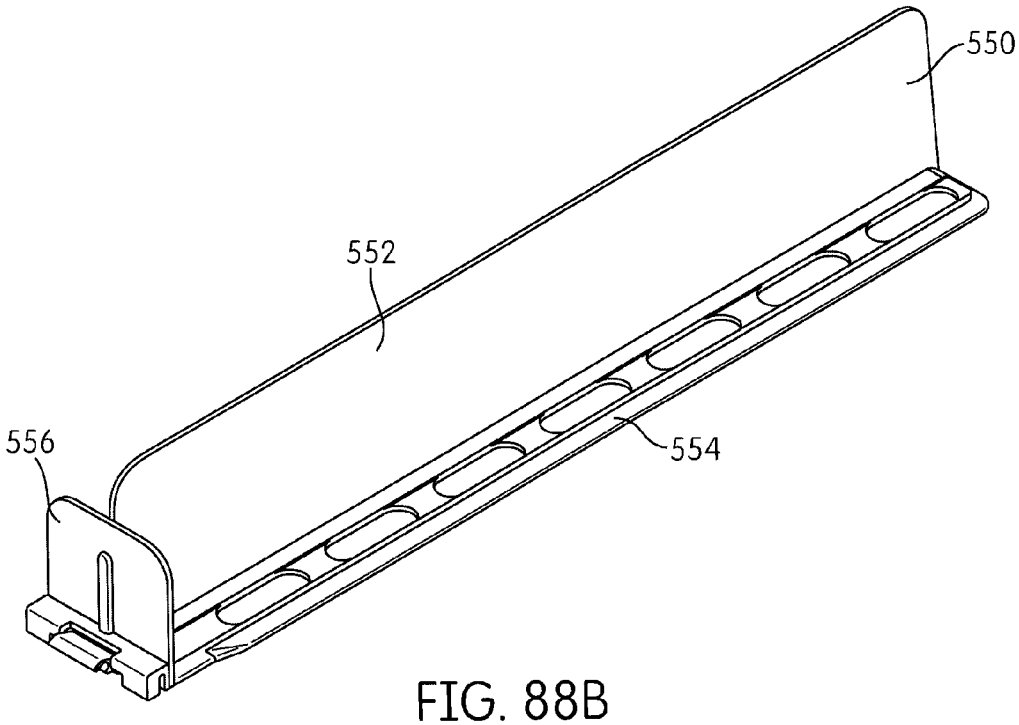

In an embodiment, barrier 556 can be snap fit or otherwise engaged with divider 550, as shown in FIG. 88B. The engagement between barrier 556 and divider 550 can be such that barrier 556 cannot be removed from divider 550 under normal operating conditions and without deleteriously affecting the structure of barrier 556 or divider 550.

Figure 89A:
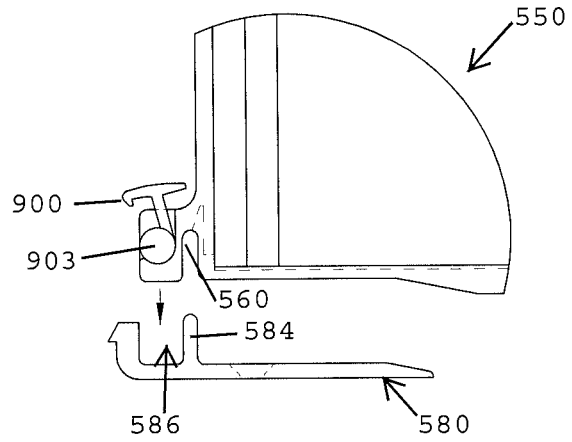
FIGS. 89A-C depict side views of an exemplary divider attaching to a front rail in accordance with one or more aspects of the disclosure.
Figure 89B:
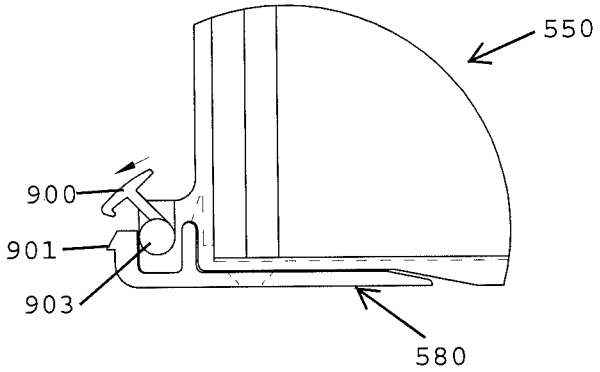
Figure 89C:
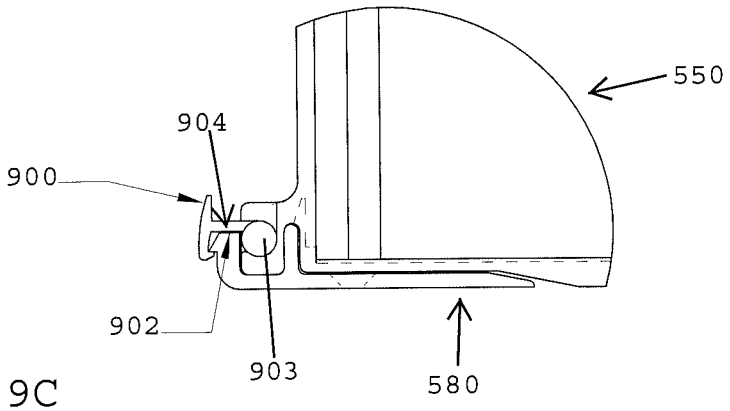

FIGS. 89A-C show an example of a step by step approach to placement of a divider in a front rail. In the initial step, as illustrated in FIG. 89A, the divider 550 may be lowered into contact with the front rail 590. A rotating "T" lock 900 may be rotated to snap over the front rail 580. The rotating "T" lock 900 may be attached to a front portion of the divider 550. The rotating "T" lock 900 may rotate around an axis 903. The divider 550 may be lowered and placed in contact with the front rail 580, as illustrated in FIG. 89B. The groove 560 or other recess of the divider 550 engages the ridge or tongue 584 or other protrusion of the front rail 580. At this point the divider 550 can be moved in a lateral direction parallel to the front rail and can allow for ease of replanogramming. In an example the divider 550 can move along the front rail. The divider 550, with or without product on the divider floor 554, can be slid in the direction previously noted by arrow "A" in FIG. 65, without requiring that the divider 550 be lifted up. In the final step, as illustrated in FIG. 89C, the rotating "T" lock 900 may be pushed forward and downwardly toward the front rail 580. The rotating "T" lock 900 may engage with a lip 901 on a front portion of the front rail 580. In at least one embodiment, the front rail 580 includes a top front surface 902. The top front surface 902 may include a texture or may be a resilient surface, such as rubber. Alternatively, the top front surface 902 may include one or more teeth. The top front surface 902 may engage with a surface 904 on the rotating "T" lock 900. The surface 904 may also include a texture or may be a resilient surface, such as rubber. Alternatively, the surface 904 may include teeth configured to engage the teeth on the top front surface 902. When the rotating "T" lock 900 engages lip 901, the divider 550 is engaged to the front rail 580 and cannot move in a lateral direction under a normal amount of force.

Figure 90A:
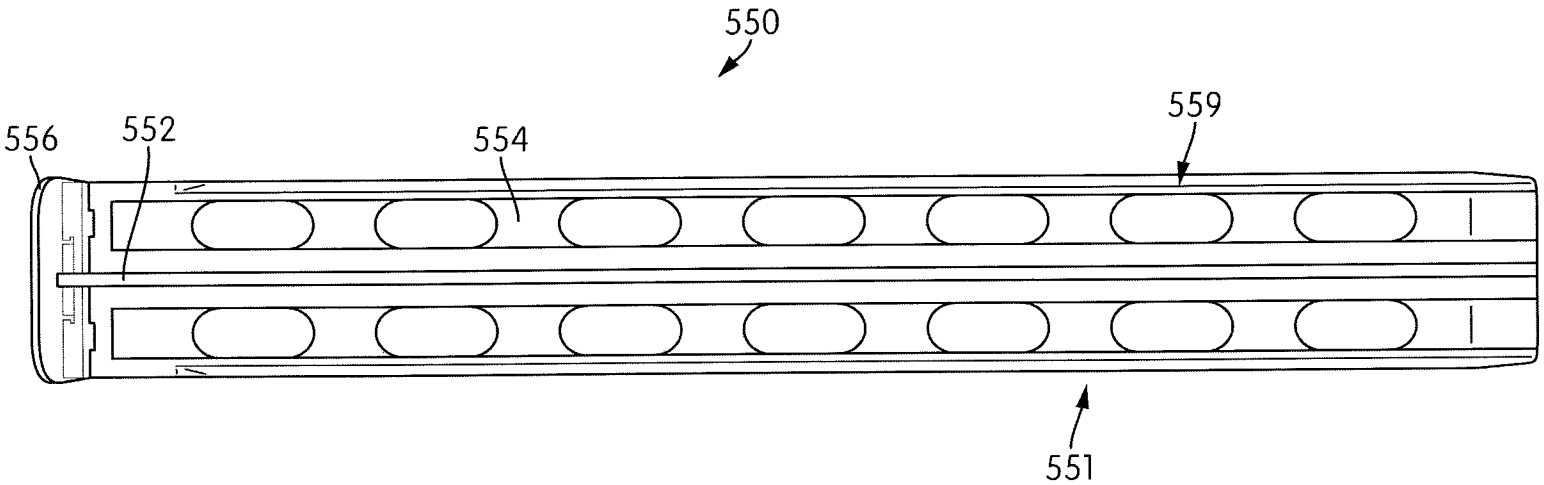
FIGS. 90A-F depict views of an exemplary divider attaching to a front rail in accordance with one or more aspects of the disclosure.
Figure 90B:
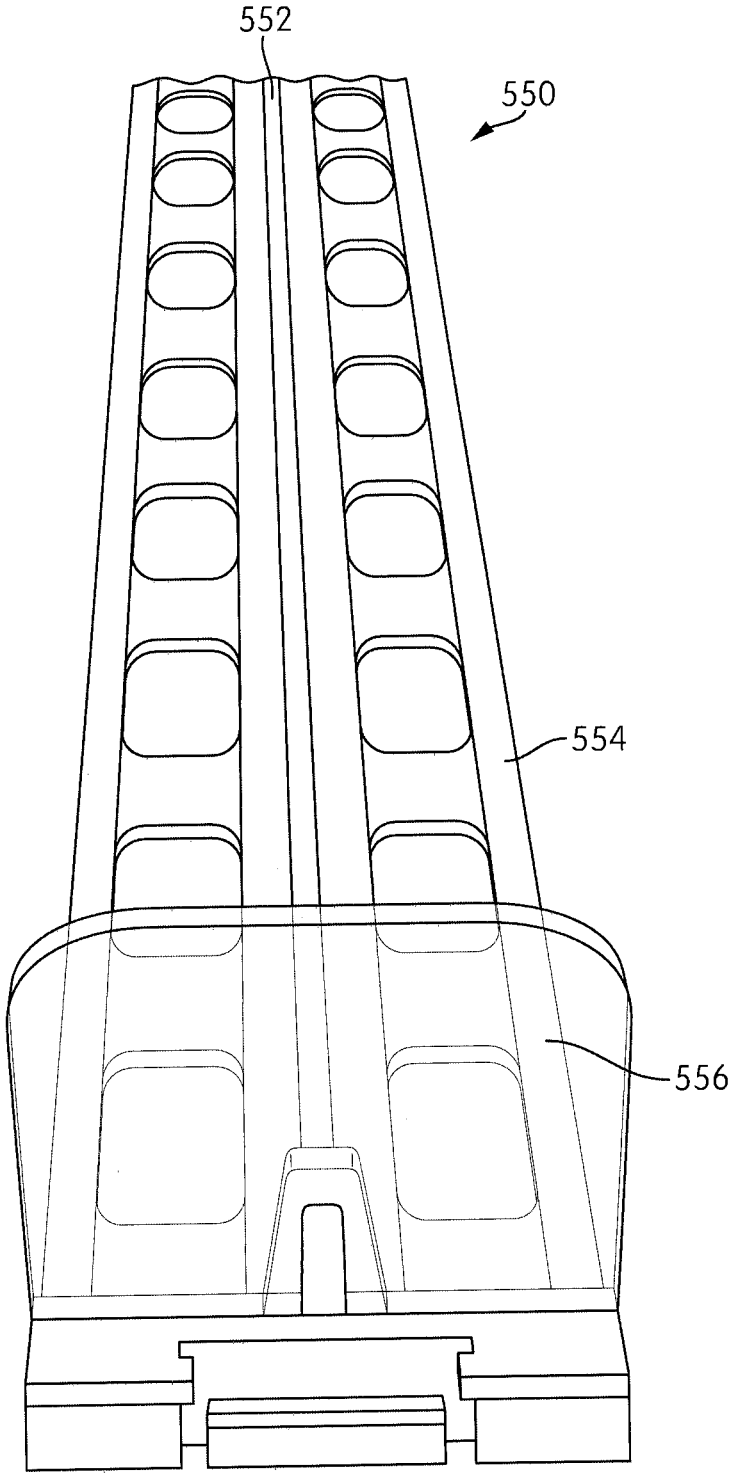
Figure 90C:
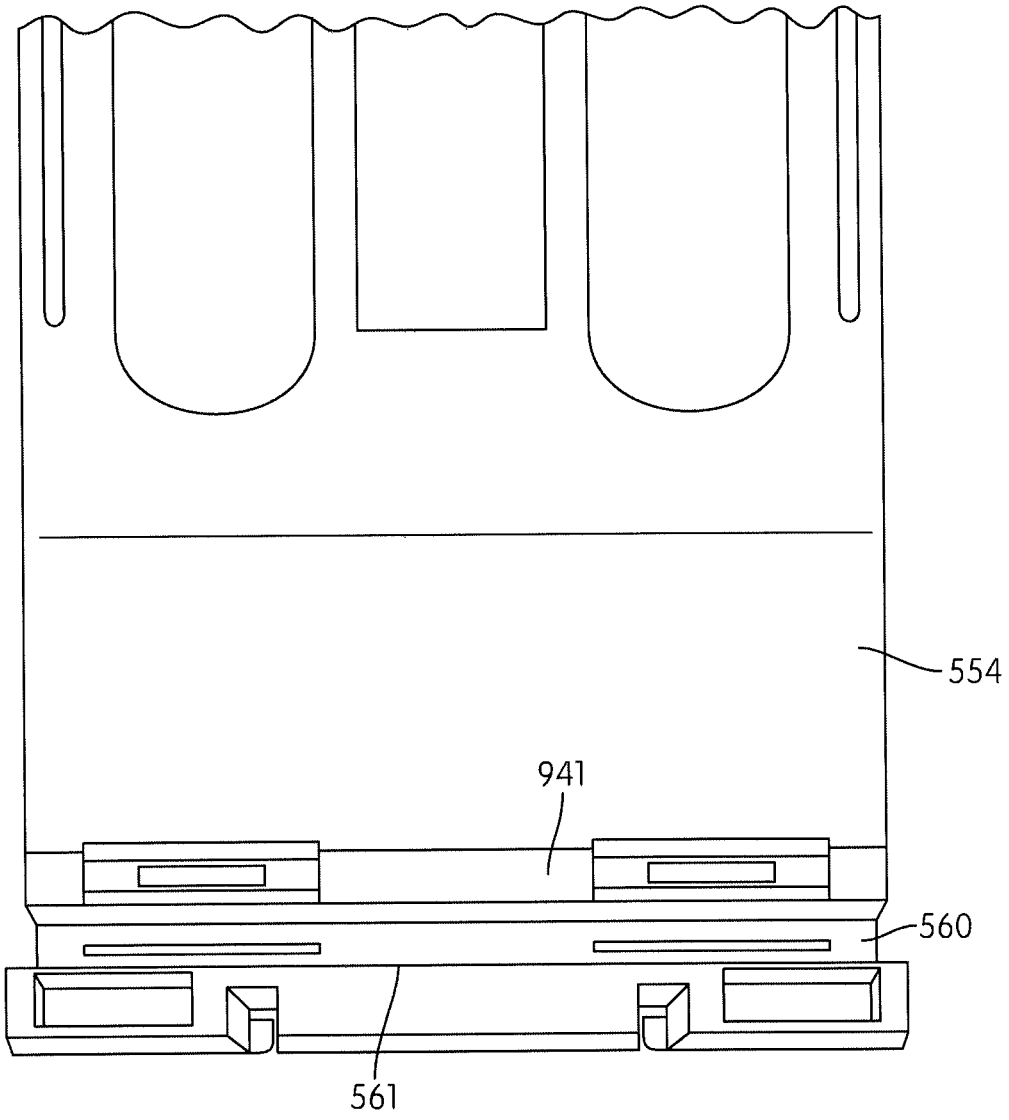
Figure 90D:
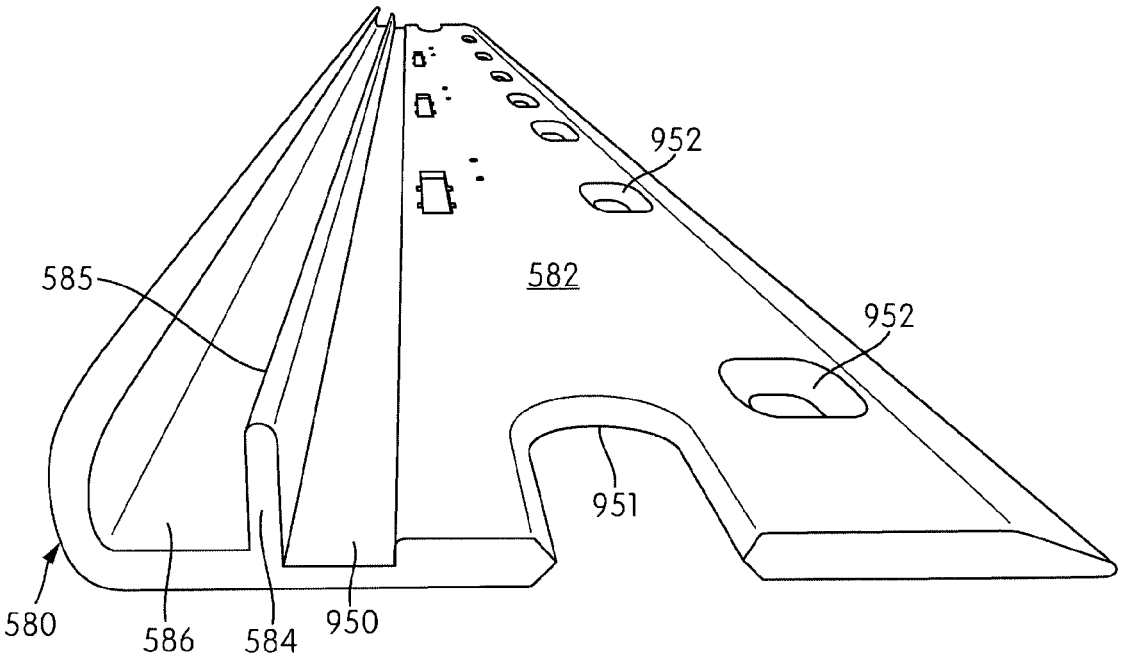
Figure 90E:
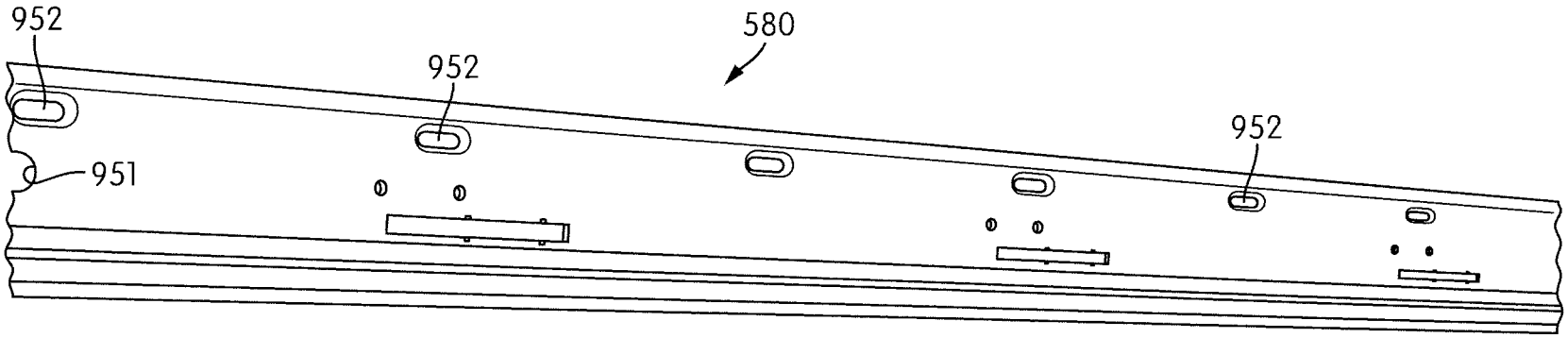
Figure 90F:
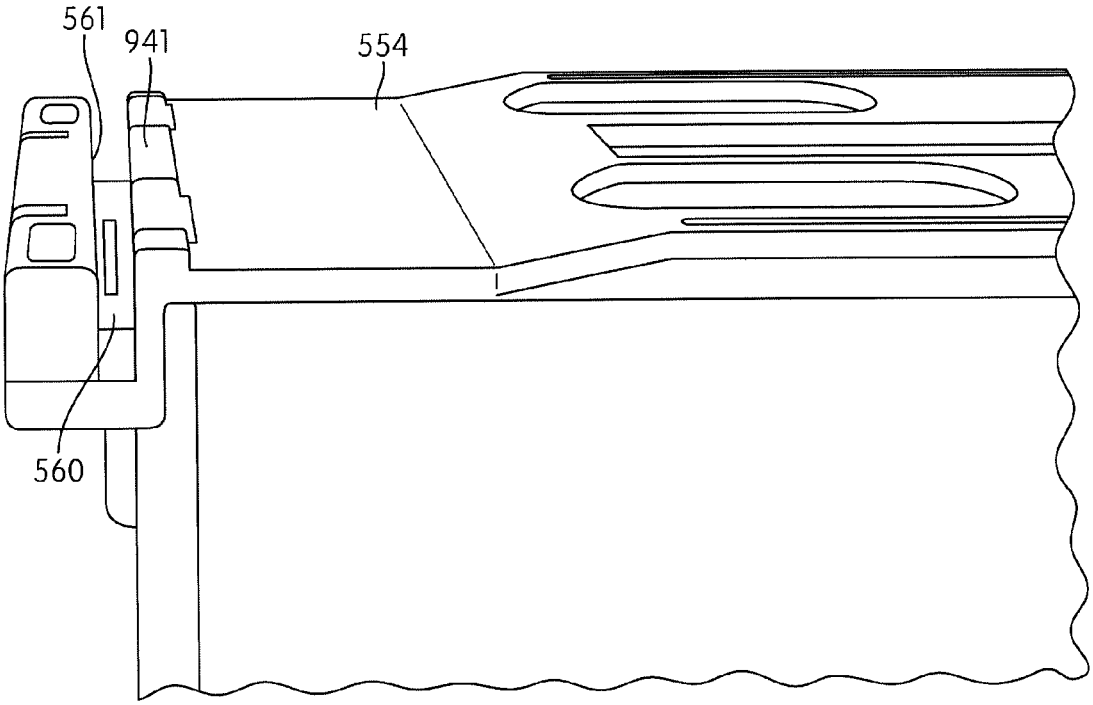

FIGS. 90A-F illustrate embodiments of the divider 550 and front rail 580. As shown in FIG. 90A, a divider 550 may include wall 552, a floor 554 and a barrier 556. The divider wall 552 may divide the divider floor 554 into two portions, 559 and 551 with one portion on each side of the divider wall 552. As illustrated in FIG. 90B, the divider wall 552 may extend perpendicularly from the divider floor 554. The barrier 556 may be located at the front of the divider wall 552. As illustrated in FIGS. 90C and 90F, the bottom surface of the divider floor 554 may include a groove 560 or other recess, a tongue 941 or other protrusion, and a front wall 561. In at least one embodiment, the front wall 561 of groove 560 is textured. This texturing can be in the form of roughening or small teeth. The texturing may cause the surface of the front wall 561 of groove 560 to not be smooth.

As illustrated in FIG. 90D, a front rail 580 can define a planar surface 582, a ridge or tongue 584 or other projection, a first channel or groove 586 or other recess, and a second channel or groove 950 or other recess. The front wall 561 of the divider 550 may engage the first groove 586 of the front rail 580. The ridge or tongue 584 of the front rail 580 may engage the groove 560 of the divider 550. The tongue 941 of the divider 550 may engage the second groove 950 of the front rail 580. In an embodiment, front wall 585 of ridge 584 is textured. This texturing can be in the form of roughening or small teeth and causes the surface of front wall 585 of ridge 584 to not be smooth. The texturing of the front wall 585 of the ridge 584 may engage with the texturing of the front wall 561 of groove 560. The engagement of the front wall 561 of the divider 550 to the first channel 586 of the front rail 580, the engagement of the ridge or tongue 584 of the front rail 580 to the groove 560 of the divider 550, and the engagement of the projection 941 of the divider 550 to the second groove 950 of the front rail 580 may keep the divider wall 552 perpendicular to the front rail 580 and prevent a back portion of the divider 550 from splaying. In at least one embodiment, the divider 550 may be moved laterally parallel to and/or along the front rail 580 when the divider 550 receives a lateral force.

The front rail 580 may include apertures 951 and openings 952, as illustrated in FIG. 90E. The apertures 951 may be configured to engage with corresponding engagement projections (not shown). In an example, the engagement projection can be a flat splicer. The corresponding engagement projections may connect one or more front rails 580 together in series. The connection of the apertures 951 and engagement projections can allow for one or more front rails 580 to be connected in series, even if the front rails 580 are not in perfect alignment with each other. The openings 952 may be configured to receive fasteners, which fasten the front rail 580 to a display shelf. The front rail 580 may include any number of opening 952 suitable for securing the front rail 580 to a display shelf. Any type of fastener may be contemplated within the scope of the invention.

Figure 91A:
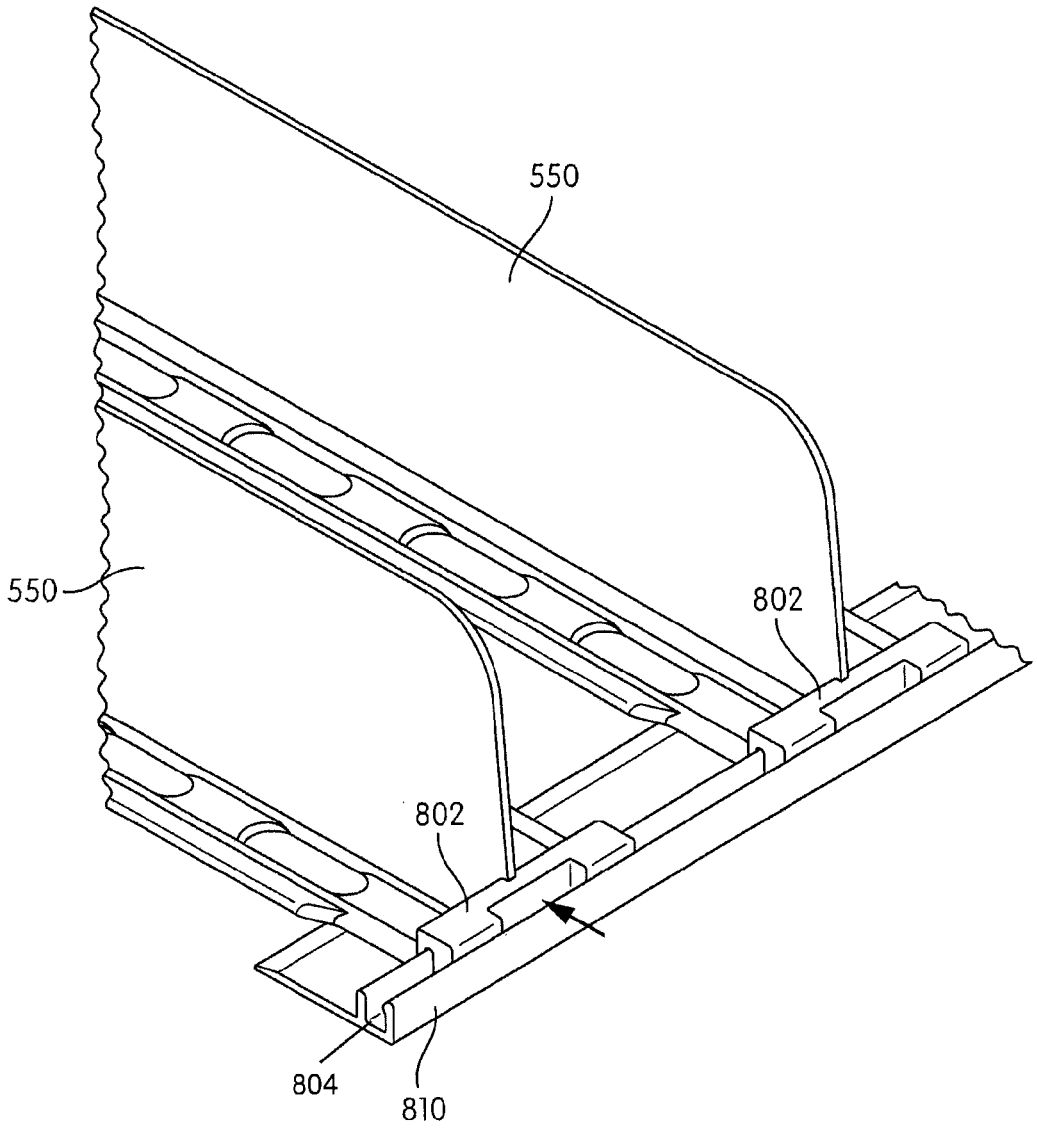
FIG. 91A depicts a view of an exemplary divider and a rear rail in accordance with one or more aspects of the disclosure.

In an example, as illustrated in FIG. 91A, the merchandise display system 10 may include a back rail 810. The back rail 810 can be located at or near the back of a shelf. The back rail

810 may be a similar construction as the front rail 580 and the disclosure herein regarding the front rail 580 applies equally to the back rail 810. For example, the back rail 810 may include a recess 804, which may generally be in the shape of a "u". In this embodiment, the dividers 550 may be connected to divider blocks 802. The divider blocks 802 may then engage with the back rail 810. The back rail 810 can be a second rail in the merchandise display system, along with the front rail 580. The back rail 810 also can be the only rail in the merchandise display system. As noted above, front rail 580 can be located at the rear of the merchandise display system and thereby function as a back rail 810. In at least one embodiment, the plurality of divider blocks 802 each has a cam 710 (not shown in FIG. 91A) in the location denoted by the arrow in FIG. 91A. This cam 720 can rotate from a first position to a second position and have the same effect as the cam 720 in the divider that engages with the front rail 580. The divider blocks 802 also can include other engaging devices, including the engaging devices described herein for the divider 550, that engage with the back rail 810. The use of the back rail 810 may keep the back of the dividers 550 in position and prevent product from moving to a position behind the pusher 520. To unlock the dividers 550 from the back rail 810, the 720 or other engaging device is rotated away from the back rail 810 or otherwise disengaged with the back rail 810.

In an example, a divider 550 can be placed into contact with a front rail 580. Groove 560 can be placed over ridge 584 and ridge 584 can be placed within groove 560. Groove 560 and ridge 584 can be in contact with each other in this position. Divider 550 also can be placed into contact with rear rail 810. A groove or other recess in the divider 550 can be placed over a ridge or other protrusion of rear rail 810 and the ridge or protrusion of the rear rail 810 can be placed within a groove or other recess of divider 550. Divider 550 can be in contact with front rail 580 and rear rail 810 at the same time. An engagement device, such as cam 720, on the front of the divider can be in a position such that the divider 550 can move laterally parallel to the front rail 580 and the rear rail 810, but the divider 550 is immovable in a direction perpendicular to front rail 580 or rear rail 810 (the direction between front rail 580 and rear rail 810). The divider block 802 also can include an engagement device (not shown), such as cam 720 or other engagement devices described above with respect to the front rail 810. The engagement device on divider block 802 can be in a position such that the divider 550 can move laterally parallel to the front rail 580 and the rear rail 810, but the divider 550 is fixed in a direction perpendicular to front rail 580 or rear rail 810 (the direction between front rail 580 and rear rail 810).

In an example, the engagement device on the front of the divider 550 can be moved to a second position. In the second position the divider 550 is fixed in a direction parallel to the front rail 580 under normal operating forces. The engagement device on divider block 802 also can be moved to a second position. In the second position, the engagement device on divider block 802 renders the divider 550 fixed in a direction parallel to the rear rail 810 under normal operating forces. The front rail 580, divider 550 and rear rail 810 can form a rigid tray that may be moved as a unit from one location to another. The front rail 580, rear rail 810 and a plurality of dividers 550 can be preassembled and formed into a rigid tray in a location away from the shelf. The front rail 580, rear rail 810 and a plurality of dividers 550 can then be moved to the shelf and secured to the shelf by one or more fasteners.

In an embodiment, a merchandise display system can include a barrier that is moveable by rotation between a folded position and an upright position without the aid of, for example, a rotation biasing element (such as a spring loaded hinge) dedicated to biasing the barrier into the upright position. Various example aspects of example systems that can include a barrier that is moveable between a folded position and an upright position without the aid of a rotation biasing element are shown in FIGS. 95 through 106. In an embodiment, the system can include a divider assembly 550 configured to be secured to a support structure. As used herein, a divider assembly 550 can also be referred to as a divider 550. A support structure can include, for example, a front rail 580. In an embodiment, a divider 550 can include forward end 553 and a reward end 555. Movement in the forward direction as used herein in regard to embodiments including a rotational barrier is defined by movement from the reward end 555 toward the forward end 553. For example, the arrow F depicted in FIGS. 99B and 100D is pointing toward the forward direction. Movement in the reward direction as used herein in regard to embodiments including a rotational barrier is defined by movement from the forward end 553 toward the reward end 555. For example, the arrow R depicted in FIGS. 99A and 100C is pointing toward the reward direction. Movement in a lateral direction as used herein in regard to embodiments including a rotational barrier is defined by movement in the directions shown, by example, by arrow A in FIGS. 65, 100A, and 103A. In an embodiment, a divider 550 can include a divider wall 552 having a right side surface 552*a* and a left side surface 552*b*. In an embodiment, the divider wall 552 can extend from the forward end 553 of the divider 550 to the reward end 555. In an embodiment, the divider wall 552 can extend upwardly from a divider floor 554. The divider floor can include a top surface 554*a* and a bottom surface 554*b*. In an embodiment, the divider wall 552 separates the divider floor 554 into a first side portion 559 and a second side portion 551 on each side of the divider 550. The first side portion 559 of the divider floor 554 can also be referred to as the right side portion 559 of the divider floor 554 and the second side portion 551 can also be referred to as the left side portion 551 of the divider floor 554.

Figure 96A:
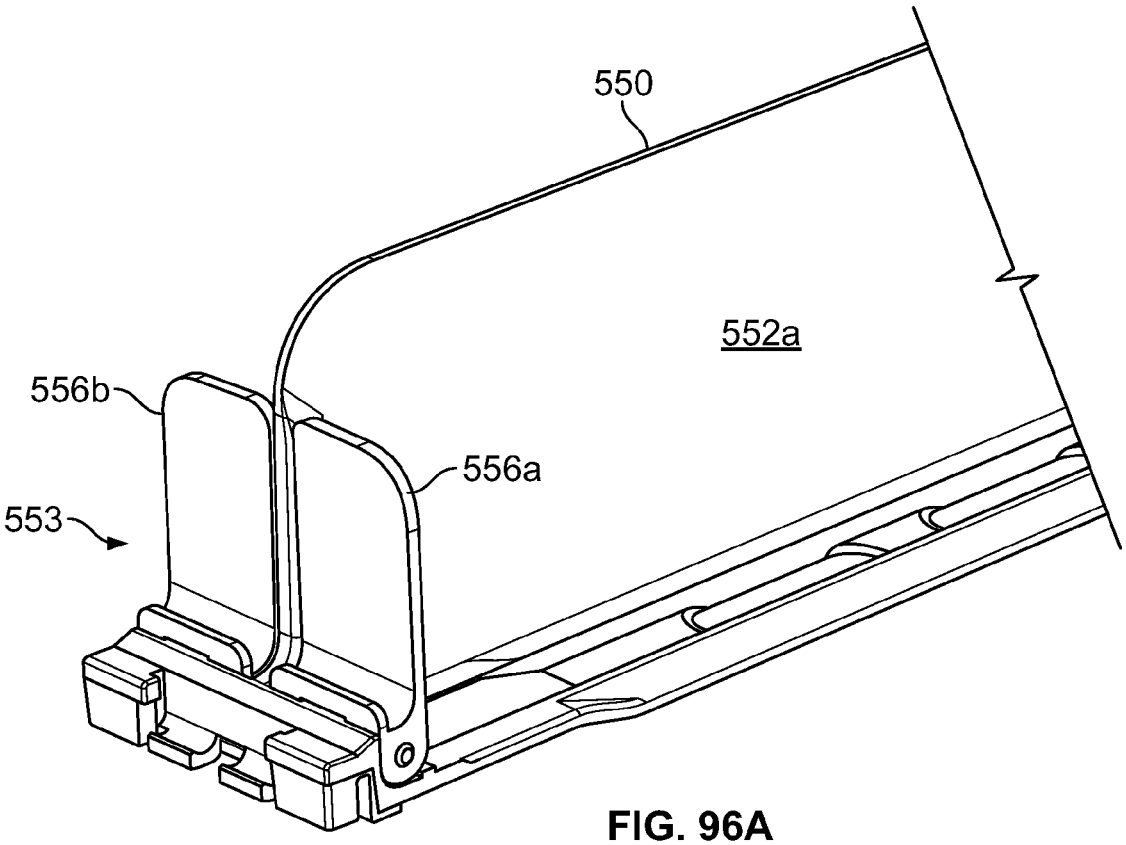
FIGS. 96A and 96B are top, right perspective views of aspects of example components of a merchandise display system.
Figure 96B:
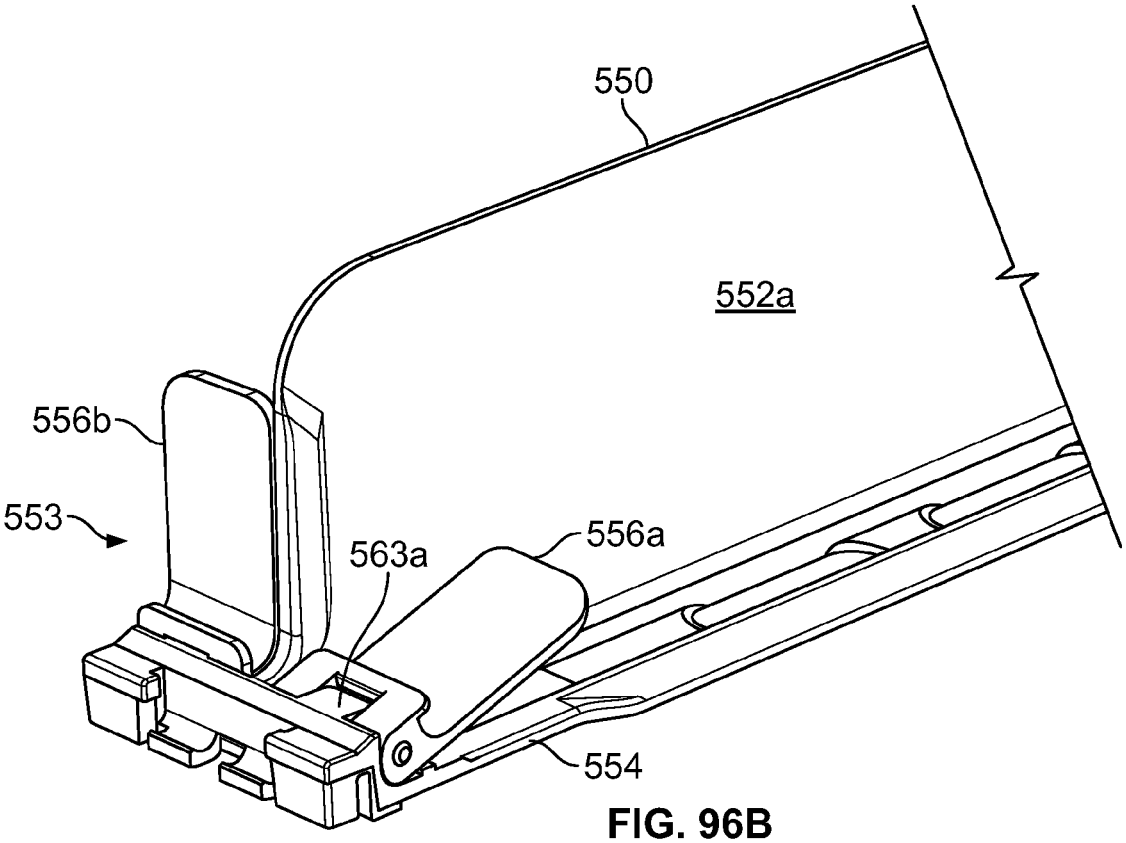
Figure 97:
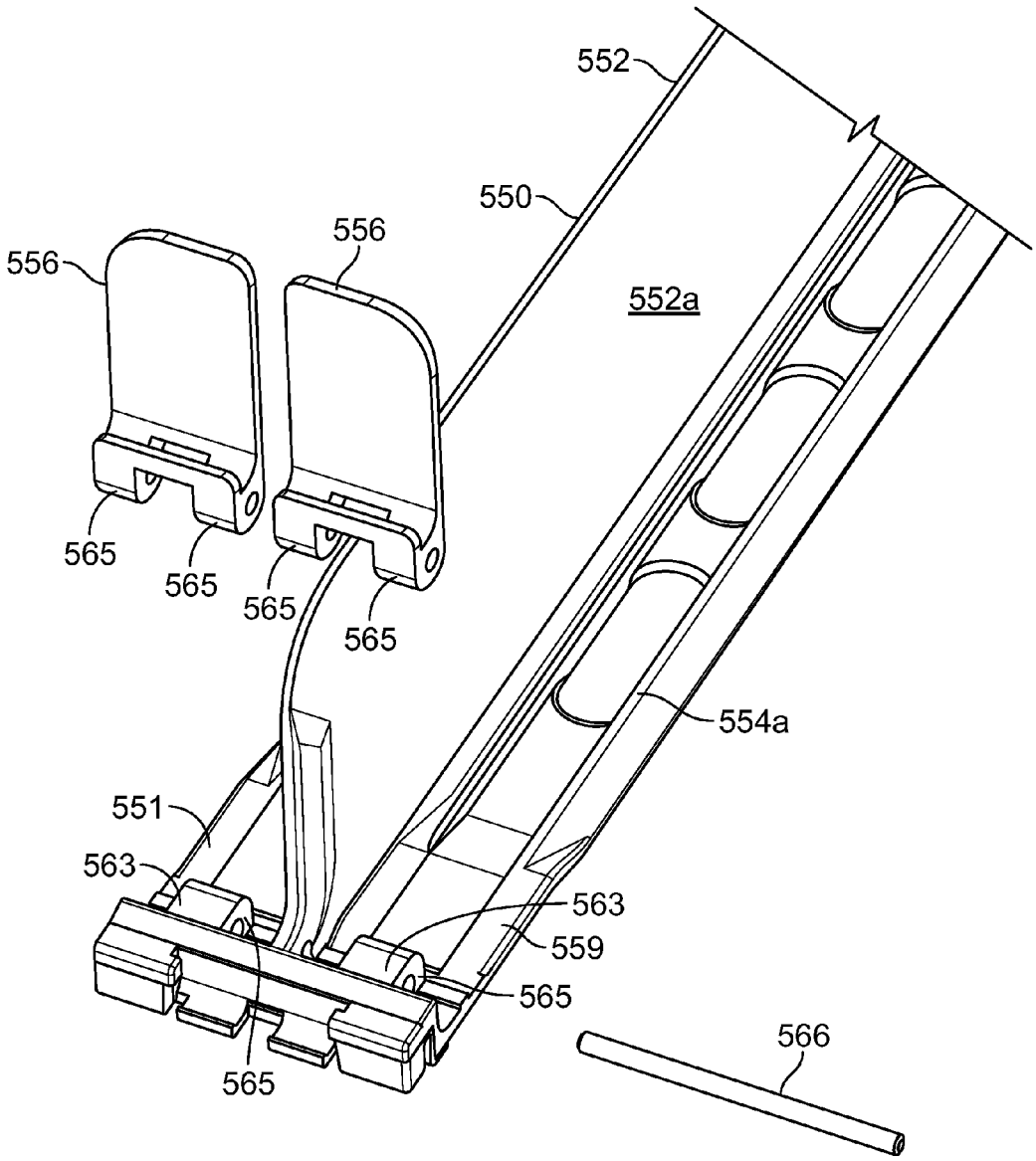
FIG. 97 is a top, right perspective exploded view of aspects of example components of a merchandise display system.

In an embodiment, barriers 556 are moveable by rotation between a folded position, as shown by example in FIG. 96B for the barrier 556*a* on the right side of the divider, to an upright position, as shown by example in FIG. 96A for both barriers 556*a*, 556*b*. In an embodiment, barriers 556 can be connected to a rotational mounting structure 563. In an embodiment, the rotational mounting structure 563 can be directly connected to the divider. In an embodiment, as discussed below in reference to examples shown in FIGS. 102 and 103, the rotational mounting structure 563 can be removably connected to the divider. Referring to FIG. 97, in an embodiment, the rotational mounting structure 563 can be a knuckle 565 and pin 566 type hinge. In an embodiment, the rotational mounting structure 563 can be a flexible member, such as flexible polymer or metal component.

In an embodiment, barrier 556 can be considered positioned proximate the forward end 553 of the divider 550 when a product positioned on the top surface 554*a* of the divider floor 554 can contact the barrier 556 when the product moves in the forward direction toward the forward end 553 of the divider 550. In an embodiment, the rotational mounting structure 563 is proximate to and connected to the forward end 553 of the divider 550 and/or the divider floor 554. For example, referring to FIGS. 95, 96A, and 96B, the barrier 556*a* is shown positioned proximate to and is connected to the forward end 553 of the divider 550 and the divider floor 554. In an embodiment, the barrier 556 can be positioned proximate to the forward end 553 of the divider 550 and/or the divider floor 554 while being spaced from and/or not being directly connected to either the forward end 553 or the divider floor 554 (not shown). For example, in an embodiment, the barrier can be removably connected to the front rail 580 and not connected to the divider 550 but positioned close enough to the divider such that a product positioned on the top surface 55*a* of the divider floor 554 can contact the barrier 556 when the product moves in the forward direction (not shown). In such example, the barrier 556 can be considered positioned proximate the forward end 553 of the divider 550. In an embodiment, the barrier 556 can be positioned proximate to the forward end of the divider and be connected to the divider wall. In an embodiment, the barrier can fold toward the divider wall when moving toward the folded position (not shown).

Figure 98A:
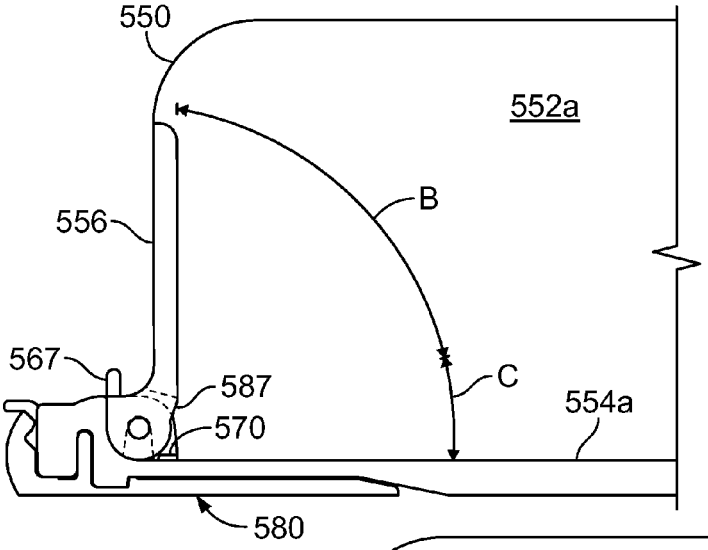
FIGS. 98A-C are side views of aspects of example components of a merchandise display system.
Figure 98B:
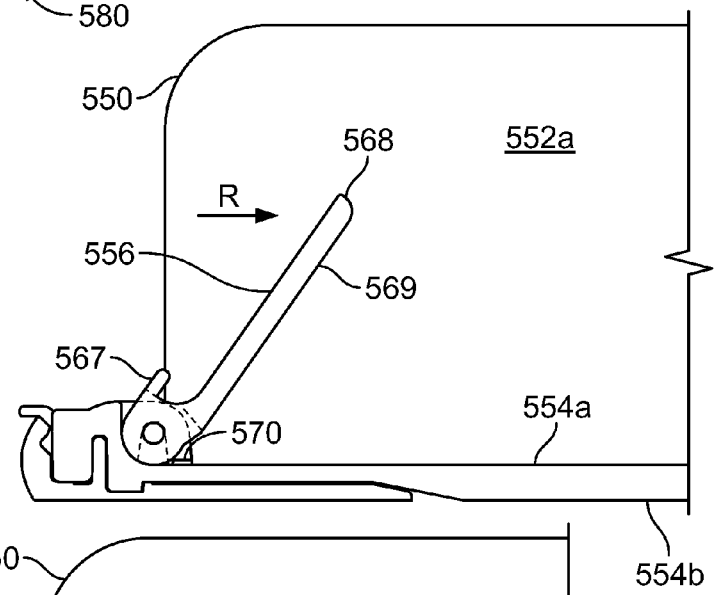
Figure 98C:
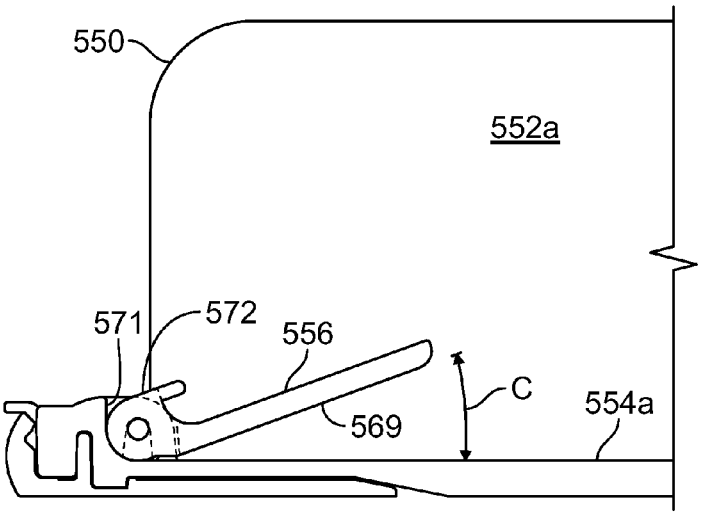
Figure 99A:
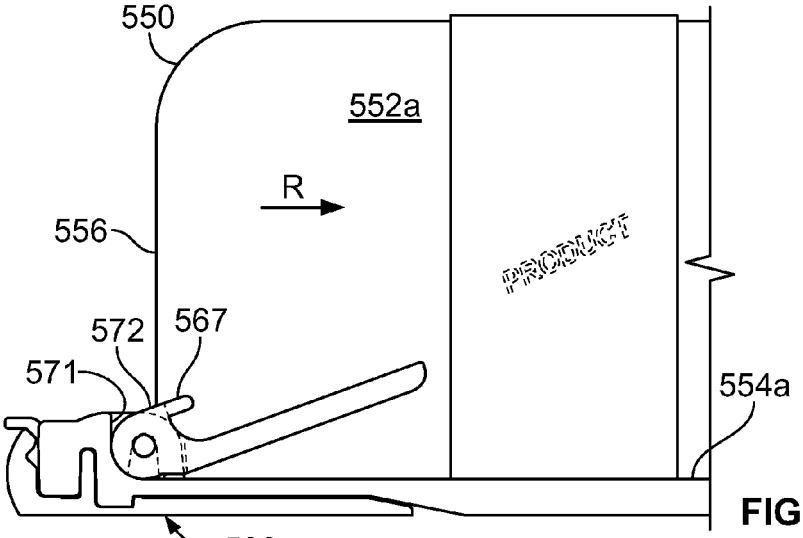
FIGS. 99A-C are side views of aspects of example components of a merchandise display system.
Figure 99B:
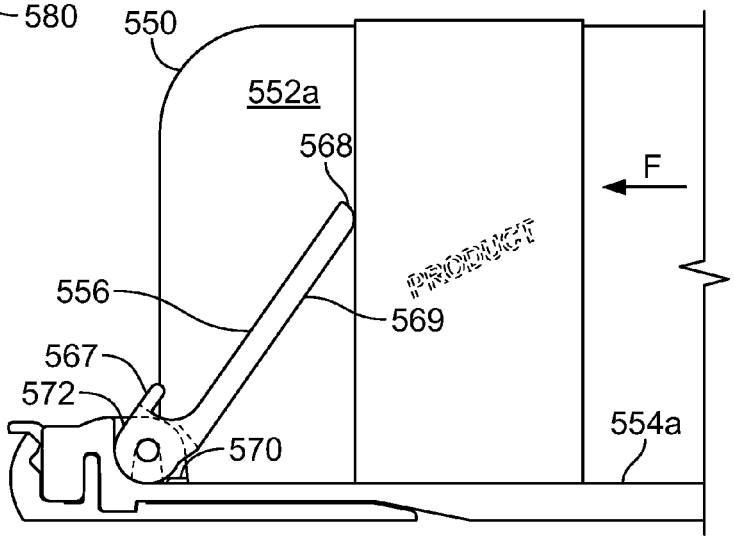

Referring to FIGS. 98A-C, in an embodiment, the barrier 556 is configured to rotate between an upright position and a folded position. An example upright position is shown in FIG. 98A and an example folded position is shown in FIG. 98C. In an embodiment, the top edge 568 of the barrier 556 can rotate along the arc shown as B in FIG. 98A. For example, a force applied in the reward direction R to a barrier 556 in the upright position can cause the barrier to rotate toward the folded position, as shown in FIG. 98B, to reach the folded position as shown by example in FIG. 98C. In addition, for example, the barrier 556 can be rotated manually by digitally pulling or pushing the barrier handle 567 to, respectively, raise the barrier to the upright position or lower the barrier to the folded position. In an embodiment, the top edge 568 of the barrier 556 can rotate along the entire arc of B and C such that the top edge contacts the top surface of the divider floor (not shown).

In an embodiment, in the folded position, the barrier 556 defines a folded angle C in between a rear surface 569 of the barrier and the top surface 554*a* of the divider floor. In an embodiment, the folded angle C is between about 45 degrees to about 20 degrees. In another embodiment, the folded angle C is between about 30 degrees and 15 degrees. The term "about" as used herein in regard to embodiments including a rotational barrier means plus or minus 5% of the stated value. In an embodiment, the folded angle is about 20 degrees.

In an embodiment, a folding stop structure 570 is configured to stop rotation of the barrier 556 toward the divider floor 554 and maintain the barrier at a desired folded angle C in the folded position. In an embodiment, the folding stop structure 570 is a protrusion positioned proximate a lower portion of the rear surface 569 of the barrier. In an embodiment, the folding stop structure is connected to the top surface 554*a* of the divider floor such that the lower portion 587 of the rear surface of the barrier contacts the folding stop structure 570 when barrier reaches the folded angle C in the folded position. In an embodiment, the folding stop structure is connected to the lower portion of the rear surface of the barrier so that the folding stop structure contacts the top surface of the divider floor when the barrier reaches the desired folded angle in the folded position (not shown). In an embodiment, the folding stop structure is an extension or plateau or plate secured to or integral with the divider floor 554. In an embodiment, the divider floor prevents the barrier 556 from becoming completely horizontal. The barrier 556 is configured such that when the barrier 556 is rotated to the folded position, the barrier is at an angle from horizontal. This angle can be about 10 degrees, 15 degrees, 20 degrees or between about 20-45 degrees or between about 10-35 degrees. In an embodiment, the barrier has a horizontal portion and a vertical portion that allow the barrier 556 to be at a predetermined angle to the divider floor when the barrier 556 is in contact with the divider floor 554. In an example, the stop structure 570 does not exist and the barrier 556 contacts the divider floor 554 directly on the horizontal top surface 554*a* of the divider floor.

Referring to 99A-C, in an embodiment, a force applied in the forward direction to a product positioned in contact with at least a portion of the rear surface 569 of the barrier 556 while the barrier is in the folded position can cause the barrier to rotate from the folded position to the upright position. For example, referring to FIG. 99A, a product can be placed on the top surface 554*a* of the divider floor 554 while the barrier is in the folded position. In an embodiment, a force can be applied to the product to move the product in the forward direction toward the barrier, as shown by example in FIG. 99B. In an embodiment, the force is gravity. For example, a divider 550 positioned so that the forward end 553 is angled downwardly relative to the reward end can cause products positioned thereon to move by gravity alone toward the forward end 553. In an embodiment, the force can be applied by a pusher mechanism 520. In an embodiment, the pusher mechanism 520 can be biased in the forward direction and can be configured to slide across the divider floor and move the product in the forward direction. In an embodiment, the top edge 568 of the rear surface 569 of the barrier is rounded off or defines a curved or radiused surface. The rounded edge of the top of the rear surface of the barrier assists in rotation of the barrier by, for example, allowing the barrier 556 to slip or slide up the surface of the product as the movement vector of the barrier changes while rotating toward the upright position as the product moves forward. In addition, for example, the rounded edge prevents the edge from digging into the surface of the product packaging and maintains a low friction between the rounded edge and the product as the product moves forward and the rounded edge moves up the surface of the product. In an embodiment, the top of the barrier can include other structures to facilitate the sliding of the barrier up the surface of the product such as, for example, a roller structure. In an embodiment, when the barrier reaches the upright position, the barrier ceases rotation and ceases movement of the product in the forward direction. In an embodiment, a vertical stop structure is configured to stop rotation of the barrier in the forward position and establish the upright position of the barrier. In an embodiment, the vertical stop structure can be a vertical surface 571 on the rotational mounting structure and an opposing vertical surface 572 on the barrier 556.

Figure 100A:
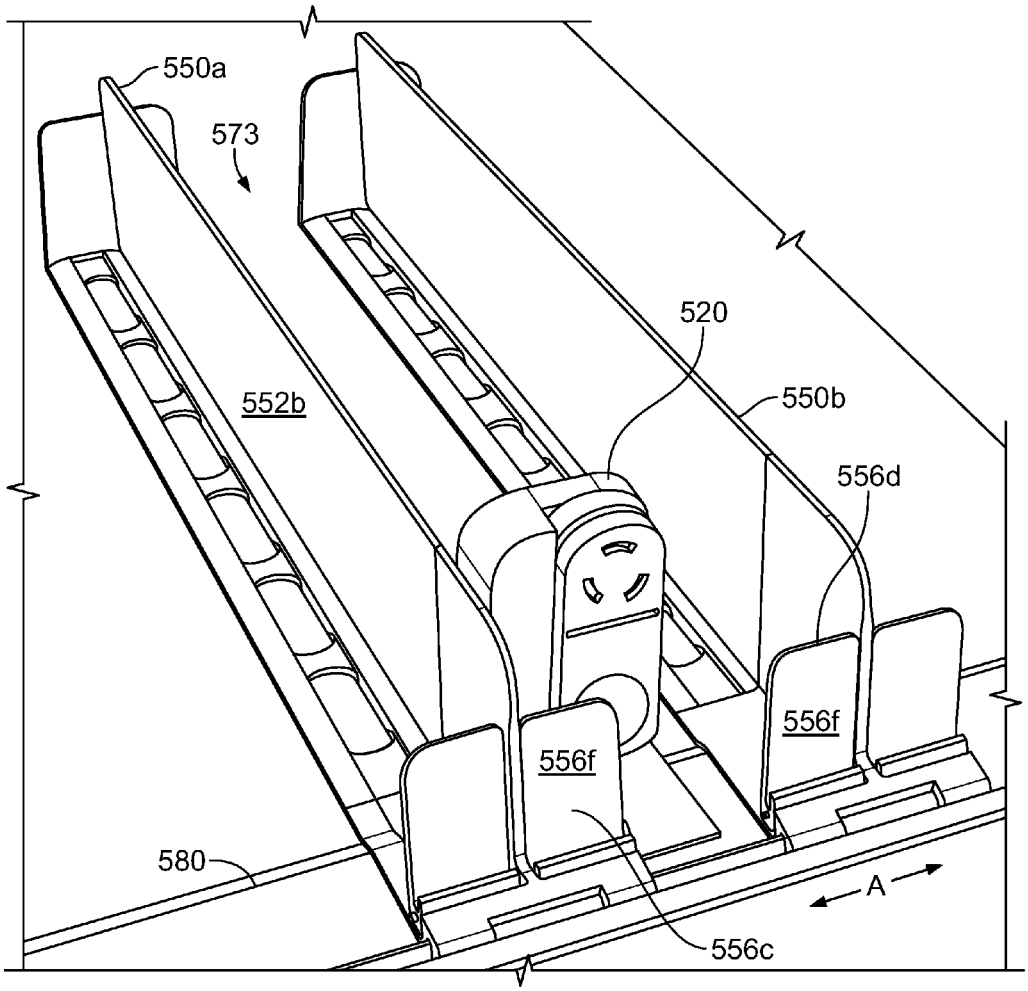
FIGS. 100A-D are a top, left perspective views of aspects of example components of a merchandise display system.
Figure 100B:
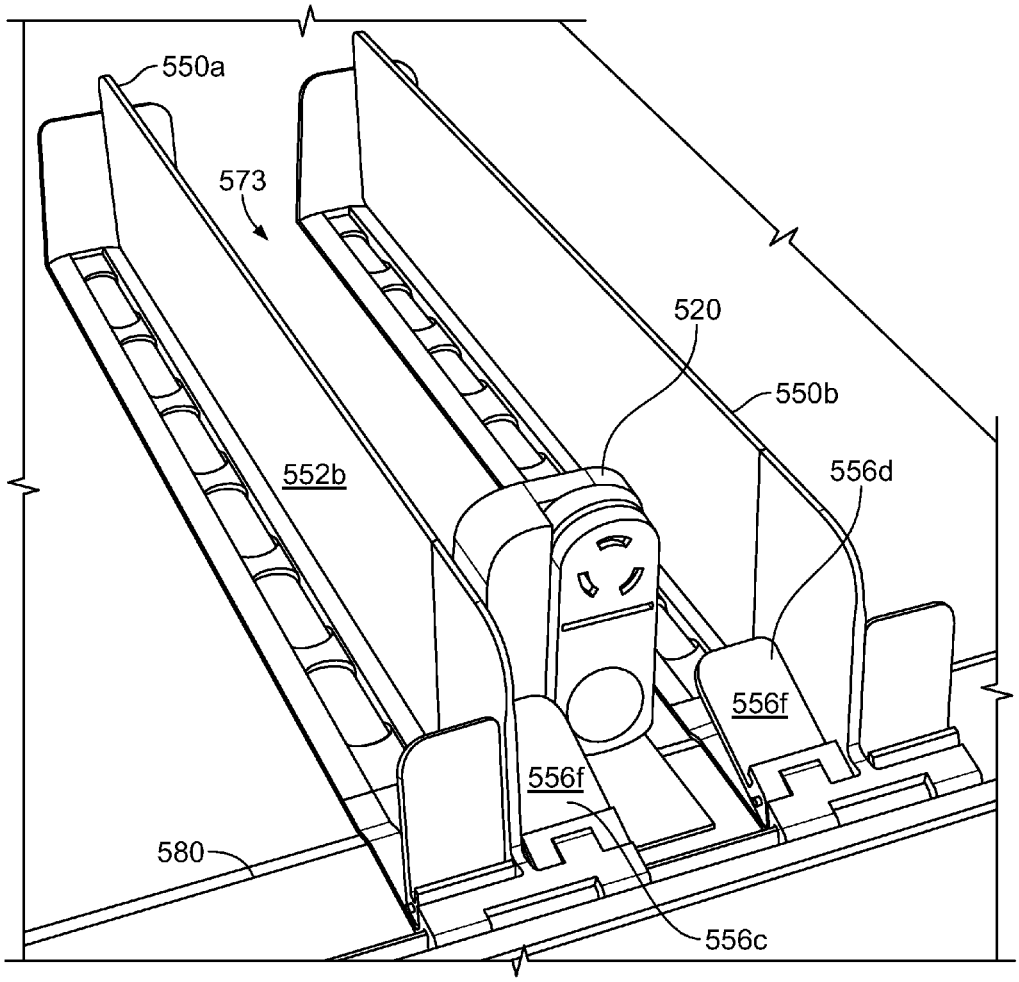

Referring to FIGS. 100A-D, in an embodiment, aspects of a rotational barrier described in the examples above can be used, for example, in an embodiment of merchandise display system that includes a pair of dividers 550*a*, 550*b* and a pusher mechanism 520. The dividers 550*a*, 550*b* can define a product pocket 573 in between the opposing walls of the dividers. The product pocket 573 can, for example, have a width that is slightly greater than a product which is intended to be displayed in the system. In an embodiment, the barriers can be positioned in the folded position as shown in FIG. 100B to facilitate placement of the product in the system. In addition, in an embodiment, manual positioning of a product against the front surface 556*f* of the barriers in the upright position and pushing of the product in the reward direction against the front surface 556*f* of the barriers can cause the barriers to rotate to the folded position and allow the product to be easily inserted into the product pocket 573 as shown in FIG. 100C. In an embodiment, once the product is positioned in the product pocket on the top surfaces of the divider floors and against the front surface of the pusher mechanism, and then released, the pusher mechanism pushes the product in a forward direction F and causes the product to rotate the barriers from the folded position to the upright position, as shown in FIG. 100D, where the forward movement of the product is then ceased.

In an embodiment, the rotational mounting structure 563 can be removably connected to the divider 550, front rail 580, or shelf 234. In an embodiment, the rotational mounting structure 563 is removably connected to the forward end 553 of the divider 550. Referring to FIGS. 102A-D and 103A-E, an example removable rotational mounting structure 563 can include a vertical stanchion 591, horizontal cross beam 593, and rotational mounts 597*a*, 597*b* connected to the horizontal cross beam 593. In an embodiment, the vertical stanchion 591 can be an elongate post oriented in the vertical direction and the horizontal cross beam 593 can be an elongate beam oriented horizontally in the lateral direction. In an embodiment, the stanchion can include a gripping structure near the top portion of the stanchion to facilitate manual insertion and removal of the rotational mounting structure 563 onto or off of the divider 550. In an embodiment, the horizontal cross beam 593 is connected to the vertical stanchion 591 and extends from the opposite sides of the vertical stanchion in a cross-like manner such that a left section 593*b* of the horizontal cross beam 593 extends in a lateral direction from a left side 591*b* of the vertical stanchion 591 and a right section 593*a* of the horizontal cross beam 593 extends in the lateral direction from a right side 591*a* of the vertical stanchion 591. In an embodiment, a right rotational mount 597*a* is connected to the right section 593*a* of the horizontal cross beam 593 and a left rotational mount 597*b* is connected to the left section 53*b* of the horizontal cross beam 593. In an embodiment, each section 593*a*, 593*b* of the horizontal cross beam extend to a length about equal to the width of the respective side portions 559, 551 of the divider floor 554.

In an embodiment, a rotational mount can include a knuckle and pin type hinge or flexible member. In an embodiment wherein a rotational mount 597*a* is a knuckle and pin hinge, the rotational mount 597*a* can include a first knuckle component 601 and the barrier can include a second knuckle component 602, the first and second knuckle components are complimentary such that a pin 566 can extend through the first and second knuckle components to form a hinge for rotational attachment of the barrier 556*a* to the rotational mount 597*a* and rotational mounting structure 563.

In an embodiment, a rotational mount 597*a* includes a folding stop structure 570*a* configured to stop rotation of the barrier 556*a* toward the divider floor 554*a* and maintain the desired folded angle C for the folded position. In an embodiment, the folding stop structure 570*a* is a plate 603 extending from and integral with the rotational mount 597*a* or horizontal cross beam 593*a*, the plate 603 having a raised or angled portion 615 configured to define the folded angle C. In an embodiment, as described above, the folding stop structure is connected to the lower portion of the rear surface 569 of the barrier so that the folding stop structure contacts the top surface of the divider floor 554 or plate 603 when the barrier reaches the desired folded angle in the folded position (not shown). In an embodiment, the folding stop structure is integral with the divider floor.

In an embodiment, a rotational mount 597*a* includes a vertical stop structure configured to stop rotation of the barrier in the forward position and establish the upright position of the barrier. In an embodiment, the vertical stop structure can be a vertical surface 571 on the rotational mount and an opposing vertical surface 572 on the barrier 556. In an embodiment, the vertical surface of the vertical stop structure of the rotational mount can be within a mount recess 604 defined within the rotational mount 597*a* and the opposing vertical surface 572 on the barrier 556 can be on a tab 605 formed on the bottom portion of the barrier. The mount recess 604 can be of complimentary shape with the tab 605 so that the tab fits into the mount recess 604 when the barrier rotates in the forward direction.

In an embodiment, the stanchion 591 can include a mount slot 598 defined in the stanchion which is configured to mate with a front ridge 599 of the divider 550 to removably connect the rotational mounting structure 563 to the forward end 553 of the divider 550. In an embodiment, the rotational mounting structure removably connects to the divider using clip, cam, or other coupling structure.

In an embodiment, referring to FIGS. 104A-G, an example removable rotational mounting structure 563 can include a horizontal cross beam 593 and rotational mounts 597*a*, 597*b* connected to the horizontal cross beam 593. In an embodiment, the horizontal cross beam 593 extends in a lateral direction and has a length about equal to the width of respective side portions 559, 551 of the divider floor 554. In an embodiment, a right rotational mount 597*a* is connected to a right section 593*a* of the horizontal cross beam 593 and a left rotational mount 597*b* is connected to a left section 593*b* of the horizontal cross beam 593. In an embodiment, as shown in FIGS. 104A-104G, the horizontal cross beam 593 is configured to have a low-profile where the height of the beam over the divider block 802 is minimized. A low-profile horizontal cross beam 593 can provide for more space for product to be inserted over the removable rotational mounting structure 563 from the forward direction into the merchandise display system.

In an embodiment, the horizontal cross beam 593 can include a forward extension 593*c* of the horizontal cross beam that extends toward the front of the divider block 802. In an embodiment, the forward extension 593*c* of the horizontal cross beam 593 can extend forward of the front of the divider block 802 and include an extension hook 593*e* configured to extend downward from the forward end of the forward extension so that the extension hook is positioned in front of the divider block 802 when the removable mounting structure is secured in place on the divider. In an embodiment, the rotational mounting structure includes a forward extension 593*c* and extension hook 593*e* extending from a right section 593*a* of the horizontal cross beam 593 and a forward extension 593*d* and extension hook 593*f* extending from a left section 593*b* of the horizontal cross beam 593. The forward extensions 593*c*, 593*d* and extension hooks 593*e*, 593*f* can, for example, assist in stabilizing the removable mounting structure on the divider.

In an embodiment, the removable mounting structure 563 includes a first plate 603*a* extending from the right rotational mount 597*a* or right section 593*a* of the horizontal cross beam 593 and a second plate 603*b* extending from the left rotational mount 597*b* or left section 593*b* of the horizontal cross beam 593. In an embodiment, the plates 603*a*, 603*b* can extend in the lateral direction from either side of the rotational mounts 597*a*, 597*b*. In an embodiment, the inside edges of the plates 603*a*, 603*b* can be configured to define a mount slot 598 configured to mate the removable mounting structure 563 with the front ridge 599 of the divider 550 to removably connect the rotational mounting structure 563 to the forward end 553 of the divider 550. In an embodiment, each plate 603*a*, 603*b* can include a folding stop structure 570*a*, 570*b*. In embodiment, the folding stop structure can include a raised or angled portion 615*a*, 615*b* configured to define the folded angle C.

Figure 105A:
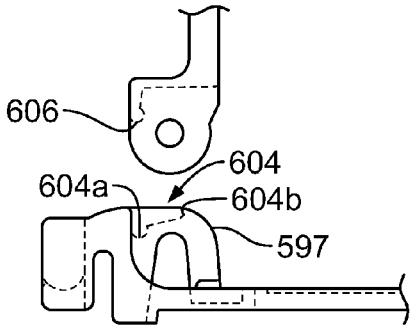
Figure 105B:
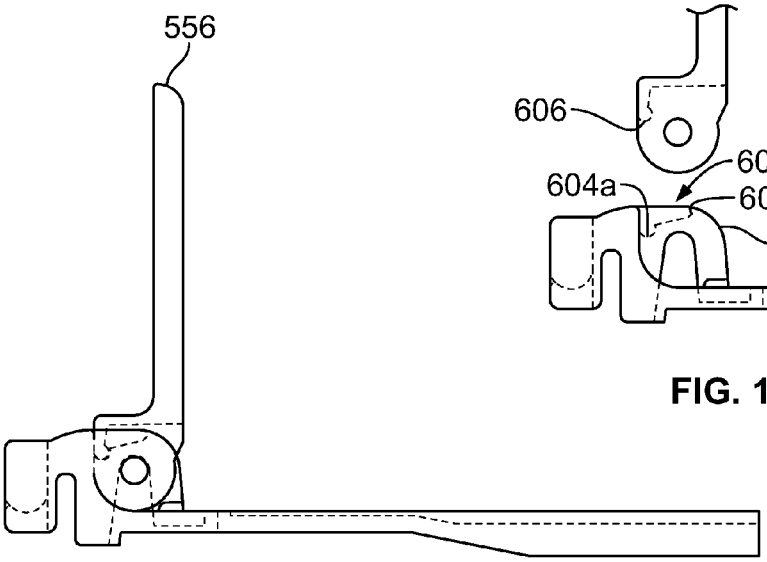
Figure 105C:
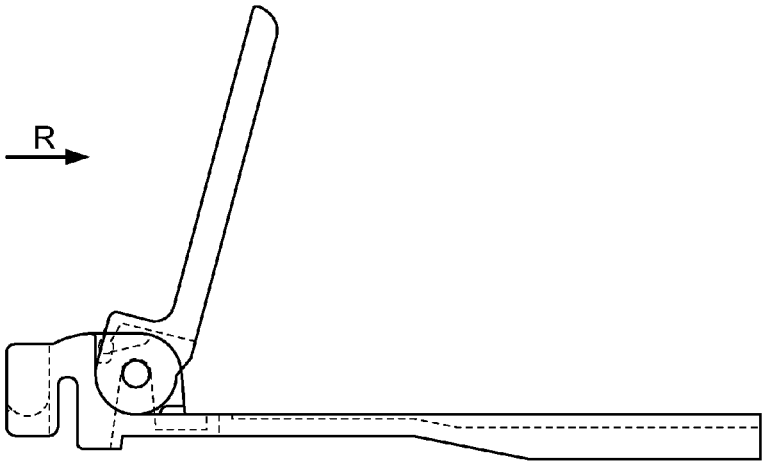
Figure 105D:
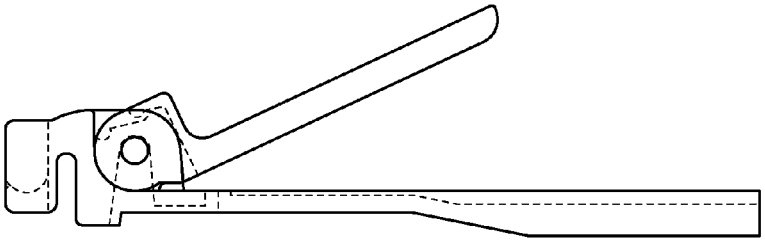

Referring to FIGS. 105A-D, in an embodiment, the barrier 556 includes a resilient tab 606 configured to engage a tab recess 604*a* defined in the rotational mount 597 when the barrier reaches the upright position, as shown in FIG. 105B. The resilient tab 606 is configured to hold the barrier in the upright position when it engages tab recess 604*a*. In an embodiment, the tab recess 604*a* is defined in the mount recess 604. In an embodiment, when a reward force is applied to the barrier, the resilient tab 606 flexes and disengages from the tab recess 604*a* so that the barrier can move toward the folded position, shown in FIG. 105D. In an embodiment, the mount recess 604 includes a folding stop structure 604*b*. In an embodiment, the tab resilient 606 engages the folding stop structure to stop rotation of the barrier 556 toward the divider floor 554 and maintain the desired folded angle of the folded position. In an embodiment, the folding stop structure 604*b* is defined in the mount recess 604 and can be, for example, an angled portion as shown in FIG. 105A.

Referring to FIGS. 106A-B, example aspects of an example system that can include a barrier moveable between a folded position and an upright position without the aid of a rotation biasing element are shown. In an embodiment, a system can include a divider assembly 550 configured to be secured to a support structure, such as a front rail. In an embodiment, the divider wall 552 can include a divider wall extension 552*a* configured to increase the height of the divider wall. In an embodiment, the divider wall extension 552*a* and the divider wall 552 can include tongue and groove components configured to secure the extension to the divider wall. In an embodiment, the front edge 552*d* of the divider wall can be rounded. The rounded edge can, for example, prevent a product package from catching on the edge and tearing. In addition, the thickness of divider wall can be increased to improve the strength of the wall and, for example, accommodate the tongue and groove components for the divider wall extension. Examples of systems that use divider walls of increased thickness can be useful for heavier products, such as cases of canned soda, which may require more robust aspects of a display system than smaller, lighter products. In an embodiment, the width of the system and barriers can be increased to, for example, accommodate larger products that may require more shelf space. In an embodiment, as shown in FIG. 106B, the folding stop structure 570 is defined in the divider floor 554

In an embodiment, an example method of restocking a merchandise display system is described in reference to FIGS. 100A through 100D. As shown in FIG. 100A, a merchandise display system can include a first divider 550*a* and second divider 550*b*. The first and second divider can also be referred to as a left side divider 550*a* and a right side divider 550*b*. The first and second dividers can include first and second divider walls that extend from the forward end to the reward end of the respective dividers. A product pocket 573 can be defined in between the opposing first and second divider walls. The first divider can include a first barrier 556*c* positioned at the forward end of the divider 550*a* and to the right of the first divider wall. And, the second divider 550*b* can include a barrier 556*d* positioned at the forward end of the second divider and to the left of the second divider wall. The system can include a pusher 520 positioned in between the first and second dividers. The pusher can include a biasing element which biases the pusher in the forward direction F toward the forward ends of the dividers. The barriers 556*c*, 556*d* can be in a first, upright position as shown in FIG. 100A. Referring to FIG. 100B, the barriers 556*c*, 556*d* can be positioned in a second, folded position by, for example, digitally moving the barriers into the second position or using the product to push the barriers into the second position while positioning the product in the product pocket. Alternatively, the product can be placed in the product pocket by moving the product over the top of the barriers which are in the first, upright position and directly into the product pocket. Referring to FIG. 100C, the product can be positioned forward the product pusher and in contact with the front surface of the product pusher so that the product pusher is in position to move the product forward when the product is released. Once the product is released, the pusher 520 moves the product forward so that the product contacts the barriers. When the barriers are in the second, folded position and the product is in the product pocket and released, the pusher can push the product forward so that the product contacts the barriers and moves the barriers from the second, folded position to the first, upright position. The barriers cease the forward movement of the pusher and the product when the barriers reach the first, upright position, as shown in FIG. 100D. In an embodiment, the product can be positioned in the product pocket by moving the product over barriers which are positioned in the first, upright position. In such example, the pusher can move the product forward until the product contacts the barriers which are in the first, upright position—where then the forward movement of the product will be stopped, as shown in FIG. 100D.

Figure 101A:
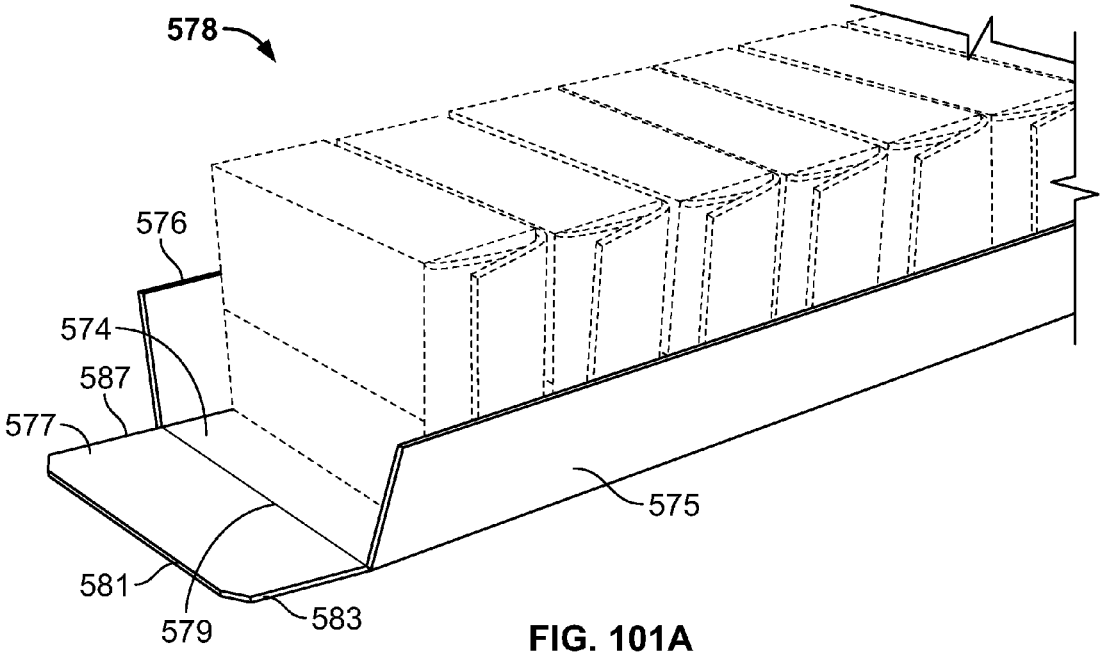
FIG. 101A is a top, right perspective view of aspects of an example product tray.
Figure 101B:
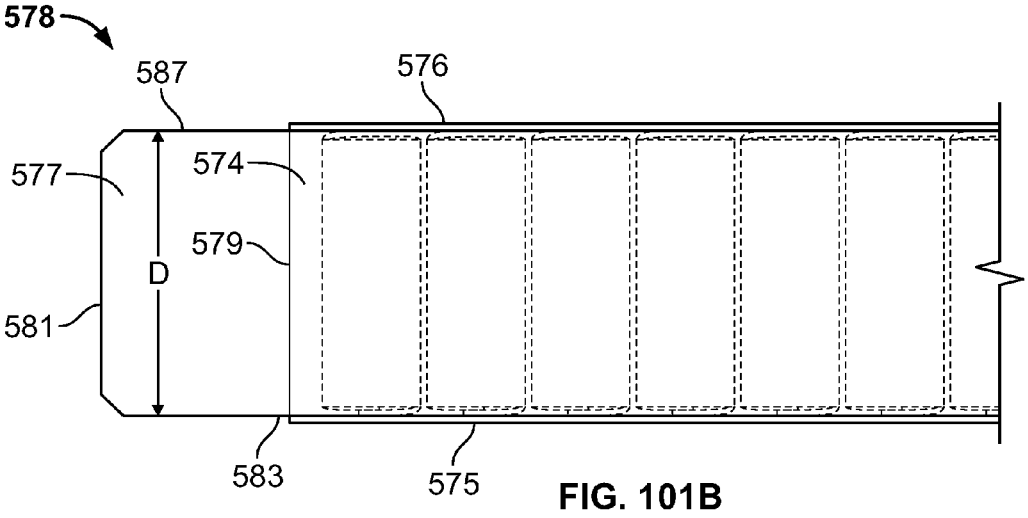
FIG. 101B is a top view of aspects of an example product tray.
Figure 101C:
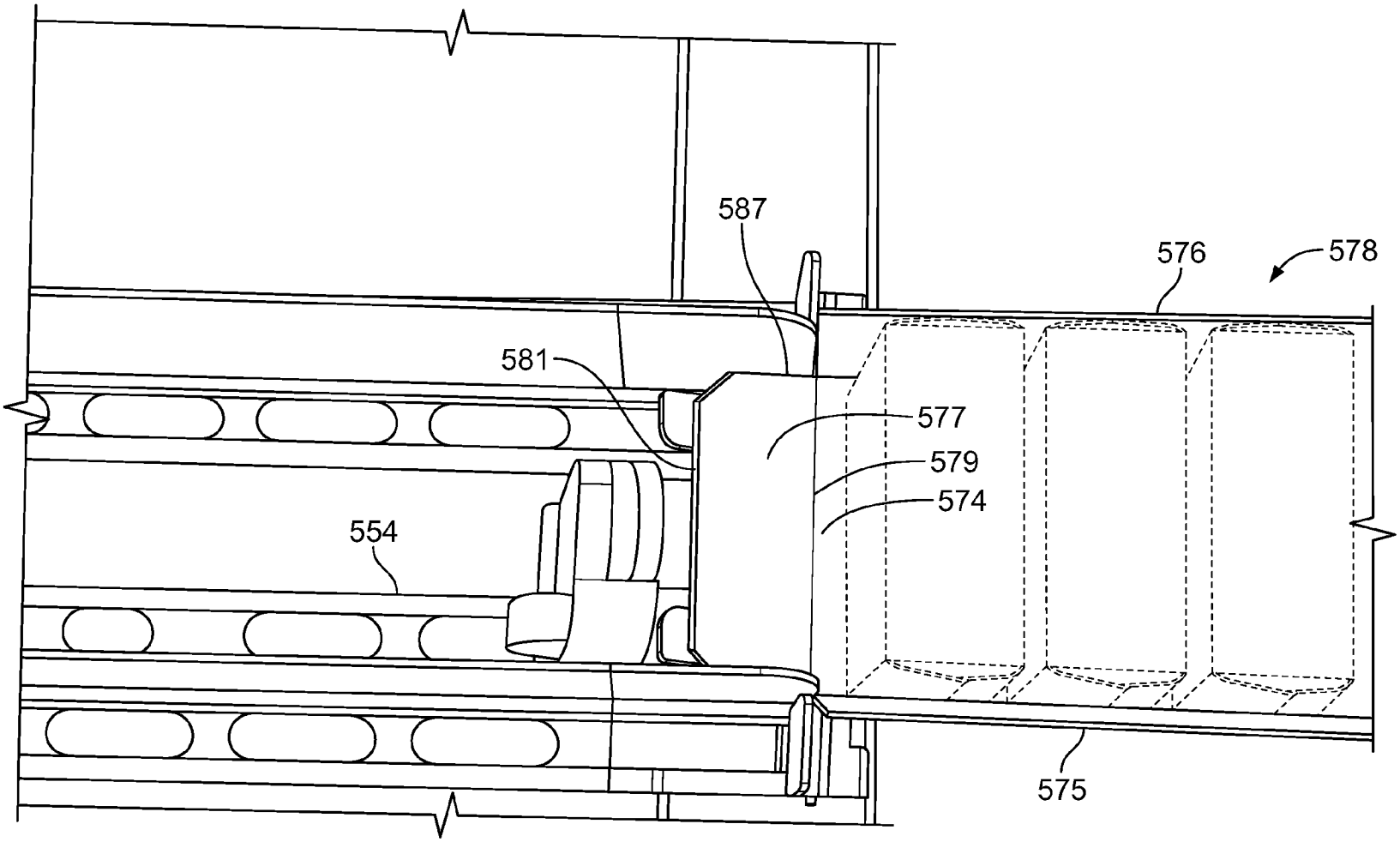
FIGS. 101C-F are top, left perspective views of aspects of an example product tray used in conjunction with example components of a merchandise display system.
Figure 101D:
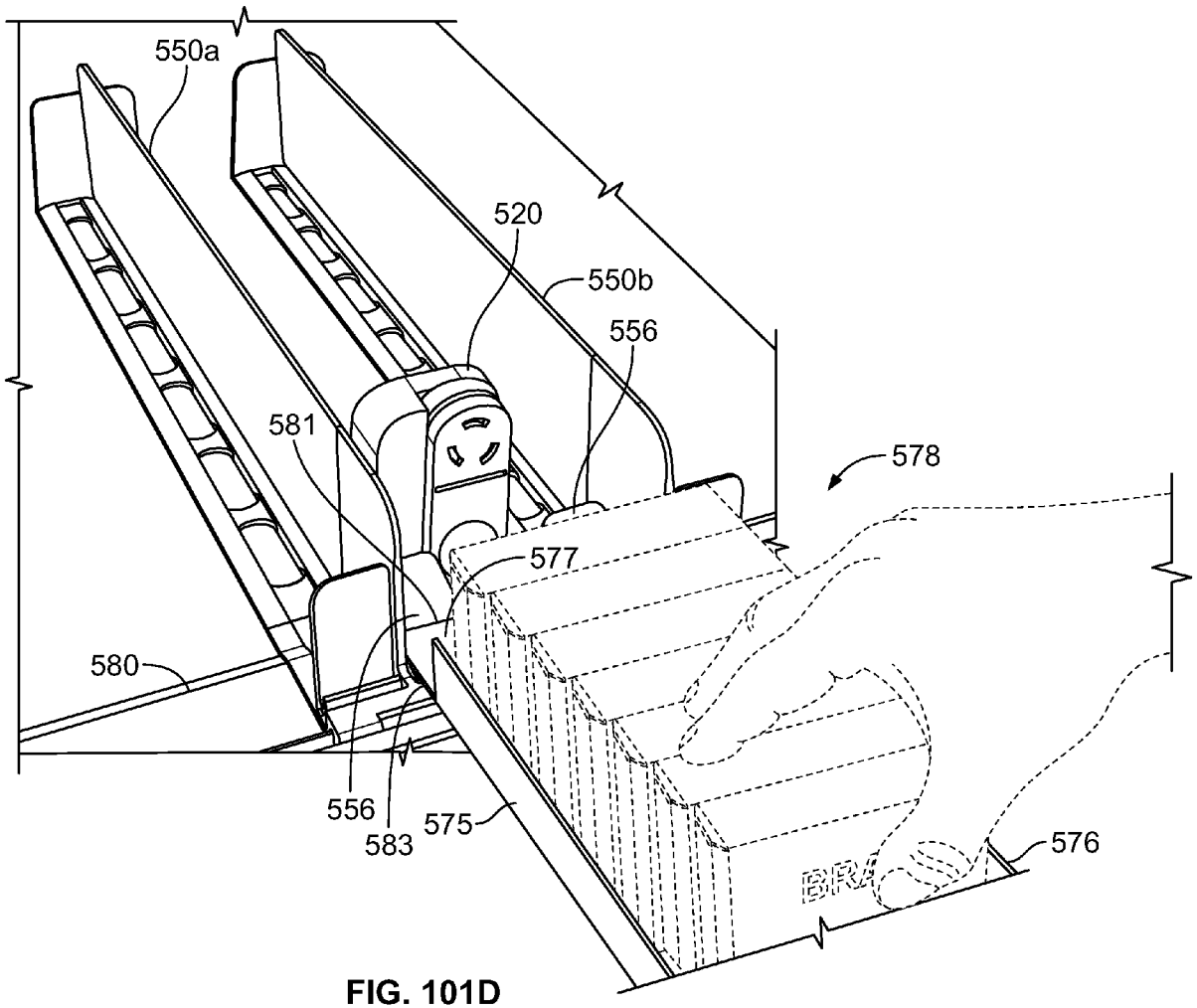
Figure 101E:
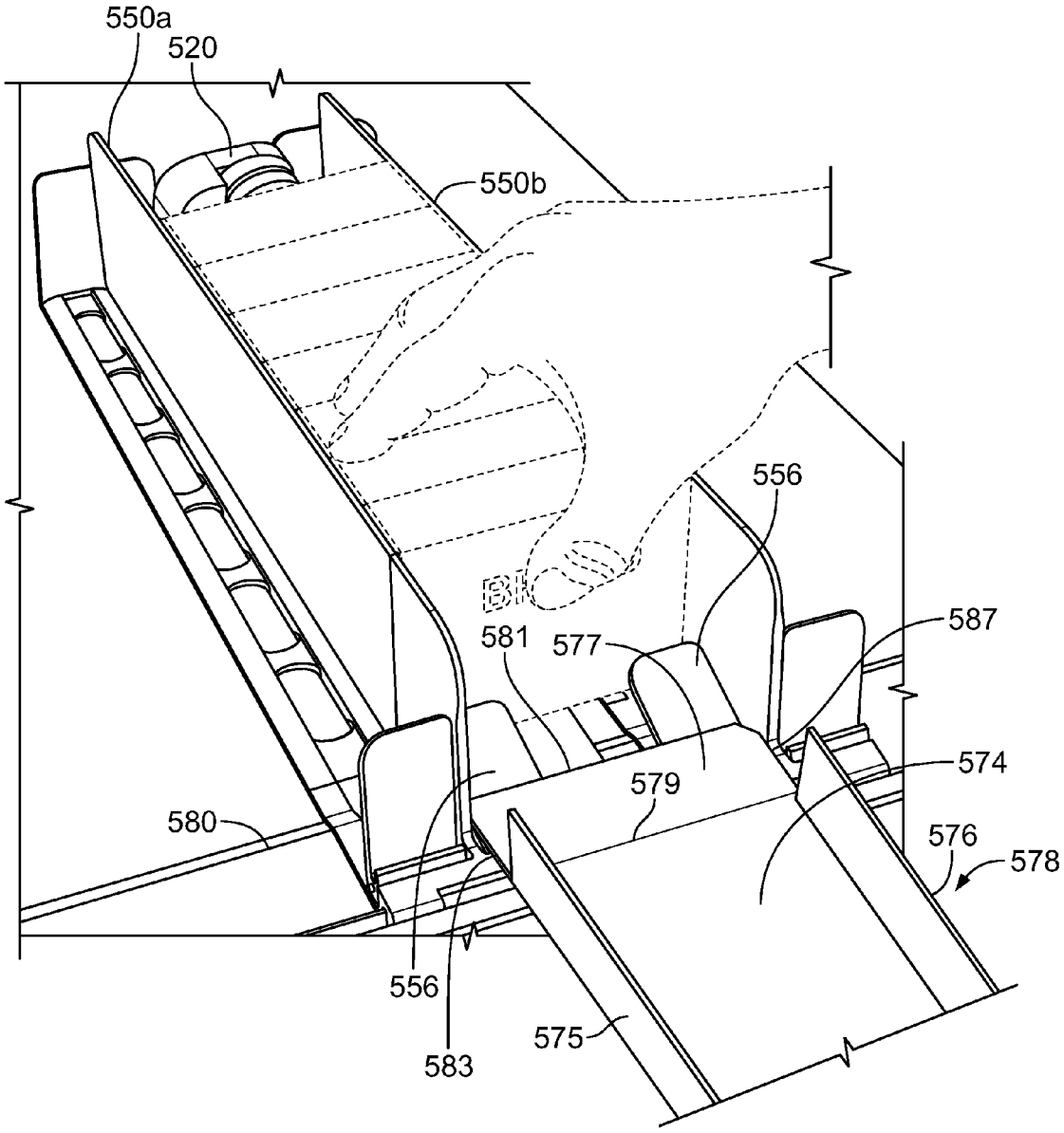
Figure 101F:
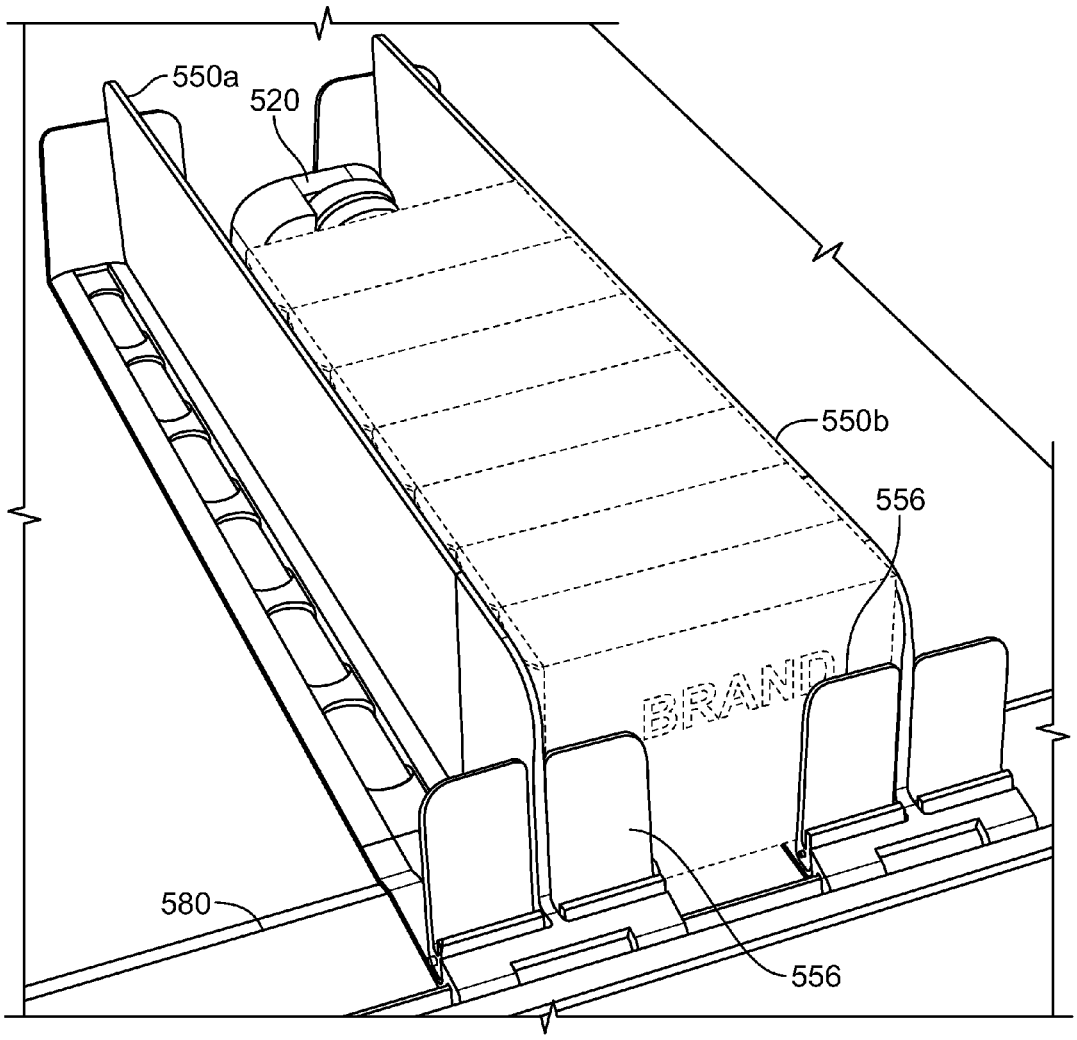
Figure 102A:
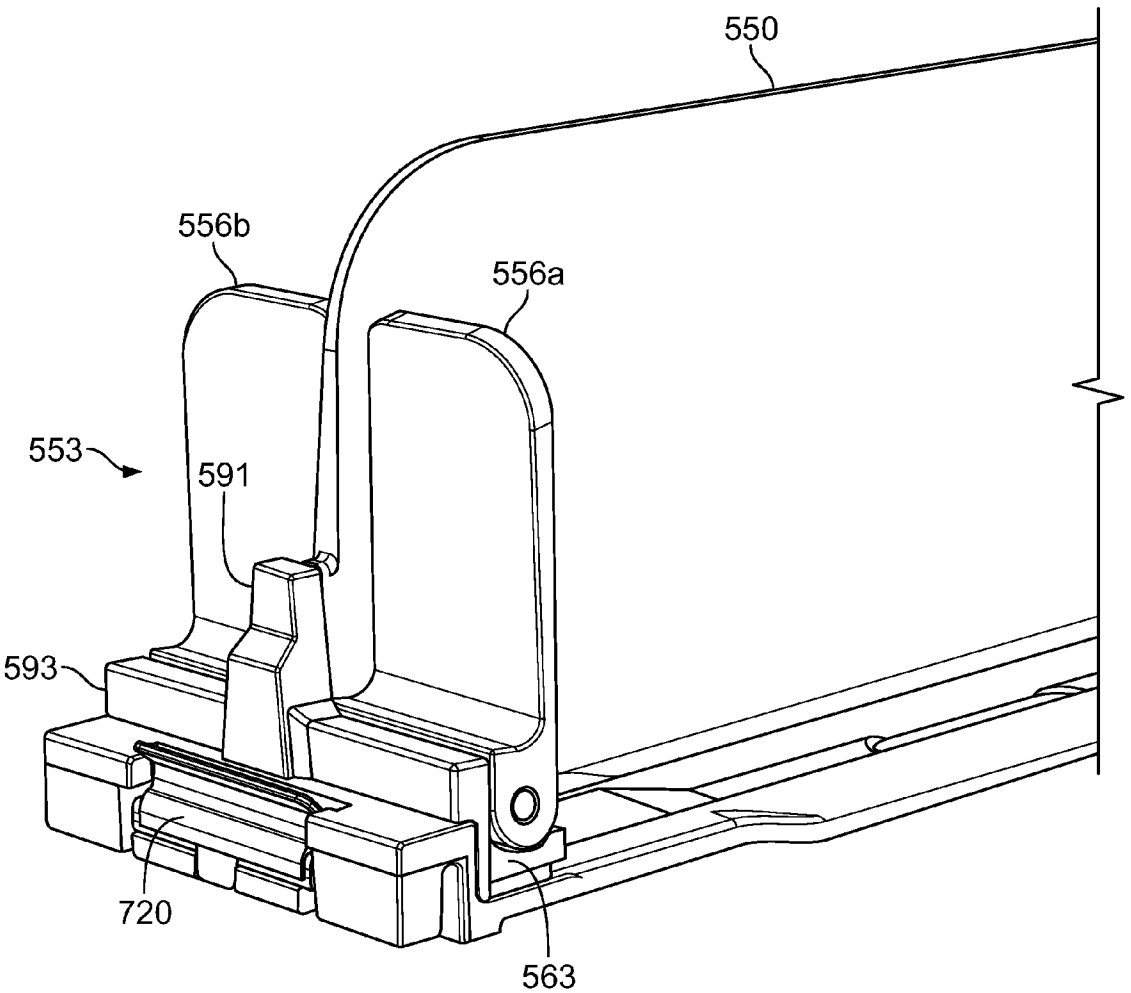
FIG. 102A is a top, right perspective view of aspects of example components of a merchandise display system.
Figure 102B:
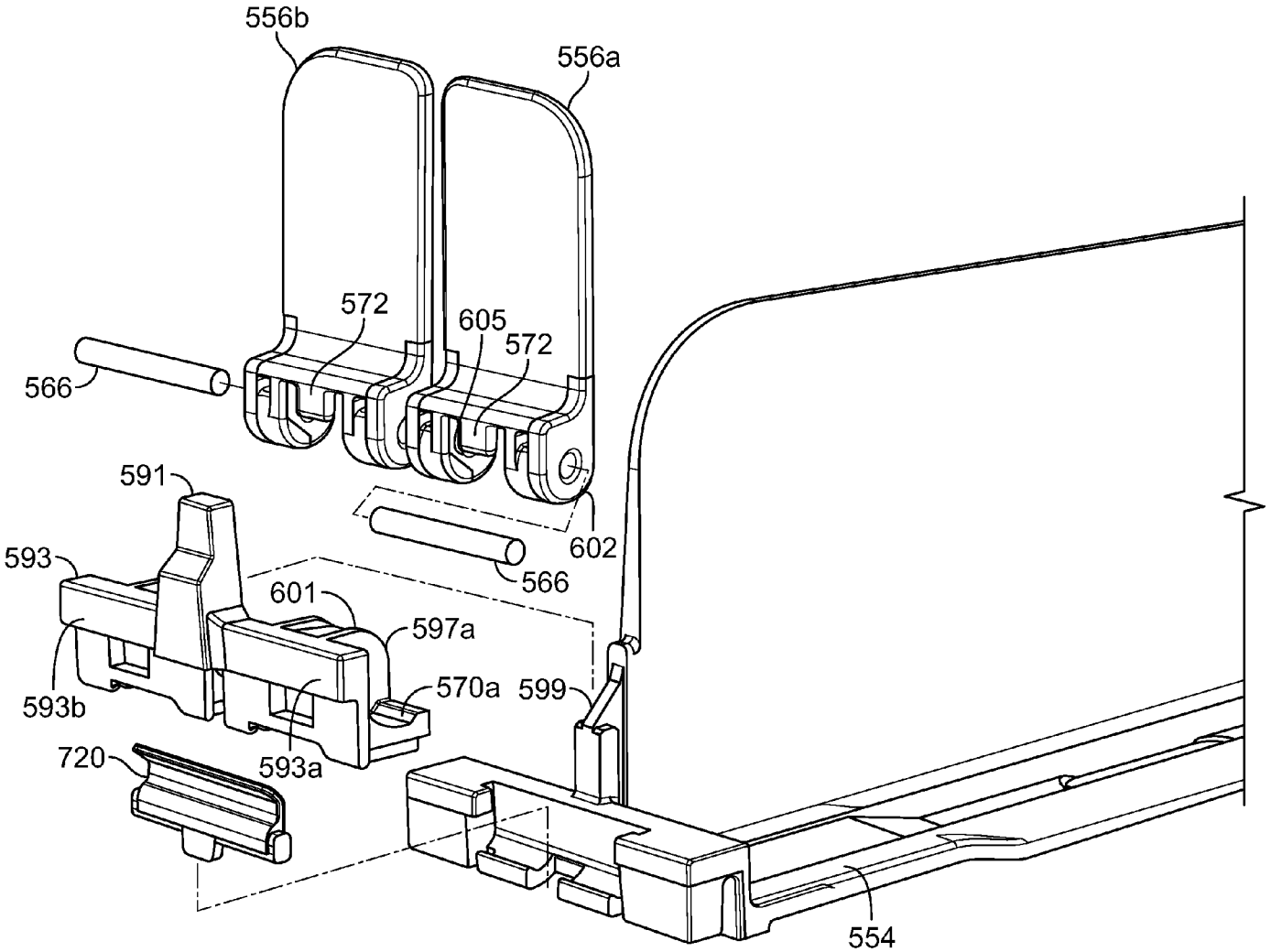
FIG. 102B is a top, right perspective exploded view of aspects of example components of a merchandise display system.
Figure 102C:
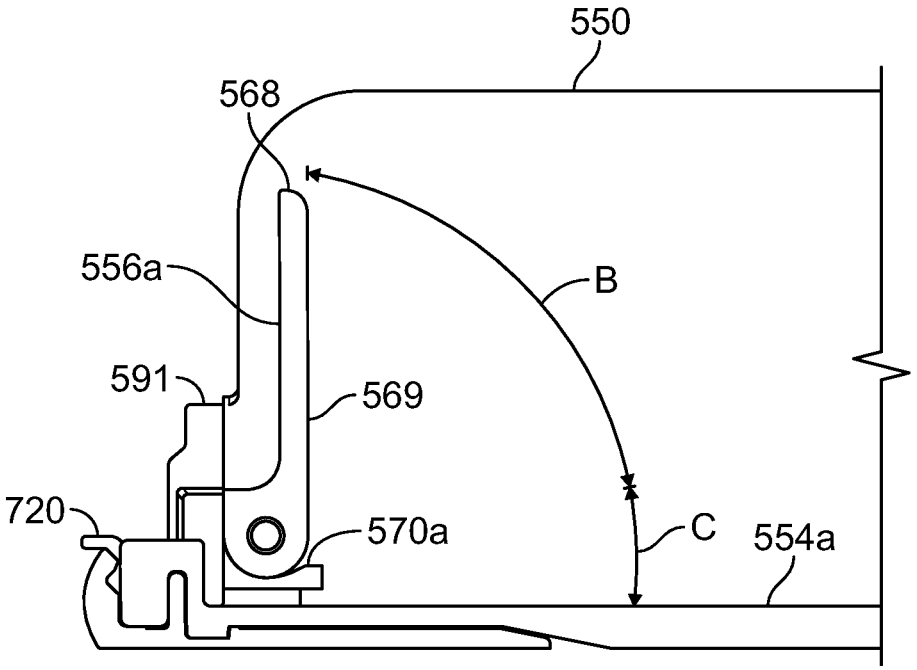
FIGS. 102C and 102D are side views of aspects of example components of a merchandise display system.
Figure 102D:
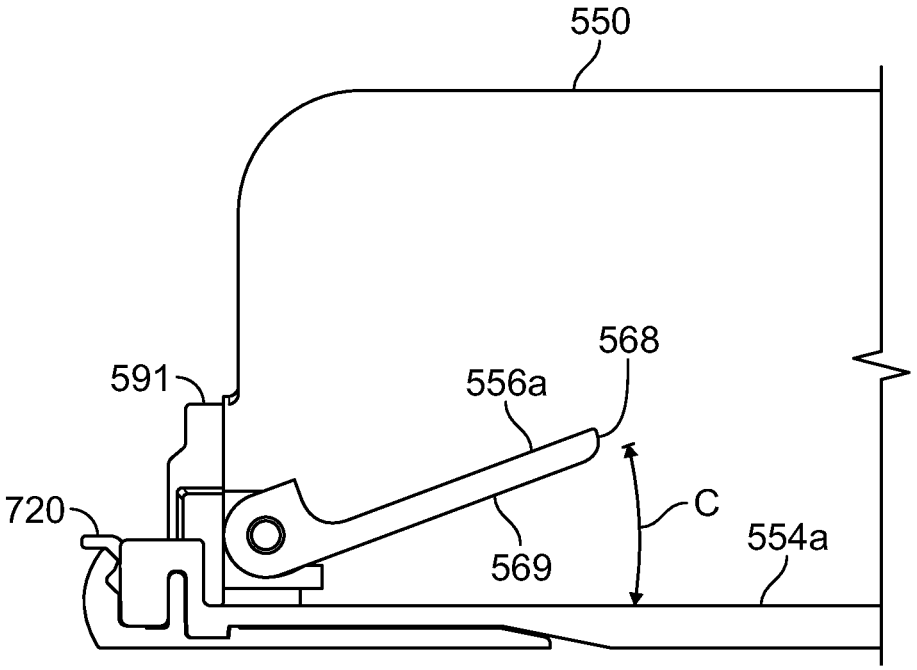
Figure 103A:
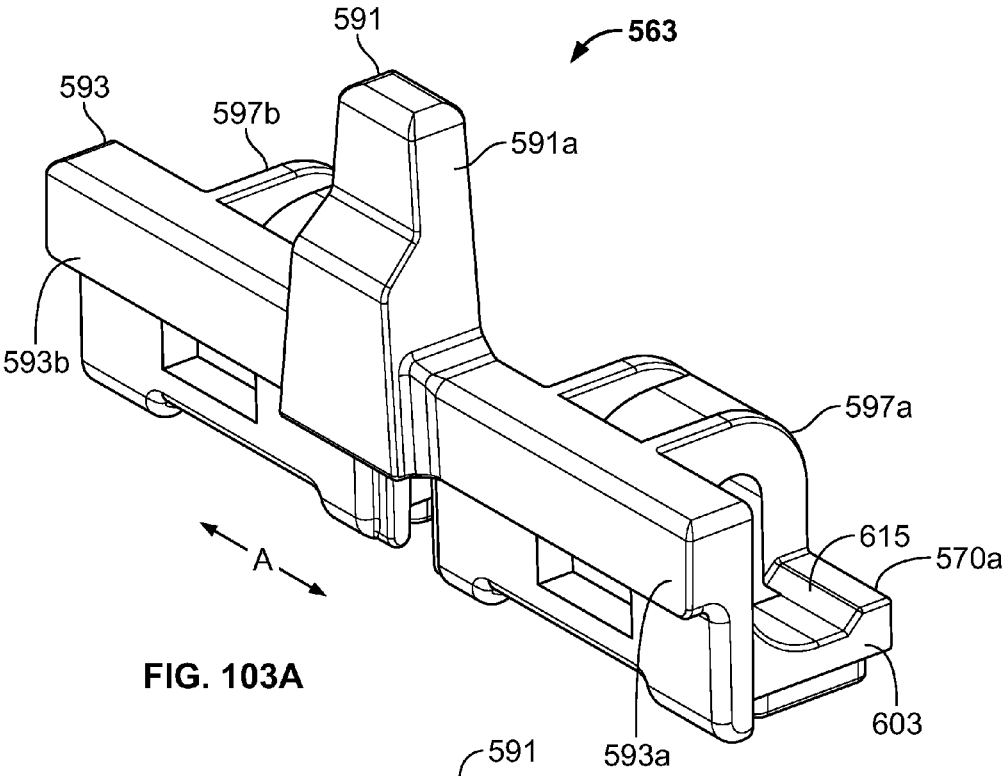
FIG. 103A is a top, front, right perspective view of aspects of example components of a rotational mounting structure of a merchandise display system.
Figure 103B:
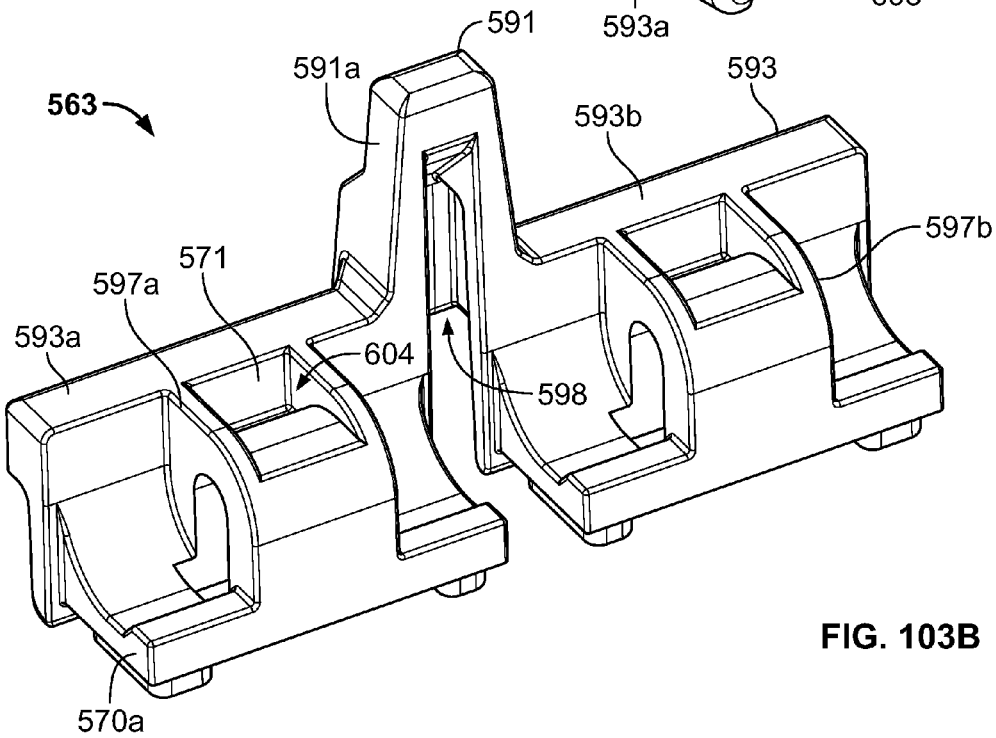
FIG. 103B is a top, rear, right perspective view of aspects of example components of a rotational mounting structure of a merchandise display system.
Figure 103C:
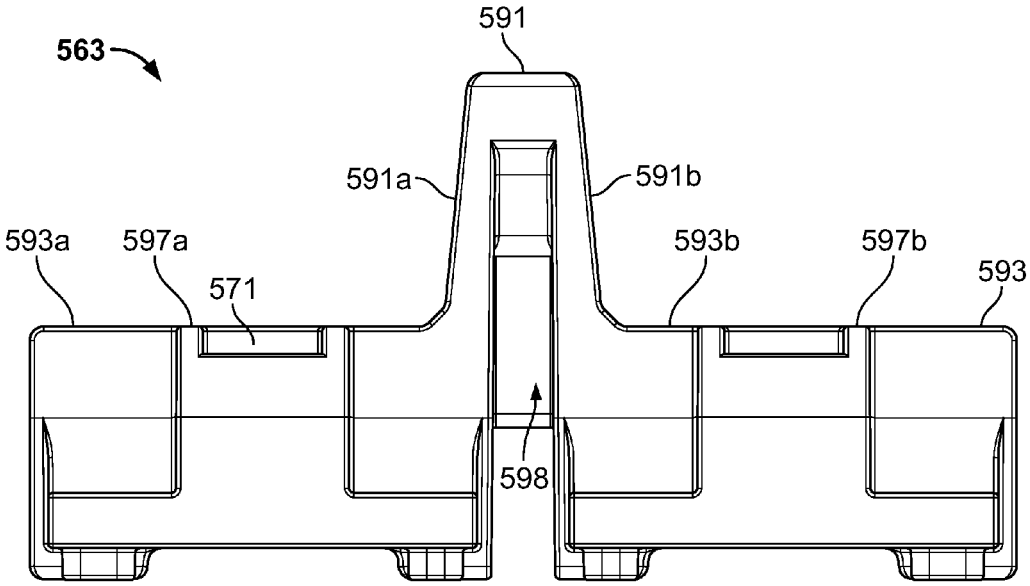
FIG. 103C is a rear view of aspects of example components of a rotational mounting structure of a merchandise display system.
Figure 103D:
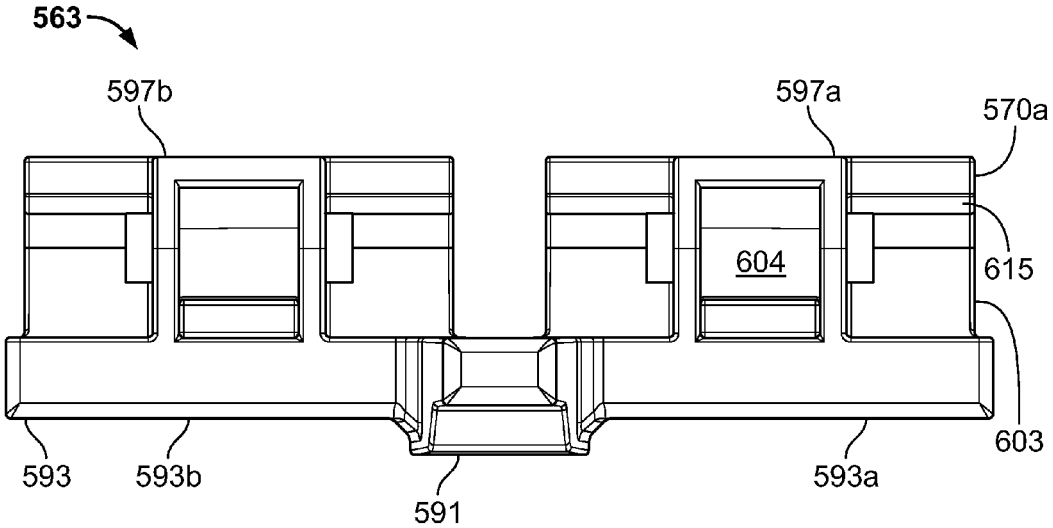
FIG. 103D is a top view of aspects of example components of a rotational mounting structure of a merchandise display system.
Figure 103E:
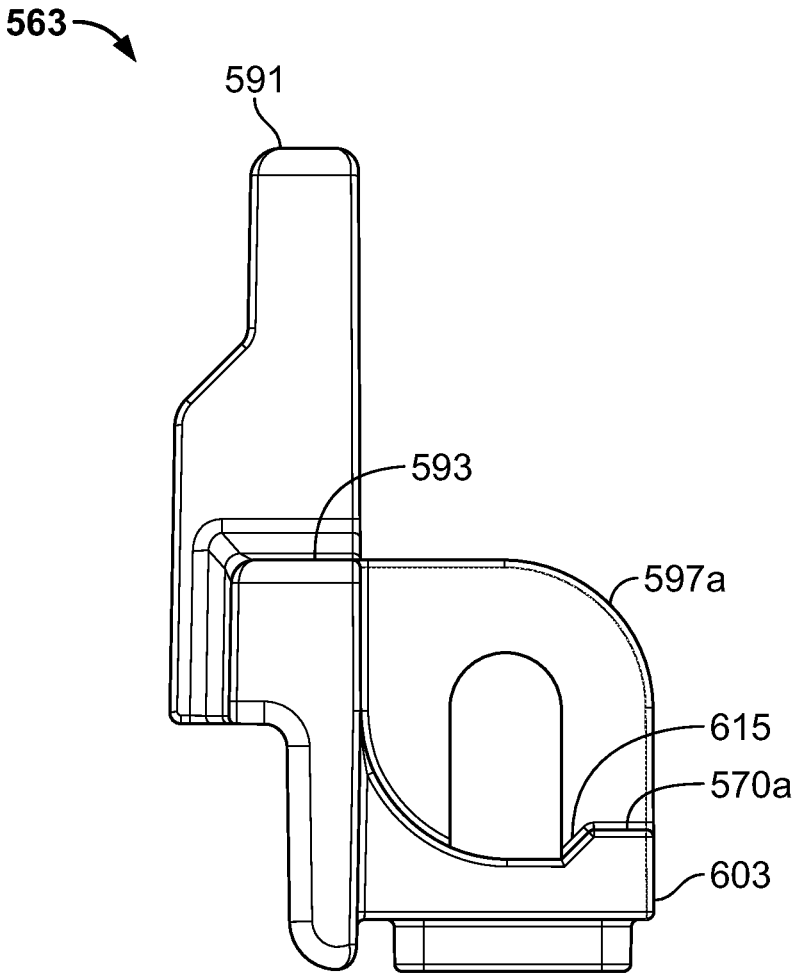
FIG. 103E is a right side view of aspects of example components of a rotational mounting structure of a merchandise display system.
Figure 104A:
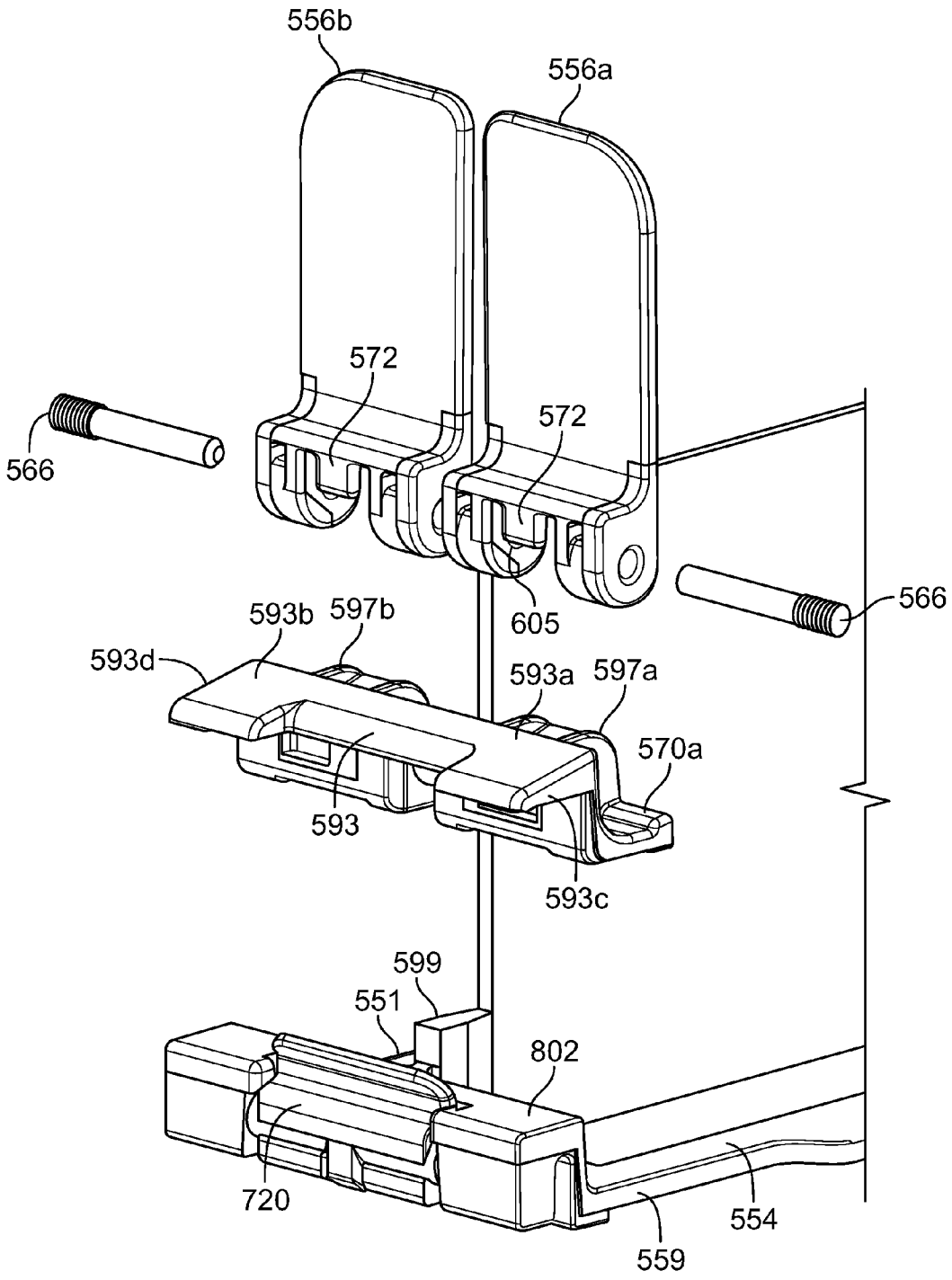
FIG. 104A is a top, right perspective exploded view of aspects of example components of a merchandise display system.
Figure 104B:
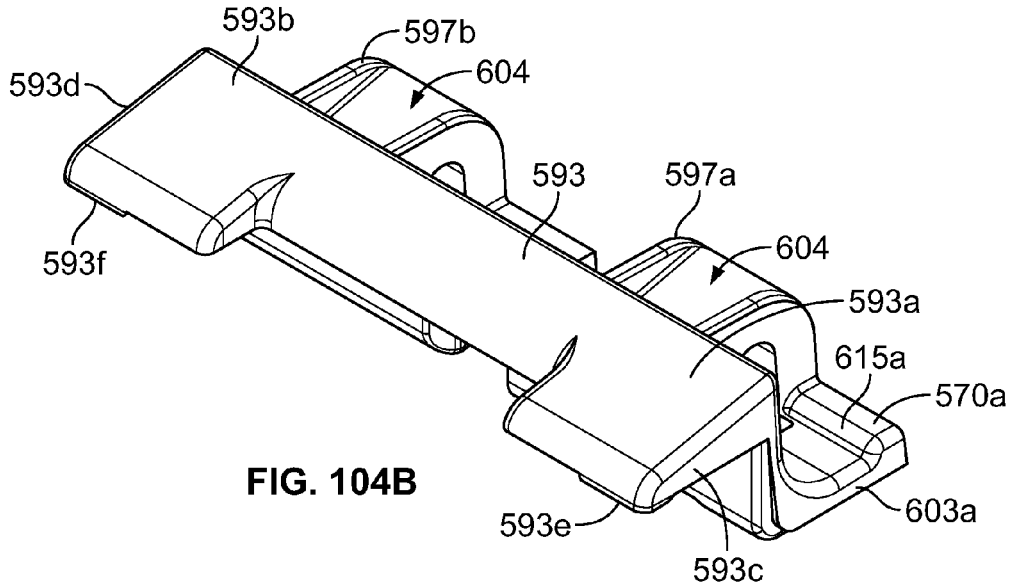
FIG. 104B is a top, right perspective view of aspects of example components of a rotational mounting structure of a merchandise display system.
Figure 104C:
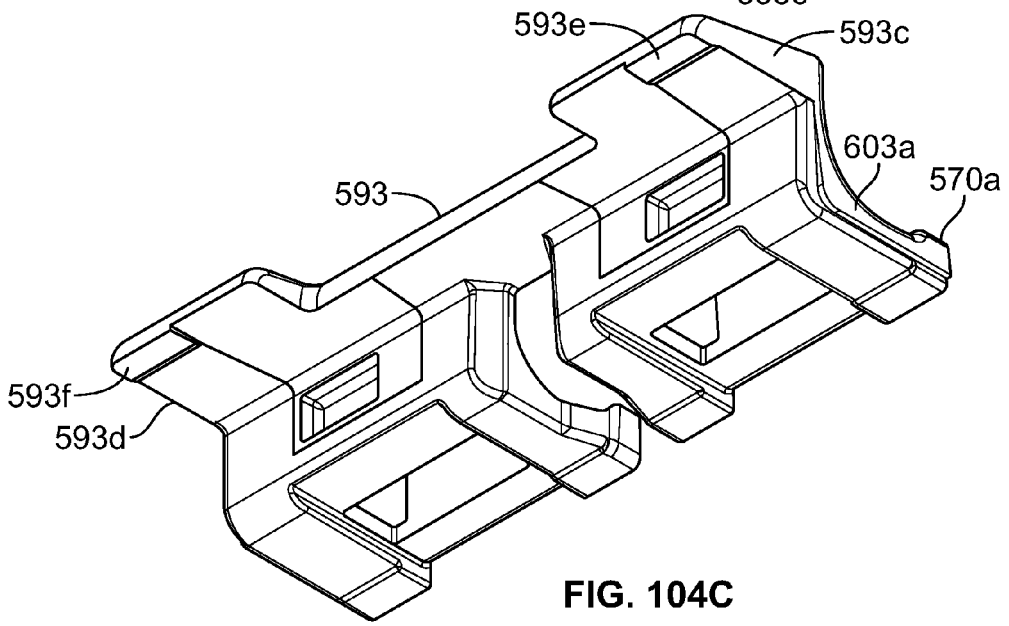
Figure 104D:
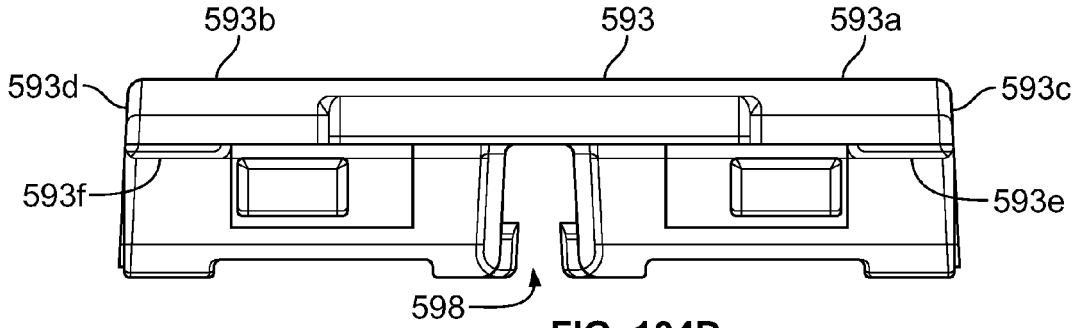
Figure 104E:
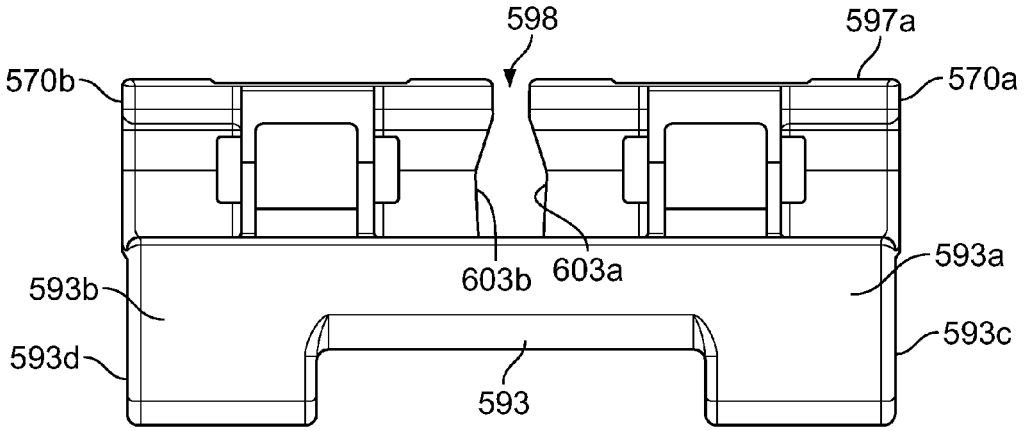
Figure 104F:
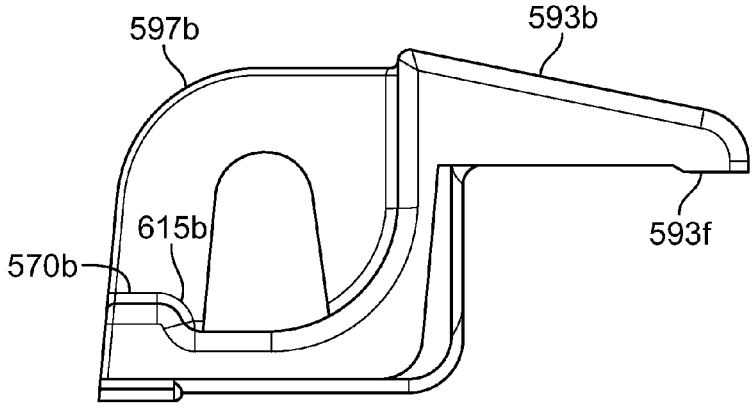
Figure 104G:
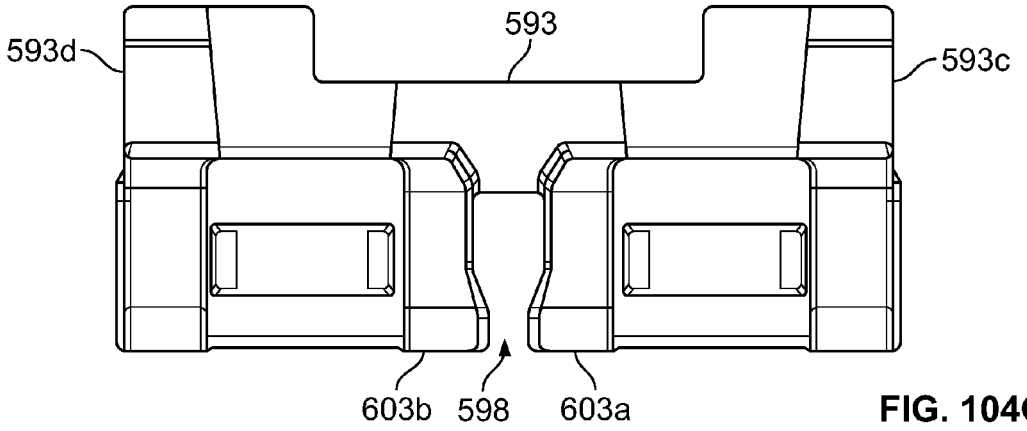

Referring to FIGS. 101A-F, in an embodiment, a merchandise display system including rotational barriers described above can be used in conjunction with an improved product tray to facilitate efficient stocking of product in the merchandise display system. Referring to FIGS. 101A and 101B, in an embodiment, an improved product tray 578 can include a bottom surface 574, right side wall 575, left side wall 576, and an alignment flap 577. In an embodiment, the alignment flap 577 can have a proximate end 579, a distal end 581, a right edge 583, and a left edge 587. A flap width D of the alignment flap 577 can be defined in between the right edge 583 and the left edge 587 of the alignment flap 577. In an embodiment, the flap width D is about equal to the width of the product in the product tray 578. In an embodiment, the length of the alignment flap is defined in a direction perpendicular to the width D. In an embodiment, the length of the alignment flap can vary. In an embodiment, the length of the alignment flap can be about equal to the height of the barrier 556 or the height of the product. In an embodiment, the proximate end 579 of the alignment flap is configured to be connected to the bottom surface 574 of the product tray. In an embodiment, the alignment flap 577 is configured to be positioned in between opposing divider walls of a merchandise display system such that the alignment flap aligns the product tray and the product stored in the product tray with the product pocket so that the product stored in the product tray can be slid from within the product tray, as shown in FIG. 101D, directly into the product pocket of the merchandise display system, as shown in FIG. 101E. In an embodiment, a portion of the alignment flap can be tapered toward the distal end to aid in insertion of the alignment flap between the opposing divider walls of the system. In an embodiment, the alignment flap can be used to move the barriers from the upright position to the folded position to facilitate sliding of the product from the product tray into the product pocket of the system. In an embodiment, the alignment flap is positioned within the product pocket such that the alignment flap moves the barriers from the upright position to the folded position (as shown in FIGS. 101C and 101D), product can then be slid from the product tray into the product pocket of the system (as shown in FIG. 101E), and the alignment flap is removed from the product pocket and removed from contact with the barriers. In such embodiment, in an embodiment with a pusher (as shown in FIG. 101E), the pusher can then push the product forward so that the forward-most product contacts the barriers and moves the barriers from the folded position to the upright position. When the barriers reach the upright position, rotation of the barriers ceases and forward movement of the product is stopped so that the forward most product is positioned in the forward-most position in the display system (as shown in FIG. 101F). In such example, the alignment flap is used to temporarily move the barriers from the upright position to the folded position for stocking of the system. In an embodiment, the barriers can be physically removed from the system so that the system may be stocked with product. In an embodiment, the barriers can be configured to rotate from the upright position toward the forward direction so that, for example, the top of the barrier extends beyond the front end of the divider in the forward direction. Such position can be referred to as a forward folded position. In an embodiment, the barrier can be configured to rotate from the folded position, to the upright position, and beyond the front end of the divider in the forward direction to reach the forward folded position (not shown). In an embodiment, a barrier that can rotate in the forward direction beyond the forward end of the divider can include a rotational stop and define angles relative to the divider floor as described above in regard to barriers that rotate only between the upright position and folded position as described above. In an embodiment, the barriers can be configured to slide in the lateral direction, left and/or right. In an embodiment, the barriers can be manually positioned in the folded position, upright position, and/or folded forward position.

In an example, an unbiased barrier 556 is connected to a divider floor 554. The unbiased barrier 556 is configured to be adjustable from a first position to a second position. In a first position, the unbiased barrier 556 is configured to inhibit or prevent product on the divider floor 554 from moving beyond the front edge of the divider 550. In a first position, the unbiased barrier 556 is configured to inhibit product from being placed onto the divider floor 554. In a first position, the unbiased barrier is configured to be vertical. In a second position, the unbiased barrier 556 is configured to allow product to be placed onto the divider floor 554. In the second position the unbiased barrier is horizontal or diagonal in respect to the divider floor 554 or shelf or other structure on which the divider 550 resides. In aspects, in the second position the unbiased barrier 556 is configured to be horizontal to the divider floor 554, or the shelf or other structure on which the unbiased barrier 556 resides; or the unbiased barrier 556, in the second position, is configured to be rotated or adjusted at a horizontal angle from the divider floor 554. The horizontal angle from the divider floor 554 can be 20 degrees, can be between approximately 10 and 30 degrees, or can be between approximately 20 and 45 degrees. In an embodiment, the unbiased barrier 556 is configured to have no spring or other biasing element forcing it between a first position and a second position. In an embodiment, the unbiased barrier 556 is configured to be freely adjustable from the first position to the second position. In an embodiment, the unbiased barrier 556 is configured such that it can be moved to the first position and will remain in the first position and can be moved to the second position and will remain in the second position. In an embodiment, the unbiased barrier 556 is configured to be unbiased and to include no biasing mechanism such as a spring or other device that places a force on the unbiased barrier 556 to force the unbiased barrier into the first position or the second position.

Figure 99C:
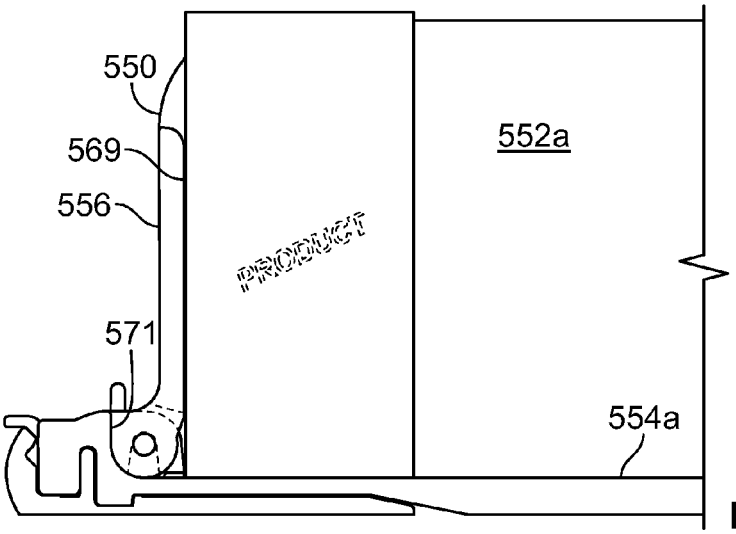
Figure 100C:
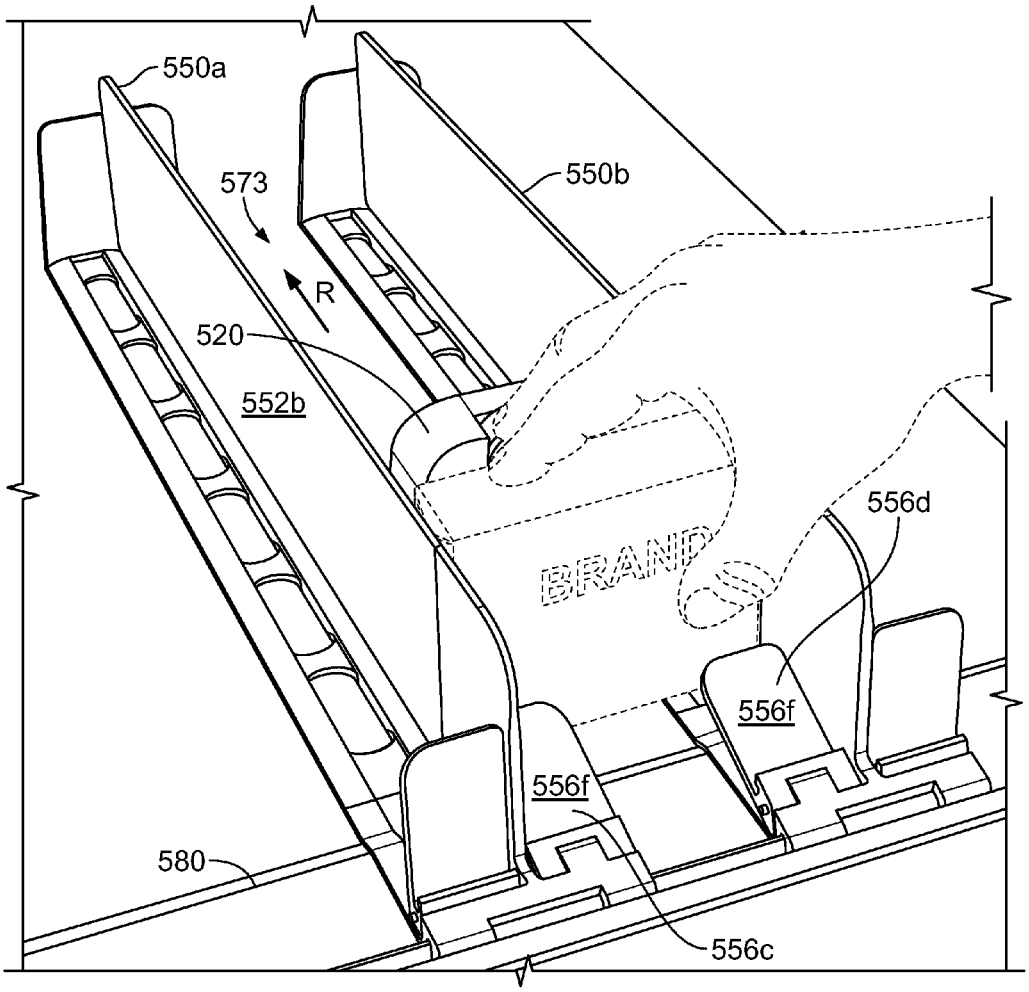
Figure 100D:
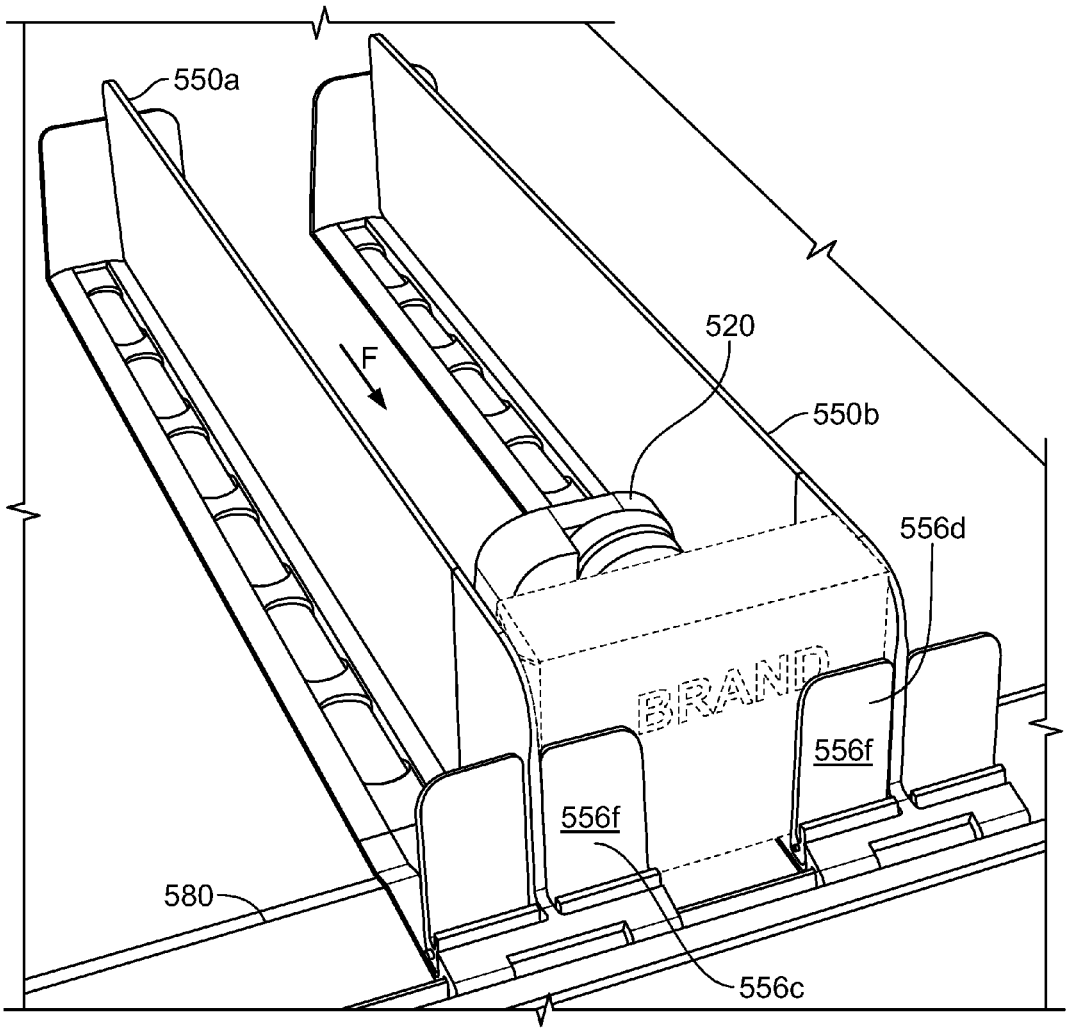

In various embodiments, including example embodiments as in the previous paragraph, external objects, such as product shown in FIGS. 99A-99C or a product tray 578 or alignment flap 577 or a wall of the product tray 578 shown in FIGS. 101A-101C or a hand or digit of a human, can move or force the unbiased barrier 556 from the first position to the second position or from the second position to the first position. Product or a tray 578 or alignment flap 577 or a human digit can exert a force on the unbiased barrier 556 such that the unbiased barrier 556 moves from a first position which is substantially vertical to the divider floor 554 to a second position which is diagonal or a second position which is substantially horizontal. In the second position, the unbiased barrier 556 is configured so that product can be placed onto the divider floor 554 and allow for product to be restocked in a prompt manner. After the product has been restocked onto the divider floor 554, a pusher 520 exerts a force on the product in the direction toward the front of the divider 550 and the front of the product shelf or other structure on which the divider 550 is residing. The pusher can be a spring-urged pusher in which a spring or other biasing unit exerts a force on the pusher, biasing it toward the front of the divider 550. The spring or other biasing unit is not physically connected to or in direct contact with the unbiased barrier 556. The product in turn exerts a force on the unbiased barrier 554 that forces the biased barrier into a first position. In the first position, the unbiased barrier prevents the product from moving beyond the front edge of the divider 550 or shelf or other structure on which the divider 550 is secured.

In an embodiment, multiple products can be positioned in the product pocket of the system. A consumer can, for example, remove the forward-most product. In such case, for example, the pusher can push the remaining product in the product pocket forward so that the next product in line contacts the barriers and forward movement of the product stops. In such case, a product in the forward-most position is replaced with next product in line, thereby maintaining product in the forward-most position until the product in the pocket 573 runs out.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A merchandise display system comprising:

a divider configured to be secured to a support structure, wherein the divider includes a forward end and a rearward end;

the divider includes a divider wall and a divider floor, the divider wall extending upwardly from the divider floor, the divider floor including a top surface;

a barrier that is moveable by rotation between a folded position and an upright position such that a rear surface of the barrier moves toward the rearward end to define an acute angle between the rear surface of the barrier and the divider floor when the barrier rotates from the upright position to the folded position and the rear surface of the barrier moves toward the forward end when the barrier rotates from the folded position to the upright position, wherein the barrier is configured to be positioned proximate the forward end of the divider such that a product positioned on the top surface of the divider floor contacts the barrier when the product moves toward the forward end of the divider;

a rotational mounting structure, wherein a bottom end of the barrier is connected to the rotational mounting structure, wherein the rotational mounting structure is removably connected to the forward end of the divider;

wherein the barrier is configured to rotate from the folded position to the upright position when the product positioned on the top surface of the divider floor moves in a forward direction and contacts the barrier such that forward movement of the product rotates the barrier from the folded position to the upright position; wherein the barrier is configured to cease the forward movement of the product when the barrier is in the upright position; and wherein the barrier defines a folded angle in between a rear surface of the barrier and the divided floor when the barrier is in the folded position, wherein the folded angle is between about 45 degrees to about 20 degrees.

2. The merchandise display system of claim 1, wherein the barrier includes a barrier handle to rotate the barrier between the upright position and the folded position.

3. The merchandise display system of claim 1, wherein the folded angle is about 20 degrees.

4. The merchandise display system of claim 1, wherein a top edge of the rear surface of the barrier is rounded off.

5. The merchandise display system of claim 1, wherein the rotational mounting structure includes a mount slot defined in the rotational mounting structure and wherein the mount slot is configured to mate with a front ridge of the divider to removably connect the rotational mounting structure to the forward end of the divider.

6. The merchandise display system of claim 5, wherein the rotational mounting structure includes a vertical stanchion and a horizontal cross beam, wherein the cross beam is connected to and extends from the vertical stanchion in a lateral direction, and wherein at least a portion of the mount slot is defined within the vertical stanchion.

7. The merchandise display system of claim 1, wherein the rotational mounting structure includes a first knuckle component and the barrier includes a second knuckle component, wherein a pin extends through the first knuckle component and the second knuckle component to form a hinge for rotational attachment of the barrier to the rotational mounting structure.

8. The merchandise display system of claim 7, wherein the rotational mounting structure includes a rotational stop structure configured to engage the barrier and stop rotation of the barrier toward the folded position when the barrier reaches the folded angle.

9. The merchandise display system of claim 1, wherein the rotational mounting structure is one of a hinge or flexible resilient member.

10. The merchandise display system of claim 1, further comprising a rotational stop structure configured to stop rotation of the barrier toward the folded position when the barrier reaches the folded angle.

11. The merchandise display system of claim 10, wherein the rotational stop structure is a protrusion positioned proximate a lower portion of the rear surface of the barrier such that the lower portion of the rear surface of the barrier contacts the rotational stop structure when barrier reaches the folded angle in the folded position.

12. The merchandise display system of claim 1, wherein the divider includes a pusher mechanism configured to slide along the divider floor to move the product toward the forward end.

13. The merchandise display system comprising:

a divider configured to be secured to a support structure, wherein the divider includes a forward end and a rearward end;

the divider includes a divider wall and a divider floor, the divider wall extending upwardly from the divider floor, the divider floor includes a top surface, wherein the divider wall separates the divider floor into a first side portion and a second side portion, the first side portion having the top surface of the divider floor and the second side portion including a second top surface of the divider floor;

a barrier that is moveable by rotation between a folded position and an upright position such that a rear surface of the barrier moves toward the rearward end to define an acute angle between the rear surface of the barrier and the divider floor when the barrier rotates from the upright position to the folded position and the rear surface of the barrier moved toward the forward end when the barrier rotates from the folded position to the upright position, wherein the barrier is configured to be positioned proximate the forward end of the divider such that a product positioned on the top surface of the divider floor contacts the barrier when the product moves toward the forward end of the divider;

wherein the barrier is configured to rotate from the folded position to the upright position when the product positioned on the top surface of the divider floor moves in a forward direction and contacts the barrier such that forward movement of the product rotates the barrier from the folded position to the upright position; and wherein the barrier is configured to cease the forward movement of the product when the barrier is in the upright position;

a first rotational mount connected to the forward end of the divider and proximate to the first side portion of the divider floor, the barrier connected to the first rotational mount;

a second rotational mount connected to the forward end of the divider and proximate to the second side portion of the divider floor;

a second barrier connected to the second rotational mount that is moveable by rotation between the folded position and the upright position, the second barrier positioned such that a second product positioned on the second top surface of the divider floor contacts the second barrier when the second product moves toward the forward end of the divider;

wherein the second barrier is configured to rotate from the folded position to the upright position when the second product positioned on the second top surface of the divider floor moves toward the second barrier and the second product contacts the second barrier when the second barrier is in the folded position such that continued movement of the second product rotates the second barrier from the folded position to the upright position, wherein the second barrier is configured to cease movement of the second product when the second barrier is in the upright position.

14. The merchandise display system of claim 13, wherein the first and second rotational mounts are removably connected to the forward end of the divider.

15. The merchandise display system of claim 13, further comprising a rotational mounting structure removably connected to the forward end of the divider, the rotational mounting structure comprising the first rotational mount, the second rotational mount, and a horizontal cross beam;

wherein the horizontal cross extends in a lateral direction and wherein the first rotational mount is connected to a first section of the horizontal cross beam and the second rotational mount is connected to a second section of the horizontal cross beam; and wherein the rotational mounting structure includes a mount slot defined in the rotational mounting structure, the mount slot is configured to mate with a front ridge of the divider to removably connect the rotational mounting structure to the forward end of the divider.

16. The merchandise system of claim 13, wherein the barrier includes a resilient tab configured to engage a tab recess when the barrier reaches the upright position.

17. The merchandise system of claim 16, wherein the tab recess is defined in the rotational mounting structure.

* * * * *